US010465269B2

(12) United States Patent
Cheney et al.

(10) Patent No.: US 10,465,269 B2
(45) Date of Patent: Nov. 5, 2019

(54) IMPACT RESISTANT HARDFACING AND ALLOYS AND METHODS FOR MAKING THE SAME

(71) Applicant: Scoperta, Inc., San Diego, CA (US)

(72) Inventors: Justin Lee Cheney, Encinitas, CA (US); Adolfo Castells, San Diego, CA (US); Jonathon Bracci, Carlsbad, CA (US)

(73) Assignee: Scoperta, Inc., San Diego, CA (US)

( * ) Notice: Subject to any disclaimer, the term of this patent is extended or adjusted under 35 U.S.C. 154(b) by 1035 days.

(21) Appl. No.: 14/805,951

(22) Filed: Jul. 22, 2015

(65) Prior Publication Data

US 2016/0024624 A1 Jan. 28, 2016

Related U.S. Application Data

(60) Provisional application No. 62/187,714, filed on Jul. 1, 2015, provisional application No. 62/028,707, filed on Jul. 24, 2014.

(51) Int. Cl.

| | |
|---|---|
| ***C22C 38/32*** | (2006.01) |
| ***C22C 32/00*** | (2006.01) |
| ***C22C 38/02*** | (2006.01) |
| ***C22C 38/04*** | (2006.01) |
| ***C22C 38/24*** | (2006.01) |

(Continued)

(52) U.S. Cl.

CPC ..... *C22C 38/32* (2013.01); *C22C 32/0052* (2013.01); *C22C 32/0073* (2013.01); *C22C 33/0278* (2013.01); *C22C 38/02* (2013.01); *C22C 38/04* (2013.01); *C22C 38/24* (2013.01); *C22C 38/26* (2013.01); *C22C 33/0292* (2013.01)

(58) Field of Classification Search

CPC ..... C22C 38/32

See application file for complete search history.

(56) References Cited

U.S. PATENT DOCUMENTS

| | | | |
|---|---|---|---|
| 2,043,952 | A | 6/1936 | Ffield |
| 2,156,306 | A | 5/1939 | Rapatz |
| 2,936,229 | A | 5/1960 | Shepard |

(Continued)

FOREIGN PATENT DOCUMENTS

| | | |
|---|---|---|
| CA | 2774546 | 1/2015 |
| CN | 102233490 A | 11/2011 |

(Continued)

OTHER PUBLICATIONS

FactStage. Mo—C Phase Diagram [online]. retrieved on Jan. 27, 2015. Retrieved from the internet from URL: http://factsage.cn/fact/documentation/SGTE/C-Mo.jpg.*

(Continued)

*Primary Examiner* — Matthew E. Hoban

(74) *Attorney, Agent, or Firm* — Knobbe Martens Olson and Bear, LLP

(57) ABSTRACT

Disclosed herein are embodiments of alloys which can be used for hardfacing applications, and hardfacing layers themselves. In particular, embodiments of the alloys can have high hardness as well as impact resistance. These advantageous properties can occur due to the inclusion of hardfacing particles, as well as other compositional, microstructural, thermodynamic, and performance criteria.

20 Claims, 8 Drawing Sheets

(51) Int. Cl.
*C22C 38/26* (2006.01)
*C22C 33/02* (2006.01)

(56) References Cited

U.S. PATENT DOCUMENTS 3,024,137 A 3/1962 Witherell
3,113,021 A 12/1963 Witherell
3,181,970 A 5/1965 Witherell et al.
3,303,063 A 2/1967 Pietryka et al.
3,448,241 A 6/1969 Penson et al.
3,554,792 A 1/1971 Johnson
3,650,734 A 3/1972 Kantor et al.
3,843,359 A 10/1974 Fiene et al.
3,859,060 A 1/1975 Eiselstein et al.
3,942,954 A 3/1976 Frehn
3,975,612 A 8/1976 Nakazaki et al.
4,010,309 A 3/1977 Peterson
4,017,339 A 4/1977 Okuda et al.
4,042,383 A 8/1977 Petersen et al.
4,066,451 A 1/1978 Rudy
4,214,145 A 7/1980 Zvanut et al.
4,255,709 A 3/1981 Zatsepium et al.
4,297,135 A 10/1981 Giessen et al.
4,365,994 A 12/1982 Ray
4,415,530 A 11/1983 Hunt
4,576,653 A 3/1986 Ray
4,606,977 A 8/1986 Dickson et al.
4,639,576 A 1/1987 Shoemaker et al.
4,762,681 A 8/1988 Tassen et al.
4,803,045 A 2/1989 Ohriner et al.
4,822,415 A 4/1989 Dorfman et al.
4,981,644 A 1/1991 Chang
5,306,358 A 4/1994 Lai et al.
5,375,759 A 12/1994 Hiraishi et al.
5,567,251 A 10/1996 Peker et al.
5,618,451 A 4/1997 Ni
5,820,939 A 10/1998 Popoola et al.
5,861,605 A 1/1999 Ogawa et al.
5,935,350 A 8/1999 Raghu et al.
5,942,289 A 8/1999 Jackson
5,988,302 A 11/1999 Sreshta et al.
6,210,635 B1 4/2001 Jackson et al.
6,232,000 B1 5/2001 Singh et al.
6,332,936 B1 12/2001 Hajaligo et al.
6,375,895 B1 4/2002 Daemen
6,398,103 B2 6/2002 Hasz et al.
6,441,334 B1 8/2002 Aida et al.
6,608,286 B2 8/2003 Jiang
6,669,790 B1 12/2003 Gundlach et al.
6,689,234 B2 2/2004 Branagan
6,702,906 B2 3/2004 Ogawa et al.
6,750,430 B2 6/2004 Kelly
7,052,561 B2 5/2006 Lu et al.
7,285,151 B2 10/2007 Sjodin et al.
7,361,411 B2 4/2008 Daemen et al.
7,491,910 B2 2/2009 Kapoor et al.
7,553,382 B2 6/2009 Branagan et al.
7,569,286 B2 8/2009 Daemen et al.
7,776,451 B2 8/2010 Jiang et al.
7,935,198 B2 5/2011 Branagan et al.
8,070,894 B2 12/2011 Branagan
8,097,095 B2 1/2012 Branagan
8,153,935 B2 4/2012 Jang et al.
8,187,529 B2 5/2012 Powell
8,187,725 B2 5/2012 Kiser et al.
8,562,759 B2 10/2013 Cheney et al.
8,562,760 B2 10/2013 Cheney et al.
8,640,941 B2 2/2014 Cheney
8,647,449 B2 2/2014 Cheney et al.
8,704,134 B2 4/2014 Branagan et al.
8,801,872 B2 8/2014 Wright et al.
8,808,471 B2 8/2014 Wright et al.
8,973,806 B2 3/2015 Cheney
9,193,011 B2 11/2015 Mars et al.
2001/0019781 A1 9/2001 Hasz
2002/0148533 A1 10/2002 Kim et al.
2004/0062677 A1 4/2004 Chabenat et al.
2004/0079742 A1 4/2004 Kelly
2004/0115086 A1 6/2004 Chabenat et al.
2005/0109431 A1 5/2005 Kernan et al.
2006/0191606 A1 8/2006 Ogawa et al.
2007/0029295 A1 2/2007 Branagan
2007/0090167 A1 4/2007 Arjakine et al.
2007/0187369 A1 8/2007 Menon et al.
2007/0253856 A1 11/2007 Vecchio et al.
2007/0284018 A1 12/2007 Hamano et al.
2008/0001115 A1 1/2008 Qiao et al.
2008/0031769 A1 2/2008 Yeh
2008/0149397 A1 6/2008 Branagan
2008/0241580 A1 10/2008 Kiser et al.
2009/0017328 A1 1/2009 Katoh et al.
2009/0258250 A1 10/2009 Daemen et al.
2009/0285715 A1 11/2009 Arjakine et al.
2010/0009089 A1 1/2010 Junod et al.
2010/0044348 A1 2/2010 Buchmann
2010/0101780 A1 4/2010 Ballew et al.
2010/0166594 A1 7/2010 Hirata et al.
2010/0189588 A1 7/2010 Kawatsu et al.
2011/0064963 A1 3/2011 Cheney et al.
2011/0100720 A1 5/2011 Branagan et al.
2011/0139761 A1 6/2011 Sugahara et al.
2011/0162612 A1 7/2011 Qiao et al.
2011/0171485 A1 7/2011 Kawamoto et al.
2012/0055903 A1 3/2012 Izutani et al.
2012/0156020 A1 6/2012 Kottilingam et al.
2012/0160363 A1 6/2012 Jin et al.
2012/0224992 A1* 9/2012 Cheney ..... B23K 35/3053 420/114
2012/0288400 A1 11/2012 Hirata et al.
2013/0094900 A1 4/2013 Folkmann et al.
2013/0167965 A1 4/2013 Cheney et al.
2013/0224516 A1 8/2013 Kusinski et al.
2013/0260177 A1 10/2013 Wallin et al.
2013/0266798 A1 10/2013 Cheney
2013/0294962 A1 11/2013 Wallin et al.
2014/0065316 A1* 3/2014 Cheney ..... B23K 35/3093 427/456
2014/0105780 A1 4/2014 Cheney
2014/0131338 A1 5/2014 Postle
2014/0219859 A1 8/2014 Cheney
2014/0234154 A1 8/2014 Cheney et al.
2014/0248509 A1 9/2014 Cheney
2014/0263248 A1 9/2014 Postle
2015/0075681 A1 3/2015 Wright et al.
2015/0118098 A1* 4/2015 Valls ..... C21D 9/00 420/102
2015/0147591 A1 5/2015 Cheney
2015/0252631 A1 9/2015 Miller
2015/0275341 A1 10/2015 Cheney
2015/0284817 A1 10/2015 Snyder et al.
2015/0284829 A1 10/2015 Cheney
2015/0307968 A1 10/2015 Mars et al.
2015/0367454 A1 12/2015 Cheney

FOREIGN PATENT DOCUMENTS

CN 102686762 3/2014
CN 103635284 3/2014
CN 104039483 9/2014
CN 104838032 8/2015
DE 2754437 7/1979
DE 33 20 513 12/1983
EP 0 365 884 5/1990
EP 1 338 663 8/2003
EP 2 305 415 8/2003
EP 2 778 247 9/2014
EP 2 563 942 10/2015
GB 2 153 846 A 8/1985
IN MUMNP-2003-00842 4/2005
JP 58-132393 8/1983
JP 60-133996 A 7/1985
JP 63-026205 A 2/1988
JP 03-133593 A 6/1991
WO WO 1984/000385 2/1984

(56) References Cited

FOREIGN PATENT DOCUMENTS

| | | |
|---|---|---|
| WO | WO 1984/004760 | 12/1984 |
| WO | WO 03/018856 | 3/2003 |
| WO | WO 2006/086350 | 8/2006 |
| WO | WO 2011/035193 | 9/2010 |
| WO | WO 2011/071054 | 6/2011 |
| WO | WO 2011/158706 | 12/2011 |
| WO | WO/2012/037339 | 3/2012 |
| WO | WO/2012/129505 | 9/2012 |
| WO | WO 2013/101561 | 7/2013 |
| WO | WO/2013/133944 | 9/2013 |
| WO | WO 2014/059177 | 4/2014 |
| WO | WO 2014/081491 | 5/2014 |
| WO | WO 2014/114714 | 7/2014 |
| WO | WO 2014/114715 | 7/2014 |
| WO | WO 2015/081209 | 6/2015 |
| WO | WO 2015/157169 | 12/2015 |
| WO | WO 2015/183955 | 12/2015 |
| WO | WO 2015/191458 | 12/2015 |
| ZA | 2013/02311 | 12/2013 |

OTHER PUBLICATIONS

FactStage. Nb—C Phase Diagram [online]. retrieved on Jan. 27, 2015. Retrieved from the internet from URL: http://www.crct.polymtl.ca/fact/documentation/BINARY/C-Nb.jpg.*

Audouard, et al.: "Corrosion Performance and Field Experience With Super Duplex and Super Austenitic Stainless Steels in FGD Systems", Corrosion 2000; p. 4, table 2.

Branagan, et al.: Developing extreme hardness (>15GPa) in iron based nanocomosites, Composites Part A: Applied Science and Manufacturing, Elsevier Science Publishers B.V., Amsterdam, NL, vol. 33, No. 6, Jun. 1, 2002, pp. 855-859.

Cheney, et al.: "Development of quaternary Fe-based bulk metallic glasses," Materials Science and Engineering, vol. 492, No. 1-2, Sep. 25, 2008, pp. 230-235.

Cheney: Modeling the Glass Forming Ability of Metals. A Dissertation submitted in partial satisfaction of the Requirements for the degree of Doctor of Philosophy. University of California, San Diego. Dec. 2007.

Cr—C Phase Diagram [online], [retrieved on Jan. 27, 2015]. Retrieved from the Internet: http://www.azom.com/work/3ud2quvLOU9g4VBMjVEh_files/image002.gif.

Davis, Jr, ed. Stainless steels. ASM International, 1994; p. 447.

International Search Report and Written Opinion re PCT Application No. PCT/US2015/41533, dated Oct. 15, 2015.

Iron-Carbon (Fe—C) Phase diagram [online], [retrieved on Jan. 27, 2014]. Retrieved from the internet: <URL:http://www.calphad.com/iron-carbon.html>.

Khalifa, et al.: "Effect of Mo—Fe substitution on glass forming ability, thermal stability, and hardness of Fe—C—B—Mo—Cr—W bulk amorphous allows," Materials Science and Engineering, vol. 490, No. 1-2, Aug. 25, 2008, pp. 221-228.

Miracle, D.B.: The efficient cluster packing model—An atomic structural model for metallic glasses, Acta Materialia vol. 54, Issue 16, Sep. 2006, pp. 4317-4336.

Olsen et al "Passages", AMS Handbook, Welding, Brazing and Soldering, vol. 6, Dec. 1, 1993 (Dec. 1, 1993) pp. 586-592, XP008097120, p. 589.

Tillack, et al.: "Selection of Nickel, Nickel-Copper, Nickel-Cromium, and Nickel-Chromium-Iron Allows", AMS Handbook, Welding, Brazing and Soldering, vol. 6, Dec. 1, 1993 (Dec. 1, 1993) pp. 586-592, XP008097120, p. 589.

Titanium-Boron (TiB) Phase Diagram [online], [retrieved on Jan. 27, 2015]. Retrieved from the internet:<URL:http://www.calphad.com/titaniumboron.html>.

Yoo et al.: "The effect of boron on the wear behavior of iron-based hardfacing alloys for nuclear power plants valves," Journal of Nuclear Materials 352 (2006) 90-96.

* cited by examiner

IMPACT RESISTANT HARDFACING AND ALLOYS AND METHODS FOR MAKING THE SAME

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The disclosure relates in some embodiments to alloys which can be produced using common metal powder manufacturing techniques which serve as effective feedstock in processes such as plasma transferred arc welding (PTA) and laser cladding hardfacing, hardfacing layers and the substrate protected thereby, and methods of making such hardfacing layers.

Description of the Related Art

Hardfacing is the process by which a hard surface coating is applied to a substrate for protection. Typical hardfacing alloys include Chromium Carbide Overlay or CCO. This type of an alloy utilizes a high fraction of chromium carbides, which are relatively hard, to provide protection against wear protection. One drawback of this material is that the material contains hypereutectic chromium carbides which embrittle the material reducing resistance to impact. Similarly, typical hardfacing alloys utilizing hard borides such as SHS9192, manufactured by Nanosteel, contain hypereutectic chromium borides, which again, reduce impact resistance.

Hardfacing materials typically contain carbides and/or borides as hard precipitates which resist abrasion and increase hardness in the alloy. It is well known by those skilled in the art that certain carbides are significantly harder than other carbides. For example, $M_3C$ type carbides, which are common in pearlitic steels, have a diamond pyramid hardness (DPH) of about 800-1100 and TiC has a DPH of about 2000-3100. This difference in hardness has a significant effect on the abrasion resistance.

The hardest carbides and borides tend to form at elevated temperatures in a liquid alloy during a potential manufacturing process. In the case of powder manufacturing, high temperature carbide and/or boride is undesirable as these carbides or borides can precipitate on the atomization nozzle and create manufacturing problems that effectively make such an alloy incompatible with that process.

U.S. Pat. No. 8,704,134, hereby incorporated by reference in its entirety, teaches a Fe-based alloy which forms borocarbides among other phases as the principle hard abrasion resistant phases present. Similarly U.S. Pat. App. No. 2007/0029295 and U.S. Pat. Nos. 7,553,382 and 8,474,541, the three of which are incorporated by reference in their entirety, describe alloys where $M_{23}(C,B)_6$ is a fundamental hard phase in the metal structure. In addition, all the alloys disclosed in the above patent references are known to form hyper-eutectic borides.

It is known by those skilled in the art that in typical chromium carbide alloys, that as the carbon and chromium content increases the alloy will move from a hypoeutectic carbide forming space to a hypereutectic carbide space. It is known by those skilled in the art, that increasing boron and carbon has a similar effect. It is not known by those skilled in the art that the $M_{23}(C,B)_6$ phase forms a specific morphology which reduces the resistance of the material to repeated impacts. Moreover, it is not known by those skilled in the art how to specifically control both the carbide and boride fraction in an alloy, such that the carbide and boride fractions can be simultaneously elevated and remain in the hypoeutectic or eutectic regime.

SUMMARY

Embodiments of the present application include but are not limited to hardfacing materials, alloy or powder compositions used to make such hardfacing materials, methods of forming the hardfacing materials, and the components or substrates incorporating or protected by these hardfacing materials.

Disclosed herein are embodiments of a hardfacing layer comprising extremely hard particles of 1500 Knoop hardness or greater at a volume fraction of 2% or greater, wherein the hardfacing layer is formed from a metallic powder produced through conventional atomization processes as defined by exhibiting a yield of at least 50% in the 53-180 μm size.

In some embodiments, the hardfacing layer can have a macro-hardness of 55 HRC or greater. In some embodiments, the hardfacing layer can have an ASTM G65A mass loss of 0.5 grams or less.

In some embodiments, the metallic powder can be formed from feedstock having a feedstock composition comprising Fe and in wt. %, B: about 0.8, C: about 0.8 to about 1, Cr: about 3.5, Nb: about 1.5 to about 3.5, Ti: about 0.4, and W: about 9. In some embodiments, the feedstock composition can comprise in wt. %, Mn: about 1.3, V: about 1.7, and Si: about 1.5.

In some embodiments, the extremely hard particles may not be thermodynamically stable at temperatures above a matrix formation temperature plus 200K.

Also disclosed herein are embodiments of a method of forming a hardfacing alloy layer comprising producing a metallic powder through conventional atomization processes as defined by exhibiting a yield of at least 50% in the 53-180 μm size, and applying the metallic powder as a hardfacing layer, wherein the hardfacing layer comprises extremely hard particles of 1500 Knoop hardness or greater at a volume fraction of 2% or greater.

In some embodiments, the metallic powder can be formed from a feedstock composition comprising Fe and in wt. %, B: about 0.8, C: about 0.8 to about 1, Cr: about 3.5, Nb: about 1.5 to about 3.5, Ti: about 0.4, and W: about 9.

In some embodiments, the metallic powder can be formed from a feedstock composition comprising in wt. %, Mn: about 1.3, V: about 1.7, and Si: about 1.5.

Disclosed herein are embodiments of an Fe-based alloy comprising an alloy matrix satisfying the following thermodynamic equilibrium conditions: at least 5 mole % hard phase fraction at 1300K, wherein a hard phase is defined as a phase which exhibits a Vickers hardness of at least 1000, 5 mole % or less hypereutectic boride phase, and 5 mole % or less $M_{23}C_6$ at a temperature where liquid exists.

In some embodiments, the alloy can comprise at least 20% mole fraction of hard phase. In some embodiments, the alloy can comprise zero hypereutectic boride phases in thermodynamic equilibrium. In some embodiments, the alloy can comprise zero $M_{23}C_6$ or $M_7C_3$ phases precipitating from the liquid in thermodynamic equilibrium or from Scheil simulation calculations. In some embodiments, the alloy matrix can comprise eutectic borides comprising chromium and/or tungsten as a primary metallic species and primary carbides comprising niobium, titanium, and/or vanadium as a primary metallic species.

In some embodiments, the alloy can be deposited via a welding process. In some embodiments, the alloy can be used to form an impact resistant hardfacing layer having abrasion resistance better than or equal to 0.3 grams loss, and impact resistance better than or equal to surviving 2,000 20 J impact without failure.

Also disclosed herein are embodiments of an Fe-based alloy, the alloy having a matrix comprising at least 5 volume % hard phases, wherein a hard phase is defined as a phase which exhibits a Vickers hardness of at least 1000, less the 5 volume % rod-like hypereutectic boride phase, and 5 volume % or less of a eutectic borocarbide phase.

In some embodiments, at least 10% volume fraction hard phases can be present. In some embodiments, the hard phases can comprise of one of the following: $M_2B$, $M_3B_2$, wherein M comprises one or more of the following: Cr, W, or Mo and MC where M comprises one or more of the following Nb, Ti, or V. In some embodiments, less than 10% volume fraction of $M_{23}(C,B)_6$ hard phases can be present. In some embodiments, less than 1% volume fraction of hypereutectic borides can be present.

In some embodiments, the alloy can be deposited via a welding process. In some embodiments, the alloy can be used to form an impact resistant hardfacing layer having abrasion resistance better than or equal to 0.3 grams loss and impact resistance better Also disclosed herein are embodiments of an Fe-based alloy, the alloy comprising high abrasion resistance as characterized by ASTM G65 mass loss of 0.3 grams or less and high impact resistance as characterized by withstanding at least 2,000 20 J impacts without losing at least 1 gram.

In some embodiments, the alloy can have a compressive strength of at least 3 GPa. In some embodiments, the alloy can have good powder manufacturability as characterized by the ability to manufacture the alloy into a 53-180 μm powder size with a yield of at least 50% using the gas atomization process. In some embodiments, the alloy can have a high deposition efficiency in a plasma transferred arc welding process as characterized by at least 95% deposition efficiency. In some embodiments, the alloy can have an abrasion resistance of 0.15 grams loss or lower. In some embodiments, the alloy can have a high impact resistance as characterized by surviving at least 5,000 20 J impacts prior to failure. In some embodiments, the alloy can have a high impact resistance as characterized by surviving at least 10,000 20 J impacts prior to failure.

Disclosed herein are embodiments of an iron-based hardfacing layer formed from an alloy comprising boron, carbon, and at least one other element configured to form borides and/or carbides, the hardfacing layer comprising greater than 2 mole and volume % of extremely hard boride/carbide particles having a Knoop hardness of 1500 or greater, an ASTM G65 abrasion loss of less than 0.5 grams, a macro-hardness of 55 HRC or greater, wherein a difference between a formation temperature of the extremely hard boride/carbide particles and a formation temperature of an iron matrix phase of the alloy is 200K or lower.

In some embodiments, the layer can have greater than 5 mole and volume % of the extremely hard boride/carbide particles. In some embodiments, the layer can have greater than 10 mole and volume % of the extremely hard boride/carbide particles.

In some embodiments, the alloy can further comprise an ASTM G65 abrasion loss of less than 0.15 grams and a macro-hardness of 65 HRC or greater, wherein a difference between a formation temperature of the extremely hard boride/carbide particles and a formation temperature of an iron matrix phase of the alloy is 100K or lower.

Also disclosed herein are embodiments of a powder, wherein the powder comprises iron, boron, carbon and at least one other element configured to form borides and/or carbides, and wherein the powder is configured to form an iron-based hardfacing layer comprising greater than 2 mole and volume % of extremely hard boride/carbide particles having a Knoop hardness of 1500 or greater, an ASTM G65 abrasion loss of less than 0.5 grams, a macro-hardness of 55 HRC or greater, wherein a difference between a formation temperature of the extremely hard boride/carbide particles and a formation temperature of an iron matrix phase of the alloy is 200K or lower.

In some embodiments, a composition of the powder can comprise Fe and, in wt. %, B: about 0.8, C: about 0.8 to about 1, Cr: about 3.5, Nb: about 1.5 to about 3.5, and W: about 9. In some embodiments, the composition of the powder can further comprise, in wt. %, Ti: about 0.4, Mn: about 1.3, V: about 1.7, and Si: about 1.5.

Also disclosed herein are embodiments of an iron-based alloy for use as a hardfacing layer, the alloy comprising Fe, between about 0.2 to about 4.0 wt. % B, between about 0.2 to about 5.0 wt. % C, at least one other element configured to form borides and/or carbides, wherein the alloy is configured to form a martensitic matrix comprising at least 2 mole and volume % of extremely hard boride/carbide particles having a Vickers hardness of at least 1000, 5 mole and volume % or less of a hypereutectic boride phases when the alloy is in a liquid state, and 5 mole and volume % or less of a eutectic $M_{23}C_6$ phase and a eutectic $M_7C_3$ phase when the alloy is in the liquid state.

In some embodiments, a difference between a formation temperature of the extremely hard boride/carbide particles and a formation temperature of an iron matrix phase of the alloy can be 200K or lower. In some embodiments, the matrix can comprise both borides and carbides.

In some embodiments, the alloy can comprise Fe and between about 0.8 to about 1.9 wt. % B, between about 0.9 to about 1.5 wt. % C, between about 3 to about 6.5 wt. % Cr, between about 3.5 to about 5.5 wt. % Nb, between about 9 to about 18 wt. % W, and between about 1.5 to about 4.5 wt. % V.

In some embodiments, the matrix can contain at least 10 mole and volume % of the extremely hard boride/carbide particles. In some embodiments, the matrix can contain at least 20 mole and volume % of the extremely hard boride/carbide particles.

In some embodiments, the matrix further can further comprise 0 mole and volume % of a hypereutectic boride phases when the alloy is in a liquid state, and 0 mole and volume % of a eutectic $M_{23}C_6$ phase and a eutectic $M_7C_3$ phase at a temperature when the alloy is in the liquid state, wherein a difference between a formation temperature of the extremely hard boride/carbide particles and a formation temperature of an iron matrix phase of the alloy is 100K or lower.

Also disclosed are embodiments of a hardfacing layer formed from the alloy described above. In some embodiments, the layer can comprise a compressive strength of 3 GPA or higher, a hardness of 55 HRC or greater, high abrasion resistance as characterized by ASTM G65 mass loss of 0.15 grams or less, and high impact resistance as characterized by surviving at least 5,000 20 J impacts prior to failure.

Also disclosed herein are embodiments of an alloy powder, the powder comprising Fe and between about 0.8 to about 1.9 wt. % B, between about 0.9 to about 1.5 wt. % C, between about 3 to about 6.5 wt. % Cr, between about 3.5 to about 5.5 wt. % Nb, between about 9 to about 18 wt. % W, and between about 1.5 to about 4.5 wt. % V, wherein the alloy powder is configured to form an alloy coating upon deposition having the following properties at least 2 mole and volume % of extremely hard boride/carbide particles having a Vickers hardness of at least 1000, 5 mole or volume % or less of a hypereutectic boride phases when the alloy powder is in a liquid state, and 5 mole and volume % or less of a eutectic $M_{23}C_6$ phase and a eutectic $M_7C_3$ phase at a temperature when the alloy powder is in the liquid state.

In some embodiments, the alloy coating can further comprise a compressive strength of 3 GPA or higher, a hardness of 55 HRC or greater, high abrasion resistance as characterized by ASTM G65 mass loss of 0.15 grams or less, and high impact resistance as characterized by surviving at least 5,000 20 J impacts prior to failure.

Also disclosed herein are embodiments of a hardfacing layer comprising iron, boron, carbon, and at least one other element configured to form borides and/or carbides, the hardfacing layer comprising a martensitic microstructure, at least 2 mole and volume % of extremely hard boride/carbide particles having a Vickers hardness of at least 1000, a compressive strength of 3 GPA or higher, a hardness of 55 HRC or greater, high abrasion resistance as characterized by ASTM G65 mass loss of 0.15 grams or less, and high impact resistance as characterized by surviving at least 5,000 20 J impacts prior to failure.

In some embodiments, the layer can further comprise 5 mole and volume % or less of a hypereutectic boride phases when the alloy is in a liquid state, and 5 mole and volume % or less of a eutectic $M_{23}C_6$ phase and a eutectic $M_7C_3$ phase when the alloy is in the liquid state, wherein a difference between a formation temperature of the extremely hard boride/carbide particles and a formation temperature of an iron matrix phase of the alloy is 200K or lower.

In some embodiments, the layer can further comprise between about 0.8 to about 1.9 wt. % B, between about 0.9 to about 1.5 wt. % C, between about 3 to about 6.5 wt. % Cr, between about 3.5 to about 5.5 wt. % Nb, between about 9 to about 18 wt. % W, and between about 1.5 to about 4.5 wt. % V.

DETAILED DESCRIPTION

Figure 1:
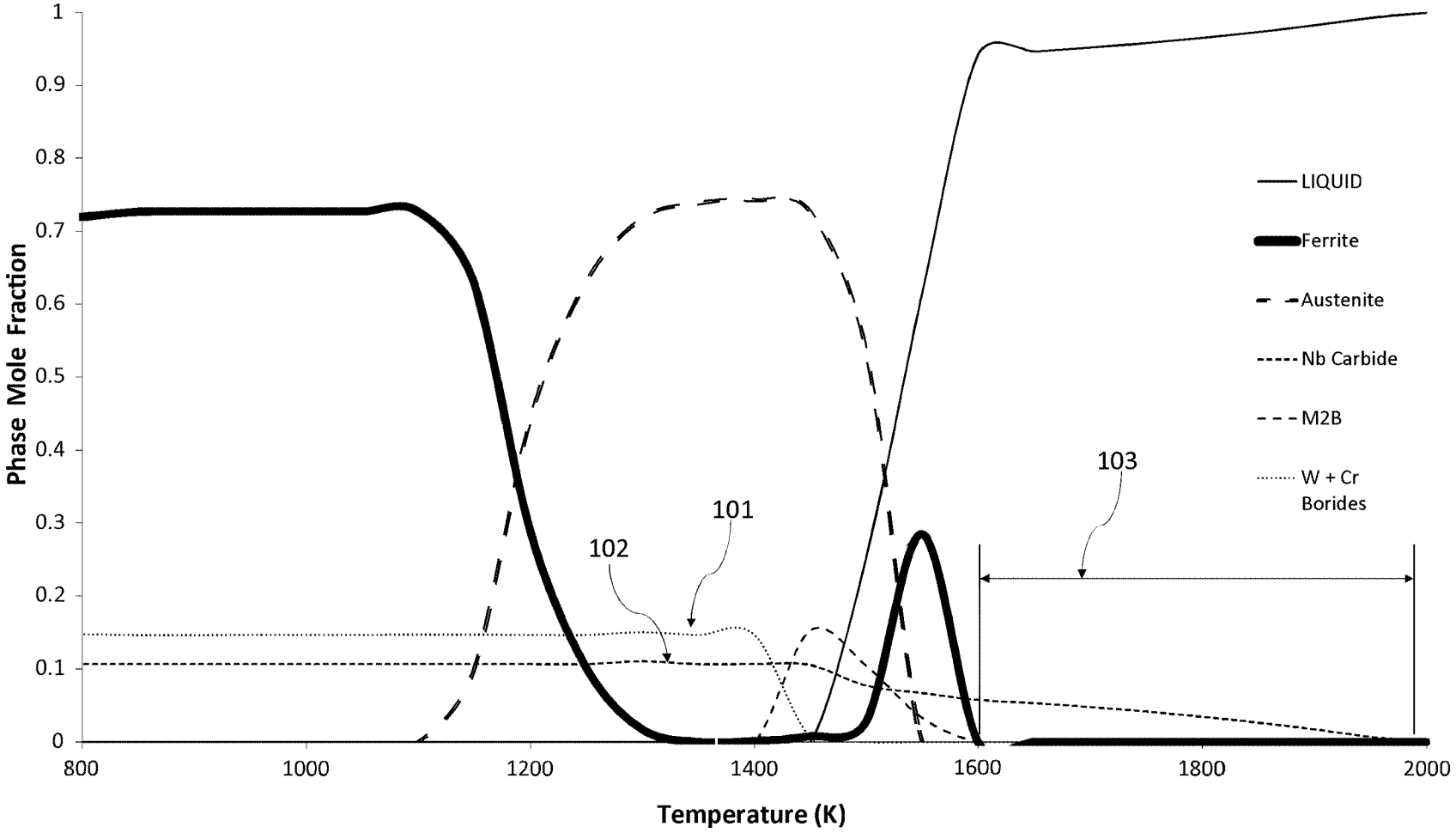
FIG. 1 illustrates a thermodynamic profile of an embodiment of a disclosed alloy.

Disclosed herein are embodiments of alloys which can simultaneously possess high abrasion and high impact resistance. Specifically, embodiments of the disclosure describe a unique alloy system which forms isolated carbides of the NbC, TiC, VC type or combinations thereof, and eutectic borides containing Cr, Mo, W, or combinations thereof as the primary metallic species. This type of structure can create a very hard and abrasion resistant alloy which can also be extremely resistant to impact.

As disclosed herein, the term alloy can refer to the chemical composition forming the powder disclosed within, the powder itself, and the composition of the metal component formed by the heating and/or deposition of the powder.

In some embodiments, certain alloy are disclosed, and the process of their design, which can be used in common powder manufacturing technologies, such as gas atomization, vacuum atomization, and other like processes which are used to make metal powders, but which also form the extremely hard carbides and borides when used in a hardfacing process.

In some embodiments, computational metallurgy can be used to identify these alloys which form extremely hard carbides and borides at relatively low temperatures.

Metal Alloy Composition

In some embodiments, an alloy can be described by the metal alloy compositions which produce the thermodynamic, microstructural, and performance criteria discussed in detail below. The disclosed compositions can be incorporated at least into ingots or welding wires.

In some embodiments, the alloy can be described by specific compositions in weight % with Fe making the balance, as presented in which have been identified using computational metallurgy and experimentally manufactured successful into ingots. In some embodiments, the metal alloy composition can be an Fe-based alloy, such that the highest elemental concentration of the alloy is Fe.

In some embodiments, the metal alloy composition can comprise both C and B. In some embodiments, the metal alloy composition can comprise the following ranges in weight percent:

C: 0.2-5% (or about 0.2 to about 5)

B: 0.2-4% (or about 0.2 or about 4)

In some embodiments, the metal alloy composition can comprise one of the following boride forming elements: Cr, Mo, and W. In some embodiments, the metal alloy composition can comprise the following ranges in weight percent:

Cr: 0-20% (or about 0 to about 20%)

W: 0-20% (or about 0 to about 20%)

Mo: 0-10% (or about 0 to about 10%)

In some embodiments, the metal alloy composition can comprise one of the following carbide forming elements: Nb, Ti, and V. In some embodiments, the metal alloy composition can comprise the following ranges in weight percent:

Nb: 0-10% (or about 0 to about 10%)

Ti: 0-9% (or about 0 to about 9%)

V: 0-20% (or about 0 to about 20%)

In some embodiments, the alloy can comprise additional alloying elements, which do not significantly affect the fundamental thermodynamic, microstructural, and performance characteristics of this disclosure but are added for the purposes of manufacturability, cost, performance, or process-ability. In some embodiments, the metal alloy composition can comprise the following ranges in weight percent:

Mn: 0-4.04% (or about 0 to about 4.04)

Ni: 0-0.64% (or about 0 to about 0.64); or 0-2% (or about 0 to about 2)

Si: 0-2% (or about 0 to about 2)

In some embodiments, the metal alloy composition may contain additional elements present as impurities or for the purposes of manufacturability, cost, performance, or process-ability. Such elements may comprise elements Na, Mg, Al, N, O, Ca, Ni, Cu, Zn, Y, and Zr.

In some embodiments, the alloy can comprise the following elements in weight percent:

B: 0.6 to 2.6 (or about 0.6 to about 2.6)
C: 0.5 to 2.5 (or about 0.5 to about 2.5)
Cr: 3.0 to 20 (or about 3.0 to about 20)
Nb: 0 to 5.0 (or about 0 to about 5.0); or 0 to 7.0 (or about 0 to about 7.0)
Ti: 0.1 to 6.0 (or about 0.1 to about 6.0)
V: 1.6 to 6.1 (or about 1.6 to about 6.1)
W: 2.0 to 13.5 (or about 2.0 to about 13.5)

In some embodiments, the above composition can further comprise elements which are added for manufacturing and processing considerations, but have minimal effect on the microstructural and performance features:

Mn: 1.0 to 2.0 (or about 1.0 to about 2.0)
Si: 0.5 to 1.2 (or about 0.5 to about 1.2)

In some embodiments, the alloy can be described by the composition of wires successfully manufactured into welding wires. In some embodiments, the alloy comprises the following elements in weight percent:

B: 0.8 to 2.2 (or about 0.8 to about 2.2)
C: 1 to 2 (or about 1 to about 2)
Cr: 4.2 to 20.8 (or about 4.2 to about 20.8)
Nb: 0 to 5.2 (or about 0 to about 5.2)
Ti: 0 to 1 (or about 0 to about 1)
V: 0 to 4.3 (or about 0 to about 4.3)
W: 6 to 11 (or about 6 to about 11)

In some embodiments, the above composition can further comprise elements which are added for manufacturing and processing considerations, but have minimal effect on the microstructural and performance features:

Mn: 0 to 1.6 (or about 0 to about 1.6)
Si: 0 to 1 (or about 0 to about 1)

Further, in some embodiments, the composition range of the alloy can be:

Fe: Bal
B: 0.8 (or about 0.8)
C: 0.8 to 1 (or about 0.8 to about 1)
Cr: 3.5 (or about 3.5)
Mn: 1.3 (or about 1.3)
Nb: 1.5 to 3.5 (or about 1.5 to about 3.5)
Si: 1.5 (about 1.5)
Ti: 0.4 (or about 0.4)
V: 1.7 (or about 1.7)
W: 9 (or about 9)

In some embodiments, the alloy can be describe by specific compositions in weight percent of alloy which have been successfully manufactured into powder. In some embodiments, the alloy can comprise:

B: 8 (or about 0.8)
C: 0.95 (or about 0.95)
Cr: 3.5 (or about 3.5)
Nb: 1.5 (or about 1.5)
Ti: 0.4 (or about 0.4)
V: 1.7 to 4 (or about 1.7 to about 4)
W: 9 (or about 9)

In some embodiments, the composition can further comprise elements which are added for manufacturing and processing considerations, but have minimal effect on the microstructural and performance features:

Mn: 1.3 (or about 1.3)
Si: 1.5 (or about 1.5)

In some embodiments, the chemistries of the alloy can be modified based on the particular process that is being used. For example, chemistry used for gas metal arc welding (GMAW) can be:

B: 0.8 to 1.1 (or about 0.8 to about 1.1)
C: 0.9 to 1.5 (or about 0.9 to about 1.5)
Cr: 4. to 5.5 (or about 4 to about 5.5)
Nb: 3.5 to 5.5 (or about 3.5 to about 5.5)
W: 9 to 11.5 (or about 9 to about 11.5); or 9 to 12.5 (or about 9 to about 12.5)
V: 2 to 2.5 (or about 2 to about 2.5); or 2 to 3.5 (or about 2 to about 3.5)

For sub-arc and open arc welding, the chemistry can be:

B: 1.4 to 1.9 (or about 1.4 to about 1.9)
C: 1.25 to 1.5 (or about 1.25 to about 1.5)
Cr: 5 to 6.5 (or about 5 to about 6.5)
Nb: 3.5 to 5.5 (or about 3.5 to about 5.5); or 3.5 to 7 (or about 3.5 to about 7)
W: 13.5 to 18 (or about 13.5 to about 18)
V: 4 to 4.5 (or about 4 to about 4.5); or 4 to 5 (or about 4 to about 5)

For plasma transferred arc or laser welding, the chemistry can be:

B: 0.8 to 0.9 (or about 0.8 to about 0.9)
C: 0.9 to 1.5 (or about 0.9 to about 1.5)
Cr: 3 to 4 (or about 3 to about 4)
Nb: 1 to 2 (or about 1 to about 2)
W: 13.5 to 18 (or about 13.5 to about 18); or 8 to 18 (or about 8 to about 18)
V: 1.5 to 4.5 (or about 1.5 to about 4.5)

Optionally, for the chemistries for the three above processes, each of Si, Ti, and Mn can be up to 1.5 (or up to about 1.5).

As will be demonstrated in this disclosure, the microstructural features are primarily a function of carbides, borides, and there morphology. The ranges and relationships of the Cr, W, Mo, Nb, Ti, V, C, and B elements are the most fundamental descriptors of the disclosed technology in terms of alloy composition. Additional elements are included in the specific embodiments for various reasons beyond the microstructural criteria described herein.

The below tables lists certain compositions that can conform to the compositional criteria discussed above. Table 1 discloses alloys produced in an ingot form.

TABLE 1

Nominal Alloy Chemistries Produced in Ingot Form, Fe is the Balance

| Alloy | B | C | Cr | Mn | Mo | Nb | Si | V | Ti | W |
|---|---|---|---|---|---|---|---|---|---|---|
| X1 | 0 | 2.6 | 28.0 | 0 | 0 | 3.0 | 0 | 0 | 0 | 5.0 |
| X2 | 0 | 2.0 | 28.0 | 0 | 0 | 3.0 | 0 | 0 | 0 | 5.0 |
| X3 | 0 | 2.0 | 28.0 | 0 | 0 | 1.5 | 0 | 0 | 0 | 5.0 |
| X4 | 1.0 | 0.5 | 15.0 | 0 | 0 | 2.0 | 0 | 0 | 0 | 5.0 |
| X5 | 0.6 | 0.7 | 15.0 | 0 | 0 | 0.0 | 0 | 0 | 0 | 5.0 |
| X6 | 0.8 | 1.0 | 15.0 | 0 | 0 | 2.0 | 0 | 0 | 0 | 5.0 |
| X7 | 0.7 | 1.0 | 15.0 | 0 | 0 | 0.0 | 0 | 0 | 0 | 5.0 |
| X8 | 1.0 | 1.2 | 15.0 | 0 | 0 | 2.0 | 0 | 0 | 0 | 5.0 |
| X9 | 1.0 | 1.2 | 15.0 | 0 | 0 | 0.0 | 0 | 0 | 0 | 5.0 |
| X10 | 1.5 | 0.5 | 3.0 | 1.0 | 0 | 5.0 | 1.0 | 0 | 0.5 | 10.7 |
| X11 | 1.5 | 1.5 | 3.0 | 1.0 | 0 | 5.0 | 1.0 | 0 | 0.5 | 10.7 |
| X12 | 1.5 | 1.0 | 3.0 | 1.0 | 0 | 5.0 | 1.0 | 0 | 0.5 | 10.7 |
| X13 | 1.5 | 1.0 | 3.0 | 1.0 | 0 | 5.0 | 1.0 | 0 | 0.5 | 10.7 |
| X14 | 1.0 | 0.5 | 15.0 | 0 | 0 | 1.0 | 0 | 0 | 0 | 5.0 |
| X15 | 0.5 | 0.8 | 15.0 | 0 | 0 | 0.0 | 0 | 0 | 0 | 5.0 |
| X16 | 2.0 | 0.5 | 5.0 | 0 | 0 | 2.0 | 0 | 0 | 0 | 4.0 |
| X17 | 1.5 | 0.5 | 7.0 | 0 | 0 | 2.0 | 0 | 0 | 0 | 4.0 |
| X18 | 2.5 | 0.5 | 5.0 | 0 | 0 | 2.0 | 0 | 0 | 0 | 6.0 |
| X19 | 0 | 5.0 | 1.5 | 1.0 | 1.0 | 0 | 4.0 | 0 | 0 | 32.0 |
| X20 | 0 | 3.5 | 1.5 | 1.0 | 1.0 | 0 | 2.0 | 0 | 0 | 32.0 |

TABLE 1-continued

Nominal Alloy Chemistries Produced in Ingot Form, Fe is the Balance

| Alloy | B | C | Cr | Mn | Mo | Nb | Si | V | Ti | W |
|---|---|---|---|---|---|---|---|---|---|---|
| X21 | 0 | 1.5 | 1.5 | 1.0 | 1.0 | 0 | 1.0 | 0 | 0 | 32.0 |
| X22 | 0 | 3.0 | 1.5 | 1.0 | 1.0 | 0 | 3.0 | 0 | 0 | 36.0 |
| X23 | 0 | 1.5 | 1.5 | 1.0 | 1.0 | 0 | 2.0 | 0 | 0 | 16.0 |
| X24 | 0 | 1.0 | 1.5 | 1.0 | 1.0 | 0 | 1.0 | 0 | 0 | 26.0 |
| X25 | 1.05 | 1.29 | 4.76 | 0 | 0 | 4.94 | 0.46 | 0 | 0.5 | 9.94 |
| X26 | 1.05 | 1.29 | 4.76 | 0 | 0 | 4.94 | 0.46 | 1.6 | 0.5 | 9.94 |
| X27 | 1.05 | 1.29 | 4.76 | 0 | 0 | 4.94 | 0.46 | 3.0 | 0.5 | 9.94 |
| X28 | 0.8 | 1.0 | 15.0 | 0 | 0 | 2.0 | 0 | 3.0 | 0 | 5.0 |
| X29 | 1.9 | 1.9 | 15.0 | 0 | 0 | 0 | 0 | 0 | 6.0 | 10.0 |
| X30 | 1.9 | 1.9 | 20.0 | 0 | 0 | 0 | 0 | 0 | 6.0 | 2.0 |
| X31 | 0.7 | 1.9 | 5.0 | 0 | 0 | 0 | 0 | 0 | 6.0 | 10.0 |
| X32 | 2.6 | 1.6 | 20.0 | 0 | 0 | 0 | 0 | 0 | 6.0 | 0 |
| X33 | 2.6 | 2.0 | 10.0 | 0 | 0 | 0 | 0 | 0 | 6.0 | 0 |
| X34 | 3.0 | 1.6 | 10.0 | 0 | 0 | 0 | 0 | 0 | 6.0 | 0 |
| X35 | 2.0 | 1.8 | 5.0 | 0 | 0 | 0 | 0 | 0 | 6.0 | 6.0 |
| X36 | 1.4 | 2.6 | 10.0 | 0 | 0 | 2.0 | 0 | 12.0 | 0 | 0 |
| X37 | 1.8 | 3.0 | 10.0 | 0 | 0 | 2.0 | 0 | 10.0 | 0 | 0 |
| X38 | 2.4 | 3.0 | 10.0 | 0 | 0 | 2.0 | 0 | 12.0 | 0 | 0 |
| X39 | 1 | 2.6 | 10.0 | 0 | 0 | 2.0 | 0 | 11.0 | 0 | 0 |
| X40 | 1.4 | 2.8 | 10.0 | 0 | 0 | 0 | 0 | 14.0 | 0 | 0 |
| X41 | 1.4 | 2.8 | 10.0 | 0 | 0 | 0 | 0 | 18.0 | 0 | 0 |
| X42 | 1.4 | 2.8 | 10.0 | 0 | 0 | 1.0 | 0 | 18.0 | 0 | 0 |

TABLE 1-continued

Nominal Alloy Chemistries Produced in Ingot Form, Fe is the Balance

| Alloy | B | C | Cr | Mn | Mo | Nb | Si | V | Ti | W |
|---|---|---|---|---|---|---|---|---|---|---|
| X43 | 0 | 3.0 | 5.0 | 0 | 0 | 0 | 0 | 15.0 | 0 | 0 |
| X44 | 1.0 | 0.9 | 4.4 | 2.0 | 0 | 1.6 | 1.2 | 0.1 | 3.1 | 12.0 |
| X45 | 1.0 | 0.9 | 4.3 | 2.0 | 0 | 1.6 | 1.2 | 0.1 | 5.0 | 11.7 |
| X46 | 1.0 | 0.9 | 4.3 | 1.9 | 0 | 1.6 | 1.2 | 0.1 | 6.1 | 11.6 |
| X47 | 1.0 | 0.9 | 4.4 | 2.0 | 0 | 1.6 | 1.2 | 0.1 | 3.2 | 12.0 |
| X48 | 1.0 | 0.9 | 4.4 | 2.0 | 0 | 1.6 | 1.2 | 0.1 | 3.4 | 11.9 |
| X49 | 1.0 | 0.9 | 4.4 | 2.0 | 0 | 1.6 | 1.2 | 0.1 | 3.6 | 11.9 |

While the above compositional ranges describe ingot chemistries, they can also represent ranges for feedstock of any type comprising both powder alloys and wire alloys. The purpose of manufacturing ingots in this study is an initial experiment to determine compositions suitable for manufacture into powder or wire.

Table 2 lists compositions that have been tested under glow discharge spectroscopy. It can be understood that Table 1 shows the measured chemistries of the listed alloys whereas Table 1 shows the nominal chemistries, as there can be variations due to manufacturing techniques.

TABLE 2

Ingot Chemistry Measurements via Glow Discharge Spectroscopy, Fe is the Balance

| Alloy | B | C | Cr | Mn | Mo | Nb | Ni | Si | Ti | V | W |
|---|---|---|---|---|---|---|---|---|---|---|---|
| X1 | 0.01 | 3.20 | 20.40 | 0.55 | 0.05 | 6.05 | 0.32 | 0.60 | 0.14 | 0.09 | 5.04 |
| X2 | 0.01 | 2.45 | 26.70 | 0.53 | 0.05 | 4.24 | 0.31 | 0.55 | 0.07 | 0.08 | 4.48 |
| X3 | 0.01 | 2.61 | 19.20 | 0.55 | 0.04 | 1.85 | 0.20 | 0.51 | 0.05 | 0.06 | 5.29 |
| X4 | 1.23 | 0.73 | 15.20 | 0.31 | 0.03 | 1.98 | 0.23 | 0.24 | 0.03 | 0.06 | 4.18 |
| X5 | 0.62 | 0.75 | 13.70 | 0.36 | 0.03 | 0.09 | 0.08 | 0.25 | 0.02 | 0.05 | 4.88 |
| X6 | 1.10 | 1.27 | 16.60 | 0.38 | 0.04 | 1.69 | 0.26 | 0.31 | 0.03 | 0.07 | 4.89 |
| X7 | 0.94 | 1.32 | 17.00 | 0.41 | 0.04 | 0.13 | 0.20 | 0.30 | 0.03 | 0.06 | 4.76 |
| X8 | 1.03 | 1.50 | 15.60 | 0.40 | 0.04 | 3.68 | 0.22 | 0.38 | 0.07 | 0.07 | 3.99 |
| X9 | 1.43 | 1.47 | 16.80 | 0.42 | 0.03 | 0.10 | 0.20 | 0.36 | 0.02 | 0.05 | 4.06 |
| X10 | 2.37 | 0.64 | 2.09 | 0.69 | 0.02 | 4.10 | 0.44 | 0.73 | 0.27 | 0.05 | 4.18 |
| X11 | 1.62 | 1.99 | 2.83 | 0.63 | 0.02 | 2.02 | 0.46 | 0.72 | 0.23 | 0.04 | 4.56 |
| X12 | 1.74 | 1.04 | 2.84 | 0.79 | 0.02 | 2.63 | 0.28 | 0.72 | 0.34 | 0.04 | 5.08 |
| X12 | 1.78 | 1.20 | 2.67 | 0.77 | 0.02 | 3.31 | 0.37 | 0.71 | 0.46 | 0.05 | 4.95 |
| X13 | 1.44 | 0.73 | 14.60 | 0.23 | 0.03 | 1.32 | 0.33 | 0.14 | 0.02 | 0.04 | 4.56 |
| X14 | 0.64 | 1.06 | 9.56 | 0.27 | 0.02 | 0.08 | 0.24 | 0.12 | 0.01 | 0.02 | 3.56 |
| X15 | 2.28 | 0.66 | 4.77 | 0.27 | 0.01 | 2.04 | 0.31 | 0.13 | 0.02 | 0.03 | 2.59 |
| X16 | 2.67 | 0.47 | 4.04 | 0.24 | 0.03 | 2.53 | 0.33 | 0.10 | 0.03 | 0.05 | 8.07 |
| X17 | 2.18 | 0.62 | 7.71 | 0.26 | 0.02 | 2.12 | 0.23 | 0.11 | 0.03 | 0.04 | 5.77 |
| X18 | 0.03 | 3.93 | 1.60 | 1.03 | 0.88 | 0.26 | 0.70 | 3.95 | 0.03 | 0.10 | 22.60 |
| X18 | 0.032 | 5.28 | 1.34 | 0.696 | 1.12 | 0.351 | 1.13 | 3.64 | 0.034 | 0.127 | 27.8 |
| X19 | 0.03 | 3.62 | 1.57 | 1.05 | 1.28 | 0.26 | 0.73 | 1.67 | 0.04 | 0.11 | 24.00 |
| X22 | 0.03 | 1.28 | 1.47 | 0.87 | 1.17 | 0.18 | 0.38 | 1.77 | 0.02 | 0.07 | 17.50 |
| X23 | 0.04 | 0.42 | 1.29 | 0.98 | 1.04 | 0.28 | 0.64 | 0.86 | 0.03 | 0.12 | 29.20 |
| X23 | 0.04 | 0.68 | 1.33 | 1.09 | 0.99 | 0.24 | 0.58 | 0.96 | 0.02 | 0.11 | 24.40 |
| X24 | 1.36 | 1.48 | 4.17 | 0.23 | 0.04 | 4.20 | 0.39 | 0.60 | 0.45 | 0.06 | 8.10 |
| X25 | 1.15 | 1.20 | 4.01 | 0.22 | 0.07 | 6.44 | 0.49 | 0.67 | 0.38 | 1.14 | 11.30 |
| X26 | 1.12 | 1.14 | 9.30 | 0.21 | 0.09 | 3.76 | 0.49 | 0.47 | 0.42 | 2.37 | 12.60 |
| X27 | 0.94 | 0.96 | 15.00 | 0.23 | 0.09 | 2.05 | 0.17 | 0.18 | 0.03 | 2.99 | 4.88 |
| X28 | 2.28 | 2.02 | 17.30 | 0.40 | 0.06 | 0.22 | 1.03 | 0.40 | 4.67 | 0.06 | 9.15 |
| X29 | 1.99 | 1.85 | 19.30 | 0.44 | 0.05 | 0.16 | 1.02 | 0.44 | 5.18 | 0.03 | 2.26 |
| X30 | 0.90 | 1.96 | 3.35 | 0.38 | 0.05 | 0.19 | 1.04 | 0.29 | 4.32 | 0.04 | 6.71 |
| X31 | 2.17 | 2.59 | 19.80 | 0.41 | 0.05 | 0.16 | 1.28 | 0.42 | 4.10 | 0.03 | 0.80 |
| X32 | 2.83 | 2.79 | 10.50 | 0.50 | 0.04 | 0.15 | 1.37 | 0.47 | 4.22 | 0.02 | 0.79 |
| X33 | 2.78 | 1.50 | 10.70 | 0.46 | 0.03 | 0.11 | 1.08 | 0.40 | 3.78 | 0.02 | 0.67 |
| X34 | 1.73 | 3.08 | 4.40 | 0.36 | 0.04 | 0.15 | 1.08 | 0.24 | 5.14 | 0.03 | 4.25 |
| X34 | 1.98 | 3.43 | 4.95 | 0.36 | 0.04 | 0.18 | 1.11 | 0.30 | 5.06 | 0.03 | 5.75 |
| X35 | 1.53 | 2.76 | 12.00 | 0.27 | 0.32 | 1.64 | 0.68 | 0.37 | 0.04 | 7.71 | 0.21 |
| X36 | 1.81 | 2.70 | 11.50 | 0.25 | 0.27 | 2.01 | 0.59 | 0.34 | 0.04 | 6.59 | 0.21 |
| X37 | 2.18 | 2.68 | 12.00 | 0.29 | 0.33 | 1.60 | 0.70 | 0.39 | 0.05 | 8.04 | 0.21 |
| X38 | 1.08 | 2.67 | 11.70 | 0.23 | 0.29 | 1.31 | 0.56 | 0.32 | 0.03 | 7.84 | 0.22 |
| X39 | 1.36 | 2.57 | 12.30 | 0.30 | 0.35 | 0.48 | 0.61 | 0.38 | 0.03 | 9.61 | 0.25 |

Table 2 above shows chemistries which were made into ingots. Table 3 below shows chemistries that were made into wires, though all of the particular chemistries can be used in either fashion.

TABLE 3

Glow Discharge Chemistries of Alloys Successfully Manufactured into Hardfacing Wire, Fe is the Balance

| Alloy | B | C | Cr | Mn | Nb | Si | Ti | V | W |
|---|---|---|---|---|---|---|---|---|---|
| W1 | 1.05 | 1.29 | 4.76 | 0.20 | 4.94 | 0.46 | 0.50 | 3.16 | 9.94 |
| W2 | 0.86 | 1.17 | 5.25 | 0.16 | 3.81 | 0.42 | 0.37 | 1.91 | 10.80 |
| W3 | 1.04 | 1.33 | 4.97 | 0.23 | 5.20 | 0.56 | 0.55 | 1.93 | 10.30 |
| W4 | 1.05 | 1.46 | 4.69 | 0.17 | 4.70 | 0.49 | 0.46 | 2.83 | 11.00 |
| W5 | 1.42 | 1.06 | 20.80 | 0.43 | 2.82 | 0.39 | 0.08 | 0.14 | 6.05 |
| W6 | 1.03 | 1.57 | 19.10 | 0.40 | 2.62 | 0.38 | 0.08 | 0.16 | 6.79 |
| W7 | 1.08 | 1.96 | 18.50 | 0.42 | 2.39 | 0.41 | 0.08 | 0.16 | 6.10 |
| W8 | 1.13 | 1.61 | 18.60 | 0.38 | 0.14 | 0.26 | 0.03 | 0.14 | 6.65 |
| W9 | 1.01 | 1.29 | 4.64 | 0.21 | 4.64 | 0.52 | 0.54 | 0.08 | 9.80 |
| W10 | 1.66 | 1.62 | 4.38 | 0.88 | 3.25 | 0.85 | 0.40 | 0.07 | 9.31 |
| W11 | 1.44 | 1.29 | 5.94 | 1.07 | 4.58 | 0.48 | 0.75 | 4.09 | 15.17 |
| W12 | 1.05 | 1.29 | 4.76 | 0.20 | 4.94 | 0.46 | 0.50 | 3.16 | 9.94 |
| W13 | 1.26 | 1.36 | 6.01 | 0.857 | 4.93 | 0.578 | 0.515 | 4.29 | 8.66 |
| W14 | 1.61 | 1.41 | 4.27 | 0.911 | 4.07 | 0.566 | 0.503 | 1.68 | 8.38 |
| W15 | 2.19 | 1.34 | 4.59 | 0.931 | 4.24 | 0.595 | 0.541 | 1.71 | 8.69 |
| W16 | 1.01 | 1.27 | 4.45 | 1.53 | 3.71 | 0.26 | 0.32 | 1.88 | 7.44 |

TABLE 4

Alloys Successfully Manufactured into Hardfacing Powder, Fe is the Balance

| Alloy | B | C | Cr | Mn | Nb | Ni | Si | Ti | V | W |
|---|---|---|---|---|---|---|---|---|---|---|
| P1 | 0.8 | 0.95 | 3.5 | 1.3 | 1.5 | 0 | 1.5 | 0.4 | 1.7 | 9 |
| P2 | 0.8 | 0.95 | 3.5 | 1.3 | 1.5 | 0 | 1.5 | 0.4 | 5 | 9 |
| P3 | 0.8 | 0.95 | 3.5 | 1.3 | 1.5 | 0 | 1.5 | 0.4 | 3 | 9 |
| P4 | 0.8 | 0.95 | 3.5 | 1.3 | 1.5 | 0 | 1.5 | 0.4 | 3.5 | 9 |
| P5 | 0.8 | 0.95 | 3.5 | 1.3 | 1.5 | 0 | 1.5 | 0.4 | 4 | 9 |
| P6 | 0 | 1.4 | 13.25 | 9.5 | 0.75 | 2.25 | 1.5 | 0.225 | 0.4 | 3.25 |

In some embodiments, the alloy can be described by compositional ranges in weight % at least partially based on the compositions presented in Table 5 which meet the disclosed thermodynamic parameters and are intended to form a ferritic or martensitic matrix.

TABLE 5

Ferritic and Martensitic Alloy Chemistries which Meet Thermodynamic Criteria

| No | B | C | Cr | Fe | Mn | Nb | Si | Ti | V | W |
|---|---|---|---|---|---|---|---|---|---|---|
| M1 | 0.8 | 0.8 | 3.5 | 78.25 | 1.3 | 2.75 | 1.5 | 0.4 | 1.7 | 9 |
| M2 | 0.8 | 0.8 | 3.5 | 77.75 | 1.3 | 3.25 | 1.5 | 0.4 | 1.7 | 9 |
| M3 | 0.8 | 0.9 | 3.5 | 79.4 | 1.3 | 1.5 | 1.5 | 0.4 | 1.7 | 9 |
| M4 | 0.8 | 0.9 | 3.5 | 79.15 | 1.3 | 1.75 | 1.5 | 0.4 | 1.7 | 9 |
| M5 | 0.8 | 0.9 | 3.5 | 78.9 | 1.3 | 2 | 1.5 | 0.4 | 1.7 | 9 |
| M6 | 0.8 | 0.9 | 3.5 | 78.65 | 1.3 | 2.25 | 1.5 | 0.4 | 1.7 | 9 |
| M7 | 0.8 | 0.9 | 3.5 | 78.4 | 1.3 | 2.5 | 1.5 | 0.4 | 1.7 | 9 |
| M8 | 0.8 | 0.9 | 3.5 | 78.15 | 1.3 | 2.75 | 1.5 | 0.4 | 1.7 | 9 |
| M9 | 0.8 | 0.9 | 3.5 | 77.9 | 1.3 | 3 | 1.5 | 0.4 | 1.7 | 9 |
| M10 | 0.8 | 0.9 | 3.5 | 77.65 | 1.3 | 3.25 | 1.5 | 0.4 | 1.7 | 9 |
| M11 | 0.8 | 0.9 | 3.5 | 77.4 | 1.3 | 3.5 | 1.5 | 0.4 | 1.7 | 9 |
| M12 | 0.8 | 1 | 3.5 | 79.3 | 1.3 | 1.5 | 1.5 | 0.4 | 1.7 | 9 |
| M13 | 0.8 | 1 | 3.5 | 78.3 | 1.3 | 2.5 | 1.5 | 0.4 | 1.7 | 9 |
| M14 | 0.8 | 1 | 3.5 | 78.05 | 1.3 | 2.75 | 1.5 | 0.4 | 1.7 | 9 |
| M15 | 0.8 | 1 | 3.5 | 77.55 | 1.3 | 3.25 | 1.5 | 0.4 | 1.7 | 9 |
| M16 | 0.8 | 1 | 3.5 | 77.3 | 1.3 | 3.5 | 1.5 | 0.4 | 1.7 | 9 |
| M17 | 0.8 | 0.8 | 3.5 | 77.5 | 1.3 | 3.5 | 1.5 | 0.4 | 1.7 | 9 |
| M18 | 0.8 | 1 | 3.5 | 79.05 | 1.3 | 1.75 | 1.5 | 0.4 | 1.7 | 9 |
| M19 | 0.8 | 1 | 3.5 | 78.8 | 1.3 | 2 | 1.5 | 0.4 | 1.7 | 9 |
| M20 | 0.8 | 1 | 3.5 | 78.55 | 1.3 | 2.25 | 1.5 | 0.4 | 1.7 | 9 |
| M21 | 0.8 | 1 | 3.5 | 77.8 | 1.3 | 3 | 1.5 | 0.4 | 1.7 | 9 |

As discussed above, different manufacturing techniques can use different chemistries. Table 6 discloses nominal and actual chemistries used for certain manufacturing methods.

TABLE 6

Nominal and Actual Alloy Chemistries for Different Manufacturing Methods

| Alloy | B | C | Cr | Mn | Nb | Si | Ti | V | W |
|---|---|---|---|---|---|---|---|---|---|
| GMAW Nominal | 1 | 1.2 | 5 | 0.3 | 4.5 | 0.5 | 0.5 | 2 | 10 |
| GMAW-Actual | 0.98 | 1.2 | 4.8 | 0.32 | 4.7 | 0.54 | 0.58 | 1.8 | 9.6 |
| GMAW-Actual | 1.03 | 1.2 | 4.85 | 0.22 | 4.96 | 0.55 | 0.43 | 2.08 | 11.09 |
| Sub/Open-Arc Nominal | 1.5 | 1.4 | 6 | 1 | 5 | 1.5 | 0.6 | 4.3 | 15 |
| SA/OA Actual | 1.48 | 1.42 | 6.1 | 1 | 4.78 | 0.59 | 0.61 | 4.09 | 18 |
| SA/OA Actual | 1.44 | 1.29 | 5.94 | 1.07 | 4.58 | 0.48 | 0.75 | 4.09 | 15.17 |
| SA/OA Actual | 1.85 | 1.36 | 5.84 | 0.99 | 4.39 | 0.57 | 0.53 | 4.13 | 13.76 |
| PTA-Nominal | 0.8 | 0.95 | 3.5 | 1.3 | 1.5 | 1.5 | 0.4 | 1.7 | 9 |
| PTA-Nominal | 0.8 | 0.95 | 3.5 | 1.3 | 1.5 | 1.5 | 0.4 | 5 | 9 |
| PTA-Nominal | 0.8 | 0.95 | 3.5 | 1.3 | 1.5 | 1.5 | 0.4 | 3 | 9 |
| PTA-Nominal | 0.8 | 0.95 | 3.5 | 1.3 | 1.5 | 1.5 | 0.4 | 3.5 | 9 |
| PTA-Nominal | 0.8 | 0.95 | 3.5 | 1.3 | 1.5 | 1.5 | 0.4 | 4 | 9 |
| PTA-Actual | 0.82 | 0.99 | 3.3 | 1.3 | 1.5 | 1.2 | 0.3 | 1.8 | 9.1 |
| PTA-Actual | 0.86 | 1.03 | 3.6 | 1.3 | 1.6 | 1.3 | 0.2 | 1.8 | 9.3 |
| PTA-Actual | 0.82 | 0.99 | 3.3 | 1.3 | 1.5 | 1.2 | 0.2 | 1.8 | 9.1 |
| PTA-Actual | 0.87 | 1.13 | 3.5 | 1.5 | 1.6 | 1 | 0.3 | 1.5 | 9 |

The Fe content identified in all of the compositions described in the above paragraphs may be the balance of the composition as indicated above, or alternatively, the balance of the composition may comprise Fe and other elements. In some embodiments, the balance may consist essentially of Fe and may include incidental impurities.

Thermodynamic Criteria

In some embodiments, alloys can be fully described by thermodynamic criteria which can be used to accurately predict their performance and manufacturability.

In some embodiments, a first thermodynamic criterion can be related to the total concentration of extremely hard particles in the microstructure. As the mole fraction of extremely hard particles is increased, the hardness and wear resistance may also increase, thus provided for an alloy that can be advantageous hardfacing applications.

Several non-limiting examples of hard phases which are extremely hard and also tend to form at very high temperatures in conventional alloys include: zirconium boride, titanium nitride, tungsten carbide, tungsten boride, tantalum carbide, zirconium carbide, alumina, beryllium carbide, titanium carbide, silicon carbide, aluminum boride, boron carbide, and diamond, though other materials can be used as well, and the type of extremely hard particle is not limiting.

For the purposes of this disclosure, extremely hard particles can be defined as material which have a Vickers hardness above 1000. The mole fraction of extremely hard phases is defined as the total mole % of any particle which meets or exceeds 1000 Vickers hardness which is thermodynamically stable at 1300K in the alloys.

In some embodiments, extremely hard particles are defined as materials which have a Knoop hardness above 1500 (or above about 1500). The mole fraction of extremely hard phases can be defined as the total mole % of any particle which meets or exceeds 1500 Knoop hardness, and which is thermodynamically stable at 1300K (or at about 1300K) in the alloy. Either Vickers or Knoop hardness can be used.

An example of this calculation is shown in FIG. 1 of the W1 alloy chemistry, where the total mole fraction of carbides at 1300K (or about 1300K) is equal to the sum of NbC [102] (11% mole fraction) and (Cr,W) Borides [101] (16% mole fraction) for a total of 27% mole fraction.

In some embodiments, the extremely hard particles fraction can be 2 mole % or greater (or about 2 mole % or greater). In some embodiments, the extremely hard particles fraction can be 5 mole % or greater (or about 5 mole % or greater). In some embodiments, the extremely hard particles fraction can be 10 mole % or greater (or about 10 mole % or greater). In some embodiments, the extremely hard particles fraction can be 15 mole % or greater (or about 15 mole % or greater). In some embodiments, the extremely hard particles fraction is 20 mole % or greater (or about 20 mole % or greater). The example provide in FIG. 1 has 27% mole fraction extremely hard particles.

In some embodiments, the hard particles can consist of (Cr,W)-rich boride and (Nb,Ti,V)-rich carbide particles. Several non-limiting examples of the borides include those of the $M_2B$ and $M_3B_2$ type. A non-limiting example of the carbides included those of the MC type. In each example M denotes a metallic element.

The second thermodynamic criterion is related to the impact resistance of the alloys. This criteria is the mole fraction of hypereutectic boride phases. An example of such is the (Cr—W)-rich borides which form in the SHS 9192 alloy and alloys described in U.S. Pat. Nos. 8,704,134, 7,553,382, and 8,474,541 and U.S. App. No. 2007/0029295, the entirety of each of which is hereby incorporated by reference. This phase, due to its rod-like morphology, can reduce the impact resistance of the material. As the amount of this phase increases, the impact resistance of the alloy can decrease. Furthermore, this type of phase can reduce the manufacturability of the alloy into powder form using conventional industrial processes.

Figure 2:
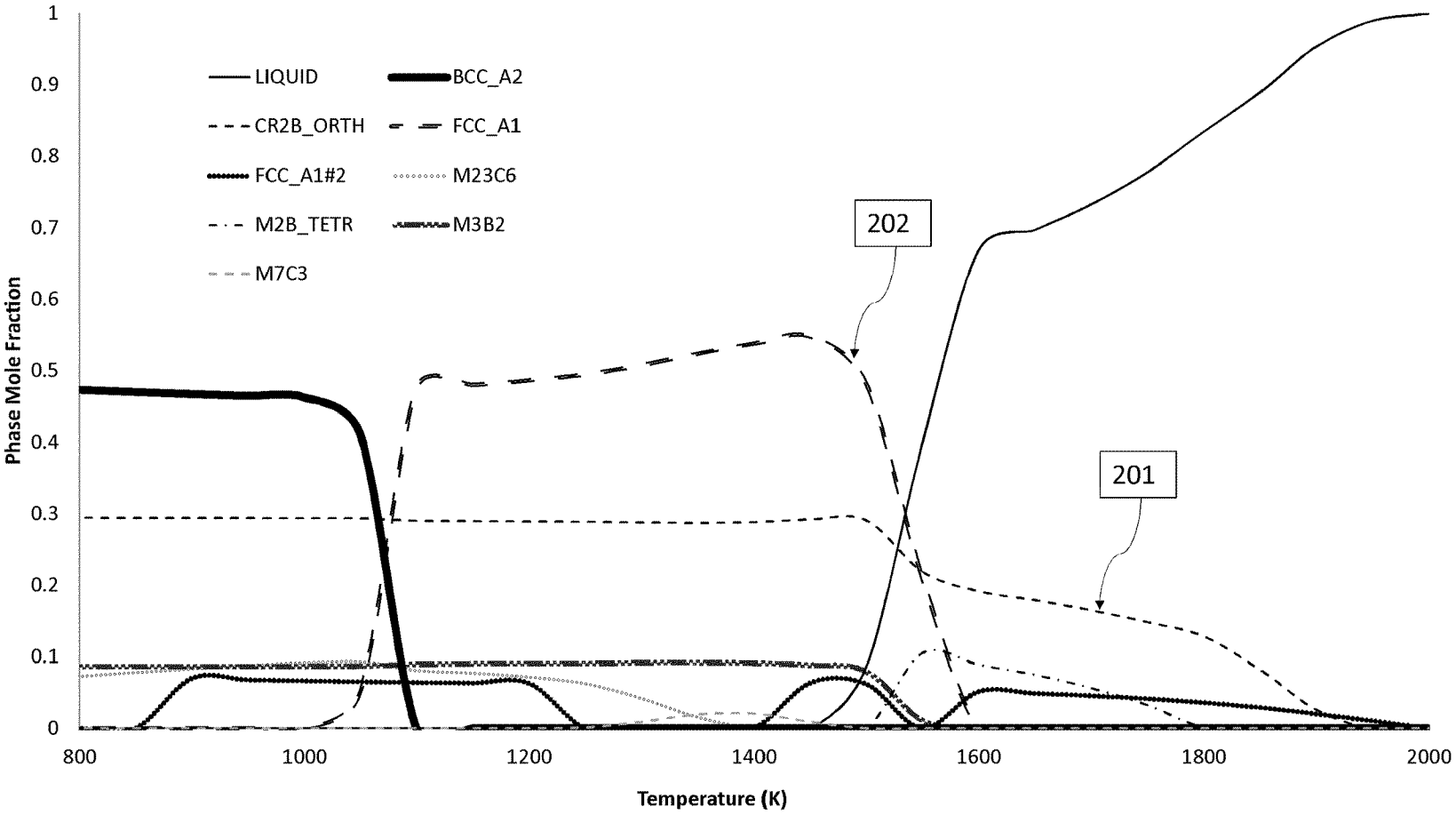
FIG. 2 illustrates a thermodynamic profile of commercial alloy SHS 9192.

As FIG. 1 demonstrates a specific embodiment of this disclosure, there is no hypereutectic boride formation. In order to demonstrate a thermodynamic profile of an alloy producing hypereutectic boride structure the calculation for commercial alloy SHS 9192 is shown in FIG. 2. As shown, the $Cr_2B$ [201] phase is present at a temperature above any temperature where the Fe matrix phase, austenite, [202] exists.

In some embodiments, the hypereutectic mole fraction can be 5% (or about 5%) or below. In some embodiments, the hypereutectic mole fraction can be 2.5% (or about 2.5%) or below. In some embodiments, the hypereutectic mole fraction can be 0% (or about 0%). The example provided in FIG. 1 has 0% hypereutectic boride formation.

A third thermodynamic criteria refers to the alloy's impact resistance and is related to the mole fraction of a secondary eutectic borocarbide present in the alloy's microstructure. Through extensive experimentation the secondary eutectic borocarbide hard phase has been shown to reduce the alloy's impact resistance. This criterion, however, is not directly visible in most thermodynamic models and required extensive comparison between experimental and modelling results to understand. It has been determined that if the $M_{23}C_6$ phase is thermodynamically stable at a temperature at which liquid is still present, then $M_{23}(C,B)_6$ in alloys of this type will likely form into an undesirable morphology. This type of effect is seen in alloys which form both borides and carbides of similar structure from the liquid.

Although experimentation reveals the $M_{23}(C,B)_6$ borocarbide to be an undesirable phase, the thermodynamic predictor of this formation is the $M_{23}C_6$ carbide. Extensive comparisons between thermodynamic criteria and experimental results were used in or to determine that carbide formation could predict the formation of boro-carbide phases. This example highlights the fact that the thermodynamic models do not directly predict the structure of the material.

It can therefore be advantageous to reduce the mole fraction or the eutectic $M_{23}C_6$ phase in thermodynamic models. For example, an alloy can be said to meet this thermodynamic criterion if the alloy contains a maximum calculated mole fraction of eutectic $M_{23}C_6$ phase. In some embodiments, the maximum mole fraction of eutectic $M_{23}C_6$ phase is at or below 5% (or at or below about 5%). In some embodiments, the maximum mole fraction of eutectic $M_{23}C_6$ phase is at or below 3% (or at or below about 3%). In some embodiments, the maximum mole fraction of eutectic $M_{23}C_6$ phase can be 0% (or about 0%). As shown in FIG. 1, there is no $M_{23}C_6$ phase present at 1300K.

Figure 3:
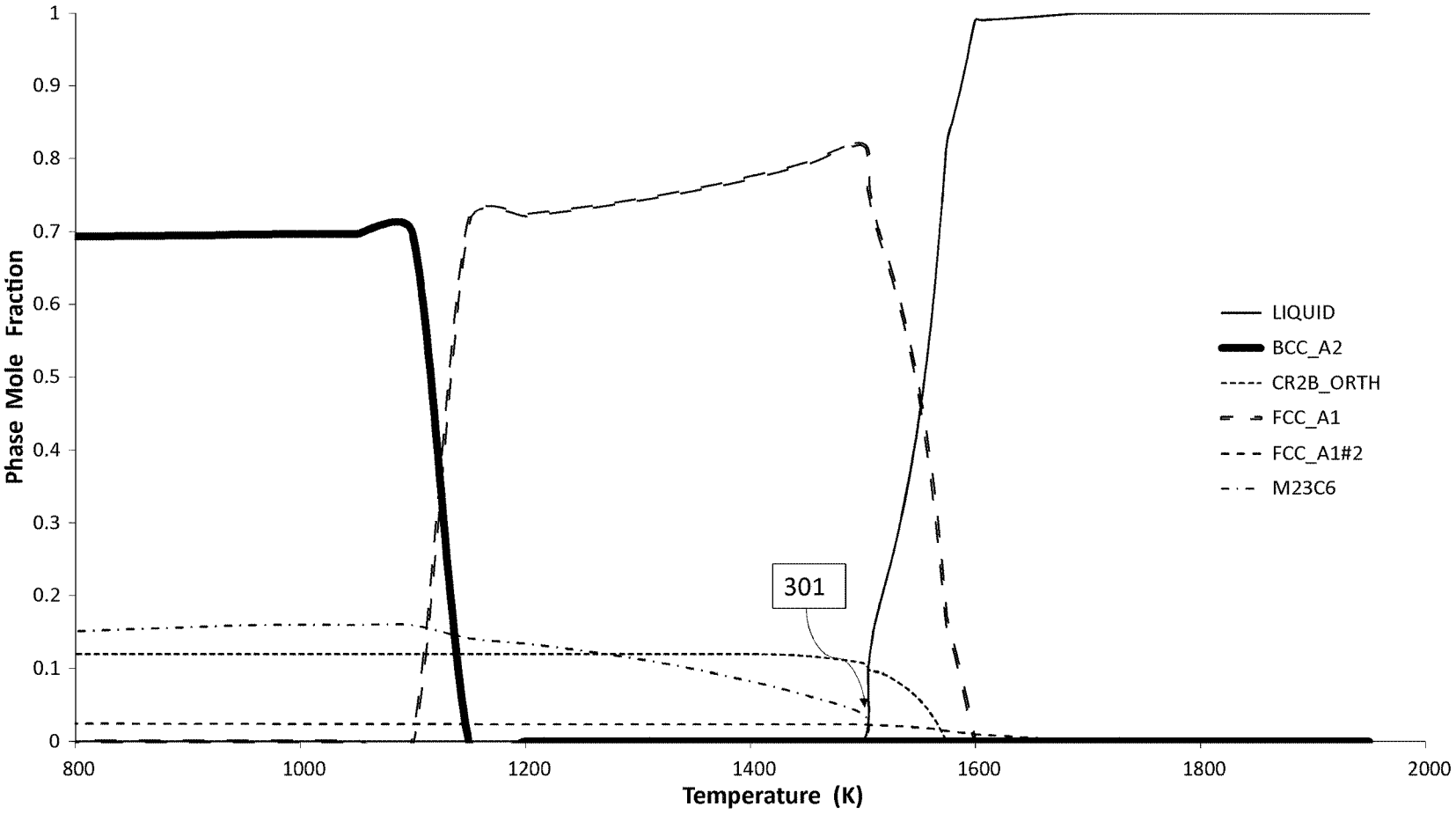
FIG. 3 illustrates a thermodynamic profile of an embodiment of alloy W10.

As FIG. 1 demonstrates a specific embodiment of this disclosure, there is no eutectic $M_{23}C_6$ formation. In order to demonstrate the thermodynamic profile of an alloy (Alloy 10) which possess eutectic $M_{23}C_6$ formation, FIG. 3 is presented. As shown in FIG. 3, $M_{23}C_6$ [301] is thermodynamically stable at a temperature where liquid is still present and thus will form a eutectic carbide.

In addition to the $M_{23}C_6$ phase, the $M_7C_3$ phase has shown a similar tendency to form the $M_{23}(C,B)_6$ phase experimentally when forming in the liquid in thermodynamic models. Thus, it can also be advantageous to limit or eliminate the $M_7C_3$ phase mole fraction at the solidus temperature.

In some embodiments, the maximum mole fraction of eutectic $M_7C_3$ phase can be at or below 5% (or at or below about 5%). In some embodiments, the maximum mole fraction of eutectic $M_7C_3$ phase is at or below 3% (or at or below about 3%). In some embodiments, the maximum mole fraction of eutectic $M_{23}C_6$ phase can be 0% (or about 0%). As shown in FIG. 1, there is no $M_7C_3$ phase present at 1300K.

The above embodiments describe the thermodynamic characteristics of alloys which meet certain desirable microstructural and performance criteria. However, in some embodiments, it can be advantageous to manufacture alloys of this type into a powder. The fourth embodiment describes the thermodynamics advantageous to produce alloys of this type into powder.

In some embodiments, a fourth thermodynamic criterion can be related to the formation temperature of the extremely hard carbides during the solidification process from a 100% liquid state. As mentioned, if the carbides precipitate out from the liquid at elevated temperatures, this can create a variety of problems in the powder manufacturing process including, but not limited to, powder clogging, increased viscosity, lower yields at desired powder sizes, and improper particle shape. Thus, it can be advantageous to reduce the formation temperature of the extremely hard particles.

The hard particle formation temperature of an alloy can be defined as the highest temperature at which a hard phase is thermodynamically present in the alloy. This temperature can be compared against the formation temperature of the iron matrix phase, whether austenite or ferrite, and used to calculate the melt range. The melt range can be simply defined as the hard phase formation temperature minus the matrix formation temperature. It can be advantageous for the powder manufacturing process to minimize the melt range. The melt range of W1 is shown as [103] in FIG. 1.

In some embodiments, the melt range can be 200K or lower (or about 200K or lower). In some embodiments, the melt range can be 150K or lower (or about 150K or lower). In some embodiments, the melt range can be 100K or lower (or about 100K or lower). Table 7 lists the thermodynamic criteria of the alloys disclosed in Table 5.

TABLE 7

Thermodynamic Criteria of Disclosed Alloys listed in Table 5

| No | Hard Phases | Melt Range |
|---|---|---|
| M1 | 7.8% | 135 |
| M2 | 8.0% | 135 |
| M3 | 7.0% | 135 |
| M4 | 7.0% | 135 |
| M5 | 7.0% | 135 |
| M6 | 7.3% | 135 |
| M7 | 7.6% | 135 |
| M8 | 7.9% | 135 |
| M9 | 8.2% | 135 |
| M10 | 8.5% | 135 |
| M11 | 8.7% | 135 |
| M12 | 7.5% | 135 |
| M13 | 8.0% | 135 |
| M14 | 8.0% | 135 |
| M15 | 8.6% | 135 |
| M16 | 8.9% | 135 |
| M17 | 7.4% | 130 |

TABLE 7-continued

Thermodynamic Criteria of Disclosed Alloys listed in Table 5

| No | Hard Phases | Melt Range |
|---|---|---|
| M18 | 7.9% | 130 |
| M19 | 7.9% | 130 |
| M20 | 7.9% | 130 |
| M21 | 8.3% | 130 |

Table 8 lists the thermodynamic criteria for selected experimental ingots. Hyper Hard is the mole fraction of hypereutectic boride phases, 1300 total hard is the summed mole fraction of all hard phases, m23c6@solidus, is the mole fraction of the $M_{23}C_6$ phase at the solidus temperature. m7c3@solidus is the mole fraction of the $M_7C_3$ phase at the solidus temperature.

The listed alloys are described as meeting the general criteria (meet criteria) and meeting the preferred criteria by a yes or no designation.

Melt Range is the temperature difference between the formation temperature of the highest solid phase and the formation temperature of the austenite or ferrite.

TABLE 8

Thermodynamic Criteria for Selected Alloy Manufactured into Experimental Ingots

| Alloy | Hyper Hard | 1300 Total Hard | Melt Range (K) | m23c6 @ solidus | m7c3 @ solidus | Meets Criteria | Meets Preferred Criteria |
|---|---|---|---|---|---|---|---|
| X4 | 4.0% | 26.1% | 50 | 0.0% | 0.0% | YES | YES |
| X5 | 0.0% | 20.2% | 0 | 2.4% | 0.0% | YES | NO |
| X6 | 2.0% | 34.5% | 100 | 11.8% | 0.0% | NO | NO |
| X7 | 0.0% | 34.8% | 0 | 15.9% | 0.0% | NO | NO |
| X8 | 1.5% | 34.2% | 250 | 9.9% | 0.0% | NO | NO |
| X9 | 5.9% | 41.8% | 50 | 16.2% | 0.0% | NO | NO |
| X10 | 0.4% | 38.9% | 250 | 0.0% | 0.0% | YES | YES |
| X11 | 0.0% | 51.7% | 400 | 34.3% | 0.0% | NO | NO |
| X12 | 0.0% | 27.7% | 250 | 0.0% | 0.0% | YES | YES |
| X13 | 5.9% | 28.7% | 300 | 0.0% | 0.0% | YES | YES |
| X14 | 0.0% | 20.3% | 50 | 2.9% | 0.0% | YES | NO |
| X16 | 0.0% | 41.3% | 0 | 0.0% | 0.0% | NO | NO |
| X17 | 6.0% | 33.2% | 150 | 0.0% | 0.0% | YES | YES |
| X25 | 0.0% | 26.3% | 100 | 0.0% | 0.0% | NO | NO |
| X26 | 0.0% | 24.8% | 350 | 0.0% | 0.0% | NO | NO |
| X27 | 0.0% | 16.6% | 250 | 6.5% | 0.0% | NO | NO |
| X28 | 17.6% | 50.0% | 50 | 2.0% | 0.0% | YES | NO |
| X29 | 15.8% | 41.5% | 350 | 0.0% | 0.0% | NO | NO |
| X30 | 0.0% | 23.8% | 300 | 0.0% | 0.0% | YES | YES |
| X31 | 18.8% | 49.8% | 300 | 0.0% | 9.1% | NO | NO |
| X33 | 16.9% | 44.7% | 350 | 0.0% | 0.0% | NO | NO |

Table 9 shows alloy compositions which meet described thermodynamic criteria. Thermodynamic Parameters Column Titles are 1, 2, 3, 4, 5, and 6 where 1 is the total hard phase mole fraction, 2 is the total hypereutectic phases, 3 and 4 are the $M_{23}C_6$ and $M_7C_3$ mole fractions of each phase at the solidus respectively, 5 is the liquid C minimum, and 6 is the max delta ferrite

TABLE 9

Alloy Compositions which meet the Thermodynamic Criteria Described in this Disclosure

| B | C | Cr | Mn | Mo | Nb | Ni | Si | Ti | V | W | 1 | 2 | 3 | 4 | 5 | 6 |
|---|---|---|---|---|---|---|---|---|---|---|---|---|---|---|---|---|
| 0.4 | 0.7 | 10 | 0 | 0 | 0 | 0 | 0 | 0 | 0 | 0 | 9% | 0% | 0% | 0% | 1% | 0% |
| 0.8 | 1 | 1 | 1.3 | 0 | 1.5 | 0 | 1.5 | 0.4 | 0 | 0 | 18% | 0% | 0% | 0% | 1% | 0% |
| 0.8 | 1 | 3 | 1.3 | 0 | 1.5 | 0 | 1.5 | 0.4 | 0 | 0 | 14% | 0% | 0% | 0% | 1% | 0% |
| 0.8 | 1 | 5 | 1.3 | 0 | 1.5 | 0 | 1.5 | 0.4 | 0 | 0 | 14% | 0% | 0% | 0% | 1% | 0% |
| 0.8 | 1 | 7 | 1.3 | 0 | 1.5 | 0 | 1.5 | 0.4 | 0 | 0 | 14% | 0% | 0% | 0% | 1% | 0% |
| 0.8 | 1 | 9 | 1.3 | 0 | 1.5 | 0 | 1.5 | 0.4 | 0 | 0 | 15% | 0% | 0% | 0% | 1% | 0% |
| 0.8 | 1 | 11 | 1.3 | 0 | 1.5 | 0 | 1.5 | 0.4 | 0 | 0 | 17% | 0% | 0% | 0% | 1% | 0% |
| 0.8 | 1 | 13 | 1.3 | 0 | 1.5 | 0 | 1.5 | 0.4 | 0 | 0 | 19% | 0% | 0% | 0% | 1% | 0% |
| 1 | 1 | 5 | 0 | 0 | 0 | 0 | 0 | 6 | 0 | 0 | 22% | 0% | 0% | 0% | 0% | 0% |
| 1 | 2 | 5 | 0 | 0 | 0 | 0 | 0 | 6 | 0 | 0 | 27% | 0% | 0% | 0% | 1% | 0% |
| 1.6 | 1.6 | 10 | 0 | 0 | 0 | 0 | 0 | 6 | 0 | 0 | 29% | 0% | 0% | 0% | 1% | 0% |
| 2 | 1.6 | 10 | 0 | 0 | 0 | 0 | 0 | 6 | 0 | 0 | 32% | 0% | 0% | 0% | 1% | 0% |
| 2.4 | 1.6 | 10 | 0 | 0 | 0 | 0 | 0 | 6 | 0 | 0 | 34% | 0% | 0% | 0% | 1% | 0% |
| 1.6 | 1.8 | 10 | 0 | 0 | 0 | 0 | 0 | 6 | 0 | 0 | 31% | 0% | 0% | 0% | 1% | 0% |
| 2 | 1.8 | 10 | 0 | 0 | 0 | 0 | 0 | 6 | 0 | 0 | 22% | 0% | 0% | 0% | 1% | 0% |
| 1.6 | 2 | 10 | 0 | 0 | 0 | 0 | 0 | 6 | 0 | 0 | 19% | 0% | 0% | 0% | 1% | 0% |
| 2 | 2 | 10 | 0 | 0 | 0 | 0 | 0 | 6 | 0 | 0 | 34% | 0% | 0% | 0% | 2% | 0% |
| 1.6 | 1.6 | 12 | 0 | 0 | 0 | 0 | 0 | 6 | 0 | 0 | 32% | 0% | 0% | 0% | 1% | 0% |
| 2 | 1.6 | 12 | 0 | 0 | 0 | 0 | 0 | 6 | 0 | 0 | 35% | 0% | 0% | 0% | 1% | 0% |
| 2.4 | 1.6 | 12 | 0 | 0 | 0 | 0 | 0 | 6 | 0 | 0 | 37% | 0% | 0% | 0% | 1% | 0% |
| 2.8 | 1.6 | 12 | 0 | 0 | 0 | 0 | 0 | 6 | 0 | 0 | 39% | 0% | 0% | 0% | 2% | 0% |
| 1.6 | 1.8 | 12 | 0 | 0 | 0 | 0 | 0 | 6 | 0 | 0 | 34% | 0% | 0% | 0% | 1% | 0% |
| 2 | 1.8 | 12 | 0 | 0 | 0 | 0 | 0 | 6 | 0 | 0 | 24% | 0% | 0% | 0% | 1% | 0% |
| 2.4 | 1.8 | 12 | 0 | 0 | 0 | 0 | 0 | 6 | 0 | 0 | 28% | 0% | 0% | 0% | 2% | 0% |
| 1.6 | 2 | 12 | 0 | 0 | 0 | 0 | 0 | 6 | 0 | 0 | 35% | 0% | 0% | 0% | 1% | 0% |
| 2 | 2 | 12 | 0 | 0 | 0 | 0 | 0 | 6 | 0 | 0 | 25% | 0% | 0% | 0% | 2% | 0% |
| 2.4 | 2 | 12 | 0 | 0 | 0 | 0 | 0 | 6 | 0 | 0 | 39% | 0% | 0% | 0% | 2% | 0% |
| 1.8 | 2.2 | 12 | 0 | 0 | 0 | 0 | 0 | 6 | 0 | 0 | 37% | 0% | 0% | 0% | 2% | 0% |
| 1.6 | 2.4 | 12 | 0 | 0 | 0 | 0 | 0 | 6 | 0 | 0 | 36% | 0% | 0% | 0% | 2% | 0% |
| 1.8 | 1.6 | 14 | 0 | 0 | 0 | 0 | 0 | 6 | 0 | 0 | 36% | 0% | 0% | 0% | 1% | 0% |
| 2.2 | 1.6 | 14 | 0 | 0 | 0 | 0 | 0 | 6 | 0 | 0 | 39% | 0% | 0% | 0% | 1% | 0% |
| 2.6 | 1.6 | 14 | 0 | 0 | 0 | 0 | 0 | 6 | 0 | 0 | 41% | 0% | 0% | 0% | 2% | 0% |
| 3 | 1.6 | 14 | 0 | 0 | 0 | 0 | 0 | 6 | 0 | 0 | 44% | 0% | 0% | 0% | 2% | 0% |
| 1.8 | 1.8 | 14 | 0 | 0 | 0 | 0 | 0 | 6 | 0 | 0 | 37% | 0% | 0% | 0% | 1% | 0% |
| 2.2 | 1.8 | 14 | 0 | 0 | 0 | 0 | 0 | 6 | 0 | 0 | 40% | 0% | 0% | 0% | 1% | 0% |
| 2.6 | 1.8 | 14 | 0 | 0 | 0 | 0 | 0 | 6 | 0 | 0 | 43% | 0% | 0% | 0% | 2% | 0% |
| 3 | 1.8 | 14 | 0 | 0 | 0 | 0 | 0 | 6 | 0 | 0 | 45% | 0% | 0% | 0% | 2% | 0% |
| 1.8 | 2 | 14 | 0 | 0 | 0 | 0 | 0 | 6 | 0 | 0 | 38% | 0% | 0% | 0% | 1% | 0% |
| 2.2 | 2 | 14 | 0 | 0 | 0 | 0 | 0 | 6 | 0 | 0 | 42% | 0% | 0% | 0% | 2% | 0% |
| 2.6 | 2 | 14 | 0 | 0 | 0 | 0 | 0 | 6 | 0 | 0 | 44% | 0% | 0% | 0% | 2% | 0% |
| 1.6 | 2.2 | 14 | 0 | 0 | 0 | 0 | 0 | 6 | 0 | 0 | 36% | 0% | 0% | 0% | 2% | 0% |
| 2 | 2.2 | 14 | 0 | 0 | 0 | 0 | 0 | 6 | 0 | 0 | 40% | 0% | 0% | 0% | 2% | 0% |
| 2.4 | 2.2 | 14 | 0 | 0 | 0 | 0 | 0 | 6 | 0 | 0 | 44% | 0% | 0% | 0% | 2% | 0% |
| 1.8 | 2.4 | 14 | 0 | 0 | 0 | 0 | 0 | 6 | 0 | 0 | 38% | 0% | 0% | 0% | 2% | 0% |
| 1.6 | 2.6 | 14 | 0 | 0 | 0 | 0 | 0 | 6 | 0 | 0 | 38% | 0% | 0% | 0% | 2% | 0% |
| 1.6 | 1.6 | 16 | 0 | 0 | 0 | 0 | 0 | 6 | 0 | 0 | 34% | 0% | 0% | 0% | 1% | 0% |
| 2 | 1.6 | 16 | 0 | 0 | 0 | 0 | 0 | 6 | 0 | 0 | 39% | 0% | 0% | 0% | 1% | 0% |
| 2.4 | 1.6 | 16 | 0 | 0 | 0 | 0 | 0 | 6 | 0 | 0 | 42% | 0% | 0% | 0% | 1% | 0% |
| 2.8 | 1.6 | 16 | 0 | 0 | 0 | 0 | 0 | 6 | 0 | 0 | 45% | 0% | 0% | 0% | 2% | 0% |
| 1.6 | 1.8 | 16 | 0 | 0 | 0 | 0 | 0 | 6 | 0 | 0 | 35% | 0% | 0% | 0% | 1% | 0% |
| 2 | 1.8 | 16 | 0 | 0 | 0 | 0 | 0 | 6 | 0 | 0 | 40% | 0% | 0% | 0% | 1% | 0% |
| 2.4 | 1.8 | 16 | 0 | 0 | 0 | 0 | 0 | 6 | 0 | 0 | 44% | 0% | 0% | 0% | 2% | 0% |
| 2.8 | 1.8 | 16 | 0 | 0 | 0 | 0 | 0 | 6 | 0 | 0 | 47% | 0% | 0% | 0% | 2% | 0% |
| 1.6 | 2 | 16 | 0 | 0 | 0 | 0 | 0 | 6 | 0 | 0 | 35% | 0% | 0% | 0% | 1% | 0% |
| 2 | 2 | 16 | 0 | 0 | 0 | 0 | 0 | 6 | 0 | 0 | 40% | 0% | 0% | 0% | 2% | 0% |
| 2.4 | 2 | 16 | 0 | 0 | 0 | 0 | 0 | 6 | 0 | 0 | 45% | 0% | 0% | 0% | 2% | 0% |
| 2.8 | 2 | 16 | 0 | 0 | 0 | 0 | 0 | 6 | 0 | 0 | 48% | 0% | 0% | 0% | 2% | 0% |
| 1.6 | 2.2 | 16 | 0 | 0 | 0 | 0 | 0 | 6 | 0 | 0 | 37% | 0% | 0% | 0% | 1% | 0% |
| 2 | 2.2 | 16 | 0 | 0 | 0 | 0 | 0 | 6 | 0 | 0 | 41% | 0% | 0% | 0% | 2% | 0% |
| 2.4 | 2.2 | 16 | 0 | 0 | 0 | 0 | 0 | 6 | 0 | 0 | 45% | 0% | 0% | 0% | 2% | 0% |
| 2.8 | 2.2 | 16 | 0 | 0 | 0 | 0 | 0 | 6 | 0 | 0 | 49% | 0% | 0% | 0% | 2% | 0% |
| 1.8 | 2.4 | 16 | 0 | 0 | 0 | 0 | 0 | 6 | 0 | 0 | 40% | 0% | 0% | 0% | 2% | 0% |
| 2.2 | 2.4 | 16 | 0 | 0 | 0 | 0 | 0 | 6 | 0 | 0 | 44% | 0% | 0% | 0% | 2% | 0% |
| 2 | 2.6 | 16 | 0 | 0 | 0 | 0 | 0 | 6 | 0 | 0 | 43% | 0% | 0% | 0% | 2% | 0% |
| 1.8 | 1.6 | 18 | 0 | 0 | 0 | 0 | 0 | 6 | 0 | 0 | 37% | 0% | 0% | 0% | 1% | 0% |
| 2.2 | 1.6 | 18 | 0 | 0 | 0 | 0 | 0 | 6 | 0 | 0 | 41% | 0% | 0% | 0% | 1% | 0% |
| 2.6 | 1.6 | 18 | 0 | 0 | 0 | 0 | 0 | 6 | 0 | 0 | 45% | 0% | 0% | 0% | 1% | 0% |
| 3 | 1.6 | 18 | 0 | 0 | 0 | 0 | 0 | 6 | 0 | 0 | 49% | 0% | 0% | 0% | 2% | 0% |
| 1.8 | 1.8 | 18 | 0 | 0 | 0 | 0 | 0 | 6 | 0 | 0 | 37% | 0% | 0% | 0% | 1% | 0% |
| 2.2 | 1.8 | 18 | 0 | 0 | 0 | 0 | 0 | 6 | 0 | 0 | 42% | 0% | 0% | 0% | 1% | 0% |
| 2.6 | 1.8 | 18 | 0 | 0 | 0 | 0 | 0 | 6 | 0 | 0 | 46% | 0% | 0% | 0% | 2% | 0% |
| 1.6 | 2 | 18 | 0 | 0 | 0 | 0 | 0 | 6 | 0 | 0 | 36% | 0% | 0% | 0% | 1% | 0% |
| 2 | 2 | 18 | 0 | 0 | 0 | 0 | 0 | 6 | 0 | 0 | 40% | 0% | 0% | 0% | 1% | 0% |
| 2.4 | 2 | 18 | 0 | 0 | 0 | 0 | 0 | 6 | 0 | 0 | 45% | 0% | 0% | 0% | 2% | 0% |
| 2.8 | 2 | 18 | 0 | 0 | 0 | 0 | 0 | 6 | 0 | 0 | 49% | 0% | 0% | 0% | 2% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.8 | 2.2 | 18 | 0 | 0 | 0 | 0 | 0 | 6 | 0 | 0 | 40% | 0% | 0% | 0% | 2% | 0% |
| 2.2 | 2.2 | 18 | 0 | 0 | 0 | 0 | 0 | 6 | 0 | 0 | 44% | 0% | 0% | 0% | 2% | 0% |
| 2.6 | 2.2 | 18 | 0 | 0 | 0 | 0 | 0 | 6 | 0 | 0 | 47% | 0% | 0% | 0% | 2% | 0% |
| 1.6 | 2.4 | 18 | 0 | 0 | 0 | 0 | 0 | 6 | 0 | 0 | 40% | 0% | 0% | 0% | 2% | 0% |
| 2 | 2.4 | 18 | 0 | 0 | 0 | 0 | 0 | 6 | 0 | 0 | 43% | 0% | 0% | 0% | 2% | 0% |
| 2.4 | 2.4 | 18 | 0 | 0 | 0 | 0 | 0 | 6 | 0 | 0 | 47% | 0% | 0% | 0% | 2% | 0% |
| 1.8 | 1.6 | 20 | 0 | 0 | 0 | 0 | 0 | 6 | 0 | 0 | 37% | 0% | 0% | 0% | 0% | 6% |
| 2.2 | 1.6 | 20 | 0 | 0 | 0 | 0 | 0 | 6 | 0 | 0 | 41% | 0% | 0% | 0% | 1% | 0% |
| 2.6 | 1.6 | 20 | 0 | 0 | 0 | 0 | 0 | 6 | 0 | 0 | 46% | 0% | 0% | 0% | 1% | 0% |
| 1.6 | 1.8 | 20 | 0 | 0 | 0 | 0 | 0 | 6 | 0 | 0 | 35% | 0% | 0% | 0% | 1% | 0% |
| 2 | 1.8 | 20 | 0 | 0 | 0 | 0 | 0 | 6 | 0 | 0 | 40% | 0% | 0% | 0% | 1% | 0% |
| 2.4 | 1.8 | 20 | 0 | 0 | 0 | 0 | 0 | 6 | 0 | 0 | 44% | 0% | 0% | 0% | 2% | 0% |
| 2.8 | 1.8 | 20 | 0 | 0 | 0 | 0 | 0 | 6 | 0 | 0 | 49% | 0% | 0% | 0% | 2% | 0% |
| 1.8 | 2 | 20 | 0 | 0 | 0 | 0 | 0 | 6 | 0 | 0 | 39% | 0% | 0% | 0% | 1% | 0% |
| 2.2 | 2 | 20 | 0 | 0 | 0 | 0 | 0 | 6 | 0 | 0 | 43% | 0% | 0% | 0% | 2% | 0% |
| 2.6 | 2 | 20 | 0 | 0 | 0 | 0 | 0 | 6 | 0 | 0 | 47% | 0% | 0% | 0% | 2% | 0% |
| 1.6 | 2.2 | 20 | 0 | 0 | 0 | 0 | 0 | 6 | 0 | 0 | 39% | 0% | 0% | 0% | 1% | 0% |
| 2 | 2.2 | 20 | 0 | 0 | 0 | 0 | 0 | 6 | 0 | 0 | 43% | 0% | 0% | 0% | 2% | 0% |
| 2.4 | 2.2 | 20 | 0 | 0 | 0 | 0 | 0 | 6 | 0 | 0 | 47% | 0% | 0% | 0% | 0% | 0% |
| 2.4 | 2.4 | 20 | 0 | 0 | 0 | 0 | 0 | 6 | 0 | 0 | 48% | 0% | 0% | 0% | 0% | 0% |
| 1.2 | 1 | 10 | 0 | 0 | 2 | 0 | 0 | 0 | 2 | 0 | 20% | 0% | 0% | 0% | 1% | 0% |
| 1.6 | 1 | 10 | 0 | 0 | 2 | 0 | 0 | 0 | 2 | 0 | 26% | 2% | 0% | 0% | 1% | 0% |
| 1 | 1.2 | 10 | 0 | 0 | 2 | 0 | 0 | 0 | 2 | 0 | 19% | 0% | 0% | 0% | 1% | 0% |
| 1.4 | 1.2 | 10 | 0 | 0 | 2 | 0 | 0 | 0 | 2 | 0 | 22% | 0% | 0% | 0% | 1% | 0% |
| 1.8 | 1.2 | 10 | 0 | 0 | 2 | 0 | 0 | 0 | 2 | 0 | 27% | 4% | 0% | 0% | 1% | 0% |
| 1.4 | 1.4 | 10 | 0 | 0 | 2 | 0 | 0 | 0 | 2 | 0 | 22% | 0% | 0% | 0% | 1% | 0% |
| 1.8 | 1.4 | 10 | 0 | 0 | 2 | 0 | 0 | 0 | 2 | 0 | 29% | 3% | 0% | 0% | 1% | 0% |
| 0.92 | 1.01 | 4 | 0.19 | 0 | 3.09 | 0 | 0.48 | 0.26 | 2 | 0 | 16% | 0% | 0% | 0% | 1% | 0% |
| 0.92 | 1.01 | 6 | 0.19 | 0 | 3.09 | 0 | 0.48 | 0.26 | 2 | 0 | 18% | 0% | 0% | 0% | 1% | 0% |
| 0.92 | 1.01 | 8 | 0.19 | 0 | 3.09 | 0 | 0.48 | 0.26 | 2 | 0 | 16% | 0% | 0% | 0% | 1% | 0% |
| 0.92 | 1.01 | 10 | 0.19 | 0 | 3.09 | 0 | 0.48 | 0.26 | 2 | 0 | 18% | 0% | 0% | 0% | 1% | 0% |
| 0.92 | 1.01 | 12 | 0.19 | 0 | 3.09 | 0 | 0.48 | 0.26 | 2 | 0 | 18% | 0% | 0% | 0% | 1% | 8% |
| 0.92 | 1.01 | 14 | 0.19 | 0 | 3.09 | 0 | 0.48 | 0.26 | 2 | 0 | 19% | 0% | 0% | 0% | 1% | 5% |
| 0.8 | 1 | 1 | 1.3 | 0 | 1.5 | 0 | 1.5 | 0.4 | 2 | 0 | 15% | 0% | 0% | 0% | 1% | 0% |
| 0.8 | 1 | 3 | 1.3 | 0 | 1.5 | 0 | 1.5 | 0.4 | 2 | 0 | 15% | 0% | 0% | 0% | 1% | 0% |
| 0.8 | 1 | 5 | 1.3 | 0 | 1.5 | 0 | 1.5 | 0.4 | 2 | 0 | 15% | 0% | 0% | 0% | 1% | 0% |
| 0.8 | 1 | 7 | 1.3 | 0 | 1.5 | 0 | 1.5 | 0.4 | 2 | 0 | 15% | 0% | 0% | 0% | 1% | 0% |
| 0.8 | 1 | 9 | 1.3 | 0 | 1.5 | 0 | 1.5 | 0.4 | 2 | 0 | 15% | 0% | 0% | 0% | 1% | 0% |
| 0.8 | 1 | 11 | 1.3 | 0 | 1.5 | 0 | 1.5 | 0.4 | 2 | 0 | 16% | 0% | 0% | 0% | 1% | 5% |
| 1 | 1 | 10 | 0 | 0 | 2 | 0 | 0 | 0 | 3 | 0 | 17% | 0% | 0% | 0% | 1% | 0% |
| 1.4 | 1 | 10 | 0 | 0 | 2 | 0 | 0 | 0 | 3 | 0 | 25% | 0% | 0% | 0% | 1% | 0% |
| 1.8 | 1 | 10 | 0 | 0 | 2 | 0 | 0 | 0 | 3 | 0 | 27% | 3% | 0% | 0% | 1% | 0% |
| 1.2 | 1.2 | 10 | 0 | 0 | 2 | 0 | 0 | 0 | 3 | 0 | 23% | 0% | 0% | 0% | 1% | 0% |
| 1.6 | 1.2 | 10 | 0 | 0 | 2 | 0 | 0 | 0 | 3 | 0 | 28% | 1% | 0% | 0% | 1% | 0% |
| 1 | 1.4 | 10 | 0 | 0 | 2 | 0 | 0 | 0 | 3 | 0 | 17% | 0% | 0% | 0% | 1% | 0% |
| 1.4 | 1.4 | 10 | 0 | 0 | 2 | 0 | 0 | 0 | 3 | 0 | 26% | 0% | 0% | 0% | 1% | 0% |
| 1.8 | 1.4 | 10 | 0 | 0 | 2 | 0 | 0 | 0 | 3 | 0 | 27% | 3% | 0% | 0% | 1% | 0% |
| 1.4 | 1.6 | 10 | 0 | 0 | 2 | 0 | 0 | 0 | 3 | 0 | 21% | 0% | 0% | 0% | 1% | 0% |
| 1.4 | 1.8 | 10 | 0 | 0 | 2 | 0 | 0 | 0 | 3 | 0 | 22% | 1% | 0% | 0% | 2% | 0% |
| 1.6 | 2 | 10 | 0 | 0 | 2 | 0 | 0 | 0 | 3 | 0 | 31% | 3% | 0% | 0% | 2% | 0% |
| 1.4 | 1 | 15 | 0 | 0 | 0 | 0 | 0 | 0 | 4 | 0 | 27% | 1% | 0% | 0% | 1% | 0% |
| 1 | 1 | 10 | 0 | 0 | 2 | 0 | 0 | 0 | 4 | 0 | 16% | 0% | 0% | 0% | 1% | 0% |
| 1.4 | 1 | 10 | 0 | 0 | 2 | 0 | 0 | 0 | 4 | 0 | 22% | 0% | 0% | 0% | 1% | 0% |
| 1.8 | 1 | 10 | 0 | 0 | 2 | 0 | 0 | 0 | 4 | 0 | 27% | 2% | 0% | 0% | 1% | 0% |
| 1 | 1.2 | 10 | 0 | 0 | 2 | 0 | 0 | 0 | 4 | 0 | 16% | 0% | 0% | 0% | 1% | 0% |
| 1.4 | 1.2 | 10 | 0 | 0 | 2 | 0 | 0 | 0 | 4 | 0 | 27% | 0% | 0% | 0% | 1% | 0% |
| 1.8 | 1.2 | 10 | 0 | 0 | 2 | 0 | 0 | 0 | 4 | 0 | 27% | 2% | 0% | 0% | 1% | 0% |
| 1 | 1.4 | 10 | 0 | 0 | 2 | 0 | 0 | 0 | 4 | 0 | 22% | 0% | 0% | 0% | 1% | 0% |
| 1.4 | 1.4 | 10 | 0 | 0 | 2 | 0 | 0 | 0 | 4 | 0 | 21% | 0% | 0% | 0% | 1% | 0% |
| 1 | 1.6 | 10 | 0 | 0 | 2 | 0 | 0 | 0 | 4 | 0 | 16% | 0% | 0% | 0% | 1% | 0% |
| 1.4 | 1.6 | 10 | 0 | 0 | 2 | 0 | 0 | 0 | 4 | 0 | 28% | 1% | 0% | 0% | 1% | 0% |
| 1.8 | 1.6 | 10 | 0 | 0 | 2 | 0 | 0 | 0 | 4 | 0 | 26% | 5% | 0% | 0% | 1% | 0% |
| 1.4 | 1.8 | 10 | 0 | 0 | 2 | 0 | 0 | 0 | 4 | 0 | 29% | 0% | 0% | 0% | 2% | 0% |
| 1.8 | 1.8 | 10 | 0 | 0 | 2 | 0 | 0 | 0 | 4 | 0 | 26% | 5% | 0% | 0% | 2% | 0% |
| 1.6 | 2 | 10 | 0 | 0 | 2 | 0 | 0 | 0 | 4 | 0 | 23% | 2% | 0% | 0% | 2% | 0% |
| 1.6 | 2.2 | 10 | 0 | 0 | 2 | 0 | 0 | 0 | 4 | 0 | 33% | 2% | 0% | 0% | 2% | 0% |
| 1.2 | 1 | 15 | 0 | 0 | 2 | 0 | 0 | 0 | 4 | 0 | 19% | 0% | 0% | 0% | 1% | 6% |
| 1.6 | 1 | 15 | 0 | 0 | 2 | 0 | 0 | 0 | 4 | 0 | 24% | 5% | 0% | 0% | 1% | 0% |
| 1.4 | 1.2 | 15 | 0 | 0 | 2 | 0 | 0 | 0 | 4 | 0 | 22% | 2% | 0% | 0% | 1% | 0% |
| 1.6 | 1.4 | 15 | 0 | 0 | 2 | 0 | 0 | 0 | 4 | 0 | 26% | 4% | 0% | 0% | 1% | 0% |
| 1.2 | 1.4 | 15 | 0 | 0 | 4 | 0 | 0 | 0 | 4 | 0 | 22% | 0% | 0% | 0% | 1% | 0% |
| 1 | 1.6 | 15 | 0 | 0 | 6 | 0 | 0 | 0 | 4 | 0 | 23% | 0% | 0% | 0% | 1% | 2% |
| 1.4 | 1.6 | 15 | 0 | 0 | 6 | 0 | 0 | 0 | 4 | 0 | 27% | 3% | 0% | 0% | 1% | 0% |
| 1.4 | 1.8 | 15 | 0 | 0 | 8 | 0 | 0 | 0 | 4 | 0 | 30% | 4% | 0% | 0% | 1% | 0% |
| 1.4 | 2.2 | 15 | 0 | 0 | 10 | 0 | 0 | 0 | 4 | 0 | 33% | 4% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.2 | 1 | 10 | 0 | 0 | 2 | 0 | 0 | 0 | 5 | 0 | 19% | 0% | 0% | 0% | 1% | 0% |
| 1.6 | 1 | 10 | 0 | 0 | 2 | 0 | 0 | 0 | 5 | 0 | 24% | 0% | 0% | 0% | 1% | 0% |
| 2 | 1 | 10 | 0 | 0 | 2 | 0 | 0 | 0 | 5 | 0 | 30% | 4% | 0% | 0% | 1% | 0% |
| 1.2 | 1.2 | 10 | 0 | 0 | 2 | 0 | 0 | 0 | 5 | 0 | 19% | 0% | 0% | 0% | 1% | 0% |
| 1.6 | 1.2 | 10 | 0 | 0 | 2 | 0 | 0 | 0 | 5 | 0 | 30% | 0% | 0% | 0% | 1% | 0% |
| 1 | 1.4 | 10 | 0 | 0 | 2 | 0 | 0 | 0 | 5 | 0 | 23% | 0% | 0% | 0% | 1% | 0% |
| 1.4 | 1.4 | 10 | 0 | 0 | 2 | 0 | 0 | 0 | 5 | 0 | 29% | 0% | 0% | 0% | 1% | 0% |
| 1.8 | 1.4 | 10 | 0 | 0 | 2 | 0 | 0 | 0 | 5 | 0 | 34% | 4% | 0% | 0% | 1% | 0% |
| 1.2 | 1.6 | 10 | 0 | 0 | 2 | 0 | 0 | 0 | 5 | 0 | 27% | 0% | 0% | 0% | 1% | 0% |
| 1.6 | 1.6 | 10 | 0 | 0 | 2 | 0 | 0 | 0 | 5 | 0 | 32% | 2% | 0% | 0% | 1% | 0% |
| 1 | 1.8 | 10 | 0 | 0 | 2 | 0 | 0 | 0 | 5 | 0 | 25% | 0% | 0% | 0% | 2% | 0% |
| 1.4 | 1.8 | 10 | 0 | 0 | 2 | 0 | 0 | 0 | 5 | 0 | 30% | 0% | 0% | 0% | 2% | 0% |
| 1.8 | 1.8 | 10 | 0 | 0 | 2 | 0 | 0 | 0 | 5 | 0 | 26% | 4% | 0% | 0% | 2% | 0% |
| 1.2 | 2 | 10 | 0 | 0 | 2 | 0 | 0 | 0 | 5 | 0 | 29% | 0% | 0% | 0% | 2% | 0% |
| 1.6 | 2 | 10 | 0 | 0 | 2 | 0 | 0 | 0 | 5 | 0 | 34% | 2% | 0% | 0% | 2% | 0% |
| 1.2 | 2.2 | 10 | 0 | 0 | 2 | 0 | 0 | 0 | 5 | 0 | 30% | 0% | 0% | 0% | 2% | 0% |
| 1.6 | 2.2 | 10 | 0 | 0 | 2 | 0 | 0 | 0 | 5 | 0 | 22% | 1% | 0% | 0% | 2% | 0% |
| 1.6 | 2.4 | 10 | 0 | 0 | 2 | 0 | 0 | 0 | 5 | 0 | 22% | 4% | 0% | 0% | 2% | 0% |
| 1.8 | 1 | 15 | 0 | 0 | 0 | 0 | 0 | 0 | 6 | 0 | 33% | 5% | 0% | 0% | 1% | 0% |
| 1.2 | 1.2 | 15 | 0 | 0 | 0 | 0 | 0 | 0 | 6 | 0 | 26% | 0% | 0% | 0% | 1% | 0% |
| 1.6 | 1.2 | 15 | 0 | 0 | 0 | 0 | 0 | 0 | 6 | 0 | 32% | 2% | 0% | 0% | 1% | 0% |
| 1 | 1.2 | 10 | 0 | 0 | 2 | 0 | 0 | 0 | 6 | 0 | 16% | 0% | 0% | 0% | 1% | 0% |
| 1.4 | 1.2 | 10 | 0 | 0 | 2 | 0 | 0 | 0 | 6 | 0 | 21% | 0% | 0% | 0% | 1% | 0% |
| 1.8 | 1.2 | 10 | 0 | 0 | 2 | 0 | 0 | 0 | 6 | 0 | 27% | 4% | 0% | 0% | 1% | 0% |
| 1.2 | 1.4 | 10 | 0 | 0 | 2 | 0 | 0 | 0 | 6 | 0 | 18% | 0% | 0% | 0% | 1% | 0% |
| 1.6 | 1.4 | 10 | 0 | 0 | 2 | 0 | 0 | 0 | 6 | 0 | 32% | 2% | 0% | 0% | 1% | 0% |
| 1 | 1.6 | 10 | 0 | 0 | 2 | 0 | 0 | 0 | 6 | 0 | 16% | 0% | 0% | 0% | 1% | 0% |
| 1.4 | 1.6 | 10 | 0 | 0 | 2 | 0 | 0 | 0 | 6 | 0 | 31% | 0% | 0% | 0% | 1% | 0% |
| 1.8 | 1.6 | 10 | 0 | 0 | 2 | 0 | 0 | 0 | 6 | 0 | 36% | 4% | 0% | 0% | 1% | 0% |
| 1.2 | 1.8 | 10 | 0 | 0 | 2 | 0 | 0 | 0 | 6 | 0 | 29% | 0% | 0% | 0% | 2% | 0% |
| 1.6 | 1.8 | 10 | 0 | 0 | 2 | 0 | 0 | 0 | 6 | 0 | 23% | 1% | 0% | 0% | 2% | 0% |
| 1 | 2 | 10 | 0 | 0 | 2 | 0 | 0 | 0 | 6 | 0 | 27% | 0% | 0% | 0% | 2% | 0% |
| 1.4 | 2 | 10 | 0 | 0 | 2 | 0 | 0 | 0 | 6 | 0 | 32% | 0% | 0% | 0% | 2% | 0% |
| 1.8 | 2 | 10 | 0 | 0 | 2 | 0 | 0 | 0 | 6 | 0 | 25% | 3% | 0% | 0% | 2% | 0% |
| 1.2 | 2.2 | 10 | 0 | 0 | 2 | 0 | 0 | 0 | 6 | 0 | 31% | 0% | 0% | 0% | 2% | 0% |
| 1.6 | 2.2 | 10 | 0 | 0 | 2 | 0 | 0 | 0 | 6 | 0 | 36% | 1% | 0% | 0% | 2% | 0% |
| 1.4 | 2.4 | 10 | 0 | 0 | 2 | 0 | 0 | 0 | 6 | 0 | 34% | 2% | 0% | 0% | 2% | 0% |
| 1.4 | 2.6 | 10 | 0 | 0 | 2 | 0 | 0 | 0 | 6 | 0 | 19% | 1% | 0% | 0% | 2% | 0% |
| 1.6 | 2.8 | 10 | 0 | 0 | 2 | 0 | 0 | 0 | 6 | 0 | 38% | 3% | 0% | 0% | 3% | 0% |
| 1.2 | 1.4 | 15 | 0 | 0 | 2 | 0 | 0 | 0 | 6 | 0 | 18% | 1% | 0% | 0% | 1% | 0% |
| 1.2 | 1.6 | 15 | 0 | 0 | 2 | 0 | 0 | 0 | 6 | 0 | 19% | 1% | 0% | 0% | 1% | 0% |
| 1.4 | 2.8 | 10 | 0 | 0 | 3 | 0 | 0 | 0 | 6 | 0 | 20% | 2% | 0% | 0% | 3% | 0% |
| 1.4 | 3 | 10 | 0 | 0 | 4 | 0 | 0 | 0 | 6 | 0 | 22% | 2% | 0% | 0% | 3% | 0% |
| 1.2 | 1.6 | 15 | 0 | 0 | 4 | 0 | 0 | 0 | 6 | 0 | 21% | 1% | 0% | 0% | 1% | 0% |
| 1.2 | 1.8 | 15 | 0 | 0 | 4 | 0 | 0 | 0 | 6 | 0 | 21% | 1% | 0% | 0% | 1% | 0% |
| 1.4 | 2.8 | 10 | 0 | 0 | 5 | 0 | 0 | 0 | 6 | 0 | 24% | 2% | 0% | 0% | 2% | 0% |
| 1.4 | 2.8 | 10 | 0 | 0 | 6 | 0 | 0 | 0 | 6 | 0 | 25% | 0% | 0% | 0% | 2% | 0% |
| 1.4 | 3.2 | 10 | 0 | 0 | 6 | 0 | 0 | 0 | 6 | 0 | 25% | 2% | 0% | 0% | 3% | 0% |
| 1.4 | 1.8 | 15 | 0 | 0 | 6 | 0 | 0 | 0 | 6 | 0 | 26% | 5% | 0% | 0% | 1% | 0% |
| 1.2 | 2 | 15 | 0 | 0 | 6 | 0 | 0 | 0 | 6 | 0 | 24% | 2% | 0% | 0% | 1% | 0% |
| 1.4 | 2.2 | 15 | 0 | 0 | 6 | 0 | 0 | 0 | 6 | 0 | 27% | 4% | 0% | 0% | 2% | 0% |
| 1.4 | 3 | 10 | 0 | 0 | 7 | 0 | 0 | 0 | 6 | 0 | 27% | 3% | 0% | 0% | 2% | 0% |
| 1.4 | 2.8 | 10 | 0 | 0 | 8 | 0 | 0 | 0 | 6 | 0 | 29% | 1% | 0% | 0% | 2% | 0% |
| 1.4 | 3.2 | 10 | 0 | 0 | 8 | 0 | 0 | 0 | 6 | 0 | 28% | 3% | 0% | 0% | 2% | 0% |
| 1 | 2.2 | 15 | 0 | 0 | 8 | 0 | 0 | 0 | 6 | 0 | 24% | 0% | 0% | 0% | 1% | 0% |
| 1.4 | 2.8 | 10 | 0 | 0 | 9 | 0 | 0 | 0 | 6 | 0 | 30% | 1% | 0% | 0% | 2% | 0% |
| 1.4 | 3.2 | 10 | 0 | 0 | 9 | 0 | 0 | 0 | 6 | 0 | 30% | 4% | 0% | 0% | 2% | 0% |
| 1.4 | 2.8 | 10 | 0 | 0 | 10 | 0 | 0 | 0 | 6 | 0 | 29% | 2% | 0% | 0% | 2% | 0% |
| 1.4 | 3.2 | 10 | 0 | 0 | 10 | 0 | 0 | 0 | 6 | 0 | 31% | 1% | 0% | 0% | 2% | 0% |
| 1.4 | 3.6 | 10 | 0 | 0 | 10 | 0 | 0 | 0 | 6 | 0 | 31% | 4% | 0% | 0% | 3% | 0% |
| 1.2 | 2.4 | 15 | 0 | 0 | 10 | 0 | 0 | 0 | 6 | 0 | 29% | 3% | 0% | 0% | 1% | 0% |
| 1.2 | 1.4 | 10 | 0 | 0 | 2 | 0 | 0 | 0 | 7 | 0 | 18% | 0% | 0% | 0% | 1% | 0% |
| 1.6 | 1.4 | 10 | 0 | 0 | 2 | 0 | 0 | 0 | 7 | 0 | 33% | 1% | 0% | 0% | 1% | 0% |
| 1 | 1.6 | 10 | 0 | 0 | 2 | 0 | 0 | 0 | 7 | 0 | 15% | 0% | 0% | 0% | 1% | 0% |
| 1.4 | 1.6 | 10 | 0 | 0 | 2 | 0 | 0 | 0 | 7 | 0 | 31% | 0% | 0% | 0% | 1% | 0% |
| 1.8 | 1.6 | 10 | 0 | 0 | 2 | 0 | 0 | 0 | 7 | 0 | 37% | 3% | 0% | 0% | 1% | 0% |
| 1.2 | 1.8 | 10 | 0 | 0 | 2 | 0 | 0 | 0 | 7 | 0 | 30% | 0% | 0% | 0% | 2% | 0% |
| 1.6 | 1.8 | 10 | 0 | 0 | 2 | 0 | 0 | 0 | 7 | 0 | 35% | 1% | 0% | 0% | 2% | 0% |
| 2 | 1.8 | 10 | 0 | 0 | 2 | 0 | 0 | 0 | 7 | 0 | 40% | 5% | 0% | 0% | 2% | 0% |
| 1.2 | 2 | 10 | 0 | 0 | 2 | 0 | 0 | 0 | 7 | 0 | 31% | 0% | 0% | 0% | 2% | 0% |
| 1.6 | 2 | 10 | 0 | 0 | 2 | 0 | 0 | 0 | 7 | 0 | 23% | 1% | 0% | 0% | 2% | 0% |
| 1 | 2.2 | 10 | 0 | 0 | 2 | 0 | 0 | 0 | 7 | 0 | 30% | 0% | 0% | 0% | 2% | 0% |
| 1.4 | 2.2 | 10 | 0 | 0 | 2 | 0 | 0 | 0 | 7 | 0 | 34% | 0% | 0% | 0% | 2% | 0% |
| 1 | 2.4 | 10 | 0 | 0 | 2 | 0 | 0 | 0 | 7 | 0 | 31% | 0% | 0% | 0% | 2% | 0% |
| 1.4 | 2.4 | 10 | 0 | 0 | 2 | 0 | 0 | 0 | 7 | 0 | 19% | 1% | 0% | 0% | 2% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.2 | 2.6 | 10 | 0 | 0 | 2 | 0 | 0 | 0 | 7 | 0 | 16% | 0% | 0% | 0% | 2% | 0% |
| 1.6 | 2.6 | 10 | 0 | 0 | 2 | 0 | 0 | 0 | 7 | 0 | 39% | 3% | 0% | 0% | 2% | 0% |
| 1.4 | 2.8 | 10 | 0 | 0 | 2 | 0 | 0 | 0 | 7 | 0 | 37% | 1% | 0% | 0% | 3% | 0% |
| 1.8 | 2.8 | 10 | 0 | 0 | 2 | 0 | 0 | 0 | 7 | 0 | 42% | 5% | 0% | 0% | 3% | 0% |
| 1.6 | 3 | 10 | 0 | 0 | 2 | 0 | 0 | 0 | 7 | 0 | 40% | 2% | 0% | 0% | 3% | 0% |
| 1.2 | 1.4 | 15 | 0 | 0 | 0 | 0 | 0 | 0 | 8 | 0 | 29% | 0% | 0% | 0% | 1% | 9% |
| 1.6 | 1.4 | 15 | 0 | 0 | 0 | 0 | 0 | 0 | 8 | 0 | 34% | 4% | 0% | 0% | 1% | 0% |
| 1.2 | 1.6 | 15 | 0 | 0 | 0 | 0 | 0 | 0 | 8 | 0 | 30% | 0% | 0% | 0% | 2% | 0% |
| 1.6 | 1.6 | 15 | 0 | 0 | 0 | 0 | 0 | 0 | 8 | 0 | 35% | 4% | 0% | 0% | 2% | 0% |
| 1.6 | 1.8 | 15 | 0 | 0 | 0 | 0 | 0 | 0 | 8 | 0 | 36% | 4% | 0% | 0% | 2% | 0% |
| 1.4 | 3 | 10 | 0 | 0 | 1 | 0 | 0 | 0 | 8 | 0 | 18% | 0% | 0% | 0% | 3% | 0% |
| 1.2 | 1.6 | 10 | 0 | 0 | 2 | 0 | 0 | 0 | 8 | 0 | 18% | 0% | 0% | 0% | 1% | 0% |
| 1.6 | 1.6 | 10 | 0 | 0 | 2 | 0 | 0 | 0 | 8 | 0 | 35% | 0% | 0% | 0% | 1% | 0% |
| 2 | 1.6 | 10 | 0 | 0 | 2 | 0 | 0 | 0 | 8 | 0 | 40% | 4% | 0% | 0% | 1% | 0% |
| 1.2 | 1.8 | 10 | 0 | 0 | 2 | 0 | 0 | 0 | 8 | 0 | 18% | 0% | 0% | 0% | 2% | 0% |
| 1.6 | 1.8 | 10 | 0 | 0 | 2 | 0 | 0 | 0 | 8 | 0 | 36% | 0% | 0% | 0% | 2% | 0% |
| 2 | 1.8 | 10 | 0 | 0 | 2 | 0 | 0 | 0 | 8 | 0 | 41% | 4% | 0% | 0% | 2% | 0% |
| 1.2 | 2 | 10 | 0 | 0 | 2 | 0 | 0 | 0 | 8 | 0 | 32% | 0% | 0% | 0% | 2% | 0% |
| 1.6 | 2 | 10 | 0 | 0 | 2 | 0 | 0 | 0 | 8 | 0 | 37% | 0% | 0% | 0% | 2% | 0% |
| 1.2 | 2.2 | 10 | 0 | 0 | 2 | 0 | 0 | 0 | 8 | 0 | 33% | 0% | 0% | 0% | 2% | 0% |
| 1.6 | 2.2 | 10 | 0 | 0 | 2 | 0 | 0 | 0 | 8 | 0 | 38% | 3% | 0% | 0% | 0% | 0% |
| 1.2 | 2.4 | 10 | 0 | 0 | 2 | 0 | 0 | 0 | 8 | 0 | 34% | 0% | 0% | 0% | 0% | 0% |
| 1.6 | 2.4 | 10 | 0 | 0 | 2 | 0 | 0 | 0 | 8 | 0 | 39% | 3% | 0% | 0% | 0% | 0% |
| 1 | 2.6 | 10 | 0 | 0 | 2 | 0 | 0 | 0 | 8 | 0 | 33% | 0% | 0% | 0% | 0% | 0% |
| 1.4 | 2.6 | 10 | 0 | 0 | 2 | 0 | 0 | 0 | 8 | 0 | 37% | 1% | 0% | 0% | 2% | 0% |
| 1.8 | 2.6 | 10 | 0 | 0 | 2 | 0 | 0 | 0 | 8 | 0 | 24% | 5% | 0% | 0% | 2% | 0% |
| 1.2 | 2.8 | 10 | 0 | 0 | 2 | 0 | 0 | 0 | 8 | 0 | 36% | 0% | 0% | 0% | 3% | 0% |
| 1.6 | 2.8 | 10 | 0 | 0 | 2 | 0 | 0 | 0 | 8 | 0 | 41% | 2% | 0% | 0% | 3% | 0% |
| 1.2 | 3 | 10 | 0 | 0 | 2 | 0 | 0 | 0 | 8 | 0 | 37% | 0% | 0% | 0% | 3% | 0% |
| 1.6 | 3 | 10 | 0 | 0 | 2 | 0 | 0 | 0 | 8 | 0 | 21% | 2% | 0% | 0% | 3% | 0% |
| 1.4 | 3.2 | 10 | 0 | 0 | 2 | 0 | 0 | 0 | 8 | 0 | 18% | 0% | 0% | 0% | 0% | 0% |
| 1.2 | 1.8 | 15 | 0 | 0 | 2 | 0 | 0 | 0 | 8 | 0 | 18% | 0% | 0% | 0% | 2% | 0% |
| 1.6 | 1.8 | 15 | 0 | 0 | 2 | 0 | 0 | 0 | 8 | 0 | 23% | 5% | 0% | 0% | 2% | 0% |
| 1.4 | 2 | 15 | 0 | 0 | 2 | 0 | 0 | 0 | 8 | 0 | 20% | 2% | 0% | 0% | 2% | 0% |
| 1.6 | 2.2 | 15 | 0 | 0 | 2 | 0 | 0 | 0 | 8 | 0 | 38% | 5% | 0% | 0% | 2% | 0% |
| 1.4 | 3 | 10 | 0 | 0 | 3 | 0 | 0 | 0 | 8 | 0 | 39% | 1% | 0% | 0% | 3% | 0% |
| 1.4 | 3.4 | 10 | 0 | 0 | 3 | 0 | 0 | 0 | 8 | 0 | 18% | 0% | 0% | 0% | 0% | 0% |
| 1.4 | 3 | 10 | 0 | 0 | 4 | 0 | 0 | 0 | 8 | 0 | 21% | 1% | 0% | 0% | 3% | 0% |
| 1.4 | 3.4 | 10 | 0 | 0 | 4 | 0 | 0 | 0 | 8 | 0 | 20% | 1% | 0% | 0% | 0% | 0% |
| 1 | 2 | 15 | 0 | 0 | 4 | 0 | 0 | 0 | 8 | 0 | 18% | 0% | 0% | 0% | 2% | 6% |
| 1.4 | 2 | 15 | 0 | 0 | 4 | 0 | 0 | 0 | 8 | 0 | 23% | 3% | 0% | 0% | 2% | 0% |
| 1.2 | 2.2 | 15 | 0 | 0 | 4 | 0 | 0 | 0 | 8 | 0 | 20% | 0% | 0% | 0% | 2% | 0% |
| 1.4 | 2.4 | 15 | 0 | 0 | 4 | 0 | 0 | 0 | 8 | 0 | 24% | 3% | 0% | 0% | 2% | 0% |
| 1.4 | 3 | 10 | 0 | 0 | 5 | 0 | 0 | 0 | 8 | 0 | 23% | 2% | 0% | 0% | 2% | 0% |
| 1.4 | 3.4 | 10 | 0 | 0 | 5 | 0 | 0 | 0 | 8 | 0 | 39% | 1% | 0% | 0% | 3% | 0% |
| 1.4 | 2.8 | 10 | 0 | 0 | 6 | 0 | 0 | 0 | 8 | 0 | 35% | 2% | 0% | 0% | 0% | 0% |
| 1.4 | 3.2 | 10 | 0 | 0 | 6 | 0 | 0 | 0 | 8 | 0 | 24% | 2% | 0% | 0% | 3% | 0% |
| 1.4 | 3.6 | 10 | 0 | 0 | 6 | 0 | 0 | 0 | 8 | 0 | 24% | 1% | 0% | 0% | 3% | 0% |
| 1.2 | 2.2 | 15 | 0 | 0 | 6 | 0 | 0 | 0 | 8 | 0 | 23% | 1% | 0% | 0% | 2% | 10% |
| 1 | 2.4 | 15 | 0 | 0 | 6 | 0 | 0 | 0 | 8 | 0 | 21% | 0% | 0% | 0% | 2% | 0% |
| 1.4 | 2.4 | 15 | 0 | 0 | 6 | 0 | 0 | 0 | 8 | 0 | 25% | 3% | 0% | 0% | 2% | 0% |
| 1.4 | 2.8 | 10 | 0 | 0 | 7 | 0 | 0 | 0 | 8 | 0 | 34% | 2% | 0% | 0% | 0% | 0% |
| 1.4 | 3.2 | 10 | 0 | 0 | 7 | 0 | 0 | 0 | 8 | 0 | 26% | 2% | 0% | 0% | 0% | 0% |
| 1.4 | 3.6 | 10 | 0 | 0 | 7 | 0 | 0 | 0 | 8 | 0 | 25% | 2% | 0% | 0% | 3% | 0% |
| 1.4 | 4 | 10 | 0 | 0 | 7 | 0 | 0 | 0 | 8 | 0 | 24% | 1% | 0% | 0% | 3% | 0% |
| 1.4 | 3 | 10 | 0 | 0 | 8 | 0 | 0 | 0 | 8 | 0 | 34% | 3% | 0% | 0% | 0% | 0% |
| 1.4 | 3.4 | 10 | 0 | 0 | 8 | 0 | 0 | 0 | 8 | 0 | 27% | 2% | 0% | 0% | 3% | 0% |
| 1.4 | 3.8 | 10 | 0 | 0 | 8 | 0 | 0 | 0 | 8 | 0 | 27% | 2% | 0% | 0% | 3% | 0% |
| 1 | 2.6 | 15 | 0 | 0 | 8 | 0 | 0 | 0 | 8 | 0 | 23% | 0% | 0% | 0% | 2% | 0% |
| 1.4 | 2.6 | 15 | 0 | 0 | 8 | 0 | 0 | 0 | 8 | 0 | 28% | 4% | 0% | 0% | 2% | 0% |
| 1.4 | 2.8 | 10 | 0 | 0 | 9 | 0 | 0 | 0 | 8 | 0 | 32% | 0% | 0% | 0% | 2% | 0% |
| 1.4 | 3.2 | 10 | 0 | 0 | 9 | 0 | 0 | 0 | 8 | 0 | 34% | 3% | 0% | 0% | 0% | 0% |
| 1.4 | 3.6 | 10 | 0 | 0 | 9 | 0 | 0 | 0 | 8 | 0 | 29% | 3% | 0% | 0% | 3% | 0% |
| 1.4 | 4 | 10 | 0 | 0 | 9 | 0 | 0 | 0 | 8 | 0 | 28% | 2% | 0% | 0% | 0% | 0% |
| 1.4 | 2.8 | 10 | 0 | 0 | 10 | 0 | 0 | 0 | 8 | 0 | 32% | 1% | 0% | 0% | 2% | 0% |
| 1.4 | 3.2 | 10 | 0 | 0 | 10 | 0 | 0 | 0 | 8 | 0 | 33% | 3% | 0% | 0% | 0% | 0% |
| 1.4 | 3.6 | 10 | 0 | 0 | 10 | 0 | 0 | 0 | 8 | 0 | 30% | 3% | 0% | 0% | 3% | 0% |
| 1.4 | 4 | 10 | 0 | 0 | 10 | 0 | 0 | 0 | 8 | 0 | 30% | 3% | 0% | 0% | 3% | 0% |
| 1.4 | 4.4 | 10 | 0 | 0 | 10 | 0 | 0 | 0 | 8 | 0 | 29% | 2% | 0% | 0% | 3% | 0% |
| 1.2 | 2.8 | 15 | 0 | 0 | 10 | 0 | 0 | 0 | 8 | 0 | 28% | 2% | 0% | 0% | 2% | 0% |
| 1.4 | 3 | 15 | 0 | 0 | 10 | 0 | 0 | 0 | 8 | 0 | 31% | 5% | 0% | 0% | 2% | 0% |
| 1.2 | 1.8 | 10 | 0 | 0 | 2 | 0 | 0 | 0 | 9 | 0 | 18% | 0% | 0% | 0% | 2% | 0% |
| 1.6 | 1.8 | 10 | 0 | 0 | 2 | 0 | 0 | 0 | 9 | 0 | 36% | 0% | 0% | 0% | 2% | 0% |
| 1 | 2 | 10 | 0 | 0 | 2 | 0 | 0 | 0 | 9 | 0 | 15% | 0% | 0% | 0% | 2% | 0% |
| 1.4 | 2 | 10 | 0 | 0 | 2 | 0 | 0 | 0 | 9 | 0 | 35% | 0% | 0% | 0% | 0% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.8 | 2 | 10 | 0 | 0 | 2 | 0 | 0 | 0 | 9 | 0 | 40% | 5% | 0% | 0% | 0% | 0% |
| 1.2 | 2.2 | 10 | 0 | 0 | 2 | 0 | 0 | 0 | 9 | 0 | 34% | 0% | 0% | 0% | 0% | 0% |
| 1.6 | 2.2 | 10 | 0 | 0 | 2 | 0 | 0 | 0 | 9 | 0 | 39% | 3% | 0% | 0% | 0% | 0% |
| 1 | 2.4 | 10 | 0 | 0 | 2 | 0 | 0 | 0 | 9 | 0 | 32% | 0% | 0% | 0% | 2% | 0% |
| 1.4 | 2.4 | 10 | 0 | 0 | 2 | 0 | 0 | 0 | 9 | 0 | 37% | 0% | 0% | 0% | 0% | 0% |
| 1.8 | 2.4 | 10 | 0 | 0 | 2 | 0 | 0 | 0 | 9 | 0 | 25% | 4% | 0% | 0% | 0% | 0% |
| 1.2 | 2.6 | 10 | 0 | 0 | 2 | 0 | 0 | 0 | 9 | 0 | 36% | 0% | 0% | 0% | 0% | 0% |
| 1.6 | 2.6 | 10 | 0 | 0 | 2 | 0 | 0 | 0 | 9 | 0 | 40% | 2% | 0% | 0% | 0% | 0% |
| 1 | 2.8 | 10 | 0 | 0 | 2 | 0 | 0 | 0 | 9 | 0 | 35% | 0% | 0% | 0% | 0% | 0% |
| 1.4 | 2.8 | 10 | 0 | 0 | 2 | 0 | 0 | 0 | 9 | 0 | 39% | 0% | 0% | 0% | 3% | 0% |
| 1.8 | 2.8 | 10 | 0 | 0 | 2 | 0 | 0 | 0 | 9 | 0 | 44% | 4% | 0% | 0% | 3% | 0% |
| 2.2 | 2.8 | 10 | 0 | 0 | 2 | 0 | 0 | 0 | 9 | 0 | 28% | 4% | 0% | 0% | 3% | 0% |
| 1.2 | 3 | 10 | 0 | 0 | 2 | 0 | 0 | 0 | 9 | 0 | 16% | 0% | 0% | 0% | 3% | 0% |
| 1.6 | 3 | 10 | 0 | 0 | 2 | 0 | 0 | 0 | 9 | 0 | 42% | 2% | 0% | 0% | 3% | 0% |
| 2 | 3 | 10 | 0 | 0 | 2 | 0 | 0 | 0 | 9 | 0 | 46% | 2% | 0% | 0% | 0% | 0% |
| 1.4 | 2.8 | 10 | 0 | 0 | 0 | 0 | 0 | 0 | 10 | 0 | 39% | 0% | 0% | 0% | 3% | 0% |
| 1.4 | 3.2 | 10 | 0 | 0 | 0 | 0 | 0 | 0 | 10 | 0 | 40% | 0% | 0% | 0% | 0% | 0% |
| 1.6 | 1.8 | 15 | 0 | 0 | 0 | 0 | 0 | 0 | 10 | 0 | 37% | 3% | 0% | 0% | 2% | 0% |
| 1.2 | 2 | 15 | 0 | 0 | 0 | 0 | 0 | 0 | 10 | 0 | 33% | 0% | 0% | 0% | 0% | 0% |
| 1.4 | 2.2 | 15 | 0 | 0 | 0 | 0 | 0 | 0 | 10 | 0 | 37% | 4% | 0% | 0% | 2% | 0% |
| 1.4 | 3 | 10 | 0 | 0 | 1 | 0 | 0 | 0 | 10 | 0 | 18% | 0% | 0% | 0% | 3% | 0% |
| 1.4 | 3.4 | 10 | 0 | 0 | 1 | 0 | 0 | 0 | 10 | 0 | 18% | 0% | 0% | 0% | 0% | 0% |
| 1.2 | 2 | 10 | 0 | 0 | 2 | 0 | 0 | 0 | 10 | 0 | 17% | 0% | 0% | 0% | 2% | 0% |
| 1.6 | 2 | 10 | 0 | 0 | 2 | 0 | 0 | 0 | 10 | 0 | 38% | 2% | 0% | 0% | 0% | 0% |
| 1 | 2.2 | 10 | 0 | 0 | 2 | 0 | 0 | 0 | 10 | 0 | 15% | 0% | 0% | 0% | 2% | 0% |
| 1.4 | 2.2 | 10 | 0 | 0 | 2 | 0 | 0 | 0 | 10 | 0 | 37% | 0% | 0% | 0% | 0% | 0% |
| 1.8 | 2.2 | 10 | 0 | 0 | 2 | 0 | 0 | 0 | 10 | 0 | 42% | 4% | 0% | 0% | 0% | 0% |
| 1.2 | 2.4 | 10 | 0 | 0 | 2 | 0 | 0 | 0 | 10 | 0 | 36% | 0% | 0% | 0% | 0% | 0% |
| 1.6 | 2.4 | 10 | 0 | 0 | 2 | 0 | 0 | 0 | 10 | 0 | 40% | 2% | 0% | 0% | 0% | 0% |
| 1 | 2.6 | 10 | 0 | 0 | 2 | 0 | 0 | 0 | 10 | 0 | 34% | 0% | 0% | 0% | 0% | 0% |
| 1.4 | 2.6 | 10 | 0 | 0 | 2 | 0 | 0 | 0 | 10 | 0 | 39% | 0% | 0% | 0% | 0% | 0% |
| 1.8 | 2.6 | 10 | 0 | 0 | 2 | 0 | 0 | 0 | 10 | 0 | 24% | 4% | 0% | 0% | 0% | 0% |
| 1.2 | 2.8 | 10 | 0 | 0 | 2 | 0 | 0 | 0 | 10 | 0 | 38% | 0% | 0% | 0% | 0% | 0% |
| 1.6 | 2.8 | 10 | 0 | 0 | 2 | 0 | 0 | 0 | 10 | 0 | 42% | 2% | 0% | 0% | 0% | 0% |
| 2 | 2.8 | 10 | 0 | 0 | 2 | 0 | 0 | 0 | 10 | 0 | 47% | 2% | 0% | 0% | 0% | 0% |
| 1 | 3 | 10 | 0 | 0 | 2 | 0 | 0 | 0 | 10 | 0 | 36% | 0% | 0% | 0% | 0% | 0% |
| 1.4 | 3 | 10 | 0 | 0 | 2 | 0 | 0 | 0 | 10 | 0 | 41% | 0% | 0% | 0% | 3% | 0% |
| 1.8 | 3 | 10 | 0 | 0 | 2 | 0 | 0 | 0 | 10 | 0 | 45% | 0% | 0% | 0% | 0% | 0% |
| 2.2 | 3 | 10 | 0 | 0 | 2 | 0 | 0 | 0 | 10 | 0 | 50% | 3% | 0% | 0% | 0% | 0% |
| 1.4 | 3.2 | 10 | 0 | 0 | 2 | 0 | 0 | 0 | 10 | 0 | 18% | 0% | 0% | 0% | 3% | 0% |
| 1.4 | 3.6 | 10 | 0 | 0 | 2 | 0 | 0 | 0 | 10 | 0 | 18% | 0% | 0% | 0% | 0% | 0% |
| 1.2 | 2.2 | 15 | 0 | 0 | 2 | 0 | 0 | 0 | 10 | 0 | 17% | 2% | 0% | 0% | 0% | 0% |
| 1 | 2.4 | 15 | 0 | 0 | 2 | 0 | 0 | 0 | 10 | 0 | 16% | 0% | 0% | 0% | 0% | 0% |
| 1.4 | 2.4 | 15 | 0 | 0 | 2 | 0 | 0 | 0 | 10 | 0 | 19% | 4% | 0% | 0% | 0% | 0% |
| 1.4 | 2.8 | 10 | 0 | 0 | 3 | 0 | 0 | 0 | 10 | 0 | 39% | 0% | 0% | 0% | 0% | 0% |
| 1.4 | 3.2 | 10 | 0 | 0 | 3 | 0 | 0 | 0 | 10 | 0 | 19% | 0% | 0% | 0% | 3% | 0% |
| 1.4 | 3.6 | 10 | 0 | 0 | 3 | 0 | 0 | 0 | 10 | 0 | 44% | 0% | 0% | 0% | 0% | 0% |
| 1.4 | 2.8 | 10 | 0 | 0 | 4 | 0 | 0 | 0 | 10 | 0 | 38% | 0% | 0% | 0% | 0% | 0% |
| 1.4 | 3.2 | 10 | 0 | 0 | 4 | 0 | 0 | 0 | 10 | 0 | 40% | 0% | 0% | 0% | 0% | 0% |
| 1.4 | 3.6 | 10 | 0 | 0 | 4 | 0 | 0 | 0 | 10 | 0 | 43% | 1% | 0% | 0% | 0% | 0% |
| 1.4 | 4 | 10 | 0 | 0 | 4 | 0 | 0 | 0 | 10 | 0 | 19% | 0% | 0% | 0% | 0% | 0% |
| 1.2 | 2.4 | 15 | 0 | 0 | 4 | 0 | 0 | 0 | 10 | 0 | 20% | 2% | 0% | 0% | 0% | 1% |
| 1 | 2.6 | 15 | 0 | 0 | 4 | 0 | 0 | 0 | 10 | 0 | 18% | 0% | 0% | 0% | 0% | 0% |
| 1.4 | 2.6 | 15 | 0 | 0 | 4 | 0 | 0 | 0 | 10 | 0 | 22% | 5% | 0% | 0% | 0% | 0% |
| 1.4 | 2.8 | 10 | 0 | 0 | 5 | 0 | 0 | 0 | 10 | 0 | 37% | 1% | 0% | 0% | 0% | 0% |
| 1.4 | 3.2 | 10 | 0 | 0 | 5 | 0 | 0 | 0 | 10 | 0 | 39% | 1% | 0% | 0% | 0% | 0% |
| 1.4 | 3.6 | 10 | 0 | 0 | 5 | 0 | 0 | 0 | 10 | 0 | 22% | 1% | 0% | 0% | 3% | 0% |
| 1.4 | 4 | 10 | 0 | 0 | 5 | 0 | 0 | 0 | 10 | 0 | 21% | 0% | 0% | 0% | 0% | 0% |
| 1.4 | 3 | 10 | 0 | 0 | 6 | 0 | 0 | 0 | 10 | 0 | 37% | 1% | 0% | 0% | 0% | 0% |
| 1.4 | 3.4 | 10 | 0 | 0 | 6 | 0 | 0 | 0 | 10 | 0 | 39% | 1% | 0% | 0% | 0% | 0% |
| 1.4 | 3.8 | 10 | 0 | 0 | 6 | 0 | 0 | 0 | 10 | 0 | 23% | 1% | 0% | 0% | 3% | 0% |
| 1.4 | 4.2 | 10 | 0 | 0 | 6 | 0 | 0 | 0 | 10 | 0 | 22% | 0% | 0% | 0% | 0% | 0% |
| 1.2 | 2.8 | 15 | 0 | 0 | 6 | 0 | 0 | 0 | 10 | 0 | 22% | 3% | 0% | 0% | 0% | 0% |
| 1.4 | 3 | 10 | 0 | 0 | 7 | 0 | 0 | 0 | 10 | 0 | 37% | 2% | 0% | 0% | 0% | 0% |
| 1.4 | 3.4 | 10 | 0 | 0 | 7 | 0 | 0 | 0 | 10 | 0 | 38% | 1% | 0% | 0% | 0% | 0% |
| 1.4 | 3.8 | 10 | 0 | 0 | 7 | 0 | 0 | 0 | 10 | 0 | 25% | 2% | 0% | 0% | 3% | 0% |
| 1.4 | 4.2 | 10 | 0 | 0 | 7 | 0 | 0 | 0 | 10 | 0 | 24% | 0% | 0% | 0% | 0% | 0% |
| 1.4 | 2.8 | 10 | 0 | 0 | 8 | 0 | 0 | 0 | 10 | 0 | 27% | 2% | 0% | 0% | 0% | 0% |
| 1.4 | 3.2 | 10 | 0 | 0 | 8 | 0 | 0 | 0 | 10 | 0 | 37% | 2% | 0% | 0% | 0% | 0% |
| 1.4 | 3.6 | 10 | 0 | 0 | 8 | 0 | 0 | 0 | 10 | 0 | 38% | 2% | 0% | 0% | 0% | 0% |
| 1.4 | 4 | 10 | 0 | 0 | 8 | 0 | 0 | 0 | 10 | 0 | 26% | 2% | 0% | 0% | 3% | 0% |
| 1.4 | 4.4 | 10 | 0 | 0 | 8 | 0 | 0 | 0 | 10 | 0 | 25% | 0% | 0% | 0% | 0% | 0% |
| 1 | 3 | 15 | 0 | 0 | 8 | 0 | 0 | 0 | 10 | 0 | 23% | 1% | 0% | 0% | 0% | 0% |
| 1.4 | 2.8 | 10 | 0 | 0 | 9 | 0 | 0 | 0 | 10 | 0 | 29% | 2% | 0% | 0% | 0% | 8% |
| 1.4 | 3.2 | 10 | 0 | 0 | 9 | 0 | 0 | 0 | 10 | 0 | 36% | 2% | 0% | 0% | 0% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.4 | 3.6 | 10 | 0 | 0 | 9 | 0 | 0 | 0 | 10 | 0 | 38% | 2% | 0% | 0% | 0% | 0% |
| 1.4 | 4 | 10 | 0 | 0 | 9 | 0 | 0 | 0 | 10 | 0 | 28% | 2% | 0% | 0% | 3% | 0% |
| 1.4 | 4.4 | 10 | 0 | 0 | 9 | 0 | 0 | 0 | 10 | 0 | 42% | 0% | 0% | 0% | 0% | 0% |
| 1.4 | 4.8 | 10 | 0 | 0 | 9 | 0 | 0 | 0 | 10 | 0 | 26% | 0% | 0% | 0% | 3% | 0% |
| 1.4 | 3.2 | 10 | 0 | 0 | 10 | 0 | 0 | 0 | 10 | 0 | 35% | 3% | 0% | 0% | 0% | 0% |
| 1.4 | 3.6 | 10 | 0 | 0 | 10 | 0 | 0 | 0 | 10 | 0 | 37% | 3% | 0% | 0% | 0% | 0% |
| 1.4 | 4 | 10 | 0 | 0 | 10 | 0 | 0 | 0 | 10 | 0 | 29% | 3% | 0% | 0% | 0% | 0% |
| 1.4 | 4.4 | 10 | 0 | 0 | 10 | 0 | 0 | 0 | 10 | 0 | 29% | 3% | 0% | 0% | 0% | 0% |
| 1.4 | 4.8 | 10 | 0 | 0 | 10 | 0 | 0 | 0 | 10 | 0 | 28% | 0% | 0% | 0% | 3% | 0% |
| 1.2 | 2.2 | 10 | 0 | 0 | 2 | 0 | 0 | 0 | 11 | 0 | 17% | 0% | 0% | 0% | 0% | 0% |
| 1.6 | 2.2 | 10 | 0 | 0 | 2 | 0 | 0 | 0 | 11 | 0 | 40% | 2% | 0% | 0% | 0% | 0% |
| 1 | 2.4 | 10 | 0 | 0 | 2 | 0 | 0 | 0 | 11 | 0 | 14% | 0% | 0% | 0% | 0% | 0% |
| 1.4 | 2.4 | 10 | 0 | 0 | 2 | 0 | 0 | 0 | 11 | 0 | 39% | 0% | 0% | 0% | 0% | 0% |
| 1.8 | 2.4 | 10 | 0 | 0 | 2 | 0 | 0 | 0 | 11 | 0 | 43% | 4% | 0% | 0% | 0% | 0% |
| 1.2 | 2.6 | 10 | 0 | 0 | 2 | 0 | 0 | 0 | 11 | 0 | 37% | 0% | 0% | 0% | 0% | 0% |
| 1.6 | 2.6 | 10 | 0 | 0 | 2 | 0 | 0 | 0 | 11 | 0 | 42% | 2% | 0% | 0% | 0% | 0% |
| 1 | 2.8 | 10 | 0 | 0 | 2 | 0 | 0 | 0 | 11 | 0 | 36% | 0% | 0% | 0% | 0% | 0% |
| 1.4 | 2.8 | 10 | 0 | 0 | 2 | 0 | 0 | 0 | 11 | 0 | 41% | 0% | 0% | 0% | 0% | 0% |
| 1.8 | 2.8 | 10 | 0 | 0 | 2 | 0 | 0 | 0 | 11 | 0 | 45% | 4% | 0% | 0% | 0% | 0% |
| 1.2 | 3 | 10 | 0 | 0 | 2 | 0 | 0 | 0 | 11 | 0 | 39% | 0% | 0% | 0% | 0% | 0% |
| 1.6 | 3 | 10 | 0 | 0 | 2 | 0 | 0 | 0 | 11 | 0 | 44% | 2% | 0% | 0% | 0% | 0% |
| 2 | 3 | 10 | 0 | 0 | 2 | 0 | 0 | 0 | 11 | 0 | 26% | 1% | 0% | 0% | 0% | 0% |
| 2.4 | 3 | 10 | 0 | 0 | 2 | 0 | 0 | 0 | 11 | 0 | 31% | 5% | 0% | 0% | 3% | 0% |
| 1.4 | 3 | 10 | 0 | 0 | 0 | 0 | 0 | 0 | 12 | 0 | 41% | 0% | 0% | 0% | 0% | 0% |
| 1.4 | 3.4 | 10 | 0 | 0 | 0 | 0 | 0 | 0 | 12 | 0 | 42% | 0% | 0% | 0% | 0% | 0% |
| 1.4 | 3.8 | 10 | 0 | 0 | 0 | 0 | 0 | 0 | 12 | 0 | 44% | 0% | 0% | 0% | 0% | 0% |
| 1.4 | 3 | 10 | 0 | 0 | 1 | 0 | 0 | 0 | 12 | 0 | 42% | 0% | 0% | 0% | 0% | 0% |
| 1.4 | 3.4 | 10 | 0 | 0 | 1 | 0 | 0 | 0 | 12 | 0 | 43% | 0% | 0% | 0% | 3% | 0% |
| 1.4 | 4 | 10 | 0 | 0 | 1 | 0 | 0 | 0 | 12 | 0 | 18% | 0% | 0% | 0% | 3% | 0% |
| 1.2 | 2.4 | 10 | 0 | 0 | 2 | 0 | 0 | 0 | 12 | 0 | 17% | 0% | 0% | 0% | 0% | 0% |
| 1.6 | 2.4 | 10 | 0 | 0 | 2 | 0 | 0 | 0 | 12 | 0 | 42% | 1% | 0% | 0% | 0% | 0% |
| 1 | 2.6 | 10 | 0 | 0 | 2 | 0 | 0 | 0 | 12 | 0 | 35% | 0% | 0% | 0% | 0% | 0% |
| 1.4 | 2.6 | 10 | 0 | 0 | 2 | 0 | 0 | 0 | 12 | 0 | 40% | 0% | 0% | 0% | 0% | 0% |
| 1.8 | 2.6 | 10 | 0 | 0 | 2 | 0 | 0 | 0 | 12 | 0 | 45% | 4% | 0% | 0% | 0% | 0% |
| 1.2 | 2.8 | 10 | 0 | 0 | 2 | 0 | 0 | 0 | 12 | 0 | 39% | 0% | 0% | 0% | 0% | 0% |
| 1.6 | 2.8 | 10 | 0 | 0 | 2 | 0 | 0 | 0 | 12 | 0 | 44% | 2% | 0% | 0% | 0% | 0% |
| 1 | 3 | 10 | 0 | 0 | 2 | 0 | 0 | 0 | 12 | 0 | 38% | 0% | 0% | 0% | 0% | 0% |
| 1.4 | 3 | 10 | 0 | 0 | 2 | 0 | 0 | 0 | 12 | 0 | 43% | 0% | 0% | 0% | 0% | 0% |
| 1.8 | 3 | 10 | 0 | 0 | 2 | 0 | 0 | 0 | 12 | 0 | 47% | 0% | 0% | 0% | 0% | 0% |
| 1.4 | 3.4 | 10 | 0 | 0 | 2 | 0 | 0 | 0 | 12 | 0 | 44% | 0% | 0% | 0% | 3% | 0% |
| 1.4 | 3.8 | 10 | 0 | 0 | 2 | 0 | 0 | 0 | 12 | 0 | 46% | 0% | 0% | 0% | 0% | 0% |
| 1.4 | 3 | 10 | 0 | 0 | 3 | 0 | 0 | 0 | 12 | 0 | 42% | 0% | 0% | 0% | 0% | 0% |
| 1.4 | 3.4 | 10 | 0 | 0 | 3 | 0 | 0 | 0 | 12 | 0 | 44% | 0% | 0% | 0% | 0% | 0% |
| 1.4 | 3.8 | 10 | 0 | 0 | 3 | 0 | 0 | 0 | 12 | 0 | 18% | 0% | 0% | 0% | 3% | 0% |
| 1.4 | 3 | 10 | 0 | 0 | 4 | 0 | 0 | 0 | 12 | 0 | 41% | 0% | 0% | 0% | 0% | 0% |
| 1.4 | 3.4 | 10 | 0 | 0 | 4 | 0 | 0 | 0 | 12 | 0 | 43% | 0% | 0% | 0% | 0% | 0% |
| 1.4 | 3.8 | 10 | 0 | 0 | 4 | 0 | 0 | 0 | 12 | 0 | 45% | 0% | 0% | 0% | 3% | 0% |
| 1.4 | 2.8 | 10 | 0 | 0 | 5 | 0 | 0 | 0 | 12 | 0 | 39% | 0% | 0% | 0% | 0% | 0% |
| 1.4 | 3.2 | 10 | 0 | 0 | 5 | 0 | 0 | 0 | 12 | 0 | 41% | 1% | 0% | 0% | 0% | 0% |
| 1.4 | 3.6 | 10 | 0 | 0 | 5 | 0 | 0 | 0 | 12 | 0 | 43% | 0% | 0% | 0% | 0% | 0% |
| 1.4 | 4 | 10 | 0 | 0 | 5 | 0 | 0 | 0 | 12 | 0 | 21% | 0% | 0% | 0% | 3% | 0% |
| 1.4 | 3 | 10 | 0 | 0 | 6 | 0 | 0 | 0 | 12 | 0 | 39% | 0% | 0% | 0% | 0% | 0% |
| 1.4 | 3.4 | 10 | 0 | 0 | 6 | 0 | 0 | 0 | 12 | 0 | 41% | 1% | 0% | 0% | 0% | 0% |
| 1.4 | 3.8 | 10 | 0 | 0 | 6 | 0 | 0 | 0 | 12 | 0 | 43% | 0% | 0% | 0% | 0% | 0% |
| 1.4 | 4.2 | 10 | 0 | 0 | 6 | 0 | 0 | 0 | 12 | 0 | 22% | 0% | 0% | 0% | 3% | 0% |
| 1.4 | 3.2 | 10 | 0 | 0 | 7 | 0 | 0 | 0 | 12 | 0 | 25% | 1% | 0% | 0% | 0% | 0% |
| 1.4 | 3.6 | 10 | 0 | 0 | 7 | 0 | 0 | 0 | 12 | 0 | 25% | 2% | 0% | 0% | 0% | 0% |
| 1.4 | 4 | 10 | 0 | 0 | 7 | 0 | 0 | 0 | 12 | 0 | 43% | 0% | 0% | 0% | 0% | 0% |
| 1.4 | 4.4 | 10 | 0 | 0 | 7 | 0 | 0 | 0 | 12 | 0 | 45% | 0% | 0% | 0% | 0% | 0% |
| 1.4 | 3.4 | 10 | 0 | 0 | 8 | 0 | 0 | 0 | 12 | 0 | 39% | 2% | 0% | 0% | 0% | 0% |
| 1.4 | 3.8 | 10 | 0 | 0 | 8 | 0 | 0 | 0 | 12 | 0 | 41% | 0% | 0% | 0% | 0% | 0% |
| 1.4 | 4.2 | 10 | 0 | 0 | 8 | 0 | 0 | 0 | 12 | 0 | 25% | 0% | 0% | 0% | 0% | 0% |
| 1.4 | 4.6 | 10 | 0 | 0 | 8 | 0 | 0 | 0 | 12 | 0 | 25% | 0% | 0% | 0% | 0% | 0% |
| 1.4 | 3.4 | 10 | 0 | 0 | 9 | 0 | 0 | 0 | 12 | 0 | 38% | 2% | 0% | 0% | 0% | 0% |
| 1.4 | 3.8 | 10 | 0 | 0 | 9 | 0 | 0 | 0 | 12 | 0 | 40% | 2% | 0% | 0% | 0% | 0% |
| 1.4 | 4.2 | 10 | 0 | 0 | 9 | 0 | 0 | 0 | 12 | 0 | 42% | 0% | 0% | 0% | 0% | 0% |
| 1.4 | 4.6 | 10 | 0 | 0 | 9 | 0 | 0 | 0 | 12 | 0 | 26% | 0% | 0% | 0% | 0% | 0% |
| 1.4 | 3.6 | 10 | 0 | 0 | 10 | 0 | 0 | 0 | 12 | 0 | 39% | 2% | 0% | 0% | 0% | 0% |
| 1.4 | 4 | 10 | 0 | 0 | 10 | 0 | 0 | 0 | 12 | 0 | 40% | 0% | 0% | 0% | 0% | 0% |
| 1.4 | 4.4 | 10 | 0 | 0 | 10 | 0 | 0 | 0 | 12 | 0 | 42% | 0% | 0% | 0% | 0% | 0% |
| 1.4 | 4.8 | 10 | 0 | 0 | 10 | 0 | 0 | 0 | 12 | 0 | 27% | 0% | 0% | 0% | 0% | 0% |
| 1.4 | 3 | 10 | 0 | 0 | 0 | 0 | 0 | 0 | 14 | 0 | 43% | 0% | 0% | 0% | 0% | 0% |
| 1.4 | 3.4 | 10 | 0 | 0 | 0 | 0 | 0 | 0 | 14 | 0 | 44% | 0% | 0% | 0% | 0% | 0% |
| 1.4 | 3.8 | 10 | 0 | 0 | 0 | 0 | 0 | 0 | 14 | 0 | 46% | 0% | 0% | 0% | 0% | 0% |
| 1.4 | 4.2 | 10 | 0 | 0 | 0 | 0 | 0 | 0 | 14 | 0 | 47% | 0% | 0% | 0% | 0% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.4 | 2.8 | 10 | 0 | 0 | 1 | 0 | 0 | 0 | 14 | 0 | 42% | 0% | 0% | 0% | 0% | 0% |
| 1.4 | 3.2 | 10 | 0 | 0 | 1 | 0 | 0 | 0 | 14 | 0 | 44% | 0% | 0% | 0% | 0% | 0% |
| 1.4 | 3.6 | 10 | 0 | 0 | 1 | 0 | 0 | 0 | 14 | 0 | 46% | 0% | 0% | 0% | 0% | 0% |
| 1.4 | 4 | 10 | 0 | 0 | 1 | 0 | 0 | 0 | 14 | 0 | 18% | 0% | 0% | 0% | 0% | 0% |
| 1.4 | 4.4 | 10 | 0 | 0 | 1 | 0 | 0 | 0 | 14 | 0 | 18% | 0% | 0% | 0% | 0% | 0% |
| 1.4 | 2.8 | 10 | 0 | 0 | 2 | 0 | 0 | 0 | 14 | 0 | 43% | 0% | 0% | 0% | 0% | 0% |
| 1.4 | 3.2 | 10 | 0 | 0 | 2 | 0 | 0 | 0 | 14 | 0 | 45% | 0% | 0% | 0% | 0% | 0% |
| 1.4 | 3.2 | 10 | 0 | 0 | 3 | 0 | 0 | 0 | 14 | 0 | 44% | 0% | 0% | 0% | 0% | 0% |
| 1.4 | 3.6 | 10 | 0 | 0 | 3 | 0 | 0 | 0 | 14 | 0 | 46% | 1% | 0% | 0% | 0% | 0% |
| 1.4 | 3.2 | 10 | 0 | 0 | 4 | 0 | 0 | 0 | 14 | 0 | 43% | 1% | 0% | 0% | 0% | 0% |
| 1.4 | 3.6 | 10 | 0 | 0 | 4 | 0 | 0 | 0 | 14 | 0 | 45% | 1% | 0% | 0% | 0% | 0% |
| 1.4 | 3.2 | 10 | 0 | 0 | 5 | 0 | 0 | 0 | 14 | 0 | 42% | 1% | 0% | 0% | 0% | 0% |
| 1.4 | 3.6 | 10 | 0 | 0 | 5 | 0 | 0 | 0 | 14 | 0 | 44% | 1% | 0% | 0% | 0% | 0% |
| 1.4 | 4 | 10 | 0 | 0 | 5 | 0 | 0 | 0 | 14 | 0 | 46% | 0% | 0% | 0% | 0% | 0% |
| 1.4 | 3.6 | 10 | 0 | 0 | 6 | 0 | 0 | 0 | 14 | 0 | 43% | 2% | 0% | 0% | 0% | 0% |
| 1.4 | 4 | 10 | 0 | 0 | 6 | 0 | 0 | 0 | 14 | 0 | 45% | 0% | 0% | 0% | 0% | 0% |
| 1.4 | 3.6 | 10 | 0 | 0 | 7 | 0 | 0 | 0 | 14 | 0 | 43% | 2% | 0% | 0% | 0% | 0% |
| 1.4 | 4 | 10 | 0 | 0 | 7 | 0 | 0 | 0 | 14 | 0 | 44% | 2% | 0% | 0% | 0% | 0% |
| 1.4 | 3.6 | 10 | 0 | 0 | 8 | 0 | 0 | 0 | 14 | 0 | 26% | 2% | 0% | 0% | 0% | 0% |
| 1.4 | 4 | 10 | 0 | 0 | 8 | 0 | 0 | 0 | 14 | 0 | 44% | 3% | 0% | 0% | 0% | 0% |
| 1.4 | 4.4 | 10 | 0 | 0 | 8 | 0 | 0 | 0 | 14 | 0 | 25% | 0% | 0% | 0% | 0% | 0% |
| 1.4 | 3.8 | 10 | 0 | 0 | 9 | 0 | 0 | 0 | 14 | 0 | 42% | 2% | 0% | 0% | 0% | 0% |
| 1.4 | 4.2 | 10 | 0 | 0 | 9 | 0 | 0 | 0 | 14 | 0 | 27% | 3% | 0% | 0% | 0% | 0% |
| 1.4 | 4.6 | 10 | 0 | 0 | 9 | 0 | 0 | 0 | 14 | 0 | 46% | 0% | 0% | 0% | 0% | 0% |
| 1.4 | 4 | 10 | 0 | 0 | 10 | 0 | 0 | 0 | 14 | 0 | 42% | 3% | 0% | 0% | 0% | 0% |
| 1.4 | 4.4 | 10 | 0 | 0 | 10 | 0 | 0 | 0 | 14 | 0 | 28% | 4% | 0% | 0% | 0% | 0% |
| 1.4 | 3 | 10 | 0 | 0 | 0 | 0 | 0 | 0 | 16 | 0 | 44% | 0% | 0% | 0% | 0% | 0% |
| 1.4 | 3.4 | 10 | 0 | 0 | 0 | 0 | 0 | 0 | 16 | 0 | 46% | 0% | 0% | 0% | 0% | 0% |
| 1.4 | 3.8 | 10 | 0 | 0 | 0 | 0 | 0 | 0 | 16 | 0 | 47% | 0% | 0% | 0% | 0% | 0% |
| 1.4 | 4.2 | 10 | 0 | 0 | 0 | 0 | 0 | 0 | 16 | 0 | 49% | 0% | 0% | 0% | 0% | 0% |
| 1.4 | 3 | 10 | 0 | 0 | 1 | 0 | 0 | 0 | 16 | 0 | 44% | 0% | 0% | 0% | 0% | 0% |
| 1.4 | 3.4 | 10 | 0 | 0 | 1 | 0 | 0 | 0 | 16 | 0 | 46% | 0% | 0% | 0% | 0% | 0% |
| 1.4 | 3.8 | 10 | 0 | 0 | 1 | 0 | 0 | 0 | 16 | 0 | 48% | 0% | 0% | 0% | 0% | 0% |
| 1.4 | 4.2 | 10 | 0 | 0 | 1 | 0 | 0 | 0 | 16 | 0 | 49% | 0% | 0% | 0% | 3% | 0% |
| 1.4 | 4.8 | 10 | 0 | 0 | 1 | 0 | 0 | 0 | 16 | 0 | 17% | 1% | 0% | 0% | 0% | 0% |
| 1.4 | 3.2 | 10 | 0 | 0 | 2 | 0 | 0 | 0 | 16 | 0 | 46% | 0% | 0% | 0% | 0% | 0% |
| 1.4 | 3.6 | 10 | 0 | 0 | 2 | 0 | 0 | 0 | 16 | 0 | 48% | 1% | 0% | 0% | 0% | 0% |
| 1.4 | 3.6 | 10 | 0 | 0 | 3 | 0 | 0 | 0 | 16 | 0 | 47% | 1% | 0% | 0% | 0% | 0% |
| 1.4 | 3.4 | 10 | 0 | 0 | 4 | 0 | 0 | 0 | 16 | 0 | 45% | 0% | 0% | 0% | 0% | 0% |
| 1.4 | 3.8 | 10 | 0 | 0 | 4 | 0 | 0 | 0 | 16 | 0 | 47% | 2% | 0% | 0% | 0% | 0% |
| 1.4 | 3.6 | 10 | 0 | 0 | 5 | 0 | 0 | 0 | 16 | 0 | 45% | 0% | 0% | 0% | 0% | 0% |
| 1.4 | 4 | 10 | 0 | 0 | 5 | 0 | 0 | 0 | 16 | 0 | 48% | 2% | 0% | 0% | 0% | 0% |
| 1.4 | 3.8 | 10 | 0 | 0 | 6 | 0 | 0 | 0 | 16 | 0 | 46% | 2% | 0% | 0% | 0% | 0% |
| 1.4 | 4.2 | 10 | 0 | 0 | 6 | 0 | 0 | 0 | 16 | 0 | 48% | 3% | 0% | 0% | 0% | 0% |
| 1.4 | 4 | 10 | 0 | 0 | 7 | 0 | 0 | 0 | 16 | 0 | 46% | 2% | 0% | 0% | 0% | 0% |
| 1.4 | 4.4 | 10 | 0 | 0 | 7 | 0 | 0 | 0 | 16 | 0 | 48% | 0% | 0% | 0% | 0% | 0% |
| 1.4 | 4.2 | 10 | 0 | 0 | 8 | 0 | 0 | 0 | 16 | 0 | 46% | 3% | 0% | 0% | 0% | 0% |
| 1.4 | 4.6 | 10 | 0 | 0 | 8 | 0 | 0 | 0 | 16 | 0 | 48% | 0% | 0% | 0% | 0% | 0% |
| 1.4 | 4.2 | 10 | 0 | 0 | 9 | 0 | 0 | 0 | 16 | 0 | 45% | 3% | 0% | 0% | 0% | 0% |
| 1.4 | 4.2 | 10 | 0 | 0 | 10 | 0 | 0 | 0 | 16 | 0 | 28% | 3% | 0% | 0% | 0% | 0% |
| 1.4 | 4.6 | 10 | 0 | 0 | 10 | 0 | 0 | 0 | 16 | 0 | 46% | 4% | 0% | 0% | 0% | 0% |
| 1.4 | 3.6 | 10 | 0 | 0 | 0 | 0 | 0 | 0 | 18 | 0 | 48% | 0% | 0% | 0% | 0% | 0% |
| 1.4 | 4 | 10 | 0 | 0 | 0 | 0 | 0 | 0 | 18 | 0 | 18% | 1% | 0% | 0% | 0% | 0% |
| 1.4 | 3.4 | 10 | 0 | 0 | 1 | 0 | 0 | 0 | 18 | 0 | 47% | 0% | 0% | 0% | 0% | 0% |
| 1.4 | 3.8 | 10 | 0 | 0 | 1 | 0 | 0 | 0 | 18 | 0 | 49% | 0% | 0% | 0% | 0% | 0% |
| 1.4 | 5 | 10 | 0 | 0 | 1 | 0 | 0 | 0 | 18 | 0 | 17% | 2% | 0% | 0% | 0% | 0% |
| 1.4 | 3.8 | 10 | 0 | 0 | 2 | 0 | 0 | 0 | 18 | 0 | 50% | 0% | 0% | 0% | 0% | 0% |
| 1.4 | 3.8 | 10 | 0 | 0 | 3 | 0 | 0 | 0 | 18 | 0 | 49% | 1% | 0% | 0% | 0% | 0% |
| 1.4 | 4 | 10 | 0 | 0 | 4 | 0 | 0 | 0 | 18 | 0 | 49% | 0% | 0% | 0% | 0% | 0% |
| 1.4 | 4.2 | 10 | 0 | 0 | 5 | 0 | 0 | 0 | 18 | 0 | 50% | 0% | 0% | 0% | 0% | 0% |
| 1.4 | 4.2 | 10 | 0 | 0 | 6 | 0 | 0 | 0 | 18 | 0 | 49% | 3% | 0% | 0% | 0% | 0% |
| 1.4 | 4.2 | 10 | 0 | 0 | 7 | 0 | 0 | 0 | 18 | 0 | 48% | 0% | 0% | 0% | 0% | 0% |
| 1.4 | 4.4 | 10 | 0 | 0 | 8 | 0 | 0 | 0 | 18 | 0 | 48% | 0% | 0% | 0% | 0% | 0% |
| 1.4 | 4.4 | 10 | 0 | 0 | 9 | 0 | 0 | 0 | 18 | 0 | 47% | 0% | 0% | 0% | 0% | 5% |
| 1.4 | 4.8 | 10 | 0 | 0 | 9 | 0 | 0 | 0 | 18 | 0 | 49% | 4% | 0% | 0% | 0% | 0% |
| 1.4 | 4.8 | 10 | 0 | 0 | 10 | 0 | 0 | 0 | 18 | 0 | 49% | 4% | 0% | 0% | 0% | 0% |
| 1.4 | 4.4 | 10 | 0 | 0 | 0 | 0 | 0 | 0 | 20 | 0 | 17% | 1% | 0% | 0% | 0% | 0% |
| 0.8 | 0.2 | 5 | 0 | 0 | 0 | 0 | 0 | 0 | 0 | 1 | 12% | 0% | 0% | 0% | 0% | 8% |
| 1.2 | 0.2 | 5 | 0 | 0 | 0 | 0 | 0 | 0 | 0 | 1 | 18% | 0% | 0% | 0% | 0% | 0% |
| 1.6 | 0.2 | 5 | 0 | 0 | 0 | 0 | 0 | 0 | 0 | 1 | 23% | 0% | 0% | 0% | 0% | 0% |
| 2 | 0.2 | 5 | 0 | 0 | 0 | 0 | 0 | 0 | 0 | 1 | 29% | 0% | 0% | 0% | 0% | 0% |
| 2.4 | 0.2 | 5 | 0 | 0 | 0 | 0 | 0 | 0 | 0 | 1 | 34% | 1% | 0% | 0% | 0% | 0% |
| 2.8 | 0.2 | 5 | 0 | 0 | 0 | 0 | 0 | 0 | 0 | 1 | 39% | 4% | 0% | 0% | 0% | 0% |
| 0.6 | 0.4 | 5 | 0 | 0 | 0 | 0 | 0 | 0 | 0 | 1 | 9% | 0% | 0% | 0% | 0% | 0% |
| 1 | 0.4 | 5 | 0 | 0 | 0 | 0 | 0 | 0 | 0 | 1 | 15% | 0% | 0% | 0% | 0% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.4 | 0.4 | 5 | 0 | 0 | 0 | 0 | 0 | 0 | 0 | 1 | 20% | 0% | 0% | 0% | 0% | 0% |
| 1.8 | 0.4 | 5 | 0 | 0 | 0 | 0 | 0 | 0 | 0 | 1 | 26% | 0% | 0% | 0% | 0% | 0% |
| 2.2 | 0.4 | 5 | 0 | 0 | 0 | 0 | 0 | 0 | 0 | 1 | 31% | 0% | 0% | 0% | 0% | 0% |
| 2.6 | 0.4 | 5 | 0 | 0 | 0 | 0 | 0 | 0 | 0 | 1 | 36% | 2% | 0% | 0% | 0% | 0% |
| 0.6 | 0.6 | 5 | 0 | 0 | 0 | 0 | 0 | 0 | 0 | 1 | 9% | 0% | 0% | 0% | 1% | 0% |
| 1 | 0.6 | 5 | 0 | 0 | 0 | 0 | 0 | 0 | 0 | 1 | 15% | 0% | 0% | 0% | 1% | 0% |
| 1.4 | 0.6 | 5 | 0 | 0 | 0 | 0 | 0 | 0 | 0 | 1 | 20% | 0% | 0% | 0% | 1% | 0% |
| 1.8 | 0.6 | 5 | 0 | 0 | 0 | 0 | 0 | 0 | 0 | 1 | 26% | 0% | 0% | 0% | 1% | 0% |
| 2.2 | 0.6 | 5 | 0 | 0 | 0 | 0 | 0 | 0 | 0 | 1 | 31% | 0% | 0% | 0% | 1% | 0% |
| 0.4 | 0.8 | 5 | 0 | 0 | 0 | 0 | 0 | 0 | 0 | 1 | 6% | 0% | 0% | 0% | 1% | 0% |
| 0.8 | 0.8 | 5 | 0 | 0 | 0 | 0 | 0 | 0 | 0 | 1 | 12% | 0% | 0% | 0% | 1% | 0% |
| 1.2 | 0.8 | 5 | 0 | 0 | 0 | 0 | 0 | 0 | 0 | 1 | 17% | 0% | 0% | 0% | 1% | 0% |
| 1.6 | 0.8 | 5 | 0 | 0 | 0 | 0 | 0 | 0 | 0 | 1 | 22% | 0% | 0% | 0% | 1% | 0% |
| 2 | 0.8 | 5 | 0 | 0 | 0 | 0 | 0 | 0 | 0 | 1 | 27% | 0% | 0% | 0% | 1% | 0% |
| 0.6 | 1 | 5 | 0 | 0 | 0 | 0 | 0 | 0 | 0 | 1 | 9% | 0% | 0% | 0% | 1% | 0% |
| 1 | 1 | 5 | 0 | 0 | 0 | 0 | 0 | 0 | 0 | 1 | 16% | 0% | 0% | 0% | 1% | 0% |
| 0.2 | 1.2 | 5 | 0 | 0 | 0 | 0 | 0 | 0 | 0 | 1 | 8% | 0% | 0% | 0% | 1% | 0% |
| 0.6 | 1.2 | 5 | 0 | 0 | 0 | 0 | 0 | 0 | 0 | 1 | 13% | 0% | 0% | 0% | 1% | 0% |
| 1.4 | 0.2 | 10 | 0 | 0 | 0 | 0 | 0 | 0 | 0 | 1 | 20% | 0% | 0% | 0% | 0% | 0% |
| 1.8 | 0.2 | 10 | 0 | 0 | 0 | 0 | 0 | 0 | 0 | 1 | 26% | 3% | 0% | 0% | 0% | 0% |
| 0.8 | 0.4 | 10 | 0 | 0 | 0 | 0 | 0 | 0 | 0 | 1 | 12% | 0% | 0% | 0% | 0% | 0% |
| 1.2 | 0.4 | 10 | 0 | 0 | 0 | 0 | 0 | 0 | 0 | 1 | 17% | 0% | 0% | 0% | 0% | 0% |
| 1.6 | 0.4 | 10 | 0 | 0 | 0 | 0 | 0 | 0 | 0 | 1 | 23% | 0% | 0% | 0% | 0% | 0% |
| 2 | 0.4 | 10 | 0 | 0 | 0 | 0 | 0 | 0 | 0 | 1 | 28% | 5% | 0% | 0% | 0% | 0% |
| 0.4 | 0.6 | 10 | 0 | 0 | 0 | 0 | 0 | 0 | 0 | 1 | 9% | 0% | 0% | 0% | 1% | 0% |
| 0.8 | 0.6 | 10 | 0 | 0 | 0 | 0 | 0 | 0 | 0 | 1 | 13% | 0% | 0% | 0% | 1% | 0% |
| 1.2 | 0.6 | 10 | 0 | 0 | 0 | 0 | 0 | 0 | 0 | 1 | 17% | 0% | 0% | 0% | 1% | 0% |
| 1.6 | 0.6 | 10 | 0 | 0 | 0 | 0 | 0 | 0 | 0 | 1 | 23% | 0% | 0% | 0% | 1% | 0% |
| 2 | 0.6 | 10 | 0 | 0 | 0 | 0 | 0 | 0 | 0 | 1 | 28% | 4% | 0% | 0% | 1% | 0% |
| 0.4 | 0.8 | 10 | 0 | 0 | 0 | 0 | 0 | 0 | 0 | 1 | 11% | 0% | 0% | 0% | 1% | 0% |
| 0.8 | 0.8 | 10 | 0 | 0 | 0 | 0 | 0 | 0 | 0 | 1 | 15% | 0% | 0% | 0% | 1% | 0% |
| 1.2 | 0.8 | 10 | 0 | 0 | 0 | 0 | 0 | 0 | 0 | 1 | 19% | 0% | 0% | 0% | 1% | 0% |
| 1.6 | 0.8 | 10 | 0 | 0 | 0 | 0 | 0 | 0 | 0 | 1 | 23% | 3% | 0% | 0% | 1% | 0% |
| 0.8 | 1 | 10 | 0 | 0 | 0 | 0 | 0 | 0 | 0 | 1 | 17% | 0% | 0% | 0% | 1% | 0% |
| 1.2 | 1 | 10 | 0 | 0 | 0 | 0 | 0 | 0 | 0 | 1 | 21% | 0% | 0% | 0% | 1% | 0% |
| 1.6 | 1 | 10 | 0 | 0 | 0 | 0 | 0 | 0 | 0 | 1 | 25% | 2% | 0% | 0% | 1% | 0% |
| 1.2 | 0.2 | 15 | 0 | 0 | 0 | 0 | 0 | 0 | 0 | 1 | 18% | 0% | 0% | 0% | 0% | 8% |
| 0.8 | 0.4 | 15 | 0 | 0 | 0 | 0 | 0 | 0 | 0 | 1 | 14% | 0% | 0% | 0% | 0% | 9% |
| 1.2 | 0.4 | 15 | 0 | 0 | 0 | 0 | 0 | 0 | 0 | 1 | 19% | 0% | 0% | 0% | 0% | 0% |
| 0.8 | 0.6 | 15 | 0 | 0 | 0 | 0 | 0 | 0 | 0 | 1 | 17% | 0% | 0% | 0% | 1% | 0% |
| 1.2 | 0.6 | 15 | 0 | 0 | 0 | 0 | 0 | 0 | 0 | 1 | 22% | 0% | 0% | 0% | 1% | 0% |
| 1.6 | 0.6 | 15 | 0 | 0 | 0 | 0 | 0 | 0 | 0 | 1 | 26% | 5% | 0% | 0% | 1% | 0% |
| 0.8 | 0.8 | 15 | 0 | 0 | 0 | 0 | 0 | 0 | 0 | 1 | 19% | 0% | 0% | 0% | 1% | 0% |
| 1.2 | 0.8 | 15 | 0 | 0 | 0 | 0 | 0 | 0 | 0 | 1 | 23% | 0% | 0% | 0% | 1% | 0% |
| 1.6 | 0.8 | 15 | 0 | 0 | 0 | 0 | 0 | 0 | 0 | 1 | 28% | 4% | 0% | 0% | 1% | 0% |
| 0.8 | 1 | 1 | 1.3 | 0 | 1.5 | 0 | 1.5 | 0.4 | 0 | 1 | 15% | 1% | 0% | 0% | 1% | 0% |
| 0.8 | 1 | 3 | 1.3 | 0 | 1.5 | 0 | 1.5 | 0.4 | 0 | 1 | 14% | 0% | 0% | 0% | 1% | 0% |
| 0.8 | 1 | 5 | 1.3 | 0 | 1.5 | 0 | 1.5 | 0.4 | 0 | 1 | 14% | 0% | 0% | 0% | 1% | 0% |
| 0.8 | 1 | 7 | 1.3 | 0 | 1.5 | 0 | 1.5 | 0.4 | 0 | 1 | 14% | 0% | 0% | 0% | 1% | 0% |
| 0.8 | 1 | 9 | 1.3 | 0 | 1.5 | 0 | 1.5 | 0.4 | 0 | 1 | 16% | 0% | 0% | 0% | 1% | 0% |
| 0.8 | 1 | 11 | 1.3 | 0 | 1.5 | 0 | 1.5 | 0.4 | 0 | 1 | 18% | 0% | 0% | 0% | 1% | 0% |
| 0.8 | 1 | 13 | 1.3 | 0 | 1.5 | 0 | 1.5 | 0.4 | 0 | 1 | 19% | 0% | 0% | 0% | 1% | 0% |
| 0.92 | 1.01 | 4 | 0.19 | 0 | 3.09 | 0 | 0.48 | 0.26 | 2 | 1 | 16% | 0% | 0% | 0% | 1% | 0% |
| 0.92 | 1.01 | 6 | 0.19 | 0 | 3.09 | 0 | 0.48 | 0.26 | 2 | 1 | 16% | 0% | 0% | 0% | 1% | 0% |
| 0.92 | 1.01 | 8 | 0.19 | 0 | 3.09 | 0 | 0.48 | 0.26 | 2 | 1 | 16% | 0% | 0% | 0% | 1% | 0% |
| 0.92 | 1.01 | 10 | 0.19 | 0 | 3.09 | 0 | 0.48 | 0.26 | 2 | 1 | 16% | 0% | 0% | 0% | 1% | 1% |
| 0.92 | 1.01 | 12 | 0.19 | 0 | 3.09 | 0 | 0.48 | 0.26 | 2 | 1 | 16% | 0% | 0% | 0% | 1% | 7% |
| 0.8 | 1 | 0 | 1.3 | 0 | 1.5 | 0 | 1.5 | 0.4 | 2 | 1 | 15% | 0% | 0% | 0% | 1% | 0% |
| 0.8 | 1 | 2 | 1.3 | 0 | 1.5 | 0 | 1.5 | 0.4 | 2 | 1 | 15% | 0% | 0% | 0% | 1% | 0% |
| 0.8 | 1 | 4 | 1.3 | 0 | 1.5 | 0 | 1.5 | 0.4 | 2 | 1 | 14% | 0% | 0% | 0% | 1% | 0% |
| 0.8 | 1 | 6 | 1.3 | 0 | 1.5 | 0 | 1.5 | 0.4 | 2 | 1 | 14% | 0% | 0% | 0% | 1% | 0% |
| 0.8 | 1 | 8 | 1.3 | 0 | 1.5 | 0 | 1.5 | 0.4 | 2 | 1 | 14% | 0% | 0% | 0% | 1% | 0% |
| 0.8 | 1 | 10 | 1.3 | 0 | 1.5 | 0 | 1.5 | 0.4 | 2 | 1 | 14% | 0% | 0% | 0% | 1% | 4% |
| 0.8 | 1 | 12 | 1.3 | 0 | 1.5 | 0 | 1.5 | 0.4 | 2 | 1 | 15% | 0% | 0% | 0% | 1% | 5% |
| 1.5 | 0.5 | 5 | 0 | 0 | 2 | 0 | 0 | 0 | 0 | 2 | 24% | 0% | 0% | 0% | 0% | 0% |
| 2.5 | 0.5 | 5 | 0 | 0 | 2 | 0 | 0 | 0 | 0 | 2 | 37% | 2% | 0% | 0% | 0% | 0% |
| 3 | 0.5 | 5 | 0 | 0 | 2 | 0 | 0 | 0 | 0 | 2 | 44% | 4% | 0% | 0% | 0% | 0% |
| 1 | 0.5 | 7 | 0 | 0 | 2 | 0 | 0 | 0 | 0 | 2 | 17% | 0% | 0% | 0% | 0% | 0% |
| 2 | 0.5 | 7 | 0 | 0 | 2 | 0 | 0 | 0 | 0 | 2 | 31% | 4% | 0% | 0% | 0% | 0% |
| 1.5 | 0.5 | 9 | 0 | 0 | 2 | 0 | 0 | 0 | 0 | 2 | 24% | 0% | 0% | 0% | 0% | 0% |
| 1.5 | 0.5 | 11 | 0 | 0 | 2 | 0 | 0 | 0 | 0 | 2 | 24% | 1% | 0% | 0% | 0% | 0% |
| 1.5 | 0.5 | 13 | 0 | 0 | 2 | 0 | 0 | 0 | 0 | 2 | 24% | 3% | 0% | 0% | 0% | 0% |
| 0.8 | 1 | 0 | 1.3 | 0 | 1.5 | 0 | 1.5 | 0.4 | 0 | 2 | 34% | 1% | 0% | 0% | 1% | 0% |
| 0.8 | 1 | 2 | 1.3 | 0 | 1.5 | 0 | 1.5 | 0.4 | 0 | 2 | 14% | 0% | 0% | 0% | 1% | 0% |
| 0.8 | 1 | 4 | 1.3 | 0 | 1.5 | 0 | 1.5 | 0.4 | 0 | 2 | 14% | 1% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 0.8 | 1 | 6 | 1.3 | 0 | 1.5 | 0 | 1.5 | 0.4 | 0 | 2 | 14% | 1% | 0% | 0% | 1% | 0% |
| 0.8 | 1 | 8 | 1.3 | 0 | 1.5 | 0 | 1.5 | 0.4 | 0 | 2 | 16% | 0% | 0% | 0% | 1% | 0% |
| 0.8 | 1 | 10 | 1.3 | 0 | 1.5 | 0 | 1.5 | 0.4 | 0 | 2 | 19% | 0% | 0% | 0% | 1% | 0% |
| 0.8 | 1 | 12 | 1.3 | 0 | 1.5 | 0 | 1.5 | 0.4 | 0 | 2 | 21% | 1% | 0% | 0% | 1% | 0% |
| 0.7 | 0.5 | 5 | 0 | 0 | 0 | 0 | 0 | 2 | 0 | 2 | 8% | 0% | 0% | 0% | 1% | 0% |
| 1.1 | 0.5 | 5 | 0 | 0 | 0 | 0 | 0 | 2 | 0 | 2 | 11% | 0% | 0% | 0% | 1% | 0% |
| 1.3 | 0.5 | 5 | 0 | 0 | 0 | 0 | 0 | 2 | 0 | 2 | 12% | 0% | 0% | 0% | 1% | 0% |
| 1.5 | 0.5 | 5 | 0 | 0 | 0 | 0 | 0 | 2 | 0 | 2 | 15% | 0% | 0% | 0% | 1% | 0% |
| 1.9 | 0.5 | 5 | 0 | 0 | 0 | 0 | 0 | 2 | 0 | 2 | 20% | 0% | 0% | 0% | 1% | 0% |
| 0.7 | 0.7 | 5 | 0 | 0 | 0 | 0 | 0 | 2 | 0 | 2 | 10% | 0% | 0% | 0% | 1% | 0% |
| 1.1 | 0.7 | 5 | 0 | 0 | 0 | 0 | 0 | 2 | 0 | 2 | 12% | 0% | 0% | 0% | 1% | 0% |
| 1.3 | 0.7 | 5 | 0 | 0 | 0 | 0 | 0 | 2 | 0 | 2 | 14% | 0% | 0% | 0% | 1% | 0% |
| 1.5 | 0.7 | 5 | 0 | 0 | 0 | 0 | 0 | 2 | 0 | 2 | 15% | 0% | 0% | 0% | 1% | 0% |
| 1.9 | 0.7 | 5 | 0 | 0 | 0 | 0 | 0 | 2 | 0 | 2 | 20% | 0% | 0% | 0% | 1% | 0% |
| 0.7 | 0.9 | 5 | 0 | 0 | 0 | 0 | 0 | 2 | 0 | 2 | 11% | 0% | 0% | 0% | 1% | 0% |
| 1.1 | 0.9 | 5 | 0 | 0 | 0 | 0 | 0 | 2 | 0 | 2 | 13% | 0% | 0% | 0% | 1% | 0% |
| 1.3 | 0.9 | 5 | 0 | 0 | 0 | 0 | 0 | 2 | 0 | 2 | 14% | 0% | 0% | 0% | 1% | 0% |
| 1.5 | 0.9 | 5 | 0 | 0 | 0 | 0 | 0 | 2 | 0 | 2 | 15% | 0% | 0% | 0% | 1% | 0% |
| 1.9 | 0.9 | 5 | 0 | 0 | 0 | 0 | 0 | 2 | 0 | 2 | 20% | 0% | 0% | 0% | 1% | 0% |
| 0.7 | 1.1 | 5 | 0 | 0 | 0 | 0 | 0 | 2 | 0 | 2 | 12% | 0% | 0% | 0% | 1% | 0% |
| 1.1 | 1.1 | 5 | 0 | 0 | 0 | 0 | 0 | 2 | 0 | 2 | 14% | 0% | 0% | 0% | 1% | 0% |
| 1.3 | 1.1 | 5 | 0 | 0 | 0 | 0 | 0 | 2 | 0 | 2 | 15% | 0% | 0% | 0% | 1% | 0% |
| 1.5 | 1.1 | 5 | 0 | 0 | 0 | 0 | 0 | 2 | 0 | 2 | 17% | 0% | 0% | 0% | 1% | 0% |
| 1.9 | 1.1 | 5 | 0 | 0 | 0 | 0 | 0 | 2 | 0 | 2 | 25% | 0% | 0% | 0% | 1% | 0% |
| 0.7 | 1.3 | 5 | 0 | 0 | 0 | 0 | 0 | 2 | 0 | 2 | 13% | 0% | 0% | 0% | 1% | 0% |
| 0.5 | 1.5 | 5 | 0 | 0 | 0 | 0 | 0 | 2 | 0 | 2 | 13% | 0% | 0% | 0% | 1% | 0% |
| 0.9 | 0.5 | 10 | 0 | 0 | 0 | 0 | 0 | 2 | 0 | 2 | 15% | 0% | 0% | 0% | 1% | 0% |
| 1.3 | 0.5 | 10 | 0 | 0 | 0 | 0 | 0 | 2 | 0 | 2 | 19% | 0% | 0% | 0% | 1% | 0% |
| 1.5 | 0.5 | 10 | 0 | 0 | 0 | 0 | 0 | 2 | 0 | 2 | 21% | 0% | 0% | 0% | 1% | 0% |
| 1.7 | 0.5 | 10 | 0 | 0 | 0 | 0 | 0 | 2 | 0 | 2 | 23% | 0% | 0% | 0% | 1% | 0% |
| 0.5 | 0.7 | 10 | 0 | 0 | 0 | 0 | 0 | 2 | 0 | 2 | 12% | 0% | 0% | 0% | 1% | 0% |
| 0.9 | 0.7 | 10 | 0 | 0 | 0 | 0 | 0 | 2 | 0 | 2 | 18% | 0% | 0% | 0% | 1% | 0% |
| 1.3 | 0.7 | 10 | 0 | 0 | 0 | 0 | 0 | 2 | 0 | 2 | 22% | 0% | 0% | 0% | 1% | 0% |
| 1.5 | 0.7 | 10 | 0 | 0 | 0 | 0 | 0 | 2 | 0 | 2 | 23% | 0% | 0% | 0% | 1% | 0% |
| 1.7 | 0.7 | 10 | 0 | 0 | 0 | 0 | 0 | 2 | 0 | 2 | 25% | 0% | 0% | 0% | 1% | 0% |
| 0.5 | 0.9 | 10 | 0 | 0 | 0 | 0 | 0 | 2 | 0 | 2 | 13% | 0% | 0% | 0% | 1% | 0% |
| 0.9 | 0.9 | 10 | 0 | 0 | 0 | 0 | 0 | 2 | 0 | 2 | 18% | 0% | 0% | 0% | 1% | 0% |
| 1.3 | 0.9 | 10 | 0 | 0 | 0 | 0 | 0 | 2 | 0 | 2 | 24% | 0% | 0% | 0% | 1% | 0% |
| 1.5 | 0.9 | 10 | 0 | 0 | 0 | 0 | 0 | 2 | 0 | 2 | 25% | 0% | 0% | 0% | 1% | 0% |
| 1.7 | 0.9 | 10 | 0 | 0 | 0 | 0 | 0 | 2 | 0 | 2 | 27% | 0% | 0% | 0% | 1% | 0% |
| 0.5 | 1.1 | 10 | 0 | 0 | 0 | 0 | 0 | 2 | 0 | 2 | 14% | 0% | 0% | 0% | 1% | 0% |
| 0.9 | 1.1 | 10 | 0 | 0 | 0 | 0 | 0 | 2 | 0 | 2 | 19% | 0% | 0% | 0% | 1% | 0% |
| 1.3 | 1.1 | 10 | 0 | 0 | 0 | 0 | 0 | 2 | 0 | 2 | 24% | 0% | 0% | 0% | 1% | 0% |
| 1.5 | 1.1 | 10 | 0 | 0 | 0 | 0 | 0 | 2 | 0 | 2 | 26% | 0% | 0% | 0% | 1% | 0% |
| 1.7 | 1.1 | 10 | 0 | 0 | 0 | 0 | 0 | 2 | 0 | 2 | 28% | 0% | 0% | 0% | 1% | 0% |
| 0.5 | 1.3 | 10 | 0 | 0 | 0 | 0 | 0 | 2 | 0 | 2 | 17% | 0% | 0% | 0% | 1% | 0% |
| 0.9 | 1.3 | 10 | 0 | 0 | 0 | 0 | 0 | 2 | 0 | 2 | 20% | 0% | 0% | 0% | 1% | 0% |
| 1.3 | 1.3 | 10 | 0 | 0 | 0 | 0 | 0 | 2 | 0 | 2 | 24% | 0% | 0% | 0% | 1% | 0% |
| 1.5 | 1.3 | 10 | 0 | 0 | 0 | 0 | 0 | 2 | 0 | 2 | 27% | 0% | 0% | 0% | 1% | 0% |
| 1.7 | 1.3 | 10 | 0 | 0 | 0 | 0 | 0 | 2 | 0 | 2 | 29% | 0% | 0% | 0% | 1% | 0% |
| 0.5 | 1.5 | 10 | 0 | 0 | 0 | 0 | 0 | 2 | 0 | 2 | 18% | 0% | 0% | 0% | 1% | 0% |
| 0.9 | 1.5 | 10 | 0 | 0 | 0 | 0 | 0 | 2 | 0 | 2 | 16% | 0% | 0% | 0% | 1% | 0% |
| 1.1 | 1.5 | 10 | 0 | 0 | 0 | 0 | 0 | 2 | 0 | 2 | 23% | 0% | 0% | 0% | 1% | 0% |
| 1.3 | 1.5 | 10 | 0 | 0 | 0 | 0 | 0 | 2 | 0 | 2 | 25% | 0% | 0% | 0% | 2% | 0% |
| 1.5 | 1.5 | 10 | 0 | 0 | 0 | 0 | 0 | 2 | 0 | 2 | 27% | 0% | 0% | 0% | 2% | 0% |
| 0.9 | 1.7 | 10 | 0 | 0 | 0 | 0 | 0 | 2 | 0 | 2 | 23% | 0% | 0% | 0% | 2% | 0% |
| 1.3 | 1.7 | 10 | 0 | 0 | 0 | 0 | 0 | 2 | 0 | 2 | 29% | 0% | 0% | 0% | 2% | 0% |
| 1.9 | 0.5 | 15 | 0 | 0 | 0 | 0 | 0 | 2 | 0 | 2 | 29% | 0% | 0% | 0% | 1% | 0% |
| 1.3 | 0.7 | 15 | 0 | 0 | 0 | 0 | 0 | 2 | 0 | 2 | 23% | 0% | 0% | 0% | 1% | 0% |
| 1.5 | 0.7 | 15 | 0 | 0 | 0 | 0 | 0 | 2 | 0 | 2 | 26% | 0% | 0% | 0% | 1% | 0% |
| 1.7 | 0.7 | 15 | 0 | 0 | 0 | 0 | 0 | 2 | 0 | 2 | 29% | 0% | 0% | 0% | 1% | 0% |
| 0.7 | 0.9 | 15 | 0 | 0 | 0 | 0 | 0 | 2 | 0 | 2 | 18% | 0% | 0% | 0% | 1% | 2% |
| 1.1 | 0.9 | 15 | 0 | 0 | 0 | 0 | 0 | 2 | 0 | 2 | 22% | 0% | 0% | 0% | 1% | 0% |
| 1.3 | 0.9 | 15 | 0 | 0 | 0 | 0 | 0 | 2 | 0 | 2 | 25% | 0% | 0% | 0% | 1% | 0% |
| 1.5 | 0.9 | 15 | 0 | 0 | 0 | 0 | 0 | 2 | 0 | 2 | 27% | 0% | 0% | 0% | 1% | 0% |
| 1.9 | 0.9 | 15 | 0 | 0 | 0 | 0 | 0 | 2 | 0 | 2 | 32% | 0% | 0% | 0% | 1% | 0% |
| 0.7 | 1.1 | 15 | 0 | 0 | 0 | 0 | 0 | 2 | 0 | 2 | 21% | 0% | 0% | 0% | 1% | 0% |
| 1.1 | 1.1 | 15 | 0 | 0 | 0 | 0 | 0 | 2 | 0 | 2 | 25% | 0% | 0% | 0% | 1% | 0% |
| 1.3 | 1.1 | 15 | 0 | 0 | 0 | 0 | 0 | 2 | 0 | 2 | 27% | 0% | 0% | 0% | 1% | 0% |
| 1.5 | 1.1 | 15 | 0 | 0 | 0 | 0 | 0 | 2 | 0 | 2 | 29% | 0% | 0% | 0% | 1% | 0% |
| 1.9 | 1.1 | 15 | 0 | 0 | 0 | 0 | 0 | 2 | 0 | 2 | 33% | 0% | 0% | 0% | 1% | 0% |
| 0.7 | 1.3 | 15 | 0 | 0 | 0 | 0 | 0 | 2 | 0 | 2 | 24% | 0% | 0% | 0% | 1% | 0% |
| 1.1 | 1.3 | 15 | 0 | 0 | 0 | 0 | 0 | 2 | 0 | 2 | 22% | 0% | 0% | 0% | 1% | 0% |
| 1.3 | 1.3 | 15 | 0 | 0 | 0 | 0 | 0 | 2 | 0 | 2 | 30% | 0% | 0% | 0% | 1% | 0% |
| 1.5 | 1.3 | 15 | 0 | 0 | 0 | 0 | 0 | 2 | 0 | 2 | 31% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.7 | 1.3 | 15 | 0 | 0 | 0 | 0 | 0 | 2 | 0 | 2 | 33% | 0% | 0% | 0% | 1% | 0% |
| 1.9 | 0.7 | 20 | 0 | 0 | 0 | 0 | 0 | 2 | 0 | 2 | 31% | 2% | 0% | 0% | 1% | 0% |
| 1.3 | 0.9 | 20 | 0 | 0 | 0 | 0 | 0 | 2 | 0 | 2 | 27% | 0% | 0% | 0% | 1% | 9% |
| 1.5 | 0.9 | 20 | 0 | 0 | 0 | 0 | 0 | 2 | 0 | 2 | 30% | 0% | 0% | 0% | 1% | 0% |
| 1.9 | 0.9 | 20 | 0 | 0 | 0 | 0 | 0 | 2 | 0 | 2 | 34% | 2% | 0% | 0% | 1% | 0% |
| 1.5 | 1.1 | 20 | 0 | 0 | 0 | 0 | 0 | 2 | 0 | 2 | 33% | 0% | 0% | 0% | 1% | 0% |
| 1.9 | 1.1 | 20 | 0 | 0 | 0 | 0 | 0 | 2 | 0 | 2 | 37% | 2% | 0% | 0% | 1% | 0% |
| 1.5 | 0.5 | 5 | 0 | 0 | 0 | 0 | 0 | 4 | 0 | 2 | 13% | 0% | 0% | 0% | 1% | 5% |
| 1.9 | 0.5 | 5 | 0 | 0 | 0 | 0 | 0 | 4 | 0 | 2 | 17% | 0% | 0% | 0% | 1% | 0% |
| 1.3 | 0.7 | 5 | 0 | 0 | 0 | 0 | 0 | 4 | 0 | 2 | 14% | 0% | 0% | 0% | 1% | 0% |
| 1.5 | 0.7 | 5 | 0 | 0 | 0 | 0 | 0 | 4 | 0 | 2 | 15% | 0% | 0% | 0% | 1% | 0% |
| 1.7 | 0.7 | 5 | 0 | 0 | 0 | 0 | 0 | 4 | 0 | 2 | 17% | 0% | 0% | 0% | 1% | 0% |
| 0.7 | 0.9 | 5 | 0 | 0 | 0 | 0 | 0 | 4 | 0 | 2 | 11% | 0% | 0% | 0% | 0% | 0% |
| 1.1 | 0.9 | 5 | 0 | 0 | 0 | 0 | 0 | 4 | 0 | 2 | 14% | 0% | 0% | 0% | 1% | 0% |
| 1.3 | 0.9 | 5 | 0 | 0 | 0 | 0 | 0 | 4 | 0 | 2 | 15% | 0% | 0% | 0% | 1% | 0% |
| 1.5 | 0.9 | 5 | 0 | 0 | 0 | 0 | 0 | 4 | 0 | 2 | 17% | 0% | 0% | 0% | 1% | 0% |
| 1.9 | 0.9 | 5 | 0 | 0 | 0 | 0 | 0 | 4 | 0 | 2 | 19% | 0% | 0% | 0% | 1% | 0% |
| 0.7 | 1.1 | 5 | 0 | 0 | 0 | 0 | 0 | 4 | 0 | 2 | 13% | 0% | 0% | 0% | 1% | 0% |
| 1.1 | 1.1 | 5 | 0 | 0 | 0 | 0 | 0 | 4 | 0 | 2 | 16% | 0% | 0% | 0% | 1% | 0% |
| 1.3 | 1.1 | 5 | 0 | 0 | 0 | 0 | 0 | 4 | 0 | 2 | 17% | 0% | 0% | 0% | 1% | 0% |
| 1.5 | 1.1 | 5 | 0 | 0 | 0 | 0 | 0 | 4 | 0 | 2 | 14% | 0% | 0% | 0% | 1% | 0% |
| 1.9 | 1.1 | 5 | 0 | 0 | 0 | 0 | 0 | 4 | 0 | 2 | 20% | 0% | 0% | 0% | 1% | 0% |
| 0.7 | 1.3 | 5 | 0 | 0 | 0 | 0 | 0 | 4 | 0 | 2 | 14% | 0% | 0% | 0% | 1% | 0% |
| 1.1 | 1.3 | 5 | 0 | 0 | 0 | 0 | 0 | 4 | 0 | 2 | 10% | 0% | 0% | 0% | 1% | 0% |
| 1.3 | 1.3 | 5 | 0 | 0 | 0 | 0 | 0 | 4 | 0 | 2 | 18% | 0% | 0% | 0% | 1% | 0% |
| 1.5 | 1.3 | 5 | 0 | 0 | 0 | 0 | 0 | 4 | 0 | 2 | 19% | 0% | 0% | 0% | 1% | 0% |
| 0.5 | 1.5 | 5 | 0 | 0 | 0 | 0 | 0 | 4 | 0 | 2 | 14% | 0% | 0% | 0% | 1% | 0% |
| 0.9 | 1.5 | 5 | 0 | 0 | 0 | 0 | 0 | 4 | 0 | 2 | 16% | 0% | 0% | 0% | 1% | 0% |
| 1.1 | 1.5 | 5 | 0 | 0 | 0 | 0 | 0 | 4 | 0 | 2 | 17% | 0% | 0% | 0% | 1% | 0% |
| 1.3 | 1.5 | 5 | 0 | 0 | 0 | 0 | 0 | 4 | 0 | 2 | 18% | 0% | 0% | 0% | 1% | 0% |
| 1.5 | 1.5 | 5 | 0 | 0 | 0 | 0 | 0 | 4 | 0 | 2 | 19% | 0% | 0% | 0% | 1% | 0% |
| 0.7 | 1.7 | 5 | 0 | 0 | 0 | 0 | 0 | 4 | 0 | 2 | 16% | 0% | 0% | 0% | 1% | 0% |
| 1.1 | 1.7 | 5 | 0 | 0 | 0 | 0 | 0 | 4 | 0 | 2 | 18% | 0% | 0% | 0% | 1% | 0% |
| 0.5 | 1.9 | 5 | 0 | 0 | 0 | 0 | 0 | 4 | 0 | 2 | 16% | 0% | 0% | 0% | 1% | 0% |
| 0.9 | 1.9 | 5 | 0 | 0 | 0 | 0 | 0 | 4 | 0 | 2 | 9% | 0% | 0% | 0% | 1% | 0% |
| 1.9 | 0.5 | 10 | 0 | 0 | 0 | 0 | 0 | 4 | 0 | 2 | 22% | 0% | 0% | 0% | 1% | 0% |
| 1.3 | 0.7 | 10 | 0 | 0 | 0 | 0 | 0 | 4 | 0 | 2 | 18% | 0% | 0% | 0% | 1% | 6% |
| 1.5 | 0.7 | 10 | 0 | 0 | 0 | 0 | 0 | 4 | 0 | 2 | 21% | 0% | 0% | 0% | 1% | 0% |
| 1.9 | 0.7 | 10 | 0 | 0 | 0 | 0 | 0 | 4 | 0 | 2 | 25% | 0% | 0% | 0% | 1% | 0% |
| 1.1 | 0.9 | 10 | 0 | 0 | 0 | 0 | 0 | 4 | 0 | 2 | 19% | 0% | 0% | 0% | 1% | 0% |
| 1.3 | 0.9 | 10 | 0 | 0 | 0 | 0 | 0 | 4 | 0 | 2 | 21% | 0% | 0% | 0% | 1% | 0% |
| 1.5 | 0.9 | 10 | 0 | 0 | 0 | 0 | 0 | 4 | 0 | 2 | 23% | 0% | 0% | 0% | 1% | 0% |
| 1.9 | 0.9 | 10 | 0 | 0 | 0 | 0 | 0 | 4 | 0 | 2 | 27% | 0% | 0% | 0% | 1% | 0% |
| 0.7 | 1.1 | 10 | 0 | 0 | 0 | 0 | 0 | 4 | 0 | 2 | 18% | 0% | 0% | 0% | 1% | 0% |
| 1.1 | 1.1 | 10 | 0 | 0 | 0 | 0 | 0 | 4 | 0 | 2 | 22% | 0% | 0% | 0% | 1% | 0% |
| 1.3 | 1.1 | 10 | 0 | 0 | 0 | 0 | 0 | 4 | 0 | 2 | 24% | 0% | 0% | 0% | 1% | 0% |
| 1.5 | 1.1 | 10 | 0 | 0 | 0 | 0 | 0 | 4 | 0 | 2 | 26% | 0% | 0% | 0% | 1% | 0% |
| 1.9 | 1.1 | 10 | 0 | 0 | 0 | 0 | 0 | 4 | 0 | 2 | 29% | 0% | 0% | 0% | 1% | 0% |
| 0.7 | 1.3 | 10 | 0 | 0 | 0 | 0 | 0 | 4 | 0 | 2 | 20% | 0% | 0% | 0% | 1% | 0% |
| 1.1 | 1.3 | 10 | 0 | 0 | 0 | 0 | 0 | 4 | 0 | 2 | 25% | 0% | 0% | 0% | 1% | 0% |
| 1.3 | 1.3 | 10 | 0 | 0 | 0 | 0 | 0 | 4 | 0 | 2 | 26% | 0% | 0% | 0% | 1% | 0% |
| 1.5 | 1.3 | 10 | 0 | 0 | 0 | 0 | 0 | 4 | 0 | 2 | 28% | 0% | 0% | 0% | 1% | 0% |
| 1.9 | 1.3 | 10 | 0 | 0 | 0 | 0 | 0 | 4 | 0 | 2 | 31% | 0% | 0% | 0% | 1% | 0% |
| 0.7 | 1.5 | 10 | 0 | 0 | 0 | 0 | 0 | 4 | 0 | 2 | 20% | 0% | 0% | 0% | 1% | 0% |
| 1.1 | 1.5 | 10 | 0 | 0 | 0 | 0 | 0 | 4 | 0 | 2 | 26% | 0% | 0% | 0% | 1% | 0% |
| 1.3 | 1.5 | 10 | 0 | 0 | 0 | 0 | 0 | 4 | 0 | 2 | 28% | 0% | 0% | 0% | 1% | 0% |
| 1.5 | 1.5 | 10 | 0 | 0 | 0 | 0 | 0 | 4 | 0 | 2 | 29% | 0% | 0% | 0% | 1% | 0% |
| 1.7 | 1.5 | 10 | 0 | 0 | 0 | 0 | 0 | 4 | 0 | 2 | 31% | 0% | 0% | 0% | 1% | 0% |
| 0.5 | 1.7 | 10 | 0 | 0 | 0 | 0 | 0 | 4 | 0 | 2 | 18% | 0% | 0% | 0% | 1% | 0% |
| 0.9 | 1.7 | 10 | 0 | 0 | 0 | 0 | 0 | 4 | 0 | 2 | 23% | 0% | 0% | 0% | 1% | 0% |
| 1.1 | 1.7 | 10 | 0 | 0 | 0 | 0 | 0 | 4 | 0 | 2 | 26% | 0% | 0% | 0% | 1% | 0% |
| 1.3 | 1.7 | 10 | 0 | 0 | 0 | 0 | 0 | 4 | 0 | 2 | 28% | 0% | 0% | 0% | 1% | 0% |
| 1.5 | 1.7 | 10 | 0 | 0 | 0 | 0 | 0 | 4 | 0 | 2 | 21% | 0% | 0% | 0% | 1% | 0% |
| 1.9 | 1.7 | 10 | 0 | 0 | 0 | 0 | 0 | 4 | 0 | 2 | 32% | 0% | 0% | 0% | 2% | 0% |
| 0.7 | 1.9 | 10 | 0 | 0 | 0 | 0 | 0 | 4 | 0 | 2 | 22% | 0% | 0% | 0% | 1% | 0% |
| 1.1 | 1.9 | 10 | 0 | 0 | 0 | 0 | 0 | 4 | 0 | 2 | 26% | 0% | 0% | 0% | 1% | 0% |
| 1.3 | 1.9 | 10 | 0 | 0 | 0 | 0 | 0 | 4 | 0 | 2 | 29% | 0% | 0% | 0% | 2% | 0% |
| 1.5 | 1.9 | 10 | 0 | 0 | 0 | 0 | 0 | 4 | 0 | 2 | 31% | 0% | 0% | 0% | 2% | 0% |
| 1.9 | 0.7 | 15 | 0 | 0 | 0 | 0 | 0 | 4 | 0 | 2 | 27% | 0% | 0% | 0% | 1% | 7% |
| 1.5 | 0.9 | 15 | 0 | 0 | 0 | 0 | 0 | 4 | 0 | 2 | 26% | 0% | 0% | 0% | 1% | 7% |
| 1.9 | 0.9 | 15 | 0 | 0 | 0 | 0 | 0 | 4 | 0 | 2 | 31% | 0% | 0% | 0% | 1% | 0% |
| 1.3 | 1.1 | 15 | 0 | 0 | 0 | 0 | 0 | 4 | 0 | 2 | 27% | 0% | 0% | 0% | 1% | 0% |
| 1.5 | 1.1 | 15 | 0 | 0 | 0 | 0 | 0 | 4 | 0 | 2 | 30% | 0% | 0% | 0% | 1% | 0% |
| 1.7 | 1.1 | 15 | 0 | 0 | 0 | 0 | 0 | 4 | 0 | 2 | 32% | 0% | 0% | 0% | 1% | 0% |
| 0.7 | 1.3 | 15 | 0 | 0 | 0 | 0 | 0 | 4 | 0 | 2 | 20% | 0% | 0% | 0% | 1% | 7% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.1 | 1.3 | 15 | 0 | 0 | 0 | 0 | 0 | 4 | 0 | 2 | 25% | 0% | 0% | 0% | 1% | 0% |
| 1.3 | 1.3 | 15 | 0 | 0 | 0 | 0 | 0 | 4 | 0 | 2 | 28% | 0% | 0% | 0% | 1% | 0% |
| 1.5 | 1.3 | 15 | 0 | 0 | 0 | 0 | 0 | 4 | 0 | 2 | 30% | 0% | 0% | 0% | 1% | 0% |
| 1.7 | 1.3 | 15 | 0 | 0 | 0 | 0 | 0 | 4 | 0 | 2 | 33% | 0% | 0% | 0% | 1% | 0% |
| 0.5 | 1.5 | 15 | 0 | 0 | 0 | 0 | 0 | 4 | 0 | 2 | 21% | 0% | 0% | 0% | 1% | 0% |
| 0.9 | 1.5 | 15 | 0 | 0 | 0 | 0 | 0 | 4 | 0 | 2 | 25% | 0% | 0% | 0% | 1% | 0% |
| 1.1 | 1.5 | 15 | 0 | 0 | 0 | 0 | 0 | 4 | 0 | 2 | 27% | 0% | 0% | 0% | 1% | 0% |
| 1.3 | 1.5 | 15 | 0 | 0 | 0 | 0 | 0 | 4 | 0 | 2 | 29% | 0% | 0% | 0% | 1% | 0% |
| 1.5 | 1.5 | 15 | 0 | 0 | 0 | 0 | 0 | 4 | 0 | 2 | 31% | 0% | 0% | 0% | 1% | 0% |
| 1.9 | 1.5 | 15 | 0 | 0 | 0 | 0 | 0 | 4 | 0 | 2 | 36% | 0% | 0% | 0% | 1% | 0% |
| 0.7 | 1.7 | 15 | 0 | 0 | 0 | 0 | 0 | 4 | 0 | 2 | 16% | 0% | 0% | 0% | 1% | 0% |
| 1.1 | 1.7 | 15 | 0 | 0 | 0 | 0 | 0 | 4 | 0 | 2 | 29% | 0% | 0% | 0% | 1% | 0% |
| 1.3 | 1.7 | 15 | 0 | 0 | 0 | 0 | 0 | 4 | 0 | 2 | 31% | 0% | 0% | 0% | 1% | 0% |
| 1.5 | 1.7 | 15 | 0 | 0 | 0 | 0 | 0 | 4 | 0 | 2 | 33% | 0% | 0% | 0% | 1% | 0% |
| 1.7 | 1.7 | 15 | 0 | 0 | 0 | 0 | 0 | 4 | 0 | 2 | 34% | 0% | 0% | 0% | 1% | 0% |
| 0.7 | 1.9 | 15 | 0 | 0 | 0 | 0 | 0 | 4 | 0 | 2 | 28% | 0% | 0% | 0% | 1% | 0% |
| 1.1 | 1.9 | 15 | 0 | 0 | 0 | 0 | 0 | 4 | 0 | 2 | 21% | 0% | 0% | 0% | 1% | 0% |
| 1.3 | 1.9 | 15 | 0 | 0 | 0 | 0 | 0 | 4 | 0 | 2 | 32% | 0% | 0% | 0% | 1% | 0% |
| 1.5 | 1.9 | 15 | 0 | 0 | 0 | 0 | 0 | 4 | 0 | 2 | 34% | 0% | 0% | 0% | 2% | 0% |
| 1.9 | 1.9 | 15 | 0 | 0 | 0 | 0 | 0 | 4 | 0 | 2 | 38% | 0% | 0% | 0% | 2% | 0% |
| 1.5 | 1.3 | 20 | 0 | 0 | 0 | 0 | 0 | 4 | 0 | 2 | 32% | 0% | 0% | 0% | 1% | 8% |
| 1.9 | 1.3 | 20 | 0 | 0 | 0 | 0 | 0 | 4 | 0 | 2 | 36% | 0% | 0% | 0% | 1% | 0% |
| 1.1 | 1.5 | 20 | 0 | 0 | 0 | 0 | 0 | 4 | 0 | 2 | 30% | 0% | 0% | 0% | 1% | 6% |
| 1.3 | 1.5 | 20 | 0 | 0 | 0 | 0 | 0 | 4 | 0 | 2 | 32% | 0% | 0% | 0% | 1% | 0% |
| 1.5 | 1.5 | 20 | 0 | 0 | 0 | 0 | 0 | 4 | 0 | 2 | 34% | 0% | 0% | 0% | 1% | 0% |
| 1.9 | 1.5 | 20 | 0 | 0 | 0 | 0 | 0 | 4 | 0 | 2 | 38% | 0% | 0% | 0% | 1% | 0% |
| 1.9 | 1.7 | 20 | 0 | 0 | 0 | 0 | 0 | 4 | 0 | 2 | 31% | 0% | 0% | 0% | 2% | 0% |
| 2.4 | 0.2 | 5 | 0 | 0 | 0 | 0 | 0 | 6 | 0 | 2 | 29% | 0% | 0% | 0% | 0% | 0% |
| 2.8 | 0.2 | 5 | 0 | 0 | 0 | 0 | 0 | 6 | 0 | 2 | 34% | 0% | 0% | 0% | 0% | 0% |
| 3.2 | 0.2 | 5 | 0 | 0 | 0 | 0 | 0 | 6 | 0 | 2 | 39% | 1% | 0% | 0% | 0% | 0% |
| 3.6 | 0.2 | 5 | 0 | 0 | 0 | 0 | 0 | 6 | 0 | 2 | 43% | 4% | 0% | 0% | 0% | 0% |
| 2.2 | 0.4 | 5 | 0 | 0 | 0 | 0 | 0 | 6 | 0 | 2 | 29% | 0% | 0% | 0% | 0% | 0% |
| 2.6 | 0.4 | 5 | 0 | 0 | 0 | 0 | 0 | 6 | 0 | 2 | 34% | 0% | 0% | 0% | 0% | 0% |
| 3 | 0.4 | 5 | 0 | 0 | 0 | 0 | 0 | 6 | 0 | 2 | 39% | 1% | 0% | 0% | 0% | 0% |
| 3.4 | 0.4 | 5 | 0 | 0 | 0 | 0 | 0 | 6 | 0 | 2 | 44% | 3% | 0% | 0% | 0% | 0% |
| 2 | 0.6 | 5 | 0 | 0 | 0 | 0 | 0 | 6 | 0 | 2 | 29% | 0% | 0% | 0% | 0% | 0% |
| 2.4 | 0.6 | 5 | 0 | 0 | 0 | 0 | 0 | 6 | 0 | 2 | 34% | 0% | 0% | 0% | 0% | 0% |
| 2.8 | 0.6 | 5 | 0 | 0 | 0 | 0 | 0 | 6 | 0 | 2 | 39% | 1% | 0% | 0% | 0% | 0% |
| 3.2 | 0.6 | 5 | 0 | 0 | 0 | 0 | 0 | 6 | 0 | 2 | 44% | 3% | 0% | 0% | 0% | 0% |
| 2 | 0.8 | 5 | 0 | 0 | 0 | 0 | 0 | 6 | 0 | 2 | 32% | 0% | 0% | 0% | 0% | 0% |
| 2.4 | 0.8 | 5 | 0 | 0 | 0 | 0 | 0 | 6 | 0 | 2 | 37% | 0% | 0% | 0% | 0% | 0% |
| 2.8 | 0.8 | 5 | 0 | 0 | 0 | 0 | 0 | 6 | 0 | 2 | 42% | 2% | 0% | 0% | 0% | 0% |
| 3.2 | 0.8 | 5 | 0 | 0 | 0 | 0 | 0 | 6 | 0 | 2 | 46% | 4% | 0% | 0% | 0% | 0% |
| 1.9 | 0.9 | 5 | 0 | 0 | 0 | 0 | 0 | 6 | 0 | 2 | 19% | 0% | 0% | 0% | 1% | 0% |
| 1.4 | 1 | 5 | 0 | 0 | 0 | 0 | 0 | 6 | 0 | 2 | 27% | 0% | 0% | 0% | 0% | 0% |
| 1.8 | 1 | 5 | 0 | 0 | 0 | 0 | 0 | 6 | 0 | 2 | 32% | 0% | 0% | 0% | 0% | 0% |
| 2.2 | 1 | 5 | 0 | 0 | 0 | 0 | 0 | 6 | 0 | 2 | 37% | 0% | 0% | 0% | 0% | 0% |
| 2.6 | 1 | 5 | 0 | 0 | 0 | 0 | 0 | 6 | 0 | 2 | 42% | 2% | 0% | 0% | 0% | 0% |
| 3 | 1 | 5 | 0 | 0 | 0 | 0 | 0 | 6 | 0 | 2 | 47% | 4% | 0% | 0% | 0% | 0% |
| 1.3 | 1.1 | 5 | 0 | 0 | 0 | 0 | 0 | 6 | 0 | 2 | 17% | 0% | 0% | 0% | 1% | 0% |
| 1.5 | 1.1 | 5 | 0 | 0 | 0 | 0 | 0 | 6 | 0 | 2 | 18% | 0% | 0% | 0% | 1% | 0% |
| 1.9 | 1.1 | 5 | 0 | 0 | 0 | 0 | 0 | 6 | 0 | 2 | 21% | 0% | 0% | 0% | 1% | 0% |
| 1.2 | 1.2 | 5 | 0 | 0 | 0 | 0 | 0 | 6 | 0 | 2 | 27% | 0% | 0% | 0% | 0% | 0% |
| 1.6 | 1.2 | 5 | 0 | 0 | 0 | 0 | 0 | 6 | 0 | 2 | 33% | 0% | 0% | 0% | 0% | 0% |
| 2 | 1.2 | 5 | 0 | 0 | 0 | 0 | 0 | 6 | 0 | 2 | 38% | 0% | 0% | 0% | 0% | 0% |
| 2.4 | 1.2 | 5 | 0 | 0 | 0 | 0 | 0 | 6 | 0 | 2 | 42% | 0% | 0% | 0% | 0% | 0% |
| 2.8 | 1.2 | 5 | 0 | 0 | 0 | 0 | 0 | 6 | 0 | 2 | 47% | 4% | 0% | 0% | 0% | 0% |
| 1.1 | 1.3 | 5 | 0 | 0 | 0 | 0 | 0 | 6 | 0 | 2 | 17% | 0% | 0% | 0% | 1% | 0% |
| 1.3 | 1.3 | 5 | 0 | 0 | 0 | 0 | 0 | 6 | 0 | 2 | 18% | 0% | 0% | 0% | 1% | 0% |
| 1.5 | 1.3 | 5 | 0 | 0 | 0 | 0 | 0 | 6 | 0 | 2 | 20% | 0% | 0% | 0% | 1% | 0% |
| 1.9 | 1.3 | 5 | 0 | 0 | 0 | 0 | 0 | 6 | 0 | 2 | 15% | 0% | 0% | 0% | 1% | 0% |
| 1.2 | 1.4 | 5 | 0 | 0 | 0 | 0 | 0 | 6 | 0 | 2 | 29% | 0% | 0% | 0% | 0% | 0% |
| 1.6 | 1.4 | 5 | 0 | 0 | 0 | 0 | 0 | 6 | 0 | 2 | 34% | 0% | 0% | 0% | 0% | 0% |
| 2 | 1.4 | 5 | 0 | 0 | 0 | 0 | 0 | 6 | 0 | 2 | 39% | 0% | 0% | 0% | 0% | 0% |
| 2.4 | 1.4 | 5 | 0 | 0 | 0 | 0 | 0 | 6 | 0 | 2 | 44% | 0% | 0% | 0% | 0% | 0% |
| 2.8 | 1.4 | 5 | 0 | 0 | 0 | 0 | 0 | 6 | 0 | 2 | 49% | 5% | 0% | 0% | 0% | 0% |
| 0.7 | 1.5 | 5 | 0 | 0 | 0 | 0 | 0 | 6 | 0 | 2 | 16% | 0% | 0% | 0% | 1% | 0% |
| 1.1 | 1.5 | 5 | 0 | 0 | 0 | 0 | 0 | 6 | 0 | 2 | 19% | 0% | 0% | 0% | 1% | 0% |
| 1.3 | 1.5 | 5 | 0 | 0 | 0 | 0 | 0 | 6 | 0 | 2 | 20% | 0% | 0% | 0% | 1% | 0% |
| 1.5 | 1.5 | 5 | 0 | 0 | 0 | 0 | 0 | 6 | 0 | 2 | 12% | 0% | 0% | 0% | 1% | 0% |
| 1.7 | 1.5 | 5 | 0 | 0 | 0 | 0 | 0 | 6 | 0 | 2 | 14% | 0% | 0% | 0% | 1% | 0% |
| 1 | 1.6 | 5 | 0 | 0 | 0 | 0 | 0 | 6 | 0 | 2 | 27% | 0% | 0% | 0% | 1% | 0% |
| 1.4 | 1.6 | 5 | 0 | 0 | 0 | 0 | 0 | 6 | 0 | 2 | 32% | 0% | 0% | 0% | 1% | 0% |
| 1.8 | 1.6 | 5 | 0 | 0 | 0 | 0 | 0 | 6 | 0 | 2 | 37% | 0% | 0% | 0% | 0% | 0% |
| 2.2 | 1.6 | 5 | 0 | 0 | 0 | 0 | 0 | 6 | 0 | 2 | 42% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 2.6 | 1.6 | 5 | 0 | 0 | 0 | 0 | 0 | 6 | 0 | 2 | 46% | 4% | 0% | 0% | 1% | 0% |
| 0.5 | 1.7 | 5 | 0 | 0 | 0 | 0 | 0 | 6 | 0 | 2 | 16% | 0% | 0% | 0% | 1% | 0% |
| 0.9 | 1.7 | 5 | 0 | 0 | 0 | 0 | 0 | 6 | 0 | 2 | 19% | 0% | 0% | 0% | 1% | 0% |
| 1.1 | 1.7 | 5 | 0 | 0 | 0 | 0 | 0 | 6 | 0 | 2 | 9% | 0% | 0% | 0% | 1% | 0% |
| 1.3 | 1.7 | 5 | 0 | 0 | 0 | 0 | 0 | 6 | 0 | 2 | 11% | 0% | 0% | 0% | 1% | 0% |
| 1.5 | 1.7 | 5 | 0 | 0 | 0 | 0 | 0 | 6 | 0 | 2 | 22% | 0% | 0% | 0% | 1% | 0% |
| 1.9 | 1.7 | 5 | 0 | 0 | 0 | 0 | 0 | 6 | 0 | 2 | 23% | 0% | 0% | 0% | 1% | 0% |
| 1.2 | 1.8 | 5 | 0 | 0 | 0 | 0 | 0 | 6 | 0 | 2 | 30% | 0% | 0% | 0% | 1% | 0% |
| 1.6 | 1.8 | 5 | 0 | 0 | 0 | 0 | 0 | 6 | 0 | 2 | 35% | 0% | 0% | 0% | 1% | 0% |
| 2 | 1.8 | 5 | 0 | 0 | 0 | 0 | 0 | 6 | 0 | 2 | 39% | 0% | 0% | 0% | 1% | 0% |
| 2.4 | 1.8 | 5 | 0 | 0 | 0 | 0 | 0 | 6 | 0 | 2 | 44% | 3% | 0% | 0% | 1% | 0% |
| 0.5 | 1.9 | 5 | 0 | 0 | 0 | 0 | 0 | 6 | 0 | 2 | 18% | 0% | 0% | 0% | 1% | 0% |
| 0.9 | 1.9 | 5 | 0 | 0 | 0 | 0 | 0 | 6 | 0 | 2 | 8% | 0% | 0% | 0% | 1% | 0% |
| 1.1 | 1.9 | 5 | 0 | 0 | 0 | 0 | 0 | 6 | 0 | 2 | 10% | 0% | 0% | 0% | 1% | 0% |
| 1.3 | 1.9 | 5 | 0 | 0 | 0 | 0 | 0 | 6 | 0 | 2 | 21% | 0% | 0% | 0% | 1% | 0% |
| 1.7 | 1.9 | 5 | 0 | 0 | 0 | 0 | 0 | 6 | 0 | 2 | 23% | 0% | 0% | 0% | 1% | 0% |
| 1.2 | 2 | 5 | 0 | 0 | 0 | 0 | 0 | 6 | 0 | 2 | 30% | 0% | 0% | 0% | 1% | 0% |
| 1.6 | 2 | 5 | 0 | 0 | 0 | 0 | 0 | 6 | 0 | 2 | 35% | 0% | 0% | 0% | 1% | 0% |
| 2 | 2 | 5 | 0 | 0 | 0 | 0 | 0 | 6 | 0 | 2 | 40% | 1% | 0% | 0% | 1% | 0% |
| 2.4 | 2 | 5 | 0 | 0 | 0 | 0 | 0 | 6 | 0 | 2 | 44% | 3% | 0% | 0% | 1% | 0% |
| 1 | 2.2 | 5 | 0 | 0 | 0 | 0 | 0 | 6 | 0 | 2 | 28% | 0% | 0% | 0% | 1% | 0% |
| 1.4 | 2.2 | 5 | 0 | 0 | 0 | 0 | 0 | 6 | 0 | 2 | 32% | 0% | 0% | 0% | 1% | 0% |
| 1.8 | 2.2 | 5 | 0 | 0 | 0 | 0 | 0 | 6 | 0 | 2 | 37% | 0% | 0% | 0% | 1% | 0% |
| 1 | 2.4 | 5 | 0 | 0 | 0 | 0 | 0 | 6 | 0 | 2 | 28% | 0% | 0% | 0% | 1% | 0% |
| 1.4 | 2.4 | 5 | 0 | 0 | 0 | 0 | 0 | 6 | 0 | 2 | 35% | 0% | 0% | 0% | 1% | 0% |
| 1.5 | 1.1 | 10 | 0 | 0 | 0 | 0 | 0 | 6 | 0 | 2 | 23% | 0% | 0% | 0% | 1% | 0% |
| 1.7 | 1.1 | 10 | 0 | 0 | 0 | 0 | 0 | 6 | 0 | 2 | 25% | 0% | 0% | 0% | 1% | 0% |
| 1.1 | 1.3 | 10 | 0 | 0 | 0 | 0 | 0 | 6 | 0 | 2 | 22% | 0% | 0% | 0% | 1% | 0% |
| 1.3 | 1.3 | 10 | 0 | 0 | 0 | 0 | 0 | 6 | 0 | 2 | 24% | 0% | 0% | 0% | 1% | 0% |
| 1.5 | 1.3 | 10 | 0 | 0 | 0 | 0 | 0 | 6 | 0 | 2 | 26% | 0% | 0% | 0% | 1% | 0% |
| 1.9 | 1.3 | 10 | 0 | 0 | 0 | 0 | 0 | 6 | 0 | 2 | 30% | 0% | 0% | 0% | 1% | 0% |
| 0.9 | 1.5 | 10 | 0 | 0 | 0 | 0 | 0 | 6 | 0 | 2 | 23% | 0% | 0% | 0% | 1% | 0% |
| 1.1 | 1.5 | 10 | 0 | 0 | 0 | 0 | 0 | 6 | 0 | 2 | 25% | 0% | 0% | 0% | 1% | 0% |
| 1.3 | 1.5 | 10 | 0 | 0 | 0 | 0 | 0 | 6 | 0 | 2 | 27% | 0% | 0% | 0% | 1% | 0% |
| 1.5 | 1.5 | 10 | 0 | 0 | 0 | 0 | 0 | 6 | 0 | 2 | 29% | 0% | 0% | 0% | 1% | 0% |
| 1.9 | 1.5 | 10 | 0 | 0 | 0 | 0 | 0 | 6 | 0 | 2 | 32% | 0% | 0% | 0% | 1% | 0% |
| 0.7 | 1.7 | 10 | 0 | 0 | 0 | 0 | 0 | 6 | 0 | 2 | 24% | 0% | 0% | 0% | 1% | 0% |
| 1.1 | 1.7 | 10 | 0 | 0 | 0 | 0 | 0 | 6 | 0 | 2 | 27% | 0% | 0% | 0% | 1% | 0% |
| 1.3 | 1.7 | 10 | 0 | 0 | 0 | 0 | 0 | 6 | 0 | 2 | 29% | 0% | 0% | 0% | 1% | 0% |
| 1.5 | 1.7 | 10 | 0 | 0 | 0 | 0 | 0 | 6 | 0 | 2 | 31% | 0% | 0% | 0% | 1% | 0% |
| 1.7 | 1.7 | 10 | 0 | 0 | 0 | 0 | 0 | 6 | 0 | 2 | 32% | 0% | 0% | 0% | 1% | 0% |
| 0.5 | 1.9 | 10 | 0 | 0 | 0 | 0 | 0 | 6 | 0 | 2 | 22% | 0% | 0% | 0% | 1% | 0% |
| 0.9 | 1.9 | 10 | 0 | 0 | 0 | 0 | 0 | 6 | 0 | 2 | 27% | 0% | 0% | 0% | 1% | 0% |
| 1.1 | 1.9 | 10 | 0 | 0 | 0 | 0 | 0 | 6 | 0 | 2 | 29% | 0% | 0% | 0% | 1% | 0% |
| 1.3 | 1.9 | 10 | 0 | 0 | 0 | 0 | 0 | 6 | 0 | 2 | 31% | 0% | 0% | 0% | 1% | 0% |
| 1.7 | 1.9 | 10 | 0 | 0 | 0 | 0 | 0 | 6 | 0 | 2 | 33% | 0% | 0% | 0% | 1% | 0% |
| 1.7 | 1.3 | 15 | 0 | 0 | 0 | 0 | 0 | 6 | 0 | 2 | 31% | 0% | 0% | 0% | 1% | 5% |
| 1.3 | 1.5 | 15 | 0 | 0 | 0 | 0 | 0 | 6 | 0 | 2 | 30% | 0% | 0% | 0% | 1% | 5% |
| 1.5 | 1.5 | 15 | 0 | 0 | 0 | 0 | 0 | 6 | 0 | 2 | 32% | 0% | 0% | 0% | 1% | 0% |
| 1.7 | 1.5 | 15 | 0 | 0 | 0 | 0 | 0 | 6 | 0 | 2 | 34% | 0% | 0% | 0% | 1% | 0% |
| 0.9 | 1.7 | 15 | 0 | 0 | 0 | 0 | 0 | 6 | 0 | 2 | 26% | 0% | 0% | 0% | 1% | 5% |
| 1.1 | 1.7 | 15 | 0 | 0 | 0 | 0 | 0 | 6 | 0 | 2 | 29% | 0% | 0% | 0% | 1% | 0% |
| 1.3 | 1.7 | 15 | 0 | 0 | 0 | 0 | 0 | 6 | 0 | 2 | 31% | 0% | 0% | 0% | 1% | 0% |
| 1.5 | 1.7 | 15 | 0 | 0 | 0 | 0 | 0 | 6 | 0 | 2 | 34% | 0% | 0% | 0% | 1% | 0% |
| 1.9 | 1.7 | 15 | 0 | 0 | 0 | 0 | 0 | 6 | 0 | 2 | 39% | 0% | 0% | 0% | 1% | 0% |
| 0.7 | 1.9 | 15 | 0 | 0 | 0 | 0 | 0 | 6 | 0 | 2 | 25% | 0% | 0% | 0% | 1% | 0% |
| 1.1 | 1.9 | 15 | 0 | 0 | 0 | 0 | 0 | 6 | 0 | 2 | 29% | 0% | 0% | 0% | 1% | 0% |
| 1.3 | 1.9 | 15 | 0 | 0 | 0 | 0 | 0 | 6 | 0 | 2 | 32% | 0% | 0% | 0% | 1% | 0% |
| 1.5 | 1.9 | 15 | 0 | 0 | 0 | 0 | 0 | 6 | 0 | 2 | 35% | 0% | 0% | 0% | 1% | 0% |
| 1.9 | 1.9 | 15 | 0 | 0 | 0 | 0 | 0 | 6 | 0 | 2 | 39% | 0% | 0% | 0% | 1% | 0% |
| 1.9 | 1.7 | 20 | 0 | 0 | 0 | 0 | 0 | 6 | 0 | 2 | 39% | 0% | 0% | 0% | 1% | 0% |
| 1.3 | 1.9 | 20 | 0 | 0 | 0 | 0 | 0 | 6 | 0 | 2 | 34% | 0% | 0% | 0% | 1% | 6% |
| 1.7 | 1.9 | 20 | 0 | 0 | 0 | 0 | 0 | 6 | 0 | 2 | 38% | 0% | 0% | 0% | 1% | 0% |
| 0.92 | 1.01 | 4 | 0.19 | 0 | 3.09 | 0 | 0.48 | 0.26 | 2 | 2 | 16% | 0% | 0% | 0% | 1% | 0% |
| 0.92 | 1.01 | 6 | 0.19 | 0 | 3.09 | 0 | 0.48 | 0.26 | 2 | 2 | 21% | 0% | 0% | 0% | 1% | 0% |
| 0.92 | 1.01 | 8 | 0.19 | 0 | 3.09 | 0 | 0.48 | 0.26 | 2 | 2 | 16% | 0% | 0% | 0% | 1% | 0% |
| 0.92 | 1.01 | 10 | 0.19 | 0 | 3.09 | 0 | 0.48 | 0.26 | 2 | 2 | 21% | 0% | 0% | 0% | 1% | 9% |
| 0.92 | 1.01 | 12 | 0.19 | 0 | 3.09 | 0 | 0.48 | 0.26 | 2 | 2 | 21% | 0% | 0% | 0% | 1% | 5% |
| 0.8 | 1 | 1 | 1.3 | 0 | 1.5 | 0 | 1.5 | 0.4 | 2 | 2 | 14% | 0% | 0% | 0% | 1% | 0% |
| 0.8 | 1 | 3 | 1.3 | 0 | 1.5 | 0 | 1.5 | 0.4 | 2 | 2 | 14% | 0% | 0% | 0% | 1% | 0% |
| 0.8 | 1 | 5 | 1.3 | 0 | 1.5 | 0 | 1.5 | 0.4 | 2 | 2 | 15% | 0% | 0% | 0% | 1% | 0% |
| 0.8 | 1 | 7 | 1.3 | 0 | 1.5 | 0 | 1.5 | 0.4 | 2 | 2 | 14% | 0% | 0% | 0% | 1% | 0% |
| 0.8 | 1 | 9 | 1.3 | 0 | 1.5 | 0 | 1.5 | 0.4 | 2 | 2 | 14% | 0% | 0% | 0% | 1% | 3% |
| 0.8 | 1 | 11 | 1.3 | 0 | 1.5 | 0 | 1.5 | 0.4 | 2 | 2 | 18% | 0% | 0% | 0% | 1% | 7% |
| 2.28 | 0.66 | 4.77 | 0 | 0 | 2.04 | 0 | 0 | 0 | 0 | 2.59 | 35% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1 | 0.2 | 5 | 0 | 0 | 0 | 0 | 0 | 0 | 0 | 3 | 15% | 0% | 0% | 0% | 0% | 0% |
| 1.4 | 0.2 | 5 | 0 | 0 | 0 | 0 | 0 | 0 | 0 | 3 | 21% | 0% | 0% | 0% | 0% | 0% |
| 1.8 | 0.2 | 5 | 0 | 0 | 0 | 0 | 0 | 0 | 0 | 3 | 26% | 0% | 0% | 0% | 0% | 0% |
| 2.2 | 0.2 | 5 | 0 | 0 | 0 | 0 | 0 | 0 | 0 | 3 | 32% | 0% | 0% | 0% | 0% | 0% |
| 2.6 | 0.2 | 5 | 0 | 0 | 0 | 0 | 0 | 0 | 0 | 3 | 37% | 1% | 0% | 0% | 0% | 0% |
| 3 | 0.2 | 5 | 0 | 0 | 0 | 0 | 0 | 0 | 0 | 3 | 42% | 0% | 0% | 0% | 0% | 0% |
| 0.6 | 0.4 | 5 | 0 | 0 | 0 | 0 | 0 | 0 | 0 | 3 | 9% | 0% | 0% | 0% | 0% | 7% |
| 1 | 0.4 | 5 | 0 | 0 | 0 | 0 | 0 | 0 | 0 | 3 | 15% | 0% | 0% | 0% | 0% | 0% |
| 1.4 | 0.4 | 5 | 0 | 0 | 0 | 0 | 0 | 0 | 0 | 3 | 20% | 0% | 0% | 0% | 0% | 0% |
| 1.8 | 0.4 | 5 | 0 | 0 | 0 | 0 | 0 | 0 | 0 | 3 | 26% | 0% | 0% | 0% | 0% | 0% |
| 2.2 | 0.4 | 5 | 0 | 0 | 0 | 0 | 0 | 0 | 0 | 3 | 31% | 0% | 0% | 0% | 0% | 0% |
| 2.6 | 0.4 | 5 | 0 | 0 | 0 | 0 | 0 | 0 | 0 | 3 | 36% | 1% | 0% | 0% | 0% | 0% |
| 3 | 0.4 | 5 | 0 | 0 | 0 | 0 | 0 | 0 | 0 | 3 | 41% | 0% | 0% | 0% | 0% | 0% |
| 0.6 | 0.6 | 5 | 0 | 0 | 0 | 0 | 0 | 0 | 0 | 3 | 9% | 0% | 0% | 0% | 1% | 0% |
| 1 | 0.6 | 5 | 0 | 0 | 0 | 0 | 0 | 0 | 0 | 3 | 14% | 0% | 0% | 0% | 1% | 0% |
| 1.4 | 0.6 | 5 | 0 | 0 | 0 | 0 | 0 | 0 | 0 | 3 | 20% | 0% | 0% | 0% | 1% | 0% |
| 1.8 | 0.6 | 5 | 0 | 0 | 0 | 0 | 0 | 0 | 0 | 3 | 26% | 0% | 0% | 0% | 1% | 0% |
| 2.2 | 0.6 | 5 | 0 | 0 | 0 | 0 | 0 | 0 | 0 | 3 | 31% | 0% | 0% | 0% | 1% | 0% |
| 2.6 | 0.6 | 5 | 0 | 0 | 0 | 0 | 0 | 0 | 0 | 3 | 36% | 2% | 0% | 0% | 1% | 0% |
| 3 | 0.6 | 5 | 0 | 0 | 0 | 0 | 0 | 0 | 0 | 3 | 41% | 0% | 0% | 0% | 1% | 0% |
| 0.6 | 0.8 | 5 | 0 | 0 | 0 | 0 | 0 | 0 | 0 | 3 | 9% | 0% | 0% | 0% | 1% | 0% |
| 1 | 0.8 | 5 | 0 | 0 | 0 | 0 | 0 | 0 | 0 | 3 | 14% | 0% | 0% | 0% | 1% | 0% |
| 1.4 | 0.8 | 5 | 0 | 0 | 0 | 0 | 0 | 0 | 0 | 3 | 20% | 0% | 0% | 0% | 1% | 0% |
| 1.8 | 0.8 | 5 | 0 | 0 | 0 | 0 | 0 | 0 | 0 | 3 | 26% | 0% | 0% | 0% | 1% | 0% |
| 2.2 | 0.8 | 5 | 0 | 0 | 0 | 0 | 0 | 0 | 0 | 3 | 34% | 2% | 0% | 0% | 1% | 0% |
| 0.4 | 1 | 5 | 0 | 0 | 0 | 0 | 0 | 0 | 0 | 3 | 8% | 0% | 0% | 0% | 1% | 0% |
| 0.8 | 1 | 5 | 0 | 0 | 0 | 0 | 0 | 0 | 0 | 3 | 11% | 0% | 0% | 0% | 1% | 0% |
| 1.2 | 1 | 5 | 0 | 0 | 0 | 0 | 0 | 0 | 0 | 3 | 20% | 0% | 0% | 0% | 1% | 0% |
| 0.4 | 1.2 | 5 | 0 | 0 | 0 | 0 | 0 | 0 | 0 | 3 | 11% | 0% | 0% | 0% | 1% | 0% |
| 0.8 | 1.2 | 5 | 0 | 0 | 0 | 0 | 0 | 0 | 0 | 3 | 17% | 0% | 0% | 0% | 1% | 0% |
| 1.4 | 0.2 | 10 | 0 | 0 | 0 | 0 | 0 | 0 | 0 | 3 | 20% | 0% | 0% | 0% | 0% | 0% |
| 1.8 | 0.2 | 10 | 0 | 0 | 0 | 0 | 0 | 0 | 0 | 3 | 26% | 3% | 0% | 0% | 0% | 0% |
| 1 | 0.4 | 10 | 0 | 0 | 0 | 0 | 0 | 0 | 0 | 3 | 15% | 0% | 0% | 0% | 0% | 3% |
| 1.4 | 0.4 | 10 | 0 | 0 | 0 | 0 | 0 | 0 | 0 | 3 | 20% | 0% | 0% | 0% | 0% | 0% |
| 1.8 | 0.4 | 10 | 0 | 0 | 0 | 0 | 0 | 0 | 0 | 3 | 26% | 2% | 0% | 0% | 0% | 0% |
| 0.4 | 0.6 | 10 | 0 | 0 | 0 | 0 | 0 | 0 | 0 | 3 | 11% | 0% | 0% | 0% | 1% | 0% |
| 0.8 | 0.6 | 10 | 0 | 0 | 0 | 0 | 0 | 0 | 0 | 3 | 16% | 0% | 0% | 0% | 1% | 0% |
| 1.2 | 0.6 | 10 | 0 | 0 | 0 | 0 | 0 | 0 | 0 | 3 | 19% | 0% | 0% | 0% | 1% | 0% |
| 1.6 | 0.6 | 10 | 0 | 0 | 0 | 0 | 0 | 0 | 0 | 3 | 23% | 0% | 0% | 0% | 1% | 0% |
| 0.2 | 0.8 | 10 | 0 | 0 | 0 | 0 | 0 | 0 | 0 | 3 | 12% | 0% | 0% | 0% | 1% | 0% |
| 0.8 | 0.8 | 10 | 0 | 0 | 0 | 0 | 0 | 0 | 0 | 3 | 18% | 0% | 0% | 0% | 1% | 0% |
| 1.2 | 0.8 | 10 | 0 | 0 | 0 | 0 | 0 | 0 | 0 | 3 | 22% | 0% | 0% | 0% | 1% | 0% |
| 1.6 | 0.8 | 10 | 0 | 0 | 0 | 0 | 0 | 0 | 0 | 3 | 24% | 2% | 0% | 0% | 1% | 0% |
| 1.2 | 1 | 10 | 0 | 0 | 0 | 0 | 0 | 0 | 0 | 3 | 24% | 0% | 0% | 0% | 1% | 0% |
| 1.8 | 1 | 10 | 0 | 0 | 0 | 0 | 0 | 0 | 0 | 3 | 29% | 4% | 0% | 0% | 1% | 0% |
| 1.4 | 0.4 | 15 | 0 | 0 | 0 | 0 | 0 | 0 | 0 | 3 | 24% | 2% | 0% | 0% | 0% | 0% |
| 0.6 | 0.6 | 15 | 0 | 0 | 0 | 0 | 0 | 0 | 0 | 3 | 17% | 0% | 0% | 0% | 1% | 10% |
| 1 | 0.6 | 15 | 0 | 0 | 0 | 0 | 0 | 0 | 0 | 3 | 22% | 0% | 0% | 0% | 1% | 0% |
| 1.4 | 0.6 | 15 | 0 | 0 | 0 | 0 | 0 | 0 | 0 | 3 | 26% | 2% | 0% | 0% | 1% | 0% |
| 1 | 0.5 | 5 | 0 | 0 | 2 | 0 | 0 | 0 | 0 | 3 | 17% | 0% | 0% | 0% | 0% | 0% |
| 2 | 0.5 | 5 | 0 | 0 | 2 | 0 | 0 | 0 | 0 | 3 | 31% | 0% | 0% | 0% | 0% | 0% |
| 2.5 | 0.5 | 5 | 0 | 0 | 2 | 0 | 0 | 0 | 0 | 3 | 38% | 2% | 0% | 0% | 0% | 0% |
| 3 | 0.5 | 5 | 0 | 0 | 2 | 0 | 0 | 0 | 0 | 3 | 44% | 0% | 0% | 0% | 0% | 0% |
| 1.5 | 0.5 | 7 | 0 | 0 | 2 | 0 | 0 | 0 | 0 | 3 | 24% | 0% | 0% | 0% | 0% | 0% |
| 1 | 0.5 | 9 | 0 | 0 | 2 | 0 | 0 | 0 | 0 | 3 | 17% | 0% | 0% | 0% | 0% | 0% |
| 1 | 0.5 | 11 | 0 | 0 | 2 | 0 | 0 | 0 | 0 | 3 | 17% | 0% | 0% | 0% | 0% | 0% |
| 1.5 | 0.5 | 13 | 0 | 0 | 2 | 0 | 0 | 0 | 0 | 3 | 24% | 3% | 0% | 0% | 0% | 0% |
| 0.8 | 1 | 1 | 1.3 | 0 | 1.5 | 0 | 1.5 | 0.4 | 0 | 3 | 14% | 0% | 0% | 0% | 1% | 0% |
| 0.8 | 1 | 3 | 1.3 | 0 | 1.5 | 0 | 1.5 | 0.4 | 0 | 3 | 14% | 0% | 0% | 0% | 1% | 0% |
| 0.8 | 1 | 5 | 1.3 | 0 | 1.5 | 0 | 1.5 | 0.4 | 0 | 3 | 14% | 0% | 0% | 0% | 1% | 0% |
| 0.8 | 1 | 7 | 1.3 | 0 | 1.5 | 0 | 1.5 | 0.4 | 0 | 3 | 15% | 0% | 0% | 0% | 1% | 0% |
| 0.8 | 1 | 9 | 1.3 | 0 | 1.5 | 0 | 1.5 | 0.4 | 0 | 3 | 19% | 0% | 0% | 0% | 1% | 0% |
| 0.8 | 1 | 11 | 1.3 | 0 | 1.5 | 0 | 1.5 | 0.4 | 0 | 3 | 21% | 0% | 0% | 0% | 1% | 0% |
| 0.92 | 1.01 | 4 | 0.19 | 0 | 3.09 | 0 | 0.48 | 0.26 | 2 | 3 | 16% | 0% | 0% | 0% | 1% | 0% |
| 0.92 | 1.01 | 6 | 0.19 | 0 | 3.09 | 0 | 0.48 | 0.26 | 2 | 3 | 21% | 0% | 0% | 0% | 1% | 0% |
| 0.92 | 1.01 | 8 | 0.19 | 0 | 3.09 | 0 | 0.48 | 0.26 | 2 | 3 | 16% | 0% | 0% | 0% | 1% | 0% |
| 0.92 | 1.01 | 10 | 0.19 | 0 | 3.09 | 0 | 0.48 | 0.26 | 2 | 3 | 21% | 0% | 0% | 0% | 1% | 8% |
| 0.8 | 1 | 0 | 1.3 | 0 | 1.5 | 0 | 1.5 | 0.4 | 2 | 3 | 15% | 0% | 0% | 0% | 1% | 0% |
| 0.8 | 1 | 2 | 1.3 | 0 | 1.5 | 0 | 1.5 | 0.4 | 2 | 3 | 15% | 0% | 0% | 0% | 1% | 0% |
| 0.8 | 1 | 4 | 1.3 | 0 | 1.5 | 0 | 1.5 | 0.4 | 2 | 3 | 15% | 0% | 0% | 0% | 1% | 0% |
| 0.8 | 1 | 6 | 1.3 | 0 | 1.5 | 0 | 1.5 | 0.4 | 2 | 3 | 16% | 0% | 0% | 0% | 1% | 0% |
| 0.8 | 1 | 8 | 1.3 | 0 | 1.5 | 0 | 1.5 | 0.4 | 2 | 3 | 14% | 0% | 0% | 0% | 1% | 2% |
| 0.8 | 1 | 10 | 1.3 | 0 | 1.5 | 0 | 1.5 | 0.4 | 2 | 3 | 16% | 0% | 0% | 0% | 1% | 9% |
| 1.5 | 0.5 | 5 | 0 | 0 | 2 | 0 | 0 | 0 | 0 | 4 | 24% | 0% | 0% | 0% | 0% | 0% |
| 2.5 | 0.5 | 5 | 0 | 0 | 2 | 0 | 0 | 0 | 0 | 4 | 38% | 0% | 0% | 0% | 0% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 3 | 0.5 | 5 | 0 | 0 | 2 | 0 | 0 | 0 | 0 | 4 | 44% | 0% | 0% | 0% | 0% | 0% |
| 1 | 0.5 | 7 | 0 | 0 | 2 | 0 | 0 | 0 | 0 | 4 | 17% | 0% | 0% | 0% | 0% | 0% |
| 2 | 0.5 | 7 | 0 | 0 | 2 | 0 | 0 | 0 | 0 | 4 | 31% | 3% | 0% | 0% | 0% | 0% |
| 1.5 | 0.5 | 9 | 0 | 0 | 2 | 0 | 0 | 0 | 0 | 4 | 24% | 2% | 0% | 0% | 0% | 0% |
| 1.5 | 0.5 | 13 | 0 | 0 | 2 | 0 | 0 | 0 | 0 | 4 | 24% | 3% | 0% | 0% | 0% | 10% |
| 0.8 | 1 | 1 | 1.3 | 0 | 1.5 | 0 | 1.5 | 0.4 | 0 | 4 | 14% | 0% | 0% | 0% | 1% | 0% |
| 0.8 | 1 | 3 | 1.3 | 0 | 1.5 | 0 | 1.5 | 0.4 | 0 | 4 | 14% | 0% | 0% | 0% | 1% | 0% |
| 0.8 | 1 | 5 | 1.3 | 0 | 1.5 | 0 | 1.5 | 0.4 | 0 | 4 | 14% | 0% | 0% | 0% | 1% | 0% |
| 0.8 | 1 | 7 | 1.3 | 0 | 1.5 | 0 | 1.5 | 0.4 | 0 | 4 | 16% | 0% | 0% | 0% | 1% | 0% |
| 0.8 | 1 | 9 | 1.3 | 0 | 1.5 | 0 | 1.5 | 0.4 | 0 | 4 | 19% | 0% | 0% | 0% | 1% | 0% |
| 0.8 | 1 | 11 | 1.3 | 0 | 1.5 | 0 | 1.5 | 0.4 | 0 | 4 | 22% | 0% | 0% | 0% | 1% | 0% |
| 1.1 | 0.5 | 5 | 0 | 0 | 0 | 0 | 0 | 2 | 0 | 4 | 12% | 0% | 0% | 0% | 1% | 0% |
| 1.3 | 0.5 | 5 | 0 | 0 | 0 | 0 | 0 | 2 | 0 | 4 | 13% | 0% | 0% | 0% | 1% | 0% |
| 1.5 | 0.5 | 5 | 0 | 0 | 0 | 0 | 0 | 2 | 0 | 4 | 15% | 0% | 0% | 0% | 1% | 0% |
| 1.9 | 0.5 | 5 | 0 | 0 | 0 | 0 | 0 | 2 | 0 | 4 | 20% | 0% | 0% | 0% | 1% | 0% |
| 0.7 | 0.7 | 5 | 0 | 0 | 0 | 0 | 0 | 2 | 0 | 4 | 11% | 0% | 0% | 0% | 1% | 0% |
| 1.1 | 0.7 | 5 | 0 | 0 | 0 | 0 | 0 | 2 | 0 | 4 | 13% | 0% | 0% | 0% | 1% | 0% |
| 1.3 | 0.7 | 5 | 0 | 0 | 0 | 0 | 0 | 2 | 0 | 4 | 15% | 0% | 0% | 0% | 1% | 0% |
| 1.5 | 0.7 | 5 | 0 | 0 | 0 | 0 | 0 | 2 | 0 | 4 | 16% | 0% | 0% | 0% | 1% | 0% |
| 1.9 | 0.7 | 5 | 0 | 0 | 0 | 0 | 0 | 2 | 0 | 4 | 20% | 0% | 0% | 0% | 1% | 0% |
| 0.7 | 0.9 | 5 | 0 | 0 | 0 | 0 | 0 | 2 | 0 | 4 | 12% | 0% | 0% | 0% | 1% | 0% |
| 1.1 | 0.9 | 5 | 0 | 0 | 0 | 0 | 0 | 2 | 0 | 4 | 15% | 0% | 0% | 0% | 1% | 0% |
| 1.3 | 0.9 | 5 | 0 | 0 | 0 | 0 | 0 | 2 | 0 | 4 | 16% | 0% | 0% | 0% | 1% | 0% |
| 1.5 | 0.9 | 5 | 0 | 0 | 0 | 0 | 0 | 2 | 0 | 4 | 17% | 0% | 0% | 0% | 1% | 0% |
| 1.9 | 0.9 | 5 | 0 | 0 | 0 | 0 | 0 | 2 | 0 | 4 | 20% | 0% | 0% | 0% | 1% | 0% |
| 0.7 | 1.1 | 5 | 0 | 0 | 0 | 0 | 0 | 2 | 0 | 4 | 13% | 0% | 0% | 0% | 1% | 0% |
| 1.1 | 1.1 | 5 | 0 | 0 | 0 | 0 | 0 | 2 | 0 | 4 | 15% | 0% | 0% | 0% | 1% | 0% |
| 1.3 | 1.1 | 5 | 0 | 0 | 0 | 0 | 0 | 2 | 0 | 4 | 16% | 0% | 0% | 0% | 1% | 0% |
| 1.5 | 1.1 | 5 | 0 | 0 | 0 | 0 | 0 | 2 | 0 | 4 | 17% | 0% | 0% | 0% | 1% | 0% |
| 1.9 | 1.1 | 5 | 0 | 0 | 0 | 0 | 0 | 2 | 0 | 4 | 24% | 0% | 0% | 0% | 1% | 0% |
| 0.7 | 1.3 | 5 | 0 | 0 | 0 | 0 | 0 | 2 | 0 | 4 | 14% | 0% | 0% | 0% | 1% | 0% |
| 0.5 | 1.5 | 5 | 0 | 0 | 0 | 0 | 0 | 2 | 0 | 4 | 13% | 0% | 0% | 0% | 1% | 0% |
| 1.7 | 0.5 | 10 | 0 | 0 | 0 | 0 | 0 | 2 | 0 | 4 | 24% | 0% | 0% | 0% | 1% | 0% |
| 0.9 | 0.7 | 10 | 0 | 0 | 0 | 0 | 0 | 2 | 0 | 4 | 18% | 0% | 0% | 0% | 1% | 0% |
| 1.3 | 0.7 | 10 | 0 | 0 | 0 | 0 | 0 | 2 | 0 | 4 | 22% | 0% | 0% | 0% | 1% | 0% |
| 1.5 | 0.7 | 10 | 0 | 0 | 0 | 0 | 0 | 2 | 0 | 4 | 24% | 0% | 0% | 0% | 1% | 0% |
| 1.7 | 0.7 | 10 | 0 | 0 | 0 | 0 | 0 | 2 | 0 | 4 | 26% | 0% | 0% | 0% | 1% | 0% |
| 0.5 | 0.9 | 10 | 0 | 0 | 0 | 0 | 0 | 2 | 0 | 4 | 14% | 0% | 0% | 0% | 1% | 0% |
| 0.9 | 0.9 | 10 | 0 | 0 | 0 | 0 | 0 | 2 | 0 | 4 | 19% | 0% | 0% | 0% | 1% | 0% |
| 1.3 | 0.9 | 10 | 0 | 0 | 0 | 0 | 0 | 2 | 0 | 4 | 24% | 0% | 0% | 0% | 1% | 0% |
| 1.5 | 0.9 | 10 | 0 | 0 | 0 | 0 | 0 | 2 | 0 | 4 | 26% | 0% | 0% | 0% | 1% | 0% |
| 1.7 | 0.9 | 10 | 0 | 0 | 0 | 0 | 0 | 2 | 0 | 4 | 28% | 0% | 0% | 0% | 1% | 0% |
| 0.5 | 1.1 | 10 | 0 | 0 | 0 | 0 | 0 | 2 | 0 | 4 | 16% | 0% | 0% | 0% | 1% | 0% |
| 0.9 | 1.1 | 10 | 0 | 0 | 0 | 0 | 0 | 2 | 0 | 4 | 20% | 0% | 0% | 0% | 1% | 0% |
| 1.3 | 1.1 | 10 | 0 | 0 | 0 | 0 | 0 | 2 | 0 | 4 | 24% | 0% | 0% | 0% | 1% | 0% |
| 1.5 | 1.1 | 10 | 0 | 0 | 0 | 0 | 0 | 2 | 0 | 4 | 27% | 0% | 0% | 0% | 1% | 0% |
| 1.7 | 1.1 | 10 | 0 | 0 | 0 | 0 | 0 | 2 | 0 | 4 | 29% | 0% | 0% | 0% | 1% | 0% |
| 0.7 | 1.3 | 10 | 0 | 0 | 0 | 0 | 0 | 2 | 0 | 4 | 21% | 0% | 0% | 0% | 1% | 0% |
| 1.1 | 1.3 | 10 | 0 | 0 | 0 | 0 | 0 | 2 | 0 | 4 | 24% | 0% | 0% | 0% | 1% | 0% |
| 1.3 | 1.3 | 10 | 0 | 0 | 0 | 0 | 0 | 2 | 0 | 4 | 25% | 0% | 0% | 0% | 1% | 0% |
| 1.5 | 1.3 | 10 | 0 | 0 | 0 | 0 | 0 | 2 | 0 | 4 | 27% | 0% | 0% | 0% | 1% | 0% |
| 0.9 | 1.5 | 10 | 0 | 0 | 0 | 0 | 0 | 2 | 0 | 4 | 25% | 0% | 0% | 0% | 1% | 0% |
| 1.1 | 1.5 | 10 | 0 | 0 | 0 | 0 | 0 | 2 | 0 | 4 | 26% | 0% | 0% | 0% | 1% | 0% |
| 1.3 | 1.5 | 10 | 0 | 0 | 0 | 0 | 0 | 2 | 0 | 4 | 28% | 0% | 0% | 0% | 2% | 0% |
| 1.5 | 1.5 | 10 | 0 | 0 | 0 | 0 | 0 | 2 | 0 | 4 | 29% | 0% | 0% | 0% | 2% | 0% |
| 1.5 | 0.7 | 15 | 0 | 0 | 0 | 0 | 0 | 2 | 0 | 4 | 27% | 0% | 0% | 0% | 1% | 4% |
| 1.7 | 0.7 | 15 | 0 | 0 | 0 | 0 | 0 | 2 | 0 | 4 | 29% | 0% | 0% | 0% | 1% | 0% |
| 0.9 | 0.9 | 15 | 0 | 0 | 0 | 0 | 0 | 2 | 0 | 4 | 22% | 0% | 0% | 0% | 1% | 4% |
| 1.3 | 0.9 | 15 | 0 | 0 | 0 | 0 | 0 | 2 | 0 | 4 | 26% | 0% | 0% | 0% | 1% | 0% |
| 1.5 | 0.9 | 15 | 0 | 0 | 0 | 0 | 0 | 2 | 0 | 4 | 28% | 0% | 0% | 0% | 1% | 0% |
| 1.7 | 0.9 | 15 | 0 | 0 | 0 | 0 | 0 | 2 | 0 | 4 | 30% | 0% | 0% | 0% | 1% | 0% |
| 0.5 | 1.1 | 15 | 0 | 0 | 0 | 0 | 0 | 2 | 0 | 4 | 20% | 0% | 0% | 0% | 1% | 4% |
| 0.9 | 1.1 | 15 | 0 | 0 | 0 | 0 | 0 | 2 | 0 | 4 | 25% | 0% | 0% | 0% | 1% | 0% |
| 1.3 | 1.1 | 15 | 0 | 0 | 0 | 0 | 0 | 2 | 0 | 4 | 29% | 0% | 0% | 0% | 1% | 0% |
| 1.5 | 1.1 | 15 | 0 | 0 | 0 | 0 | 0 | 2 | 0 | 4 | 31% | 0% | 0% | 0% | 1% | 0% |
| 1.7 | 1.1 | 15 | 0 | 0 | 0 | 0 | 0 | 2 | 0 | 4 | 33% | 0% | 0% | 0% | 1% | 0% |
| 1.9 | 1.3 | 15 | 0 | 0 | 0 | 0 | 0 | 2 | 0 | 4 | 37% | 0% | 0% | 0% | 1% | 0% |
| 1.9 | 0.9 | 20 | 0 | 0 | 0 | 0 | 0 | 2 | 0 | 4 | 36% | 2% | 0% | 0% | 1% | 0% |
| 1.5 | 0.5 | 5 | 0 | 0 | 0 | 0 | 0 | 4 | 0 | 4 | 14% | 0% | 0% | 0% | 1% | 10% |
| 1.9 | 0.5 | 5 | 0 | 0 | 0 | 0 | 0 | 4 | 0 | 4 | 17% | 0% | 0% | 0% | 1% | 1% |
| 1.3 | 0.7 | 5 | 0 | 0 | 0 | 0 | 0 | 4 | 0 | 4 | 14% | 0% | 0% | 0% | 1% | 0% |
| 1.5 | 0.7 | 5 | 0 | 0 | 0 | 0 | 0 | 4 | 0 | 4 | 16% | 0% | 0% | 0% | 1% | 0% |
| 1.7 | 0.7 | 5 | 0 | 0 | 0 | 0 | 0 | 4 | 0 | 4 | 18% | 0% | 0% | 0% | 1% | 0% |
| 0.7 | 0.9 | 5 | 0 | 0 | 0 | 0 | 0 | 4 | 0 | 4 | 12% | 0% | 0% | 0% | 1% | 10% |
| 1.1 | 0.9 | 5 | 0 | 0 | 0 | 0 | 0 | 4 | 0 | 4 | 15% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.3 | 0.9 | 5 | 0 | 0 | 0 | 0 | 0 | 4 | 0 | 4 | 16% | 0% | 0% | 0% | 1% | 0% |
| 1.5 | 0.9 | 5 | 0 | 0 | 0 | 0 | 0 | 4 | 0 | 4 | 18% | 0% | 0% | 0% | 1% | 0% |
| 1.9 | 0.9 | 5 | 0 | 0 | 0 | 0 | 0 | 4 | 0 | 4 | 17% | 0% | 0% | 0% | 1% | 0% |
| 0.7 | 1.1 | 5 | 0 | 0 | 0 | 0 | 0 | 4 | 0 | 4 | 14% | 0% | 0% | 0% | 1% | 0% |
| 1.1 | 1.1 | 5 | 0 | 0 | 0 | 0 | 0 | 4 | 0 | 4 | 17% | 0% | 0% | 0% | 1% | 0% |
| 1.3 | 1.1 | 5 | 0 | 0 | 0 | 0 | 0 | 4 | 0 | 4 | 18% | 0% | 0% | 0% | 1% | 0% |
| 1.5 | 1.1 | 5 | 0 | 0 | 0 | 0 | 0 | 4 | 0 | 4 | 19% | 0% | 0% | 0% | 1% | 0% |
| 1.9 | 1.1 | 5 | 0 | 0 | 0 | 0 | 0 | 4 | 0 | 4 | 21% | 0% | 0% | 0% | 1% | 0% |
| 0.7 | 1.3 | 5 | 0 | 0 | 0 | 0 | 0 | 4 | 0 | 4 | 15% | 0% | 0% | 0% | 1% | 0% |
| 1.1 | 1.3 | 5 | 0 | 0 | 0 | 0 | 0 | 4 | 0 | 4 | 18% | 0% | 0% | 0% | 1% | 0% |
| 1.3 | 1.3 | 5 | 0 | 0 | 0 | 0 | 0 | 4 | 0 | 4 | 13% | 0% | 0% | 0% | 1% | 0% |
| 1.5 | 1.3 | 5 | 0 | 0 | 0 | 0 | 0 | 4 | 0 | 4 | 14% | 0% | 0% | 0% | 1% | 0% |
| 1.9 | 1.3 | 5 | 0 | 0 | 0 | 0 | 0 | 4 | 0 | 4 | 22% | 0% | 0% | 0% | 1% | 0% |
| 0.7 | 1.5 | 5 | 0 | 0 | 0 | 0 | 0 | 4 | 0 | 4 | 17% | 0% | 0% | 0% | 1% | 0% |
| 1.1 | 1.5 | 5 | 0 | 0 | 0 | 0 | 0 | 4 | 0 | 4 | 19% | 0% | 0% | 0% | 1% | 0% |
| 1.3 | 1.5 | 5 | 0 | 0 | 0 | 0 | 0 | 4 | 0 | 4 | 20% | 0% | 0% | 0% | 1% | 0% |
| 1.5 | 1.5 | 5 | 0 | 0 | 0 | 0 | 0 | 4 | 0 | 4 | 21% | 0% | 0% | 0% | 1% | 0% |
| 0.5 | 1.7 | 5 | 0 | 0 | 0 | 0 | 0 | 4 | 0 | 4 | 17% | 0% | 0% | 0% | 1% | 0% |
| 0.9 | 1.7 | 5 | 0 | 0 | 0 | 0 | 0 | 4 | 0 | 4 | 10% | 0% | 0% | 0% | 1% | 0% |
| 1.1 | 1.7 | 5 | 0 | 0 | 0 | 0 | 0 | 4 | 0 | 4 | 19% | 0% | 0% | 0% | 1% | 0% |
| 0.7 | 1.9 | 5 | 0 | 0 | 0 | 0 | 0 | 4 | 0 | 4 | 8% | 0% | 0% | 0% | 1% | 0% |
| 1.7 | 0.7 | 10 | 0 | 0 | 0 | 0 | 0 | 4 | 0 | 4 | 23% | 0% | 0% | 0% | 1% | 6% |
| 1.3 | 0.9 | 10 | 0 | 0 | 0 | 0 | 0 | 4 | 0 | 4 | 22% | 0% | 0% | 0% | 1% | 4% |
| 1.5 | 0.9 | 10 | 0 | 0 | 0 | 0 | 0 | 4 | 0 | 4 | 24% | 0% | 0% | 0% | 1% | 0% |
| 1.7 | 0.9 | 10 | 0 | 0 | 0 | 0 | 0 | 4 | 0 | 4 | 26% | 0% | 0% | 0% | 1% | 0% |
| 0.9 | 1.1 | 10 | 0 | 0 | 0 | 0 | 0 | 4 | 0 | 4 | 21% | 0% | 0% | 0% | 1% | 2% |
| 1.3 | 1.1 | 10 | 0 | 0 | 0 | 0 | 0 | 4 | 0 | 4 | 25% | 0% | 0% | 0% | 1% | 0% |
| 1.5 | 1.1 | 10 | 0 | 0 | 0 | 0 | 0 | 4 | 0 | 4 | 27% | 0% | 0% | 0% | 1% | 0% |
| 1.7 | 1.1 | 10 | 0 | 0 | 0 | 0 | 0 | 4 | 0 | 4 | 28% | 0% | 0% | 0% | 1% | 0% |
| 0.5 | 1.3 | 10 | 0 | 0 | 0 | 0 | 0 | 4 | 0 | 4 | 18% | 0% | 0% | 0% | 1% | 1% |
| 0.9 | 1.3 | 10 | 0 | 0 | 0 | 0 | 0 | 4 | 0 | 4 | 23% | 0% | 0% | 0% | 1% | 0% |
| 1.3 | 1.3 | 10 | 0 | 0 | 0 | 0 | 0 | 4 | 0 | 4 | 27% | 0% | 0% | 0% | 1% | 0% |
| 1.5 | 1.3 | 10 | 0 | 0 | 0 | 0 | 0 | 4 | 0 | 4 | 29% | 0% | 0% | 0% | 1% | 0% |
| 1.7 | 1.3 | 10 | 0 | 0 | 0 | 0 | 0 | 4 | 0 | 4 | 30% | 0% | 0% | 0% | 1% | 0% |
| 0.5 | 1.5 | 10 | 0 | 0 | 0 | 0 | 0 | 4 | 0 | 4 | 18% | 0% | 0% | 0% | 1% | 0% |
| 0.9 | 1.5 | 10 | 0 | 0 | 0 | 0 | 0 | 4 | 0 | 4 | 24% | 0% | 0% | 0% | 1% | 0% |
| 1.1 | 1.5 | 10 | 0 | 0 | 0 | 0 | 0 | 4 | 0 | 4 | 26% | 0% | 0% | 0% | 1% | 0% |
| 1.3 | 1.5 | 10 | 0 | 0 | 0 | 0 | 0 | 4 | 0 | 4 | 29% | 0% | 0% | 0% | 1% | 0% |
| 1.5 | 1.5 | 10 | 0 | 0 | 0 | 0 | 0 | 4 | 0 | 4 | 31% | 0% | 0% | 0% | 1% | 0% |
| 1.9 | 1.5 | 10 | 0 | 0 | 0 | 0 | 0 | 4 | 0 | 4 | 33% | 0% | 0% | 0% | 1% | 0% |
| 0.7 | 1.7 | 10 | 0 | 0 | 0 | 0 | 0 | 4 | 0 | 4 | 22% | 0% | 0% | 0% | 1% | 0% |
| 1.1 | 1.7 | 10 | 0 | 0 | 0 | 0 | 0 | 4 | 0 | 4 | 27% | 0% | 0% | 0% | 1% | 0% |
| 1.3 | 1.7 | 10 | 0 | 0 | 0 | 0 | 0 | 4 | 0 | 4 | 29% | 0% | 0% | 0% | 1% | 0% |
| 1.5 | 1.7 | 10 | 0 | 0 | 0 | 0 | 0 | 4 | 0 | 4 | 32% | 0% | 0% | 0% | 1% | 0% |
| 1.7 | 1.7 | 10 | 0 | 0 | 0 | 0 | 0 | 4 | 0 | 4 | 33% | 0% | 0% | 0% | 2% | 0% |
| 0.5 | 1.9 | 10 | 0 | 0 | 0 | 0 | 0 | 4 | 0 | 4 | 23% | 0% | 0% | 0% | 1% | 0% |
| 0.9 | 1.9 | 10 | 0 | 0 | 0 | 0 | 0 | 4 | 0 | 4 | 26% | 0% | 0% | 0% | 1% | 0% |
| 1.1 | 1.9 | 10 | 0 | 0 | 0 | 0 | 0 | 4 | 0 | 4 | 27% | 0% | 0% | 0% | 1% | 0% |
| 1.3 | 1.9 | 10 | 0 | 0 | 0 | 0 | 0 | 4 | 0 | 4 | 30% | 0% | 0% | 0% | 2% | 0% |
| 1.7 | 1.9 | 10 | 0 | 0 | 0 | 0 | 0 | 4 | 0 | 4 | 34% | 0% | 0% | 0% | 2% | 0% |
| 1.9 | 0.9 | 15 | 0 | 0 | 0 | 0 | 0 | 4 | 0 | 4 | 31% | 0% | 0% | 0% | 1% | 1% |
| 1.5 | 1.1 | 15 | 0 | 0 | 0 | 0 | 0 | 4 | 0 | 4 | 30% | 0% | 0% | 0% | 1% | 1% |
| 1.9 | 1.1 | 15 | 0 | 0 | 0 | 0 | 0 | 4 | 0 | 4 | 34% | 0% | 0% | 0% | 1% | 0% |
| 1.1 | 1.3 | 15 | 0 | 0 | 0 | 0 | 0 | 4 | 0 | 4 | 26% | 0% | 0% | 0% | 1% | 1% |
| 1.3 | 1.3 | 15 | 0 | 0 | 0 | 0 | 0 | 4 | 0 | 4 | 28% | 0% | 0% | 0% | 1% | 0% |
| 1.5 | 1.3 | 15 | 0 | 0 | 0 | 0 | 0 | 4 | 0 | 4 | 31% | 0% | 0% | 0% | 1% | 0% |
| 1.9 | 1.3 | 15 | 0 | 0 | 0 | 0 | 0 | 4 | 0 | 4 | 36% | 0% | 0% | 0% | 1% | 0% |
| 0.9 | 1.5 | 15 | 0 | 0 | 0 | 0 | 0 | 4 | 0 | 4 | 27% | 0% | 0% | 0% | 1% | 0% |
| 1.1 | 1.5 | 15 | 0 | 0 | 0 | 0 | 0 | 4 | 0 | 4 | 29% | 0% | 0% | 0% | 1% | 0% |
| 1.3 | 1.5 | 15 | 0 | 0 | 0 | 0 | 0 | 4 | 0 | 4 | 31% | 0% | 0% | 0% | 1% | 0% |
| 1.5 | 1.5 | 15 | 0 | 0 | 0 | 0 | 0 | 4 | 0 | 4 | 33% | 0% | 0% | 0% | 1% | 0% |
| 1.9 | 1.5 | 15 | 0 | 0 | 0 | 0 | 0 | 4 | 0 | 4 | 37% | 0% | 0% | 0% | 1% | 0% |
| 0.7 | 1.7 | 15 | 0 | 0 | 0 | 0 | 0 | 4 | 0 | 4 | 27% | 0% | 0% | 0% | 1% | 0% |
| 1.1 | 1.7 | 15 | 0 | 0 | 0 | 0 | 0 | 4 | 0 | 4 | 31% | 0% | 0% | 0% | 1% | 0% |
| 1.3 | 1.7 | 15 | 0 | 0 | 0 | 0 | 0 | 4 | 0 | 4 | 33% | 0% | 0% | 0% | 1% | 0% |
| 1.5 | 1.7 | 15 | 0 | 0 | 0 | 0 | 0 | 4 | 0 | 4 | 35% | 0% | 0% | 0% | 1% | 0% |
| 1.7 | 1.7 | 15 | 0 | 0 | 0 | 0 | 0 | 4 | 0 | 4 | 37% | 0% | 0% | 0% | 1% | 0% |
| 1.7 | 1.9 | 15 | 0 | 0 | 0 | 0 | 0 | 4 | 0 | 4 | 39% | 0% | 0% | 0% | 2% | 0% |
| 1.9 | 1.3 | 20 | 0 | 0 | 0 | 0 | 0 | 4 | 0 | 4 | 37% | 0% | 0% | 0% | 1% | 5% |
| 1.5 | 1.5 | 20 | 0 | 0 | 0 | 0 | 0 | 4 | 0 | 4 | 36% | 0% | 0% | 0% | 1% | 0% |
| 1.9 | 1.5 | 20 | 0 | 0 | 0 | 0 | 0 | 4 | 0 | 4 | 40% | 0% | 0% | 0% | 1% | 0% |
| 2.6 | 0.2 | 5 | 0 | 0 | 0 | 0 | 0 | 6 | 0 | 4 | 31% | 0% | 0% | 0% | 0% | 0% |
| 3 | 0.2 | 5 | 0 | 0 | 0 | 0 | 0 | 6 | 0 | 4 | 37% | 0% | 0% | 0% | 0% | 0% |
| 3.4 | 0.2 | 5 | 0 | 0 | 0 | 0 | 0 | 6 | 0 | 4 | 42% | 1% | 0% | 0% | 0% | 0% |
| 3.8 | 0.2 | 5 | 0 | 0 | 0 | 0 | 0 | 6 | 0 | 4 | 46% | 3% | 0% | 0% | 0% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 2.2 | 0.4 | 5 | 0 | 0 | 0 | 0 | 0 | 6 | 0 | 4 | 29% | 0% | 0% | 0% | 0% | 3% |
| 2.6 | 0.4 | 5 | 0 | 0 | 0 | 0 | 0 | 6 | 0 | 4 | 34% | 0% | 0% | 0% | 0% | 0% |
| 3 | 0.4 | 5 | 0 | 0 | 0 | 0 | 0 | 6 | 0 | 4 | 40% | 1% | 0% | 0% | 0% | 0% |
| 3.4 | 0.4 | 5 | 0 | 0 | 0 | 0 | 0 | 6 | 0 | 4 | 44% | 2% | 0% | 0% | 0% | 0% |
| 3.8 | 0.4 | 5 | 0 | 0 | 0 | 0 | 0 | 6 | 0 | 4 | 49% | 2% | 0% | 0% | 0% | 0% |
| 2.2 | 0.6 | 5 | 0 | 0 | 0 | 0 | 0 | 6 | 0 | 4 | 32% | 0% | 0% | 0% | 0% | 0% |
| 2.6 | 0.6 | 5 | 0 | 0 | 0 | 0 | 0 | 6 | 0 | 4 | 37% | 0% | 0% | 0% | 0% | 0% |
| 3 | 0.6 | 5 | 0 | 0 | 0 | 0 | 0 | 6 | 0 | 4 | 42% | 1% | 0% | 0% | 0% | 0% |
| 3.4 | 0.6 | 5 | 0 | 0 | 0 | 0 | 0 | 6 | 0 | 4 | 47% | 2% | 0% | 0% | 0% | 0% |
| 2 | 0.8 | 5 | 0 | 0 | 0 | 0 | 0 | 6 | 0 | 4 | 32% | 0% | 0% | 0% | 0% | 0% |
| 2.4 | 0.8 | 5 | 0 | 0 | 0 | 0 | 0 | 6 | 0 | 4 | 38% | 0% | 0% | 0% | 0% | 0% |
| 2.8 | 0.8 | 5 | 0 | 0 | 0 | 0 | 0 | 6 | 0 | 4 | 42% | 1% | 0% | 0% | 0% | 0% |
| 3.2 | 0.8 | 5 | 0 | 0 | 0 | 0 | 0 | 6 | 0 | 4 | 47% | 2% | 0% | 0% | 0% | 0% |
| 1.7 | 0.9 | 5 | 0 | 0 | 0 | 0 | 0 | 6 | 0 | 4 | 18% | 0% | 0% | 0% | 1% | 0% |
| 1.4 | 1 | 5 | 0 | 0 | 0 | 0 | 0 | 6 | 0 | 4 | 27% | 0% | 0% | 0% | 0% | 6% |
| 1.8 | 1 | 5 | 0 | 0 | 0 | 0 | 0 | 6 | 0 | 4 | 32% | 0% | 0% | 0% | 0% | 0% |
| 2.2 | 1 | 5 | 0 | 0 | 0 | 0 | 0 | 6 | 0 | 4 | 38% | 0% | 0% | 0% | 0% | 0% |
| 2.6 | 1 | 5 | 0 | 0 | 0 | 0 | 0 | 6 | 0 | 4 | 43% | 1% | 0% | 0% | 0% | 0% |
| 3 | 1 | 5 | 0 | 0 | 0 | 0 | 0 | 6 | 0 | 4 | 47% | 1% | 0% | 0% | 0% | 0% |
| 1.3 | 1.1 | 5 | 0 | 0 | 0 | 0 | 0 | 6 | 0 | 4 | 17% | 0% | 0% | 0% | 1% | 0% |
| 1.5 | 1.1 | 5 | 0 | 0 | 0 | 0 | 0 | 6 | 0 | 4 | 19% | 0% | 0% | 0% | 1% | 0% |
| 1.7 | 1.1 | 5 | 0 | 0 | 0 | 0 | 0 | 6 | 0 | 4 | 20% | 0% | 0% | 0% | 1% | 0% |
| 1 | 1.2 | 5 | 0 | 0 | 0 | 0 | 0 | 6 | 0 | 4 | 25% | 0% | 0% | 0% | 0% | 7% |
| 1.4 | 1.2 | 5 | 0 | 0 | 0 | 0 | 0 | 6 | 0 | 4 | 30% | 0% | 0% | 0% | 0% | 0% |
| 1.8 | 1.2 | 5 | 0 | 0 | 0 | 0 | 0 | 6 | 0 | 4 | 36% | 0% | 0% | 0% | 0% | 0% |
| 2.2 | 1.2 | 5 | 0 | 0 | 0 | 0 | 0 | 6 | 0 | 4 | 41% | 0% | 0% | 0% | 0% | 0% |
| 2.6 | 1.2 | 5 | 0 | 0 | 0 | 0 | 0 | 6 | 0 | 4 | 45% | 1% | 0% | 0% | 0% | 0% |
| 3 | 1.2 | 5 | 0 | 0 | 0 | 0 | 0 | 6 | 0 | 4 | 50% | 1% | 0% | 0% | 0% | 0% |
| 1.1 | 1.3 | 5 | 0 | 0 | 0 | 0 | 0 | 6 | 0 | 4 | 18% | 0% | 0% | 0% | 1% | 0% |
| 1.3 | 1.3 | 5 | 0 | 0 | 0 | 0 | 0 | 6 | 0 | 4 | 19% | 0% | 0% | 0% | 1% | 0% |
| 1.5 | 1.3 | 5 | 0 | 0 | 0 | 0 | 0 | 6 | 0 | 4 | 21% | 0% | 0% | 0% | 1% | 0% |
| 1.9 | 1.3 | 5 | 0 | 0 | 0 | 0 | 0 | 6 | 0 | 4 | 23% | 0% | 0% | 0% | 1% | 0% |
| 1.2 | 1.4 | 5 | 0 | 0 | 0 | 0 | 0 | 6 | 0 | 4 | 29% | 0% | 0% | 0% | 0% | 0% |
| 1.6 | 1.4 | 5 | 0 | 0 | 0 | 0 | 0 | 6 | 0 | 4 | 35% | 0% | 0% | 0% | 0% | 0% |
| 2 | 1.4 | 5 | 0 | 0 | 0 | 0 | 0 | 6 | 0 | 4 | 40% | 0% | 0% | 0% | 0% | 0% |
| 2.4 | 1.4 | 5 | 0 | 0 | 0 | 0 | 0 | 6 | 0 | 4 | 45% | 0% | 0% | 0% | 0% | 0% |
| 2.8 | 1.4 | 5 | 0 | 0 | 0 | 0 | 0 | 6 | 0 | 4 | 49% | 1% | 0% | 0% | 0% | 0% |
| 0.7 | 1.5 | 5 | 0 | 0 | 0 | 0 | 0 | 6 | 0 | 4 | 17% | 0% | 0% | 0% | 1% | 0% |
| 1.1 | 1.5 | 5 | 0 | 0 | 0 | 0 | 0 | 6 | 0 | 4 | 20% | 0% | 0% | 0% | 1% | 0% |
| 1.3 | 1.5 | 5 | 0 | 0 | 0 | 0 | 0 | 6 | 0 | 4 | 21% | 0% | 0% | 0% | 1% | 0% |
| 1.5 | 1.5 | 5 | 0 | 0 | 0 | 0 | 0 | 6 | 0 | 4 | 22% | 0% | 0% | 0% | 1% | 0% |
| 1.7 | 1.5 | 5 | 0 | 0 | 0 | 0 | 0 | 6 | 0 | 4 | 23% | 0% | 0% | 0% | 1% | 0% |
| 1 | 1.6 | 5 | 0 | 0 | 0 | 0 | 0 | 6 | 0 | 4 | 27% | 0% | 0% | 0% | 1% | 0% |
| 1.4 | 1.6 | 5 | 0 | 0 | 0 | 0 | 0 | 6 | 0 | 4 | 33% | 0% | 0% | 0% | 1% | 0% |
| 1.8 | 1.6 | 5 | 0 | 0 | 0 | 0 | 0 | 6 | 0 | 4 | 38% | 0% | 0% | 0% | 0% | 0% |
| 2.2 | 1.6 | 5 | 0 | 0 | 0 | 0 | 0 | 6 | 0 | 4 | 42% | 0% | 0% | 0% | 0% | 0% |
| 2.6 | 1.6 | 5 | 0 | 0 | 0 | 0 | 0 | 6 | 0 | 4 | 47% | 1% | 0% | 0% | 1% | 0% |
| 0.5 | 1.7 | 5 | 0 | 0 | 0 | 0 | 0 | 6 | 0 | 4 | 17% | 0% | 0% | 0% | 1% | 0% |
| 0.9 | 1.7 | 5 | 0 | 0 | 0 | 0 | 0 | 6 | 0 | 4 | 20% | 0% | 0% | 0% | 1% | 0% |
| 1.1 | 1.7 | 5 | 0 | 0 | 0 | 0 | 0 | 6 | 0 | 4 | 21% | 0% | 0% | 0% | 1% | 0% |
| 1.3 | 1.7 | 5 | 0 | 0 | 0 | 0 | 0 | 6 | 0 | 4 | 22% | 0% | 0% | 0% | 1% | 0% |
| 1.5 | 1.7 | 5 | 0 | 0 | 0 | 0 | 0 | 6 | 0 | 4 | 23% | 0% | 0% | 0% | 1% | 0% |
| 1.9 | 1.7 | 5 | 0 | 0 | 0 | 0 | 0 | 6 | 0 | 4 | 17% | 0% | 0% | 0% | 1% | 0% |
| 1.2 | 1.8 | 5 | 0 | 0 | 0 | 0 | 0 | 6 | 0 | 4 | 30% | 0% | 0% | 0% | 1% | 0% |
| 1.6 | 1.8 | 5 | 0 | 0 | 0 | 0 | 0 | 6 | 0 | 4 | 35% | 0% | 0% | 0% | 1% | 0% |
| 2 | 1.8 | 5 | 0 | 0 | 0 | 0 | 0 | 6 | 0 | 4 | 40% | 0% | 0% | 0% | 1% | 0% |
| 2.4 | 1.8 | 5 | 0 | 0 | 0 | 0 | 0 | 6 | 0 | 4 | 45% | 2% | 0% | 0% | 1% | 0% |
| 2.8 | 1.8 | 5 | 0 | 0 | 0 | 0 | 0 | 6 | 0 | 4 | 50% | 1% | 0% | 0% | 1% | 0% |
| 0.7 | 1.9 | 5 | 0 | 0 | 0 | 0 | 0 | 6 | 0 | 4 | 20% | 0% | 0% | 0% | 1% | 0% |
| 1.1 | 1.9 | 5 | 0 | 0 | 0 | 0 | 0 | 6 | 0 | 4 | 22% | 0% | 0% | 0% | 1% | 0% |
| 1.3 | 1.9 | 5 | 0 | 0 | 0 | 0 | 0 | 6 | 0 | 4 | 23% | 0% | 0% | 0% | 1% | 0% |
| 1.5 | 1.9 | 5 | 0 | 0 | 0 | 0 | 0 | 6 | 0 | 4 | 14% | 0% | 0% | 0% | 1% | 0% |
| 1 | 2 | 5 | 0 | 0 | 0 | 0 | 0 | 6 | 0 | 4 | 28% | 0% | 0% | 0% | 1% | 0% |
| 1.4 | 2 | 5 | 0 | 0 | 0 | 0 | 0 | 6 | 0 | 4 | 33% | 0% | 0% | 0% | 1% | 0% |
| 1.8 | 2 | 5 | 0 | 0 | 0 | 0 | 0 | 6 | 0 | 4 | 38% | 0% | 0% | 0% | 1% | 0% |
| 2.2 | 2 | 5 | 0 | 0 | 0 | 0 | 0 | 6 | 0 | 4 | 43% | 2% | 0% | 0% | 1% | 0% |
| 2.6 | 2 | 5 | 0 | 0 | 0 | 0 | 0 | 6 | 0 | 4 | 47% | 2% | 0% | 0% | 1% | 0% |
| 1 | 2.2 | 5 | 0 | 0 | 0 | 0 | 0 | 6 | 0 | 4 | 29% | 0% | 0% | 0% | 1% | 0% |
| 1.4 | 2.2 | 5 | 0 | 0 | 0 | 0 | 0 | 6 | 0 | 4 | 33% | 0% | 0% | 0% | 1% | 0% |
| 1.8 | 2.2 | 5 | 0 | 0 | 0 | 0 | 0 | 6 | 0 | 4 | 38% | 0% | 0% | 0% | 1% | 0% |
| 1 | 2.4 | 5 | 0 | 0 | 0 | 0 | 0 | 6 | 0 | 4 | 29% | 0% | 0% | 0% | 1% | 0% |
| 1.4 | 2.4 | 5 | 0 | 0 | 0 | 0 | 0 | 6 | 0 | 4 | 33% | 0% | 0% | 0% | 1% | 0% |
| 1.8 | 2.4 | 5 | 0 | 0 | 0 | 0 | 0 | 6 | 0 | 4 | 40% | 0% | 0% | 0% | 1% | 0% |
| 1.9 | 1.1 | 10 | 0 | 0 | 0 | 0 | 0 | 6 | 0 | 4 | 27% | 0% | 0% | 0% | 1% | 0% |
| 1.5 | 1.3 | 10 | 0 | 0 | 0 | 0 | 0 | 6 | 0 | 4 | 26% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.9 | 1.3 | 10 | 0 | 0 | 0 | 0 | 0 | 6 | 0 | 4 | 30% | 0% | 0% | 0% | 1% | 0% |
| 1.1 | 1.5 | 10 | 0 | 0 | 0 | 0 | 0 | 6 | 0 | 4 | 25% | 0% | 0% | 0% | 1% | 0% |
| 1.3 | 1.5 | 10 | 0 | 0 | 0 | 0 | 0 | 6 | 0 | 4 | 27% | 0% | 0% | 0% | 1% | 0% |
| 1.5 | 1.5 | 10 | 0 | 0 | 0 | 0 | 0 | 6 | 0 | 4 | 29% | 0% | 0% | 0% | 1% | 0% |
| 1.9 | 1.5 | 10 | 0 | 0 | 0 | 0 | 0 | 6 | 0 | 4 | 32% | 0% | 0% | 0% | 1% | 0% |
| 0.9 | 1.7 | 10 | 0 | 0 | 0 | 0 | 0 | 6 | 0 | 4 | 26% | 0% | 0% | 0% | 1% | 0% |
| 1.1 | 1.7 | 10 | 0 | 0 | 0 | 0 | 0 | 6 | 0 | 4 | 28% | 0% | 0% | 0% | 1% | 0% |
| 1.3 | 1.7 | 10 | 0 | 0 | 0 | 0 | 0 | 6 | 0 | 4 | 30% | 0% | 0% | 0% | 1% | 0% |
| 1.5 | 1.7 | 10 | 0 | 0 | 0 | 0 | 0 | 6 | 0 | 4 | 31% | 0% | 0% | 0% | 1% | 0% |
| 1.9 | 1.7 | 10 | 0 | 0 | 0 | 0 | 0 | 6 | 0 | 4 | 34% | 0% | 0% | 0% | 1% | 0% |
| 0.7 | 1.9 | 10 | 0 | 0 | 0 | 0 | 0 | 6 | 0 | 4 | 25% | 0% | 0% | 0% | 1% | 0% |
| 1.1 | 1.9 | 10 | 0 | 0 | 0 | 0 | 0 | 6 | 0 | 4 | 30% | 0% | 0% | 0% | 1% | 0% |
| 1.3 | 1.9 | 10 | 0 | 0 | 0 | 0 | 0 | 6 | 0 | 4 | 32% | 0% | 0% | 0% | 1% | 0% |
| 1.5 | 1.9 | 10 | 0 | 0 | 0 | 0 | 0 | 6 | 0 | 4 | 33% | 0% | 0% | 0% | 1% | 0% |
| 1.9 | 1.9 | 10 | 0 | 0 | 0 | 0 | 0 | 6 | 0 | 4 | 36% | 0% | 0% | 0% | 1% | 0% |
| 1.9 | 1.5 | 15 | 0 | 0 | 0 | 0 | 0 | 6 | 0 | 4 | 36% | 0% | 0% | 0% | 1% | 0% |
| 1.3 | 1.7 | 15 | 0 | 0 | 0 | 0 | 0 | 6 | 0 | 4 | 32% | 0% | 0% | 0% | 1% | 0% |
| 1.5 | 1.7 | 15 | 0 | 0 | 0 | 0 | 0 | 6 | 0 | 4 | 35% | 0% | 0% | 0% | 1% | 0% |
| 1.9 | 1.7 | 15 | 0 | 0 | 0 | 0 | 0 | 6 | 0 | 4 | 39% | 0% | 0% | 0% | 1% | 0% |
| 1.1 | 1.9 | 15 | 0 | 0 | 0 | 0 | 0 | 6 | 0 | 4 | 31% | 0% | 0% | 0% | 1% | 0% |
| 1.3 | 1.9 | 15 | 0 | 0 | 0 | 0 | 0 | 6 | 0 | 4 | 33% | 0% | 0% | 0% | 1% | 0% |
| 1.5 | 1.9 | 15 | 0 | 0 | 0 | 0 | 0 | 6 | 0 | 4 | 35% | 0% | 0% | 0% | 1% | 0% |
| 1.9 | 1.9 | 15 | 0 | 0 | 0 | 0 | 0 | 6 | 0 | 4 | 40% | 0% | 0% | 0% | 1% | 0% |
| 1.9 | 1.9 | 20 | 0 | 0 | 0 | 0 | 0 | 6 | 0 | 4 | 42% | 0% | 0% | 0% | 1% | 0% |
| 0.92 | 1.01 | 5 | 0.19 | 0 | 3.09 | 0 | 0.48 | 0.26 | 2 | 4 | 16% | 0% | 0% | 0% | 1% | 0% |
| 0.92 | 1.01 | 7 | 0.19 | 0 | 3.09 | 0 | 0.48 | 0.26 | 2 | 4 | 18% | 0% | 0% | 0% | 1% | 0% |
| 0.92 | 1.01 | 9 | 0.19 | 0 | 3.09 | 0 | 0.48 | 0.26 | 2 | 4 | 21% | 0% | 0% | 0% | 1% | 8% |
| 0.8 | 1 | 0 | 1.3 | 0 | 1.5 | 0 | 1.5 | 0.4 | 2 | 4 | 15% | 0% | 0% | 0% | 1% | 0% |
| 0.8 | 1 | 2 | 1.3 | 0 | 1.5 | 0 | 1.5 | 0.4 | 2 | 4 | 15% | 0% | 0% | 0% | 1% | 0% |
| 0.8 | 1 | 4 | 1.3 | 0 | 1.5 | 0 | 1.5 | 0.4 | 2 | 4 | 15% | 0% | 0% | 0% | 1% | 0% |
| 0.8 | 1 | 6 | 1.3 | 0 | 1.5 | 0 | 1.5 | 0.4 | 2 | 4 | 16% | 0% | 0% | 0% | 1% | 2% |
| 0.8 | 1 | 8 | 1.3 | 0 | 1.5 | 0 | 1.5 | 0.4 | 2 | 4 | 18% | 0% | 0% | 0% | 1% | 3% |
| 1.4 | 0.2 | 5 | 0 | 0 | 0 | 0 | 0 | 0 | 0 | 5 | 20% | 0% | 0% | 0% | 0% | 0% |
| 1.8 | 0.2 | 5 | 0 | 0 | 0 | 0 | 0 | 0 | 0 | 5 | 27% | 0% | 0% | 0% | 0% | 0% |
| 2.2 | 0.2 | 5 | 0 | 0 | 0 | 0 | 0 | 0 | 0 | 5 | 32% | 0% | 0% | 0% | 0% | 0% |
| 2.6 | 0.2 | 5 | 0 | 0 | 0 | 0 | 0 | 0 | 0 | 5 | 37% | 0% | 0% | 0% | 0% | 0% |
| 3 | 0.2 | 5 | 0 | 0 | 0 | 0 | 0 | 0 | 0 | 5 | 42% | 0% | 0% | 0% | 0% | 0% |
| 0.8 | 0.4 | 5 | 0 | 0 | 0 | 0 | 0 | 0 | 0 | 5 | 12% | 0% | 0% | 0% | 0% | 0% |
| 1.2 | 0.4 | 5 | 0 | 0 | 0 | 0 | 0 | 0 | 0 | 5 | 17% | 0% | 0% | 0% | 0% | 0% |
| 1.6 | 0.4 | 5 | 0 | 0 | 0 | 0 | 0 | 0 | 0 | 5 | 23% | 0% | 0% | 0% | 0% | 0% |
| 2 | 0.4 | 5 | 0 | 0 | 0 | 0 | 0 | 0 | 0 | 5 | 29% | 0% | 0% | 0% | 0% | 0% |
| 2.4 | 0.4 | 5 | 0 | 0 | 0 | 0 | 0 | 0 | 0 | 5 | 34% | 0% | 0% | 0% | 0% | 0% |
| 2.8 | 0.4 | 5 | 0 | 0 | 0 | 0 | 0 | 0 | 0 | 5 | 39% | 0% | 0% | 0% | 0% | 0% |
| 0.4 | 0.6 | 5 | 0 | 0 | 0 | 0 | 0 | 0 | 0 | 5 | 6% | 0% | 0% | 0% | 1% | 0% |
| 0.8 | 0.6 | 5 | 0 | 0 | 0 | 0 | 0 | 0 | 0 | 5 | 11% | 0% | 0% | 0% | 1% | 0% |
| 1.2 | 0.6 | 5 | 0 | 0 | 0 | 0 | 0 | 0 | 0 | 5 | 17% | 0% | 0% | 0% | 1% | 0% |
| 1.6 | 0.6 | 5 | 0 | 0 | 0 | 0 | 0 | 0 | 0 | 5 | 23% | 0% | 0% | 0% | 1% | 0% |
| 2 | 0.6 | 5 | 0 | 0 | 0 | 0 | 0 | 0 | 0 | 5 | 29% | 0% | 0% | 0% | 1% | 0% |
| 2.4 | 0.6 | 5 | 0 | 0 | 0 | 0 | 0 | 0 | 0 | 5 | 34% | 0% | 0% | 0% | 1% | 0% |
| 2.8 | 0.6 | 5 | 0 | 0 | 0 | 0 | 0 | 0 | 0 | 5 | 39% | 0% | 0% | 0% | 1% | 0% |
| 0.2 | 0.8 | 5 | 0 | 0 | 0 | 0 | 0 | 0 | 0 | 5 | 6% | 0% | 0% | 0% | 1% | 0% |
| 0.6 | 0.8 | 5 | 0 | 0 | 0 | 0 | 0 | 0 | 0 | 5 | 9% | 0% | 0% | 0% | 1% | 0% |
| 1 | 0.8 | 5 | 0 | 0 | 0 | 0 | 0 | 0 | 0 | 5 | 14% | 0% | 0% | 0% | 1% | 0% |
| 1.4 | 0.8 | 5 | 0 | 0 | 0 | 0 | 0 | 0 | 0 | 5 | 20% | 0% | 0% | 0% | 1% | 0% |
| 1.8 | 0.8 | 5 | 0 | 0 | 0 | 0 | 0 | 0 | 0 | 5 | 26% | 0% | 0% | 0% | 1% | 0% |
| 2.2 | 0.8 | 5 | 0 | 0 | 0 | 0 | 0 | 0 | 0 | 5 | 34% | 0% | 0% | 0% | 1% | 0% |
| 0.4 | 1 | 5 | 0 | 0 | 0 | 0 | 0 | 0 | 0 | 5 | 10% | 0% | 0% | 0% | 1% | 0% |
| 0.8 | 1 | 5 | 0 | 0 | 0 | 0 | 0 | 0 | 0 | 5 | 11% | 0% | 0% | 0% | 1% | 0% |
| 1.2 | 1 | 5 | 0 | 0 | 0 | 0 | 0 | 0 | 0 | 5 | 19% | 0% | 0% | 0% | 1% | 0% |
| 1.6 | 1 | 5 | 0 | 0 | 0 | 0 | 0 | 0 | 0 | 5 | 28% | 0% | 0% | 0% | 1% | 0% |
| 0.8 | 1.2 | 5 | 0 | 0 | 0 | 0 | 0 | 0 | 0 | 5 | 17% | 0% | 0% | 0% | 1% | 0% |
| 1.4 | 0.2 | 10 | 0 | 0 | 0 | 0 | 0 | 0 | 0 | 5 | 20% | 0% | 0% | 0% | 0% | 0% |
| 1.8 | 0.2 | 10 | 0 | 0 | 0 | 0 | 0 | 0 | 0 | 5 | 26% | 2% | 0% | 0% | 0% | 0% |
| 1 | 0.4 | 10 | 0 | 0 | 0 | 0 | 0 | 0 | 0 | 5 | 16% | 0% | 0% | 0% | 0% | 1% |
| 1.4 | 0.4 | 10 | 0 | 0 | 0 | 0 | 0 | 0 | 0 | 5 | 20% | 0% | 0% | 0% | 0% | 0% |
| 1.8 | 0.4 | 10 | 0 | 0 | 0 | 0 | 0 | 0 | 0 | 5 | 26% | 2% | 0% | 0% | 0% | 0% |
| 0.4 | 0.6 | 10 | 0 | 0 | 0 | 0 | 0 | 0 | 0 | 5 | 12% | 0% | 0% | 0% | 1% | 0% |
| 0.8 | 0.6 | 10 | 0 | 0 | 0 | 0 | 0 | 0 | 0 | 5 | 17% | 0% | 0% | 0% | 1% | 0% |
| 1.2 | 0.6 | 10 | 0 | 0 | 0 | 0 | 0 | 0 | 0 | 5 | 20% | 0% | 0% | 0% | 1% | 0% |
| 1.6 | 0.6 | 10 | 0 | 0 | 0 | 0 | 0 | 0 | 0 | 5 | 23% | 2% | 0% | 0% | 1% | 0% |
| 0.8 | 0.8 | 10 | 0 | 0 | 0 | 0 | 0 | 0 | 0 | 5 | 20% | 0% | 0% | 0% | 1% | 0% |
| 1.2 | 0.8 | 10 | 0 | 0 | 0 | 0 | 0 | 0 | 0 | 5 | 23% | 0% | 0% | 0% | 1% | 0% |
| 1.6 | 0.8 | 10 | 0 | 0 | 0 | 0 | 0 | 0 | 0 | 5 | 26% | 2% | 0% | 0% | 1% | 0% |
| 1.8 | 1 | 10 | 0 | 0 | 0 | 0 | 0 | 0 | 0 | 5 | 30% | 4% | 0% | 0% | 1% | 0% |
| 1.4 | 0.6 | 15 | 0 | 0 | 0 | 0 | 0 | 0 | 0 | 5 | 28% | 1% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1 | 0.7 | 15 | 0 | 0 | 1 | 0 | 0 | 0 | 0 | 5 | 24% | 0% | 0% | 0% | 1% | 2% |
| 1.5 | 0.5 | 5 | 0 | 0 | 2 | 0 | 0 | 0 | 0 | 5 | 24% | 0% | 0% | 0% | 0% | 0% |
| 2.5 | 0.5 | 5 | 0 | 0 | 2 | 0 | 0 | 0 | 0 | 5 | 38% | 0% | 0% | 0% | 0% | 0% |
| 3 | 0.5 | 5 | 0 | 0 | 2 | 0 | 0 | 0 | 0 | 5 | 44% | 0% | 0% | 0% | 0% | 0% |
| 0.5 | 1 | 5 | 0 | 0 | 2 | 0 | 0 | 0 | 0 | 5 | 10% | 0% | 0% | 0% | 1% | 0% |
| 1.5 | 1 | 5 | 0 | 0 | 2 | 0 | 0 | 0 | 0 | 5 | 24% | 0% | 0% | 0% | 1% | 0% |
| 1 | 0.5 | 6 | 0 | 0 | 2 | 0 | 0 | 0 | 0 | 5 | 17% | 0% | 0% | 0% | 0% | 0% |
| 0.5 | 1 | 6 | 0 | 0 | 2 | 0 | 0 | 0 | 0 | 5 | 12% | 0% | 0% | 0% | 1% | 0% |
| 1.5 | 1 | 6 | 0 | 0 | 2 | 0 | 0 | 0 | 0 | 5 | 24% | 0% | 0% | 0% | 1% | 0% |
| 1.5 | 0.5 | 7 | 0 | 0 | 2 | 0 | 0 | 0 | 0 | 5 | 24% | 0% | 0% | 0% | 0% | 0% |
| 2.5 | 0.5 | 7 | 0 | 0 | 2 | 0 | 0 | 0 | 0 | 5 | 38% | 4% | 0% | 0% | 0% | 0% |
| 3 | 0.5 | 7 | 0 | 0 | 2 | 0 | 0 | 0 | 0 | 5 | 44% | 4% | 0% | 0% | 0% | 0% |
| 0.5 | 1 | 7 | 0 | 0 | 2 | 0 | 0 | 0 | 0 | 5 | 14% | 0% | 0% | 0% | 1% | 0% |
| 1.5 | 1 | 7 | 0 | 0 | 2 | 0 | 0 | 0 | 0 | 5 | 24% | 0% | 0% | 0% | 1% | 0% |
| 1.5 | 0.5 | 8 | 0 | 0 | 2 | 0 | 0 | 0 | 0 | 5 | 24% | 0% | 0% | 0% | 0% | 0% |
| 1 | 1 | 8 | 0 | 0 | 2 | 0 | 0 | 0 | 0 | 5 | 19% | 0% | 0% | 0% | 1% | 0% |
| 1 | 0.5 | 9 | 0 | 0 | 2 | 0 | 0 | 0 | 0 | 5 | 17% | 0% | 0% | 0% | 0% | 6% |
| 0.5 | 1 | 9 | 0 | 0 | 2 | 0 | 0 | 0 | 0 | 5 | 17% | 0% | 0% | 0% | 1% | 0% |
| 1.5 | 1 | 9 | 0 | 0 | 2 | 0 | 0 | 0 | 0 | 5 | 25% | 2% | 0% | 0% | 1% | 0% |
| 0.5 | 1 | 10 | 0 | 0 | 2 | 0 | 0 | 0 | 0 | 5 | 18% | 0% | 0% | 0% | 1% | 0% |
| 1.5 | 1 | 10 | 0 | 0 | 2 | 0 | 0 | 0 | 0 | 5 | 27% | 3% | 0% | 0% | 1% | 0% |
| 1 | 1 | 11 | 0 | 0 | 2 | 0 | 0 | 0 | 0 | 5 | 24% | 0% | 0% | 0% | 1% | 0% |
| 1.5 | 0.5 | 12 | 0 | 0 | 2 | 0 | 0 | 0 | 0 | 5 | 24% | 5% | 0% | 0% | 0% | 3% |
| 1.5 | 1 | 12 | 0 | 0 | 2 | 0 | 0 | 0 | 0 | 5 | 30% | 5% | 0% | 0% | 1% | 0% |
| 1 | 0.8 | 15 | 0 | 0 | 2 | 0 | 0 | 0 | 0 | 5 | 25% | 0% | 0% | 0% | 1% | 3% |
| 0.8 | 1 | 1 | 1.3 | 0 | 1.5 | 0 | 1.5 | 0.4 | 0 | 5 | 14% | 0% | 0% | 0% | 1% | 0% |
| 0.8 | 1 | 3 | 1.3 | 0 | 1.5 | 0 | 1.5 | 0.4 | 0 | 5 | 14% | 1% | 0% | 0% | 1% | 0% |
| 0.8 | 1 | 5 | 1.3 | 0 | 1.5 | 0 | 1.5 | 0.4 | 0 | 5 | 14% | 1% | 0% | 0% | 1% | 0% |
| 0.8 | 1 | 7 | 1.3 | 0 | 1.5 | 0 | 1.5 | 0.4 | 0 | 5 | 16% | 0% | 0% | 0% | 1% | 0% |
| 0.8 | 1 | 9 | 1.3 | 0 | 1.5 | 0 | 1.5 | 0.4 | 0 | 5 | 20% | 0% | 0% | 0% | 1% | 0% |
| 0.92 | 1.01 | 4 | 0.19 | 0 | 3.09 | 0 | 0.48 | 0.26 | 2 | 5 | 16% | 0% | 0% | 0% | 1% | 0% |
| 0.92 | 1.01 | 6 | 0.19 | 0 | 3.09 | 0 | 0.48 | 0.26 | 2 | 5 | 21% | 0% | 0% | 0% | 1% | 4% |
| 0.92 | 1.01 | 9 | 0.19 | 0 | 3.09 | 0 | 0.48 | 0.26 | 2 | 5 | 16% | 0% | 0% | 0% | 1% | 8% |
| 0.8 | 1 | 1 | 1.3 | 0 | 1.5 | 0 | 1.5 | 0.4 | 2 | 5 | 14% | 0% | 0% | 0% | 1% | 0% |
| 0.8 | 1 | 3 | 1.3 | 0 | 1.5 | 0 | 1.5 | 0.4 | 2 | 5 | 15% | 0% | 0% | 0% | 1% | 0% |
| 0.8 | 1 | 5 | 1.3 | 0 | 1.5 | 0 | 1.5 | 0.4 | 2 | 5 | 15% | 0% | 0% | 0% | 1% | 2% |
| 0.8 | 1 | 7 | 1.3 | 0 | 1.5 | 0 | 1.5 | 0.4 | 2 | 5 | 14% | 0% | 0% | 0% | 1% | 6% |
| 1.5 | 0.5 | 3 | 0.7 | 0 | 2.45 | 0 | 0.7 | 0.35 | 0 | 5.25 | 24% | 0% | 0% | 0% | 0% | 0% |
| 2.18 | 0.62 | 7.71 | 0 | 0 | 2.12 | 0 | 0 | 0 | 0 | 5.77 | 33% | 4% | 0% | 0% | 1% | 0% |
| 1.5 | 0.5 | 5 | 0 | 0 | 2 | 0 | 0 | 0 | 0 | 6 | 24% | 0% | 0% | 0% | 0% | 0% |
| 2.5 | 0.5 | 5 | 0 | 0 | 2 | 0 | 0 | 0 | 0 | 6 | 38% | 0% | 0% | 0% | 0% | 0% |
| 3 | 0.5 | 5 | 0 | 0 | 2 | 0 | 0 | 0 | 0 | 6 | 45% | 0% | 0% | 0% | 0% | 0% |
| 1 | 0.5 | 7 | 0 | 0 | 2 | 0 | 0 | 0 | 0 | 6 | 17% | 0% | 0% | 0% | 0% | 0% |
| 2 | 0.5 | 7 | 0 | 0 | 2 | 0 | 0 | 0 | 0 | 6 | 31% | 0% | 0% | 0% | 0% | 0% |
| 2.5 | 0.5 | 7 | 0 | 0 | 2 | 0 | 0 | 0 | 0 | 6 | 38% | 2% | 0% | 0% | 0% | 0% |
| 3 | 0.5 | 7 | 0 | 0 | 2 | 0 | 0 | 0 | 0 | 6 | 45% | 2% | 0% | 0% | 0% | 0% |
| 1.5 | 0.5 | 9 | 0 | 0 | 2 | 0 | 0 | 0 | 0 | 6 | 24% | 1% | 0% | 0% | 0% | 0% |
| 1 | 0.5 | 13 | 0 | 0 | 2 | 0 | 0 | 0 | 0 | 6 | 19% | 0% | 0% | 0% | 0% | 8% |
| 0.8 | 1 | 1 | 1.3 | 0 | 1.5 | 0 | 1.5 | 0.4 | 0 | 6 | 14% | 0% | 0% | 0% | 1% | 0% |
| 0.8 | 1 | 3 | 1.3 | 0 | 1.5 | 0 | 1.5 | 0.4 | 0 | 6 | 14% | 0% | 0% | 0% | 1% | 0% |
| 0.8 | 1 | 5 | 1.3 | 0 | 1.5 | 0 | 1.5 | 0.4 | 0 | 6 | 14% | 1% | 0% | 0% | 1% | 0% |
| 0.8 | 1 | 7 | 1.3 | 0 | 1.5 | 0 | 1.5 | 0.4 | 0 | 6 | 17% | 0% | 0% | 0% | 1% | 0% |
| 0.8 | 1 | 9 | 1.3 | 0 | 1.5 | 0 | 1.5 | 0.4 | 0 | 6 | 20% | 0% | 0% | 0% | 1% | 0% |
| 0.9 | 0.5 | 5 | 0 | 0 | 0 | 0 | 0 | 2 | 0 | 6 | 11% | 0% | 0% | 0% | 1% | 3% |
| 1.3 | 0.5 | 5 | 0 | 0 | 0 | 0 | 0 | 2 | 0 | 6 | 14% | 0% | 0% | 0% | 1% | 0% |
| 1.5 | 0.5 | 5 | 0 | 0 | 0 | 0 | 0 | 2 | 0 | 6 | 16% | 0% | 0% | 0% | 1% | 0% |
| 1.7 | 0.5 | 5 | 0 | 0 | 0 | 0 | 0 | 2 | 0 | 6 | 18% | 0% | 0% | 0% | 1% | 0% |
| 0.5 | 0.7 | 5 | 0 | 0 | 0 | 0 | 0 | 2 | 0 | 6 | 10% | 0% | 0% | 0% | 1% | 0% |
| 0.9 | 0.7 | 5 | 0 | 0 | 0 | 0 | 0 | 2 | 0 | 6 | 13% | 0% | 0% | 0% | 1% | 0% |
| 1.3 | 0.7 | 5 | 0 | 0 | 0 | 0 | 0 | 2 | 0 | 6 | 16% | 0% | 0% | 0% | 1% | 0% |
| 1.5 | 0.7 | 5 | 0 | 0 | 0 | 0 | 0 | 2 | 0 | 6 | 17% | 0% | 0% | 0% | 1% | 0% |
| 1.7 | 0.7 | 5 | 0 | 0 | 0 | 0 | 0 | 2 | 0 | 6 | 18% | 0% | 0% | 0% | 1% | 0% |
| 0.5 | 0.9 | 5 | 0 | 0 | 0 | 0 | 0 | 2 | 0 | 6 | 12% | 0% | 0% | 0% | 1% | 0% |
| 0.9 | 0.9 | 5 | 0 | 0 | 0 | 0 | 0 | 2 | 0 | 6 | 15% | 0% | 0% | 0% | 1% | 0% |
| 1.3 | 0.9 | 5 | 0 | 0 | 0 | 0 | 0 | 2 | 0 | 6 | 17% | 0% | 0% | 0% | 1% | 0% |
| 1.5 | 0.9 | 5 | 0 | 0 | 0 | 0 | 0 | 2 | 0 | 6 | 18% | 0% | 0% | 0% | 1% | 0% |
| 1.7 | 0.9 | 5 | 0 | 0 | 0 | 0 | 0 | 2 | 0 | 6 | 19% | 0% | 0% | 0% | 1% | 0% |
| 0.5 | 1.1 | 5 | 0 | 0 | 0 | 0 | 0 | 2 | 0 | 6 | 13% | 0% | 0% | 0% | 1% | 0% |
| 0.9 | 1.1 | 5 | 0 | 0 | 0 | 0 | 0 | 2 | 0 | 6 | 16% | 0% | 0% | 0% | 1% | 0% |
| 1.3 | 1.1 | 5 | 0 | 0 | 0 | 0 | 0 | 2 | 0 | 6 | 18% | 0% | 0% | 0% | 1% | 0% |
| 1.5 | 1.1 | 5 | 0 | 0 | 0 | 0 | 0 | 2 | 0 | 6 | 19% | 0% | 0% | 0% | 1% | 0% |
| 1.7 | 1.1 | 5 | 0 | 0 | 0 | 0 | 0 | 2 | 0 | 6 | 21% | 0% | 0% | 0% | 1% | 0% |
| 0.5 | 1.3 | 5 | 0 | 0 | 0 | 0 | 0 | 2 | 0 | 6 | 13% | 0% | 0% | 0% | 1% | 0% |
| 0.9 | 1.3 | 5 | 0 | 0 | 0 | 0 | 0 | 2 | 0 | 6 | 16% | 0% | 0% | 0% | 1% | 0% |
| 0.5 | 1.5 | 5 | 0 | 0 | 0 | 0 | 0 | 2 | 0 | 6 | 13% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 0.5 | 1.7 | 5 | 0 | 0 | 0 | 0 | 0 | 2 | 0 | 6 | 16% | 0% | 0% | 0% | 1% | 0% |
| 1.5 | 0.5 | 10 | 0 | 0 | 0 | 0 | 0 | 2 | 0 | 6 | 22% | 0% | 0% | 0% | 1% | 8% |
| 1.9 | 0.5 | 10 | 0 | 0 | 0 | 0 | 0 | 2 | 0 | 6 | 26% | 0% | 0% | 0% | 1% | 0% |
| 1.3 | 0.7 | 10 | 0 | 0 | 0 | 0 | 0 | 2 | 0 | 6 | 23% | 0% | 0% | 0% | 1% | 2% |
| 1.5 | 0.7 | 10 | 0 | 0 | 0 | 0 | 0 | 2 | 0 | 6 | 25% | 0% | 0% | 0% | 1% | 0% |
| 1.9 | 0.7 | 10 | 0 | 0 | 0 | 0 | 0 | 2 | 0 | 6 | 28% | 0% | 0% | 0% | 1% | 0% |
| 0.9 | 0.9 | 10 | 0 | 0 | 0 | 0 | 0 | 2 | 0 | 6 | 19% | 0% | 0% | 0% | 1% | 0% |
| 1.3 | 0.9 | 10 | 0 | 0 | 0 | 0 | 0 | 2 | 0 | 6 | 24% | 0% | 0% | 0% | 1% | 0% |
| 1.5 | 0.9 | 10 | 0 | 0 | 0 | 0 | 0 | 2 | 0 | 6 | 27% | 0% | 0% | 0% | 1% | 0% |
| 1.7 | 0.9 | 10 | 0 | 0 | 0 | 0 | 0 | 2 | 0 | 6 | 29% | 0% | 0% | 0% | 1% | 0% |
| 0.5 | 1.1 | 10 | 0 | 0 | 0 | 0 | 0 | 2 | 0 | 6 | 17% | 0% | 0% | 0% | 1% | 0% |
| 0.9 | 1.1 | 10 | 0 | 0 | 0 | 0 | 0 | 2 | 0 | 6 | 21% | 0% | 0% | 0% | 1% | 0% |
| 1.3 | 1.1 | 10 | 0 | 0 | 0 | 0 | 0 | 2 | 0 | 6 | 24% | 0% | 0% | 0% | 1% | 0% |
| 1.5 | 1.1 | 10 | 0 | 0 | 0 | 0 | 0 | 2 | 0 | 6 | 27% | 0% | 0% | 0% | 1% | 0% |
| 1.7 | 1.1 | 10 | 0 | 0 | 0 | 0 | 0 | 2 | 0 | 6 | 30% | 0% | 0% | 0% | 1% | 0% |
| 0.7 | 1.3 | 10 | 0 | 0 | 0 | 0 | 0 | 2 | 0 | 6 | 22% | 0% | 0% | 0% | 1% | 0% |
| 1.1 | 1.3 | 10 | 0 | 0 | 0 | 0 | 0 | 2 | 0 | 6 | 25% | 0% | 0% | 0% | 1% | 0% |
| 1.3 | 1.3 | 10 | 0 | 0 | 0 | 0 | 0 | 2 | 0 | 6 | 27% | 0% | 0% | 0% | 1% | 0% |
| 1.5 | 1.3 | 10 | 0 | 0 | 0 | 0 | 0 | 2 | 0 | 6 | 28% | 0% | 0% | 0% | 1% | 0% |
| 1.1 | 1.5 | 10 | 0 | 0 | 0 | 0 | 0 | 2 | 0 | 6 | 28% | 0% | 0% | 0% | 1% | 0% |
| 1.3 | 1.5 | 10 | 0 | 0 | 0 | 0 | 0 | 2 | 0 | 6 | 29% | 0% | 0% | 0% | 2% | 0% |
| 1.5 | 1.5 | 10 | 0 | 0 | 0 | 0 | 0 | 2 | 0 | 6 | 30% | 0% | 0% | 0% | 2% | 0% |
| 1.9 | 0.5 | 15 | 0 | 0 | 0 | 0 | 0 | 2 | 0 | 6 | 29% | 0% | 0% | 0% | 1% | 7% |
| 1.9 | 0.7 | 15 | 0 | 0 | 0 | 0 | 0 | 2 | 0 | 6 | 32% | 0% | 0% | 0% | 1% | 0% |
| 1.3 | 0.9 | 15 | 0 | 0 | 0 | 0 | 0 | 2 | 0 | 6 | 27% | 0% | 0% | 0% | 1% | 0% |
| 1.5 | 0.9 | 15 | 0 | 0 | 0 | 0 | 0 | 2 | 0 | 6 | 29% | 0% | 0% | 0% | 1% | 0% |
| 1.9 | 0.9 | 15 | 0 | 0 | 0 | 0 | 0 | 2 | 0 | 6 | 33% | 0% | 0% | 0% | 1% | 0% |
| 1.1 | 1.1 | 15 | 0 | 0 | 0 | 0 | 0 | 2 | 0 | 6 | 28% | 0% | 0% | 0% | 1% | 0% |
| 1.3 | 1.1 | 15 | 0 | 0 | 0 | 0 | 0 | 2 | 0 | 6 | 30% | 0% | 0% | 0% | 1% | 0% |
| 1.5 | 1.1 | 15 | 0 | 0 | 0 | 0 | 0 | 2 | 0 | 6 | 32% | 0% | 0% | 0% | 1% | 0% |
| 1.9 | 1.1 | 15 | 0 | 0 | 0 | 0 | 0 | 2 | 0 | 6 | 36% | 0% | 0% | 0% | 1% | 0% |
| 1.5 | 0.5 | 5 | 0 | 0 | 0 | 0 | 0 | 4 | 0 | 6 | 15% | 0% | 0% | 0% | 1% | 9% |
| 1.9 | 0.5 | 5 | 0 | 0 | 0 | 0 | 0 | 4 | 0 | 6 | 18% | 0% | 0% | 0% | 1% | 0% |
| 1.3 | 0.7 | 5 | 0 | 0 | 0 | 0 | 0 | 4 | 0 | 6 | 15% | 0% | 0% | 0% | 1% | 0% |
| 1.5 | 0.7 | 5 | 0 | 0 | 0 | 0 | 0 | 4 | 0 | 6 | 17% | 0% | 0% | 0% | 1% | 0% |
| 1.7 | 0.7 | 5 | 0 | 0 | 0 | 0 | 0 | 4 | 0 | 6 | 19% | 0% | 0% | 0% | 1% | 0% |
| 0.7 | 0.9 | 5 | 0 | 0 | 0 | 0 | 0 | 4 | 0 | 6 | 13% | 0% | 0% | 0% | 1% | 3% |
| 1.1 | 0.9 | 5 | 0 | 0 | 0 | 0 | 0 | 4 | 0 | 6 | 16% | 0% | 0% | 0% | 1% | 0% |
| 1.3 | 0.9 | 5 | 0 | 0 | 0 | 0 | 0 | 4 | 0 | 6 | 17% | 0% | 0% | 0% | 1% | 0% |
| 1.5 | 0.9 | 5 | 0 | 0 | 0 | 0 | 0 | 4 | 0 | 6 | 19% | 0% | 0% | 0% | 1% | 0% |
| 1.9 | 0.9 | 5 | 0 | 0 | 0 | 0 | 0 | 4 | 0 | 6 | 18% | 0% | 0% | 0% | 1% | 0% |
| 0.7 | 1.1 | 5 | 0 | 0 | 0 | 0 | 0 | 4 | 0 | 6 | 14% | 0% | 0% | 0% | 1% | 0% |
| 1.1 | 1.1 | 5 | 0 | 0 | 0 | 0 | 0 | 4 | 0 | 6 | 18% | 0% | 0% | 0% | 1% | 0% |
| 1.3 | 1.1 | 5 | 0 | 0 | 0 | 0 | 0 | 4 | 0 | 6 | 19% | 0% | 0% | 0% | 1% | 0% |
| 1.5 | 1.1 | 5 | 0 | 0 | 0 | 0 | 0 | 4 | 0 | 6 | 20% | 0% | 0% | 0% | 1% | 0% |
| 1.9 | 1.1 | 5 | 0 | 0 | 0 | 0 | 0 | 4 | 0 | 6 | 22% | 0% | 0% | 0% | 1% | 0% |
| 0.7 | 1.3 | 5 | 0 | 0 | 0 | 0 | 0 | 4 | 0 | 6 | 16% | 0% | 0% | 0% | 1% | 0% |
| 1.1 | 1.3 | 5 | 0 | 0 | 0 | 0 | 0 | 4 | 0 | 6 | 19% | 0% | 0% | 0% | 1% | 0% |
| 1.3 | 1.3 | 5 | 0 | 0 | 0 | 0 | 0 | 4 | 0 | 6 | 20% | 0% | 0% | 0% | 1% | 0% |
| 1.5 | 1.3 | 5 | 0 | 0 | 0 | 0 | 0 | 4 | 0 | 6 | 21% | 0% | 0% | 0% | 1% | 0% |
| 1.9 | 1.3 | 5 | 0 | 0 | 0 | 0 | 0 | 4 | 0 | 6 | 23% | 0% | 0% | 0% | 1% | 0% |
| 0.7 | 1.5 | 5 | 0 | 0 | 0 | 0 | 0 | 4 | 0 | 6 | 18% | 0% | 0% | 0% | 1% | 0% |
| 1.1 | 1.5 | 5 | 0 | 0 | 0 | 0 | 0 | 4 | 0 | 6 | 12% | 0% | 0% | 0% | 1% | 0% |
| 1.3 | 1.5 | 5 | 0 | 0 | 0 | 0 | 0 | 4 | 0 | 6 | 14% | 0% | 0% | 0% | 1% | 0% |
| 1.5 | 1.5 | 5 | 0 | 0 | 0 | 0 | 0 | 4 | 0 | 6 | 22% | 0% | 0% | 0% | 1% | 0% |
| 1.7 | 1.5 | 5 | 0 | 0 | 0 | 0 | 0 | 4 | 0 | 6 | 23% | 0% | 0% | 0% | 1% | 0% |
| 0.7 | 1.7 | 5 | 0 | 0 | 0 | 0 | 0 | 4 | 0 | 6 | 19% | 0% | 0% | 0% | 1% | 0% |
| 1.1 | 1.7 | 5 | 0 | 0 | 0 | 0 | 0 | 4 | 0 | 6 | 12% | 0% | 0% | 0% | 1% | 0% |
| 1.3 | 1.7 | 5 | 0 | 0 | 0 | 0 | 0 | 4 | 0 | 6 | 22% | 0% | 0% | 0% | 1% | 0% |
| 0.5 | 1.9 | 5 | 0 | 0 | 0 | 0 | 0 | 4 | 0 | 6 | 19% | 0% | 0% | 0% | 1% | 0% |
| 0.9 | 1.9 | 5 | 0 | 0 | 0 | 0 | 0 | 4 | 0 | 6 | 20% | 0% | 0% | 0% | 1% | 0% |
| 1.9 | 0.9 | 10 | 0 | 0 | 0 | 0 | 0 | 4 | 0 | 6 | 29% | 0% | 0% | 0% | 1% | 0% |
| 1.3 | 1.1 | 10 | 0 | 0 | 0 | 0 | 0 | 4 | 0 | 6 | 25% | 0% | 0% | 0% | 1% | 0% |
| 1.5 | 1.1 | 10 | 0 | 0 | 0 | 0 | 0 | 4 | 0 | 6 | 27% | 0% | 0% | 0% | 1% | 0% |
| 1.9 | 1.1 | 10 | 0 | 0 | 0 | 0 | 0 | 4 | 0 | 6 | 31% | 0% | 0% | 0% | 1% | 0% |
| 1.1 | 1.3 | 10 | 0 | 0 | 0 | 0 | 0 | 4 | 0 | 6 | 26% | 0% | 0% | 0% | 1% | 0% |
| 1.3 | 1.3 | 10 | 0 | 0 | 0 | 0 | 0 | 4 | 0 | 6 | 28% | 0% | 0% | 0% | 1% | 0% |
| 1.5 | 1.3 | 10 | 0 | 0 | 0 | 0 | 0 | 4 | 0 | 6 | 30% | 0% | 0% | 0% | 1% | 0% |
| 1.9 | 1.3 | 10 | 0 | 0 | 0 | 0 | 0 | 4 | 0 | 6 | 33% | 0% | 0% | 0% | 1% | 0% |
| 0.7 | 1.5 | 10 | 0 | 0 | 0 | 0 | 0 | 4 | 0 | 6 | 22% | 0% | 0% | 0% | 1% | 0% |
| 1.1 | 1.5 | 10 | 0 | 0 | 0 | 0 | 0 | 4 | 0 | 6 | 27% | 0% | 0% | 0% | 1% | 0% |
| 1.3 | 1.5 | 10 | 0 | 0 | 0 | 0 | 0 | 4 | 0 | 6 | 29% | 0% | 0% | 0% | 1% | 0% |
| 1.5 | 1.5 | 10 | 0 | 0 | 0 | 0 | 0 | 4 | 0 | 6 | 32% | 0% | 0% | 0% | 1% | 0% |
| 1.7 | 1.5 | 10 | 0 | 0 | 0 | 0 | 0 | 4 | 0 | 6 | 33% | 0% | 0% | 0% | 1% | 0% |
| 0.5 | 1.7 | 10 | 0 | 0 | 0 | 0 | 0 | 4 | 0 | 6 | 22% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 0.9 | 1.7 | 10 | 0 | 0 | 0 | 0 | 0 | 4 | 0 | 6 | 26% | 0% | 0% | 0% | 1% | 0% |
| 1.1 | 1.7 | 10 | 0 | 0 | 0 | 0 | 0 | 4 | 0 | 6 | 27% | 0% | 0% | 0% | 1% | 0% |
| 1.3 | 1.7 | 10 | 0 | 0 | 0 | 0 | 0 | 4 | 0 | 6 | 30% | 0% | 0% | 0% | 1% | 0% |
| 1.5 | 1.7 | 10 | 0 | 0 | 0 | 0 | 0 | 4 | 0 | 6 | 32% | 0% | 0% | 0% | 1% | 0% |
| 1.9 | 1.7 | 10 | 0 | 0 | 0 | 0 | 0 | 4 | 0 | 6 | 25% | 0% | 0% | 0% | 2% | 0% |
| 0.7 | 1.9 | 10 | 0 | 0 | 0 | 0 | 0 | 4 | 0 | 6 | 26% | 0% | 0% | 0% | 1% | 0% |
| 1.1 | 1.9 | 10 | 0 | 0 | 0 | 0 | 0 | 4 | 0 | 6 | 29% | 0% | 0% | 0% | 1% | 0% |
| 1.3 | 1.9 | 10 | 0 | 0 | 0 | 0 | 0 | 4 | 0 | 6 | 30% | 0% | 0% | 0% | 2% | 0% |
| 1.5 | 1.9 | 10 | 0 | 0 | 0 | 0 | 0 | 4 | 0 | 6 | 32% | 0% | 0% | 0% | 2% | 0% |
| 1.9 | 1.9 | 10 | 0 | 0 | 0 | 0 | 0 | 4 | 0 | 6 | 36% | 0% | 0% | 0% | 2% | 0% |
| 1.5 | 1.3 | 15 | 0 | 0 | 0 | 0 | 0 | 4 | 0 | 6 | 32% | 0% | 0% | 0% | 1% | 0% |
| 1.7 | 1.3 | 15 | 0 | 0 | 0 | 0 | 0 | 4 | 0 | 6 | 34% | 0% | 0% | 0% | 1% | 0% |
| 1.1 | 1.5 | 15 | 0 | 0 | 0 | 0 | 0 | 4 | 0 | 6 | 30% | 0% | 0% | 0% | 1% | 0% |
| 1.3 | 1.5 | 15 | 0 | 0 | 0 | 0 | 0 | 4 | 0 | 6 | 32% | 0% | 0% | 0% | 1% | 0% |
| 1.5 | 1.5 | 15 | 0 | 0 | 0 | 0 | 0 | 4 | 0 | 6 | 34% | 0% | 0% | 0% | 1% | 0% |
| 1.7 | 1.5 | 15 | 0 | 0 | 0 | 0 | 0 | 4 | 0 | 6 | 36% | 0% | 0% | 0% | 1% | 0% |
| 1.1 | 1.7 | 15 | 0 | 0 | 0 | 0 | 0 | 4 | 0 | 6 | 33% | 0% | 0% | 0% | 1% | 0% |
| 1.3 | 1.7 | 15 | 0 | 0 | 0 | 0 | 0 | 4 | 0 | 6 | 35% | 0% | 0% | 0% | 1% | 0% |
| 1.5 | 1.7 | 15 | 0 | 0 | 0 | 0 | 0 | 4 | 0 | 6 | 37% | 0% | 0% | 0% | 1% | 0% |
| 1.7 | 1.7 | 15 | 0 | 0 | 0 | 0 | 0 | 4 | 0 | 6 | 38% | 0% | 0% | 0% | 1% | 0% |
| 1.9 | 1.9 | 15 | 0 | 0 | 0 | 0 | 0 | 4 | 0 | 6 | 42% | 0% | 0% | 0% | 2% | 0% |
| 2.6 | 0.2 | 5 | 0 | 0 | 0 | 0 | 0 | 6 | 0 | 6 | 32% | 0% | 0% | 0% | 0% | 0% |
| 3 | 0.2 | 5 | 0 | 0 | 0 | 0 | 0 | 6 | 0 | 6 | 37% | 0% | 0% | 0% | 0% | 0% |
| 3.4 | 0.2 | 5 | 0 | 0 | 0 | 0 | 0 | 6 | 0 | 6 | 42% | 0% | 0% | 0% | 0% | 0% |
| 3.8 | 0.2 | 5 | 0 | 0 | 0 | 0 | 0 | 6 | 0 | 6 | 47% | 0% | 0% | 0% | 0% | 0% |
| 2.4 | 0.4 | 5 | 0 | 0 | 0 | 0 | 0 | 6 | 0 | 6 | 32% | 0% | 0% | 0% | 0% | 2% |
| 2.8 | 0.4 | 5 | 0 | 0 | 0 | 0 | 0 | 6 | 0 | 6 | 37% | 0% | 0% | 0% | 0% | 0% |
| 3.2 | 0.4 | 5 | 0 | 0 | 0 | 0 | 0 | 6 | 0 | 6 | 43% | 0% | 0% | 0% | 0% | 0% |
| 3.6 | 0.4 | 5 | 0 | 0 | 0 | 0 | 0 | 6 | 0 | 6 | 47% | 0% | 0% | 0% | 0% | 0% |
| 2.2 | 0.6 | 5 | 0 | 0 | 0 | 0 | 0 | 6 | 0 | 6 | 32% | 0% | 0% | 0% | 0% | 4% |
| 2.6 | 0.6 | 5 | 0 | 0 | 0 | 0 | 0 | 6 | 0 | 6 | 38% | 0% | 0% | 0% | 0% | 0% |
| 3 | 0.6 | 5 | 0 | 0 | 0 | 0 | 0 | 6 | 0 | 6 | 43% | 0% | 0% | 0% | 0% | 0% |
| 3.4 | 0.6 | 5 | 0 | 0 | 0 | 0 | 0 | 6 | 0 | 6 | 47% | 0% | 0% | 0% | 0% | 0% |
| 2 | 0.8 | 5 | 0 | 0 | 0 | 0 | 0 | 6 | 0 | 6 | 32% | 0% | 0% | 0% | 0% | 0% |
| 2.4 | 0.8 | 5 | 0 | 0 | 0 | 0 | 0 | 6 | 0 | 6 | 38% | 0% | 0% | 0% | 0% | 0% |
| 2.8 | 0.8 | 5 | 0 | 0 | 0 | 0 | 0 | 6 | 0 | 6 | 43% | 0% | 0% | 0% | 0% | 0% |
| 3.2 | 0.8 | 5 | 0 | 0 | 0 | 0 | 0 | 6 | 0 | 6 | 48% | 0% | 0% | 0% | 0% | 0% |
| 1.9 | 0.9 | 5 | 0 | 0 | 0 | 0 | 0 | 6 | 0 | 6 | 21% | 0% | 0% | 0% | 1% | 0% |
| 1.8 | 1 | 5 | 0 | 0 | 0 | 0 | 0 | 6 | 0 | 6 | 32% | 0% | 0% | 0% | 0% | 0% |
| 2.2 | 1 | 5 | 0 | 0 | 0 | 0 | 0 | 6 | 0 | 6 | 38% | 0% | 0% | 0% | 0% | 0% |
| 2.6 | 1 | 5 | 0 | 0 | 0 | 0 | 0 | 6 | 0 | 6 | 43% | 0% | 0% | 0% | 0% | 0% |
| 3 | 1 | 5 | 0 | 0 | 0 | 0 | 0 | 6 | 0 | 6 | 48% | 0% | 0% | 0% | 0% | 0% |
| 1.3 | 1.1 | 5 | 0 | 0 | 0 | 0 | 0 | 6 | 0 | 6 | 18% | 0% | 0% | 0% | 1% | 0% |
| 1.5 | 1.1 | 5 | 0 | 0 | 0 | 0 | 0 | 6 | 0 | 6 | 20% | 0% | 0% | 0% | 1% | 0% |
| 1.9 | 1.1 | 5 | 0 | 0 | 0 | 0 | 0 | 6 | 0 | 6 | 23% | 0% | 0% | 0% | 1% | 0% |
| 1.6 | 1.2 | 5 | 0 | 0 | 0 | 0 | 0 | 6 | 0 | 6 | 33% | 0% | 0% | 0% | 0% | 0% |
| 2 | 1.2 | 5 | 0 | 0 | 0 | 0 | 0 | 6 | 0 | 6 | 39% | 0% | 0% | 0% | 0% | 0% |
| 2.4 | 1.2 | 5 | 0 | 0 | 0 | 0 | 0 | 6 | 0 | 6 | 44% | 0% | 0% | 0% | 0% | 0% |
| 2.8 | 1.2 | 5 | 0 | 0 | 0 | 0 | 0 | 6 | 0 | 6 | 48% | 0% | 0% | 0% | 0% | 0% |
| 1.1 | 1.3 | 5 | 0 | 0 | 0 | 0 | 0 | 6 | 0 | 6 | 18% | 0% | 0% | 0% | 1% | 0% |
| 1.3 | 1.3 | 5 | 0 | 0 | 0 | 0 | 0 | 6 | 0 | 6 | 20% | 0% | 0% | 0% | 1% | 0% |
| 1.5 | 1.3 | 5 | 0 | 0 | 0 | 0 | 0 | 6 | 0 | 6 | 22% | 0% | 0% | 0% | 1% | 0% |
| 1.9 | 1.3 | 5 | 0 | 0 | 0 | 0 | 0 | 6 | 0 | 6 | 24% | 0% | 0% | 0% | 1% | 0% |
| 1.2 | 1.4 | 5 | 0 | 0 | 0 | 0 | 0 | 6 | 0 | 6 | 29% | 0% | 0% | 0% | 0% | 0% |
| 1.6 | 1.4 | 5 | 0 | 0 | 0 | 0 | 0 | 6 | 0 | 6 | 35% | 0% | 0% | 0% | 0% | 0% |
| 2 | 1.4 | 5 | 0 | 0 | 0 | 0 | 0 | 6 | 0 | 6 | 40% | 0% | 0% | 0% | 0% | 0% |
| 2.4 | 1.4 | 5 | 0 | 0 | 0 | 0 | 0 | 6 | 0 | 6 | 45% | 0% | 0% | 0% | 0% | 0% |
| 2.8 | 1.4 | 5 | 0 | 0 | 0 | 0 | 0 | 6 | 0 | 6 | 50% | 0% | 0% | 0% | 0% | 0% |
| 0.7 | 1.5 | 5 | 0 | 0 | 0 | 0 | 0 | 6 | 0 | 6 | 17% | 0% | 0% | 0% | 1% | 0% |
| 1.1 | 1.5 | 5 | 0 | 0 | 0 | 0 | 0 | 6 | 0 | 6 | 21% | 0% | 0% | 0% | 1% | 0% |
| 1.3 | 1.5 | 5 | 0 | 0 | 0 | 0 | 0 | 6 | 0 | 6 | 22% | 0% | 0% | 0% | 1% | 0% |
| 1.5 | 1.5 | 5 | 0 | 0 | 0 | 0 | 0 | 6 | 0 | 6 | 23% | 0% | 0% | 0% | 1% | 0% |
| 1.7 | 1.5 | 5 | 0 | 0 | 0 | 0 | 0 | 6 | 0 | 6 | 24% | 0% | 0% | 0% | 1% | 0% |
| 1 | 1.6 | 5 | 0 | 0 | 0 | 0 | 0 | 6 | 0 | 6 | 27% | 0% | 0% | 0% | 0% | 0% |
| 1.4 | 1.6 | 5 | 0 | 0 | 0 | 0 | 0 | 6 | 0 | 6 | 32% | 0% | 0% | 0% | 1% | 0% |
| 1.8 | 1.6 | 5 | 0 | 0 | 0 | 0 | 0 | 6 | 0 | 6 | 38% | 0% | 0% | 0% | 1% | 0% |
| 2.2 | 1.6 | 5 | 0 | 0 | 0 | 0 | 0 | 6 | 0 | 6 | 43% | 0% | 0% | 0% | 0% | 0% |
| 2.6 | 1.6 | 5 | 0 | 0 | 0 | 0 | 0 | 6 | 0 | 6 | 48% | 0% | 0% | 0% | 1% | 0% |
| 0.7 | 1.7 | 5 | 0 | 0 | 0 | 0 | 0 | 6 | 0 | 6 | 19% | 0% | 0% | 0% | 1% | 0% |
| 1.1 | 1.7 | 5 | 0 | 0 | 0 | 0 | 0 | 6 | 0 | 6 | 22% | 0% | 0% | 0% | 1% | 0% |
| 1.3 | 1.7 | 5 | 0 | 0 | 0 | 0 | 0 | 6 | 0 | 6 | 23% | 0% | 0% | 0% | 1% | 0% |
| 1.5 | 1.7 | 5 | 0 | 0 | 0 | 0 | 0 | 6 | 0 | 6 | 24% | 0% | 0% | 0% | 1% | 0% |
| 1.7 | 1.7 | 5 | 0 | 0 | 0 | 0 | 0 | 6 | 0 | 6 | 16% | 0% | 0% | 0% | 1% | 0% |
| 1 | 1.8 | 5 | 0 | 0 | 0 | 0 | 0 | 6 | 0 | 6 | 28% | 0% | 0% | 0% | 1% | 0% |
| 1.4 | 1.8 | 5 | 0 | 0 | 0 | 0 | 0 | 6 | 0 | 6 | 33% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.8 | 1.8 | 5 | 0 | 0 | 0 | 0 | 0 | 6 | 0 | 6 | 39% | 0% | 0% | 0% | 1% | 0% |
| 2.2 | 1.8 | 5 | 0 | 0 | 0 | 0 | 0 | 6 | 0 | 6 | 43% | 0% | 0% | 0% | 1% | 0% |
| 2.6 | 1.8 | 5 | 0 | 0 | 0 | 0 | 0 | 6 | 0 | 6 | 48% | 0% | 0% | 0% | 1% | 0% |
| 0.7 | 1.9 | 5 | 0 | 0 | 0 | 0 | 0 | 6 | 0 | 6 | 21% | 0% | 0% | 0% | 1% | 0% |
| 1.1 | 1.9 | 5 | 0 | 0 | 0 | 0 | 0 | 6 | 0 | 6 | 23% | 0% | 0% | 0% | 1% | 0% |
| 1.3 | 1.9 | 5 | 0 | 0 | 0 | 0 | 0 | 6 | 0 | 6 | 24% | 0% | 0% | 0% | 1% | 0% |
| 1.5 | 1.9 | 5 | 0 | 0 | 0 | 0 | 0 | 6 | 0 | 6 | 25% | 0% | 0% | 0% | 1% | 0% |
| 1.9 | 1.9 | 5 | 0 | 0 | 0 | 0 | 0 | 6 | 0 | 6 | 27% | 0% | 0% | 0% | 1% | 0% |
| 1.2 | 2 | 5 | 0 | 0 | 0 | 0 | 0 | 6 | 0 | 6 | 31% | 0% | 0% | 0% | 1% | 0% |
| 1.6 | 2 | 5 | 0 | 0 | 0 | 0 | 0 | 6 | 0 | 6 | 36% | 0% | 0% | 0% | 1% | 0% |
| 2 | 2 | 5 | 0 | 0 | 0 | 0 | 0 | 6 | 0 | 6 | 41% | 0% | 0% | 0% | 1% | 0% |
| 2.4 | 2 | 5 | 0 | 0 | 0 | 0 | 0 | 6 | 0 | 6 | 46% | 0% | 0% | 0% | 1% | 0% |
| 1 | 2.2 | 5 | 0 | 0 | 0 | 0 | 0 | 6 | 0 | 6 | 29% | 0% | 0% | 0% | 1% | 0% |
| 1.4 | 2.2 | 5 | 0 | 0 | 0 | 0 | 0 | 6 | 0 | 6 | 34% | 0% | 0% | 0% | 1% | 0% |
| 1.8 | 2.2 | 5 | 0 | 0 | 0 | 0 | 0 | 6 | 0 | 6 | 39% | 0% | 0% | 0% | 1% | 0% |
| 1 | 2.4 | 5 | 0 | 0 | 0 | 0 | 0 | 6 | 0 | 6 | 29% | 0% | 0% | 0% | 1% | 0% |
| 1.4 | 2.4 | 5 | 0 | 0 | 0 | 0 | 0 | 6 | 0 | 6 | 34% | 0% | 0% | 0% | 1% | 0% |
| 1.8 | 2.4 | 5 | 0 | 0 | 0 | 0 | 0 | 6 | 0 | 6 | 39% | 0% | 0% | 0% | 1% | 0% |
| 1.2 | 2.6 | 5 | 0 | 0 | 0 | 0 | 0 | 6 | 0 | 6 | 32% | 0% | 0% | 0% | 1% | 0% |
| 1.7 | 1.3 | 10 | 0 | 0 | 0 | 0 | 0 | 6 | 0 | 6 | 29% | 0% | 0% | 0% | 1% | 7% |
| 1.3 | 1.5 | 10 | 0 | 0 | 0 | 0 | 0 | 6 | 0 | 6 | 28% | 0% | 0% | 0% | 1% | 8% |
| 1.5 | 1.5 | 10 | 0 | 0 | 0 | 0 | 0 | 6 | 0 | 6 | 30% | 0% | 0% | 0% | 1% | 0% |
| 1.7 | 1.5 | 10 | 0 | 0 | 0 | 0 | 0 | 6 | 0 | 6 | 32% | 0% | 0% | 0% | 1% | 0% |
| 0.9 | 1.7 | 10 | 0 | 0 | 0 | 0 | 0 | 6 | 0 | 6 | 27% | 0% | 0% | 0% | 1% | 10% |
| 1.1 | 1.7 | 10 | 0 | 0 | 0 | 0 | 0 | 6 | 0 | 6 | 29% | 0% | 0% | 0% | 1% | 0% |
| 1.3 | 1.7 | 10 | 0 | 0 | 0 | 0 | 0 | 6 | 0 | 6 | 30% | 0% | 0% | 0% | 1% | 0% |
| 1.5 | 1.7 | 10 | 0 | 0 | 0 | 0 | 0 | 6 | 0 | 6 | 32% | 0% | 0% | 0% | 1% | 0% |
| 1.9 | 1.7 | 10 | 0 | 0 | 0 | 0 | 0 | 6 | 0 | 6 | 35% | 0% | 0% | 0% | 1% | 0% |
| 0.9 | 1.9 | 10 | 0 | 0 | 0 | 0 | 0 | 6 | 0 | 6 | 28% | 0% | 0% | 0% | 1% | 0% |
| 1.1 | 1.9 | 10 | 0 | 0 | 0 | 0 | 0 | 6 | 0 | 6 | 31% | 0% | 0% | 0% | 1% | 0% |
| 1.3 | 1.9 | 10 | 0 | 0 | 0 | 0 | 0 | 6 | 0 | 6 | 33% | 0% | 0% | 0% | 1% | 0% |
| 1.7 | 1.9 | 10 | 0 | 0 | 0 | 0 | 0 | 6 | 0 | 6 | 35% | 0% | 0% | 0% | 1% | 0% |
| 1.9 | 1.5 | 15 | 0 | 0 | 0 | 0 | 0 | 6 | 0 | 6 | 37% | 0% | 0% | 0% | 1% | 9% |
| 1.5 | 1.7 | 15 | 0 | 0 | 0 | 0 | 0 | 6 | 0 | 6 | 35% | 0% | 0% | 0% | 1% | 9% |
| 1.9 | 1.7 | 15 | 0 | 0 | 0 | 0 | 0 | 6 | 0 | 6 | 40% | 0% | 0% | 0% | 1% | 0% |
| 1.1 | 1.9 | 15 | 0 | 0 | 0 | 0 | 0 | 6 | 0 | 6 | 32% | 0% | 0% | 0% | 1% | 9% |
| 1.3 | 1.9 | 15 | 0 | 0 | 0 | 0 | 0 | 6 | 0 | 6 | 34% | 0% | 0% | 0% | 1% | 0% |
| 1.7 | 1.9 | 15 | 0 | 0 | 0 | 0 | 0 | 6 | 0 | 6 | 39% | 0% | 0% | 0% | 1% | 0% |
| 0.92 | 1.01 | 4 | 0.19 | 0 | 3.09 | 0 | 0.48 | 0.26 | 2 | 6 | 18% | 0% | 0% | 0% | 1% | 0% |
| 0.92 | 1.01 | 7 | 0.19 | 0 | 3.09 | 0 | 0.48 | 0.26 | 2 | 6 | 18% | 0% | 0% | 0% | 1% | 9% |
| 0.8 | 1 | 0 | 1.3 | 0 | 1.5 | 0 | 1.5 | 0.4 | 2 | 6 | 14% | 0% | 0% | 0% | 1% | 5% |
| 0.8 | 1 | 2 | 1.3 | 0 | 1.5 | 0 | 1.5 | 0.4 | 2 | 6 | 15% | 0% | 0% | 0% | 1% | 3% |
| 0.8 | 1 | 4 | 1.3 | 0 | 1.5 | 0 | 1.5 | 0.4 | 2 | 6 | 15% | 0% | 0% | 0% | 1% | 1% |
| 0.8 | 1 | 6 | 1.3 | 0 | 1.5 | 0 | 1.5 | 0.4 | 2 | 6 | 16% | 0% | 0% | 0% | 1% | 1% |
| 1.2 | 0.2 | 5 | 0 | 0 | 0 | 0 | 0 | 0 | 0 | 7 | 17% | 0% | 0% | 0% | 0% | 10% |
| 1.6 | 0.2 | 5 | 0 | 0 | 0 | 0 | 0 | 0 | 0 | 7 | 23% | 0% | 0% | 0% | 0% | 0% |
| 2 | 0.2 | 5 | 0 | 0 | 0 | 0 | 0 | 0 | 0 | 7 | 30% | 0% | 0% | 0% | 0% | 0% |
| 2.4 | 0.2 | 5 | 0 | 0 | 0 | 0 | 0 | 0 | 0 | 7 | 35% | 0% | 0% | 0% | 0% | 0% |
| 2.8 | 0.2 | 5 | 0 | 0 | 0 | 0 | 0 | 0 | 0 | 7 | 40% | 0% | 0% | 0% | 0% | 0% |
| 0.6 | 0.4 | 5 | 0 | 0 | 0 | 0 | 0 | 0 | 0 | 7 | 8% | 0% | 0% | 0% | 0% | 3% |
| 1 | 0.4 | 5 | 0 | 0 | 0 | 0 | 0 | 0 | 0 | 7 | 14% | 0% | 0% | 0% | 0% | 0% |
| 1.4 | 0.4 | 5 | 0 | 0 | 0 | 0 | 0 | 0 | 0 | 7 | 20% | 0% | 0% | 0% | 0% | 0% |
| 1.8 | 0.4 | 5 | 0 | 0 | 0 | 0 | 0 | 0 | 0 | 7 | 26% | 0% | 0% | 0% | 0% | 0% |
| 2.2 | 0.4 | 5 | 0 | 0 | 0 | 0 | 0 | 0 | 0 | 7 | 32% | 0% | 0% | 0% | 0% | 0% |
| 2.6 | 0.4 | 5 | 0 | 0 | 0 | 0 | 0 | 0 | 0 | 7 | 37% | 0% | 0% | 0% | 0% | 0% |
| 3 | 0.4 | 5 | 0 | 0 | 0 | 0 | 0 | 0 | 0 | 7 | 43% | 0% | 0% | 0% | 0% | 0% |
| 0.6 | 0.6 | 5 | 0 | 0 | 0 | 0 | 0 | 0 | 0 | 7 | 8% | 0% | 0% | 0% | 1% | 0% |
| 1 | 0.6 | 5 | 0 | 0 | 0 | 0 | 0 | 0 | 0 | 7 | 14% | 0% | 0% | 0% | 1% | 0% |
| 1.4 | 0.6 | 5 | 0 | 0 | 0 | 0 | 0 | 0 | 0 | 7 | 20% | 0% | 0% | 0% | 1% | 0% |
| 1.8 | 0.6 | 5 | 0 | 0 | 0 | 0 | 0 | 0 | 0 | 7 | 26% | 0% | 0% | 0% | 1% | 0% |
| 2.2 | 0.6 | 5 | 0 | 0 | 0 | 0 | 0 | 0 | 0 | 7 | 32% | 0% | 0% | 0% | 1% | 0% |
| 2.6 | 0.6 | 5 | 0 | 0 | 0 | 0 | 0 | 0 | 0 | 7 | 37% | 0% | 0% | 0% | 1% | 0% |
| 3 | 0.6 | 5 | 0 | 0 | 0 | 0 | 0 | 0 | 0 | 7 | 42% | 0% | 0% | 0% | 1% | 0% |
| 0.4 | 0.8 | 5 | 0 | 0 | 0 | 0 | 0 | 0 | 0 | 7 | 8% | 0% | 0% | 0% | 1% | 0% |
| 0.8 | 0.8 | 5 | 0 | 0 | 0 | 0 | 0 | 0 | 0 | 7 | 11% | 0% | 0% | 0% | 1% | 0% |
| 1.2 | 0.8 | 5 | 0 | 0 | 0 | 0 | 0 | 0 | 0 | 7 | 17% | 0% | 0% | 0% | 1% | 0% |
| 1.6 | 0.8 | 5 | 0 | 0 | 0 | 0 | 0 | 0 | 0 | 7 | 23% | 0% | 0% | 0% | 1% | 0% |
| 2 | 0.8 | 5 | 0 | 0 | 0 | 0 | 0 | 0 | 0 | 7 | 30% | 0% | 0% | 0% | 1% | 0% |
| 0.2 | 1 | 5 | 0 | 0 | 0 | 0 | 0 | 0 | 0 | 7 | 10% | 0% | 0% | 0% | 1% | 0% |
| 0.6 | 1 | 5 | 0 | 0 | 0 | 0 | 0 | 0 | 0 | 7 | 12% | 0% | 0% | 0% | 1% | 0% |
| 1 | 1 | 5 | 0 | 0 | 0 | 0 | 0 | 0 | 0 | 7 | 15% | 0% | 0% | 0% | 1% | 0% |
| 1.4 | 1 | 5 | 0 | 0 | 0 | 0 | 0 | 0 | 0 | 7 | 24% | 0% | 0% | 0% | 1% | 0% |
| 1.2 | 0.2 | 10 | 0 | 0 | 0 | 0 | 0 | 0 | 0 | 7 | 18% | 0% | 0% | 0% | 0% | 0% |
| 1.6 | 0.2 | 10 | 0 | 0 | 0 | 0 | 0 | 0 | 0 | 7 | 23% | 0% | 0% | 0% | 0% | 0% |
| 2 | 0.2 | 10 | 0 | 0 | 0 | 0 | 0 | 0 | 0 | 7 | 29% | 2% | 0% | 0% | 0% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1 | 0.4 | 10 | 0 | 0 | 0 | 0 | 0 | 0 | 0 | 7 | 16% | 0% | 0% | 0% | 0% | 0% |
| 1.4 | 0.4 | 10 | 0 | 0 | 0 | 0 | 0 | 0 | 0 | 7 | 20% | 0% | 0% | 0% | 0% | 0% |
| 1.8 | 0.4 | 10 | 0 | 0 | 0 | 0 | 0 | 0 | 0 | 7 | 26% | 1% | 0% | 0% | 0% | 0% |
| 0.8 | 0.6 | 10 | 0 | 0 | 0 | 0 | 0 | 0 | 0 | 7 | 17% | 0% | 0% | 0% | 1% | 0% |
| 1.2 | 0.6 | 10 | 0 | 0 | 0 | 0 | 0 | 0 | 0 | 7 | 21% | 0% | 0% | 0% | 1% | 0% |
| 1.6 | 0.6 | 10 | 0 | 0 | 0 | 0 | 0 | 0 | 0 | 7 | 24% | 2% | 0% | 0% | 1% | 0% |
| 1.2 | 0.8 | 10 | 0 | 0 | 0 | 0 | 0 | 0 | 0 | 7 | 24% | 0% | 0% | 0% | 1% | 0% |
| 1.6 | 0.8 | 10 | 0 | 0 | 0 | 0 | 0 | 0 | 0 | 7 | 27% | 2% | 0% | 0% | 1% | 0% |
| 1.6 | 1.6 | 10 | 0 | 0 | 0 | 0 | 0 | 0 | 0 | 7 | 30% | 3% | 0% | 0% | 2% | 0% |
| 0.8 | 1 | 0 | 1.3 | 0 | 1.5 | 0 | 1.5 | 0.4 | 0 | 7 | 17% | 1% | 0% | 0% | 1% | 0% |
| 0.8 | 1 | 2 | 1.3 | 0 | 1.5 | 0 | 1.5 | 0.4 | 0 | 7 | 14% | 0% | 0% | 0% | 1% | 0% |
| 0.8 | 1 | 4 | 1.3 | 0 | 1.5 | 0 | 1.5 | 0.4 | 0 | 7 | 14% | 0% | 0% | 0% | 1% | 0% |
| 0.8 | 1 | 6 | 1.3 | 0 | 1.5 | 0 | 1.5 | 0.4 | 0 | 7 | 15% | 0% | 0% | 0% | 1% | 0% |
| 0.8 | 1 | 8 | 1.3 | 0 | 1.5 | 0 | 1.5 | 0.4 | 0 | 7 | 19% | 0% | 0% | 0% | 1% | 0% |
| 1.41 | 1.21 | 3.36 | 0.35 | 0 | 3.5 | 0 | 0.35 | 0.35 | 1.4 | 7 | 16% | 0% | 0% | 0% | 1% | 0% |
| 0.74 | 1.29 | 3.36 | 4.04 | 0 | 3.5 | 0 | 0.44 | 0.35 | 1.4 | 7 | 19% | 0% | 0% | 0% | 1% | 0% |
| 0.92 | 1.01 | 7 | 0.19 | 0 | 3.09 | 0 | 0.48 | 0.26 | 2 | 7 | 16% | 0% | 0% | 0% | 1% | 8% |
| 0.8 | 1 | 0 | 1.3 | 0 | 1.5 | 0 | 1.5 | 0.4 | 2 | 7 | 15% | 0% | 0% | 0% | 1% | 3% |
| 0.8 | 1 | 2 | 1.3 | 0 | 1.5 | 0 | 1.5 | 0.4 | 2 | 7 | 15% | 0% | 0% | 0% | 1% | 1% |
| 0.8 | 1 | 4 | 1.3 | 0 | 1.5 | 0 | 1.5 | 0.4 | 2 | 7 | 15% | 0% | 0% | 0% | 1% | 0% |
| 0.8 | 1 | 6 | 1.3 | 0 | 1.5 | 0 | 1.5 | 0.4 | 2 | 7 | 16% | 0% | 0% | 0% | 1% | 3% |
| 1.5 | 0.5 | 3 | 1 | 0 | 3.5 | 0 | 1 | 0.5 | 0 | 7.5 | 24% | 0% | 0% | 0% | 0% | 5% |
| 1.7 | 0.5 | 3 | 1 | 0 | 3.5 | 0 | 1 | 0.5 | 0 | 7.5 | 27% | 0% | 0% | 0% | 0% | 0% |
| 0.7 | 0.6 | 3 | 1 | 0 | 3.5 | 0 | 1 | 0.5 | 0 | 7.5 | 10% | 0% | 0% | 0% | 0% | 7% |
| 0.9 | 0.6 | 3 | 1 | 0 | 3.5 | 0 | 1 | 0.5 | 0 | 7.5 | 18% | 0% | 0% | 0% | 0% | 0% |
| 1.1 | 0.6 | 3 | 1 | 0 | 3.5 | 0 | 1 | 0.5 | 0 | 7.5 | 20% | 0% | 0% | 0% | 0% | 0% |
| 1.3 | 0.6 | 3 | 1 | 0 | 3.5 | 0 | 1 | 0.5 | 0 | 7.5 | 23% | 0% | 0% | 0% | 0% | 0% |
| 1.5 | 0.6 | 3 | 1 | 0 | 3.5 | 0 | 1 | 0.5 | 0 | 7.5 | 25% | 0% | 0% | 0% | 0% | 0% |
| 1.7 | 0.6 | 3 | 1 | 0 | 3.5 | 0 | 1 | 0.5 | 0 | 7.5 | 28% | 0% | 0% | 0% | 0% | 0% |
| 0.7 | 0.7 | 3 | 1 | 0 | 3.5 | 0 | 1 | 0.5 | 0 | 7.5 | 10% | 0% | 0% | 0% | 0% | 1% |
| 0.9 | 0.7 | 3 | 1 | 0 | 3.5 | 0 | 1 | 0.5 | 0 | 7.5 | 13% | 0% | 0% | 0% | 0% | 0% |
| 1.1 | 0.7 | 3 | 1 | 0 | 3.5 | 0 | 1 | 0.5 | 0 | 7.5 | 21% | 0% | 0% | 0% | 0% | 0% |
| 1.3 | 0.7 | 3 | 1 | 0 | 3.5 | 0 | 1 | 0.5 | 0 | 7.5 | 23% | 0% | 0% | 0% | 0% | 0% |
| 1.5 | 0.7 | 3 | 1 | 0 | 3.5 | 0 | 1 | 0.5 | 0 | 7.5 | 26% | 0% | 0% | 0% | 0% | 0% |
| 1.7 | 0.7 | 3 | 1 | 0 | 3.5 | 0 | 1 | 0.5 | 0 | 7.5 | 28% | 0% | 0% | 0% | 0% | 0% |
| 0.6 | 0.8 | 3 | 1 | 0 | 3.5 | 0 | 1 | 0.5 | 0 | 7.5 | 8% | 0% | 0% | 0% | 1% | 5% |
| 0.8 | 0.8 | 3 | 1 | 0 | 3.5 | 0 | 1 | 0.5 | 0 | 7.5 | 11% | 0% | 0% | 0% | 0% | 0% |
| 1 | 0.8 | 3 | 1 | 0 | 3.5 | 0 | 1 | 0.5 | 0 | 7.5 | 19% | 0% | 0% | 0% | 1% | 0% |
| 1.2 | 0.8 | 3 | 1 | 0 | 3.5 | 0 | 1 | 0.5 | 0 | 7.5 | 22% | 0% | 0% | 0% | 0% | 0% |
| 1.4 | 0.8 | 3 | 1 | 0 | 3.5 | 0 | 1 | 0.5 | 0 | 7.5 | 25% | 0% | 0% | 0% | 0% | 0% |
| 1.6 | 0.8 | 3 | 1 | 0 | 3.5 | 0 | 1 | 0.5 | 0 | 7.5 | 22% | 0% | 0% | 0% | 0% | 0% |
| 1.8 | 0.8 | 3 | 1 | 0 | 3.5 | 0 | 1 | 0.5 | 0 | 7.5 | 30% | 0% | 0% | 0% | 0% | 0% |
| 0.7 | 0.9 | 3 | 1 | 0 | 3.5 | 0 | 1 | 0.5 | 0 | 7.5 | 15% | 0% | 0% | 0% | 1% | 0% |
| 0.9 | 0.9 | 3 | 1 | 0 | 3.5 | 0 | 1 | 0.5 | 0 | 7.5 | 18% | 0% | 0% | 0% | 1% | 0% |
| 1.1 | 0.9 | 3 | 1 | 0 | 3.5 | 0 | 1 | 0.5 | 0 | 7.5 | 21% | 0% | 0% | 0% | 1% | 0% |
| 1.3 | 0.9 | 3 | 1 | 0 | 3.5 | 0 | 1 | 0.5 | 0 | 7.5 | 18% | 0% | 0% | 0% | 1% | 0% |
| 1.5 | 0.9 | 3 | 1 | 0 | 3.5 | 0 | 1 | 0.5 | 0 | 7.5 | 26% | 0% | 0% | 0% | 1% | 0% |
| 1.7 | 0.9 | 3 | 1 | 0 | 3.5 | 0 | 1 | 0.5 | 0 | 7.5 | 24% | 0% | 0% | 0% | 1% | 0% |
| 0.6 | 1 | 3 | 1 | 0 | 3.5 | 0 | 1 | 0.5 | 0 | 7.5 | 8% | 0% | 0% | 0% | 1% | 0% |
| 0.8 | 1 | 3 | 1 | 0 | 3.5 | 0 | 1 | 0.5 | 0 | 7.5 | 17% | 0% | 0% | 0% | 1% | 0% |
| 1 | 1 | 3 | 1 | 0 | 3.5 | 0 | 1 | 0.5 | 0 | 7.5 | 19% | 0% | 0% | 0% | 1% | 0% |
| 1.2 | 1 | 3 | 1 | 0 | 3.5 | 0 | 1 | 0.5 | 0 | 7.5 | 22% | 0% | 0% | 0% | 1% | 0% |
| 1.4 | 1 | 3 | 1 | 0 | 3.5 | 0 | 1 | 0.5 | 0 | 7.5 | 25% | 0% | 0% | 0% | 1% | 0% |
| 1.6 | 1 | 3 | 1 | 0 | 3.5 | 0 | 1 | 0.5 | 0 | 7.5 | 28% | 0% | 0% | 0% | 1% | 0% |
| 1.8 | 1 | 3 | 1 | 0 | 3.5 | 0 | 1 | 0.5 | 0 | 7.5 | 26% | 0% | 0% | 0% | 1% | 0% |
| 0.7 | 1.1 | 3 | 1 | 0 | 3.5 | 0 | 1 | 0.5 | 0 | 7.5 | 15% | 0% | 0% | 0% | 1% | 0% |
| 0.9 | 1.1 | 3 | 1 | 0 | 3.5 | 0 | 1 | 0.5 | 0 | 7.5 | 18% | 0% | 0% | 0% | 1% | 0% |
| 1.1 | 1.1 | 3 | 1 | 0 | 3.5 | 0 | 1 | 0.5 | 0 | 7.5 | 15% | 0% | 0% | 0% | 1% | 0% |
| 1.3 | 1.1 | 3 | 1 | 0 | 3.5 | 0 | 1 | 0.5 | 0 | 7.5 | 23% | 0% | 0% | 0% | 1% | 0% |
| 1.5 | 1.1 | 3 | 1 | 0 | 3.5 | 0 | 1 | 0.5 | 0 | 7.5 | 26% | 0% | 0% | 0% | 1% | 0% |
| 1.7 | 1.1 | 3 | 1 | 0 | 3.5 | 0 | 1 | 0.5 | 0 | 7.5 | 29% | 0% | 0% | 0% | 1% | 0% |
| 0.6 | 1.2 | 3 | 1 | 0 | 3.5 | 0 | 1 | 0.5 | 0 | 7.5 | 14% | 0% | 0% | 0% | 1% | 0% |
| 0.8 | 1.2 | 3 | 1 | 0 | 3.5 | 0 | 1 | 0.5 | 0 | 7.5 | 11% | 0% | 0% | 0% | 1% | 0% |
| 1 | 1.2 | 3 | 1 | 0 | 3.5 | 0 | 1 | 0.5 | 0 | 7.5 | 14% | 0% | 0% | 0% | 1% | 0% |
| 1.2 | 1.2 | 3 | 1 | 0 | 3.5 | 0 | 1 | 0.5 | 0 | 7.5 | 22% | 0% | 0% | 0% | 1% | 0% |
| 1.4 | 1.2 | 3 | 1 | 0 | 3.5 | 0 | 1 | 0.5 | 0 | 7.5 | 25% | 0% | 0% | 0% | 1% | 0% |
| 1.6 | 1.2 | 3 | 1 | 0 | 3.5 | 0 | 1 | 0.5 | 0 | 7.5 | 28% | 0% | 0% | 0% | 1% | 0% |
| 1.8 | 1.2 | 3 | 1 | 0 | 3.5 | 0 | 1 | 0.5 | 0 | 7.5 | 25% | 0% | 0% | 0% | 1% | 0% |
| 0.7 | 1.3 | 3 | 1 | 0 | 3.5 | 0 | 1 | 0.5 | 0 | 7.5 | 15% | 0% | 0% | 0% | 1% | 0% |
| 0.9 | 1.3 | 3 | 1 | 0 | 3.5 | 0 | 1 | 0.5 | 0 | 7.5 | 12% | 0% | 0% | 0% | 1% | 0% |
| 1.1 | 1.3 | 3 | 1 | 0 | 3.5 | 0 | 1 | 0.5 | 0 | 7.5 | 15% | 0% | 0% | 0% | 1% | 0% |
| 1.3 | 1.3 | 3 | 1 | 0 | 3.5 | 0 | 1 | 0.5 | 0 | 7.5 | 23% | 0% | 0% | 0% | 1% | 0% |
| 1.5 | 1.3 | 3 | 1 | 0 | 3.5 | 0 | 1 | 0.5 | 0 | 7.5 | 26% | 0% | 0% | 0% | 1% | 0% |
| 1.7 | 1.3 | 3 | 1 | 0 | 3.5 | 0 | 1 | 0.5 | 0 | 7.5 | 30% | 0% | 0% | 0% | 1% | 0% |
| 0.6 | 1.4 | 3 | 1 | 0 | 3.5 | 0 | 1 | 0.5 | 0 | 7.5 | 14% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 0.8 | 1.4 | 3 | 1 | 0 | 3.5 | 0 | 1 | 0.5 | 0 | 7.5 | 11% | 0% | 0% | 0% | 1% | 0% |
| 1 | 1.4 | 3 | 1 | 0 | 3.5 | 0 | 1 | 0.5 | 0 | 7.5 | 14% | 0% | 0% | 0% | 1% | 0% |
| 1.2 | 1.4 | 3 | 1 | 0 | 3.5 | 0 | 1 | 0.5 | 0 | 7.5 | 17% | 0% | 0% | 0% | 1% | 0% |
| 1.4 | 1.4 | 3 | 1 | 0 | 3.5 | 0 | 1 | 0.5 | 0 | 7.5 | 27% | 0% | 0% | 0% | 1% | 0% |
| 1.6 | 1.4 | 3 | 1 | 0 | 3.5 | 0 | 1 | 0.5 | 0 | 7.5 | 31% | 0% | 0% | 0% | 1% | 0% |
| 0.7 | 1.5 | 3 | 1 | 0 | 3.5 | 0 | 1 | 0.5 | 0 | 7.5 | 10% | 0% | 0% | 0% | 1% | 0% |
| 0.9 | 1.5 | 3 | 1 | 0 | 3.5 | 0 | 1 | 0.5 | 0 | 7.5 | 18% | 0% | 0% | 0% | 1% | 0% |
| 1.1 | 1.5 | 3 | 1 | 0 | 3.5 | 0 | 1 | 0.5 | 0 | 7.5 | 15% | 0% | 0% | 0% | 1% | 0% |
| 1.1 | 0.6 | 7 | 1 | 0 | 3.5 | 0 | 1 | 0.5 | 0 | 7.5 | 21% | 0% | 0% | 0% | 0% | 0% |
| 1.3 | 0.6 | 7 | 1 | 0 | 3.5 | 0 | 1 | 0.5 | 0 | 7.5 | 24% | 0% | 0% | 0% | 0% | 0% |
| 1.5 | 0.6 | 7 | 1 | 0 | 3.5 | 0 | 1 | 0.5 | 0 | 7.5 | 27% | 0% | 0% | 0% | 0% | 0% |
| 0.7 | 0.7 | 7 | 1 | 0 | 3.5 | 0 | 1 | 0.5 | 0 | 7.5 | 15% | 0% | 0% | 0% | 0% | 0% |
| 0.9 | 0.7 | 7 | 1 | 0 | 3.5 | 0 | 1 | 0.5 | 0 | 7.5 | 18% | 0% | 0% | 0% | 0% | 0% |
| 1.1 | 0.7 | 7 | 1 | 0 | 3.5 | 0 | 1 | 0.5 | 0 | 7.5 | 21% | 0% | 0% | 0% | 0% | 0% |
| 1.3 | 0.7 | 7 | 1 | 0 | 3.5 | 0 | 1 | 0.5 | 0 | 7.5 | 24% | 0% | 0% | 0% | 0% | 0% |
| 1.5 | 0.7 | 7 | 1 | 0 | 3.5 | 0 | 1 | 0.5 | 0 | 7.5 | 27% | 0% | 0% | 0% | 0% | 0% |
| 1.7 | 0.7 | 7 | 1 | 0 | 3.5 | 0 | 1 | 0.5 | 0 | 7.5 | 24% | 2% | 0% | 0% | 0% | 0% |
| 0.6 | 0.8 | 7 | 1 | 0 | 3.5 | 0 | 1 | 0.5 | 0 | 7.5 | 14% | 0% | 0% | 0% | 0% | 0% |
| 0.8 | 0.8 | 7 | 1 | 0 | 3.5 | 0 | 1 | 0.5 | 0 | 7.5 | 17% | 0% | 0% | 0% | 0% | 0% |
| 1 | 0.8 | 7 | 1 | 0 | 3.5 | 0 | 1 | 0.5 | 0 | 7.5 | 20% | 0% | 0% | 0% | 1% | 0% |
| 1.2 | 0.8 | 7 | 1 | 0 | 3.5 | 0 | 1 | 0.5 | 0 | 7.5 | 22% | 0% | 0% | 0% | 1% | 0% |
| 1.4 | 0.8 | 7 | 1 | 0 | 3.5 | 0 | 1 | 0.5 | 0 | 7.5 | 25% | 0% | 0% | 0% | 0% | 0% |
| 1.6 | 0.8 | 7 | 1 | 0 | 3.5 | 0 | 1 | 0.5 | 0 | 7.5 | 23% | 3% | 0% | 0% | 0% | 0% |
| 1.8 | 0.8 | 7 | 1 | 0 | 3.5 | 0 | 1 | 0.5 | 0 | 7.5 | 31% | 4% | 0% | 0% | 0% | 0% |
| 0.7 | 0.9 | 7 | 1 | 0 | 3.5 | 0 | 1 | 0.5 | 0 | 7.5 | 15% | 0% | 0% | 0% | 1% | 0% |
| 0.9 | 0.9 | 7 | 1 | 0 | 3.5 | 0 | 1 | 0.5 | 0 | 7.5 | 18% | 0% | 0% | 0% | 1% | 0% |
| 1.1 | 0.9 | 7 | 1 | 0 | 3.5 | 0 | 1 | 0.5 | 0 | 7.5 | 21% | 0% | 0% | 0% | 0% | 0% |
| 1.3 | 0.9 | 7 | 1 | 0 | 3.5 | 0 | 1 | 0.5 | 0 | 7.5 | 24% | 1% | 0% | 0% | 0% | 0% |
| 1.5 | 0.9 | 7 | 1 | 0 | 3.5 | 0 | 1 | 0.5 | 0 | 7.5 | 21% | 2% | 0% | 0% | 1% | 0% |
| 1.7 | 0.9 | 7 | 1 | 0 | 3.5 | 0 | 1 | 0.5 | 0 | 7.5 | 29% | 4% | 0% | 0% | 1% | 0% |
| 0.6 | 1 | 7 | 1 | 0 | 3.5 | 0 | 1 | 0.5 | 0 | 7.5 | 15% | 0% | 0% | 0% | 1% | 0% |
| 0.8 | 1 | 7 | 1 | 0 | 3.5 | 0 | 1 | 0.5 | 0 | 7.5 | 17% | 0% | 0% | 0% | 1% | 0% |
| 1 | 1 | 7 | 1 | 0 | 3.5 | 0 | 1 | 0.5 | 0 | 7.5 | 14% | 0% | 0% | 0% | 1% | 0% |
| 1.2 | 1 | 7 | 1 | 0 | 3.5 | 0 | 1 | 0.5 | 0 | 7.5 | 17% | 0% | 0% | 0% | 1% | 0% |
| 1.4 | 1 | 7 | 1 | 0 | 3.5 | 0 | 1 | 0.5 | 0 | 7.5 | 20% | 2% | 0% | 0% | 1% | 0% |
| 1.6 | 1 | 7 | 1 | 0 | 3.5 | 0 | 1 | 0.5 | 0 | 7.5 | 28% | 3% | 0% | 0% | 1% | 0% |
| 1.8 | 1 | 7 | 1 | 0 | 3.5 | 0 | 1 | 0.5 | 0 | 7.5 | 31% | 5% | 0% | 0% | 1% | 0% |
| 0.7 | 1.1 | 7 | 1 | 0 | 3.5 | 0 | 1 | 0.5 | 0 | 7.5 | 17% | 0% | 0% | 0% | 1% | 0% |
| 0.9 | 1.1 | 7 | 1 | 0 | 3.5 | 0 | 1 | 0.5 | 0 | 7.5 | 19% | 0% | 0% | 0% | 1% | 0% |
| 1.1 | 1.1 | 7 | 1 | 0 | 3.5 | 0 | 1 | 0.5 | 0 | 7.5 | 21% | 0% | 0% | 0% | 1% | 0% |
| 1.3 | 1.1 | 7 | 1 | 0 | 3.5 | 0 | 1 | 0.5 | 0 | 7.5 | 24% | 1% | 0% | 0% | 1% | 0% |
| 1.5 | 1.1 | 7 | 1 | 0 | 3.5 | 0 | 1 | 0.5 | 0 | 7.5 | 27% | 3% | 0% | 0% | 1% | 0% |
| 1.7 | 1.1 | 7 | 1 | 0 | 3.5 | 0 | 1 | 0.5 | 0 | 7.5 | 29% | 4% | 0% | 0% | 1% | 0% |
| 0.6 | 1.2 | 7 | 1 | 0 | 3.5 | 0 | 1 | 0.5 | 0 | 7.5 | 12% | 0% | 0% | 0% | 1% | 0% |
| 0.8 | 1.2 | 7 | 1 | 0 | 3.5 | 0 | 1 | 0.5 | 0 | 7.5 | 19% | 0% | 0% | 0% | 1% | 0% |
| 1 | 1.2 | 7 | 1 | 0 | 3.5 | 0 | 1 | 0.5 | 0 | 7.5 | 21% | 0% | 0% | 0% | 1% | 0% |
| 1.2 | 1.2 | 7 | 1 | 0 | 3.5 | 0 | 1 | 0.5 | 0 | 7.5 | 23% | 1% | 0% | 0% | 1% | 0% |
| 1.4 | 1.2 | 7 | 1 | 0 | 3.5 | 0 | 1 | 0.5 | 0 | 7.5 | 20% | 2% | 0% | 0% | 1% | 0% |
| 1.6 | 1.2 | 7 | 1 | 0 | 3.5 | 0 | 1 | 0.5 | 0 | 7.5 | 28% | 4% | 0% | 0% | 1% | 0% |
| 1.8 | 1.2 | 7 | 1 | 0 | 3.5 | 0 | 1 | 0.5 | 0 | 7.5 | 30% | 5% | 0% | 0% | 1% | 0% |
| 0.7 | 1.3 | 7 | 1 | 0 | 3.5 | 0 | 1 | 0.5 | 0 | 7.5 | 14% | 0% | 0% | 0% | 1% | 0% |
| 0.9 | 1.3 | 7 | 1 | 0 | 3.5 | 0 | 1 | 0.5 | 0 | 7.5 | 16% | 0% | 0% | 0% | 1% | 0% |
| 1.1 | 1.3 | 7 | 1 | 0 | 3.5 | 0 | 1 | 0.5 | 0 | 7.5 | 17% | 0% | 0% | 0% | 1% | 0% |
| 1.3 | 1.3 | 7 | 1 | 0 | 3.5 | 0 | 1 | 0.5 | 0 | 7.5 | 18% | 1% | 0% | 0% | 1% | 0% |
| 1.5 | 1.3 | 7 | 1 | 0 | 3.5 | 0 | 1 | 0.5 | 0 | 7.5 | 21% | 3% | 0% | 0% | 1% | 0% |
| 1.7 | 1.3 | 7 | 1 | 0 | 3.5 | 0 | 1 | 0.5 | 0 | 7.5 | 29% | 4% | 0% | 0% | 1% | 0% |
| 0.7 | 1.4 | 7 | 1 | 0 | 3.5 | 0 | 1 | 0.5 | 0 | 7.5 | 15% | 0% | 0% | 0% | 1% | 0% |
| 0.9 | 1.4 | 7 | 1 | 0 | 3.5 | 0 | 1 | 0.5 | 0 | 7.5 | 23% | 0% | 0% | 0% | 1% | 0% |
| 1.1 | 1.4 | 7 | 1 | 0 | 3.5 | 0 | 1 | 0.5 | 0 | 7.5 | 18% | 0% | 0% | 0% | 1% | 0% |
| 1.3 | 1.4 | 7 | 1 | 0 | 3.5 | 0 | 1 | 0.5 | 0 | 7.5 | 19% | 1% | 0% | 0% | 1% | 0% |
| 1.5 | 1.4 | 7 | 1 | 0 | 3.5 | 0 | 1 | 0.5 | 0 | 7.5 | 27% | 3% | 0% | 0% | 1% | 0% |
| 1.7 | 1.4 | 7 | 1 | 0 | 3.5 | 0 | 1 | 0.5 | 0 | 7.5 | 29% | 4% | 0% | 0% | 1% | 0% |
| 0.7 | 1.5 | 7 | 1 | 0 | 3.5 | 0 | 1 | 0.5 | 0 | 7.5 | 22% | 0% | 0% | 0% | 1% | 0% |
| 0.9 | 1.5 | 7 | 1 | 0 | 3.5 | 0 | 1 | 0.5 | 0 | 7.5 | 18% | 0% | 0% | 0% | 1% | 0% |
| 1.1 | 1.5 | 7 | 1 | 0 | 3.5 | 0 | 1 | 0.5 | 0 | 7.5 | 25% | 0% | 0% | 0% | 1% | 0% |
| 1.3 | 1.5 | 7 | 1 | 0 | 3.5 | 0 | 1 | 0.5 | 0 | 7.5 | 21% | 1% | 0% | 0% | 1% | 0% |
| 1.5 | 1.5 | 7 | 1 | 0 | 3.5 | 0 | 1 | 0.5 | 0 | 7.5 | 22% | 3% | 0% | 0% | 1% | 0% |
| 1.7 | 1.5 | 7 | 1 | 0 | 3.5 | 0 | 1 | 0.5 | 0 | 7.5 | 30% | 4% | 0% | 0% | 1% | 0% |
| 0.8 | 1 | 1 | 1.3 | 0 | 1.5 | 0 | 1.5 | 0.4 | 0 | 8 | 14% | 1% | 0% | 0% | 1% | 0% |
| 0.8 | 1 | 3 | 1.3 | 0 | 1.5 | 0 | 1.5 | 0.4 | 0 | 8 | 14% | 0% | 0% | 0% | 1% | 0% |
| 0.8 | 1 | 5 | 1.3 | 0 | 1.5 | 0 | 1.5 | 0.4 | 0 | 8 | 14% | 0% | 0% | 0% | 1% | 0% |
| 0.8 | 1 | 7 | 1.3 | 0 | 1.5 | 0 | 1.5 | 0.4 | 0 | 8 | 18% | 0% | 0% | 0% | 1% | 0% |
| 0.8 | 1 | 9 | 1.3 | 0 | 1.5 | 0 | 1.5 | 0.4 | 0 | 8 | 21% | 0% | 0% | 0% | 1% | 0% |
| 1.3 | 0.5 | 5 | 0 | 0 | 0 | 0 | 0 | 2 | 0 | 8 | 15% | 0% | 0% | 0% | 1% | 0% |
| 1.5 | 0.5 | 5 | 0 | 0 | 0 | 0 | 0 | 2 | 0 | 8 | 17% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.7 | 0.5 | 5 | 0 | 0 | 0 | 0 | 0 | 2 | 0 | 8 | 18% | 0% | 0% | 0% | 1% | 0% |
| 0.7 | 0.7 | 5 | 0 | 0 | 0 | 0 | 0 | 2 | 0 | 8 | 12% | 0% | 0% | 0% | 1% | 0% |
| 1.1 | 0.7 | 5 | 0 | 0 | 0 | 0 | 0 | 2 | 0 | 8 | 16% | 0% | 0% | 0% | 1% | 0% |
| 1.3 | 0.7 | 5 | 0 | 0 | 0 | 0 | 0 | 2 | 0 | 8 | 17% | 0% | 0% | 0% | 1% | 0% |
| 1.5 | 0.7 | 5 | 0 | 0 | 0 | 0 | 0 | 2 | 0 | 8 | 18% | 0% | 0% | 0% | 1% | 0% |
| 1.9 | 0.7 | 5 | 0 | 0 | 0 | 0 | 0 | 2 | 0 | 8 | 20% | 0% | 0% | 0% | 1% | 0% |
| 0.7 | 0.9 | 5 | 0 | 0 | 0 | 0 | 0 | 2 | 0 | 8 | 14% | 0% | 0% | 0% | 1% | 0% |
| 1.1 | 0.9 | 5 | 0 | 0 | 0 | 0 | 0 | 2 | 0 | 8 | 17% | 0% | 0% | 0% | 1% | 0% |
| 1.3 | 0.9 | 5 | 0 | 0 | 0 | 0 | 0 | 2 | 0 | 8 | 18% | 0% | 0% | 0% | 1% | 0% |
| 1.5 | 0.9 | 5 | 0 | 0 | 0 | 0 | 0 | 2 | 0 | 8 | 19% | 0% | 0% | 0% | 1% | 0% |
| 1.9 | 0.9 | 5 | 0 | 0 | 0 | 0 | 0 | 2 | 0 | 8 | 21% | 0% | 0% | 0% | 1% | 0% |
| 0.7 | 1.1 | 5 | 0 | 0 | 0 | 0 | 0 | 2 | 0 | 8 | 16% | 0% | 0% | 0% | 1% | 0% |
| 1.1 | 1.1 | 5 | 0 | 0 | 0 | 0 | 0 | 2 | 0 | 8 | 18% | 0% | 0% | 0% | 1% | 0% |
| 1.3 | 1.1 | 5 | 0 | 0 | 0 | 0 | 0 | 2 | 0 | 8 | 19% | 0% | 0% | 0% | 1% | 0% |
| 1.5 | 1.1 | 5 | 0 | 0 | 0 | 0 | 0 | 2 | 0 | 8 | 20% | 0% | 0% | 0% | 1% | 0% |
| 1.9 | 1.1 | 5 | 0 | 0 | 0 | 0 | 0 | 2 | 0 | 8 | 25% | 0% | 0% | 0% | 1% | 0% |
| 0.7 | 1.3 | 5 | 0 | 0 | 0 | 0 | 0 | 2 | 0 | 8 | 16% | 0% | 0% | 0% | 1% | 0% |
| 1.1 | 1.3 | 5 | 0 | 0 | 0 | 0 | 0 | 2 | 0 | 8 | 19% | 0% | 0% | 0% | 1% | 0% |
| 0.7 | 1.5 | 5 | 0 | 0 | 0 | 0 | 0 | 2 | 0 | 8 | 16% | 0% | 0% | 0% | 1% | 0% |
| 0.5 | 1.7 | 5 | 0 | 0 | 0 | 0 | 0 | 2 | 0 | 8 | 17% | 0% | 0% | 0% | 1% | 0% |
| 1.1 | 0.7 | 10 | 0 | 0 | 0 | 0 | 0 | 2 | 0 | 8 | 21% | 0% | 0% | 0% | 1% | 7% |
| 1.3 | 0.7 | 10 | 0 | 0 | 0 | 0 | 0 | 2 | 0 | 8 | 24% | 0% | 0% | 0% | 1% | 0% |
| 1.5 | 0.7 | 10 | 0 | 0 | 0 | 0 | 0 | 2 | 0 | 8 | 26% | 0% | 0% | 0% | 1% | 0% |
| 1.9 | 0.7 | 10 | 0 | 0 | 0 | 0 | 0 | 2 | 0 | 8 | 29% | 0% | 0% | 0% | 1% | 0% |
| 0.9 | 0.9 | 10 | 0 | 0 | 0 | 0 | 0 | 2 | 0 | 8 | 19% | 0% | 0% | 0% | 1% | 0% |
| 1.3 | 0.9 | 10 | 0 | 0 | 0 | 0 | 0 | 2 | 0 | 8 | 24% | 0% | 0% | 0% | 1% | 0% |
| 1.5 | 0.9 | 10 | 0 | 0 | 0 | 0 | 0 | 2 | 0 | 8 | 27% | 0% | 0% | 0% | 1% | 0% |
| 1.7 | 0.9 | 10 | 0 | 0 | 0 | 0 | 0 | 2 | 0 | 8 | 30% | 0% | 0% | 0% | 1% | 0% |
| 0.5 | 1.1 | 10 | 0 | 0 | 0 | 0 | 0 | 2 | 0 | 8 | 18% | 0% | 0% | 0% | 1% | 1% |
| 0.9 | 1.1 | 10 | 0 | 0 | 0 | 0 | 0 | 2 | 0 | 8 | 22% | 0% | 0% | 0% | 1% | 0% |
| 1.3 | 1.1 | 10 | 0 | 0 | 0 | 0 | 0 | 2 | 0 | 8 | 26% | 0% | 0% | 0% | 1% | 0% |
| 1.5 | 1.1 | 10 | 0 | 0 | 0 | 0 | 0 | 2 | 0 | 8 | 27% | 0% | 0% | 0% | 1% | 0% |
| 1.7 | 1.1 | 10 | 0 | 0 | 0 | 0 | 0 | 2 | 0 | 8 | 30% | 0% | 0% | 0% | 1% | 0% |
| 0.9 | 1.3 | 10 | 0 | 0 | 0 | 0 | 0 | 2 | 0 | 8 | 25% | 0% | 0% | 0% | 1% | 0% |
| 1.3 | 1.3 | 10 | 0 | 0 | 0 | 0 | 0 | 2 | 0 | 8 | 28% | 0% | 0% | 0% | 1% | 0% |
| 1.5 | 1.3 | 10 | 0 | 0 | 0 | 0 | 0 | 2 | 0 | 8 | 29% | 0% | 0% | 0% | 1% | 0% |
| 1.7 | 1.3 | 10 | 0 | 0 | 0 | 0 | 0 | 2 | 0 | 8 | 31% | 0% | 0% | 0% | 1% | 0% |
| 1.3 | 1.5 | 10 | 0 | 0 | 0 | 0 | 0 | 2 | 0 | 8 | 31% | 0% | 0% | 0% | 1% | 0% |
| 1.7 | 0.7 | 15 | 0 | 0 | 0 | 0 | 0 | 2 | 0 | 8 | 30% | 0% | 0% | 0% | 1% | 2% |
| 1.3 | 0.9 | 15 | 0 | 0 | 0 | 0 | 0 | 2 | 0 | 8 | 28% | 0% | 0% | 0% | 1% | 9% |
| 1.5 | 0.9 | 15 | 0 | 0 | 0 | 0 | 0 | 2 | 0 | 8 | 30% | 0% | 0% | 0% | 1% | 0% |
| 1.7 | 0.9 | 15 | 0 | 0 | 0 | 0 | 0 | 2 | 0 | 8 | 32% | 0% | 0% | 0% | 1% | 0% |
| 1.1 | 1.1 | 15 | 0 | 0 | 0 | 0 | 0 | 2 | 0 | 8 | 29% | 0% | 0% | 0% | 1% | 4% |
| 1.3 | 1.1 | 15 | 0 | 0 | 0 | 0 | 0 | 2 | 0 | 8 | 31% | 0% | 0% | 0% | 1% | 0% |
| 1.5 | 1.1 | 15 | 0 | 0 | 0 | 0 | 0 | 2 | 0 | 8 | 33% | 0% | 0% | 0% | 1% | 0% |
| 1.9 | 1.1 | 15 | 0 | 0 | 0 | 0 | 0 | 2 | 0 | 8 | 37% | 0% | 0% | 0% | 1% | 0% |
| 1.5 | 0.7 | 5 | 0 | 0 | 0 | 0 | 0 | 4 | 0 | 8 | 18% | 0% | 0% | 0% | 1% | 5% |
| 1.9 | 0.7 | 5 | 0 | 0 | 0 | 0 | 0 | 4 | 0 | 8 | 21% | 0% | 0% | 0% | 1% | 0% |
| 1.3 | 0.9 | 5 | 0 | 0 | 0 | 0 | 0 | 4 | 0 | 8 | 18% | 0% | 0% | 0% | 1% | 0% |
| 1.5 | 0.9 | 5 | 0 | 0 | 0 | 0 | 0 | 4 | 0 | 8 | 20% | 0% | 0% | 0% | 1% | 0% |
| 1.7 | 0.9 | 5 | 0 | 0 | 0 | 0 | 0 | 4 | 0 | 8 | 21% | 0% | 0% | 0% | 1% | 0% |
| 0.7 | 1.1 | 5 | 0 | 0 | 0 | 0 | 0 | 4 | 0 | 8 | 15% | 0% | 0% | 0% | 1% | 0% |
| 1.1 | 1.1 | 5 | 0 | 0 | 0 | 0 | 0 | 4 | 0 | 8 | 19% | 0% | 0% | 0% | 1% | 0% |
| 1.3 | 1.1 | 5 | 0 | 0 | 0 | 0 | 0 | 4 | 0 | 8 | 20% | 0% | 0% | 0% | 1% | 0% |
| 1.5 | 1.1 | 5 | 0 | 0 | 0 | 0 | 0 | 4 | 0 | 8 | 21% | 0% | 0% | 0% | 1% | 0% |
| 1.9 | 1.1 | 5 | 0 | 0 | 0 | 0 | 0 | 4 | 0 | 8 | 24% | 0% | 0% | 0% | 1% | 0% |
| 0.7 | 1.3 | 5 | 0 | 0 | 0 | 0 | 0 | 4 | 0 | 8 | 17% | 0% | 0% | 0% | 1% | 0% |
| 1.1 | 1.3 | 5 | 0 | 0 | 0 | 0 | 0 | 4 | 0 | 8 | 20% | 0% | 0% | 0% | 1% | 0% |
| 1.3 | 1.3 | 5 | 0 | 0 | 0 | 0 | 0 | 4 | 0 | 8 | 21% | 0% | 0% | 0% | 1% | 0% |
| 1.5 | 1.3 | 5 | 0 | 0 | 0 | 0 | 0 | 4 | 0 | 8 | 16% | 0% | 0% | 0% | 1% | 0% |
| 1.9 | 1.3 | 5 | 0 | 0 | 0 | 0 | 0 | 4 | 0 | 8 | 24% | 0% | 0% | 0% | 1% | 0% |
| 0.7 | 1.5 | 5 | 0 | 0 | 0 | 0 | 0 | 4 | 0 | 8 | 19% | 0% | 0% | 0% | 1% | 0% |
| 1.1 | 1.5 | 5 | 0 | 0 | 0 | 0 | 0 | 4 | 0 | 8 | 21% | 0% | 0% | 0% | 1% | 0% |
| 1.3 | 1.5 | 5 | 0 | 0 | 0 | 0 | 0 | 4 | 0 | 8 | 22% | 0% | 0% | 0% | 1% | 0% |
| 1.5 | 1.5 | 5 | 0 | 0 | 0 | 0 | 0 | 4 | 0 | 8 | 23% | 0% | 0% | 0% | 1% | 0% |
| 1.7 | 1.5 | 5 | 0 | 0 | 0 | 0 | 0 | 4 | 0 | 8 | 24% | 0% | 0% | 0% | 1% | 0% |
| 0.7 | 1.7 | 5 | 0 | 0 | 0 | 0 | 0 | 4 | 0 | 8 | 20% | 0% | 0% | 0% | 1% | 0% |
| 1.1 | 1.7 | 5 | 0 | 0 | 0 | 0 | 0 | 4 | 0 | 8 | 22% | 0% | 0% | 0% | 1% | 0% |
| 1.3 | 1.7 | 5 | 0 | 0 | 0 | 0 | 0 | 4 | 0 | 8 | 23% | 0% | 0% | 0% | 1% | 0% |
| 0.5 | 1.9 | 5 | 0 | 0 | 0 | 0 | 0 | 4 | 0 | 8 | 19% | 0% | 0% | 0% | 1% | 0% |
| 0.9 | 1.9 | 5 | 0 | 0 | 0 | 0 | 0 | 4 | 0 | 8 | 22% | 0% | 0% | 0% | 1% | 0% |
| 1.1 | 1.9 | 5 | 0 | 0 | 0 | 0 | 0 | 4 | 0 | 8 | 23% | 0% | 0% | 0% | 1% | 0% |
| 1.5 | 0.9 | 10 | 0 | 0 | 0 | 0 | 0 | 4 | 0 | 8 | 25% | 0% | 0% | 0% | 1% | 9% |
| 1.7 | 0.9 | 10 | 0 | 0 | 0 | 0 | 0 | 4 | 0 | 8 | 27% | 0% | 0% | 0% | 1% | 0% |
| 1.3 | 1.1 | 10 | 0 | 0 | 0 | 0 | 0 | 4 | 0 | 8 | 26% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.5 | 1.1 | 10 | 0 | 0 | 0 | 0 | 0 | 4 | 0 | 8 | 28% | 0% | 0% | 0% | 1% | 0% |
| 1.7 | 1.1 | 10 | 0 | 0 | 0 | 0 | 0 | 4 | 0 | 8 | 30% | 0% | 0% | 0% | 1% | 0% |
| 0.9 | 1.3 | 10 | 0 | 0 | 0 | 0 | 0 | 4 | 0 | 8 | 23% | 0% | 0% | 0% | 1% | 2% |
| 1.3 | 1.3 | 10 | 0 | 0 | 0 | 0 | 0 | 4 | 0 | 8 | 29% | 0% | 0% | 0% | 1% | 0% |
| 1.5 | 1.3 | 10 | 0 | 0 | 0 | 0 | 0 | 4 | 0 | 8 | 31% | 0% | 0% | 0% | 1% | 0% |
| 1.7 | 1.3 | 10 | 0 | 0 | 0 | 0 | 0 | 4 | 0 | 8 | 32% | 0% | 0% | 0% | 1% | 0% |
| 0.5 | 1.5 | 10 | 0 | 0 | 0 | 0 | 0 | 4 | 0 | 8 | 20% | 0% | 0% | 0% | 1% | 4% |
| 0.9 | 1.5 | 10 | 0 | 0 | 0 | 0 | 0 | 4 | 0 | 8 | 24% | 0% | 0% | 0% | 1% | 0% |
| 1.1 | 1.5 | 10 | 0 | 0 | 0 | 0 | 0 | 4 | 0 | 8 | 27% | 0% | 0% | 0% | 1% | 0% |
| 1.3 | 1.5 | 10 | 0 | 0 | 0 | 0 | 0 | 4 | 0 | 8 | 29% | 0% | 0% | 0% | 1% | 0% |
| 1.5 | 1.5 | 10 | 0 | 0 | 0 | 0 | 0 | 4 | 0 | 8 | 32% | 0% | 0% | 0% | 1% | 0% |
| 1.9 | 1.5 | 10 | 0 | 0 | 0 | 0 | 0 | 4 | 0 | 8 | 35% | 0% | 0% | 0% | 1% | 0% |
| 0.7 | 1.7 | 10 | 0 | 0 | 0 | 0 | 0 | 4 | 0 | 8 | 25% | 0% | 0% | 0% | 1% | 0% |
| 1.1 | 1.7 | 10 | 0 | 0 | 0 | 0 | 0 | 4 | 0 | 8 | 28% | 0% | 0% | 0% | 1% | 0% |
| 1.3 | 1.7 | 10 | 0 | 0 | 0 | 0 | 0 | 4 | 0 | 8 | 30% | 0% | 0% | 0% | 1% | 0% |
| 1.5 | 1.7 | 10 | 0 | 0 | 0 | 0 | 0 | 4 | 0 | 8 | 32% | 0% | 0% | 0% | 1% | 0% |
| 1.7 | 1.7 | 10 | 0 | 0 | 0 | 0 | 0 | 4 | 0 | 8 | 35% | 0% | 0% | 0% | 1% | 0% |
| 0.7 | 1.9 | 10 | 0 | 0 | 0 | 0 | 0 | 4 | 0 | 8 | 28% | 0% | 0% | 0% | 1% | 0% |
| 1.1 | 1.9 | 10 | 0 | 0 | 0 | 0 | 0 | 4 | 0 | 8 | 31% | 0% | 0% | 0% | 1% | 0% |
| 1.3 | 1.9 | 10 | 0 | 0 | 0 | 0 | 0 | 4 | 0 | 8 | 32% | 0% | 0% | 0% | 1% | 0% |
| 1.5 | 1.9 | 10 | 0 | 0 | 0 | 0 | 0 | 4 | 0 | 8 | 33% | 0% | 0% | 0% | 2% | 0% |
| 1.9 | 1.9 | 10 | 0 | 0 | 0 | 0 | 0 | 4 | 0 | 8 | 37% | 0% | 0% | 0% | 2% | 0% |
| 1.5 | 1.3 | 15 | 0 | 0 | 0 | 0 | 0 | 4 | 0 | 8 | 32% | 0% | 0% | 0% | 1% | 5% |
| 1.7 | 1.3 | 15 | 0 | 0 | 0 | 0 | 0 | 4 | 0 | 8 | 34% | 0% | 0% | 0% | 1% | 0% |
| 1.1 | 1.5 | 15 | 0 | 0 | 0 | 0 | 0 | 4 | 0 | 8 | 31% | 0% | 0% | 0% | 1% | 7% |
| 1.3 | 1.5 | 15 | 0 | 0 | 0 | 0 | 0 | 4 | 0 | 8 | 33% | 0% | 0% | 0% | 1% | 0% |
| 1.5 | 1.5 | 15 | 0 | 0 | 0 | 0 | 0 | 4 | 0 | 8 | 35% | 0% | 0% | 0% | 1% | 0% |
| 1.7 | 1.5 | 15 | 0 | 0 | 0 | 0 | 0 | 4 | 0 | 8 | 37% | 0% | 0% | 0% | 1% | 0% |
| 1.3 | 1.7 | 15 | 0 | 0 | 0 | 0 | 0 | 4 | 0 | 8 | 36% | 0% | 0% | 0% | 1% | 0% |
| 1.5 | 1.7 | 15 | 0 | 0 | 0 | 0 | 0 | 4 | 0 | 8 | 38% | 0% | 0% | 0% | 1% | 0% |
| 1.7 | 1.7 | 15 | 0 | 0 | 0 | 0 | 0 | 4 | 0 | 8 | 40% | 0% | 0% | 0% | 1% | 0% |
| 2.8 | 0.2 | 5 | 0 | 0 | 0 | 0 | 0 | 6 | 0 | 8 | 34% | 0% | 0% | 0% | 0% | 6% |
| 3.2 | 0.2 | 5 | 0 | 0 | 0 | 0 | 0 | 6 | 0 | 8 | 40% | 0% | 0% | 0% | 0% | 0% |
| 3.6 | 0.2 | 5 | 0 | 0 | 0 | 0 | 0 | 6 | 0 | 8 | 45% | 0% | 0% | 0% | 0% | 0% |
| 4 | 0.2 | 5 | 0 | 0 | 0 | 0 | 0 | 6 | 0 | 8 | 50% | 0% | 0% | 0% | 0% | 0% |
| 2.8 | 0.4 | 5 | 0 | 0 | 0 | 0 | 0 | 6 | 0 | 8 | 37% | 0% | 0% | 0% | 0% | 0% |
| 3.2 | 0.4 | 5 | 0 | 0 | 0 | 0 | 0 | 6 | 0 | 8 | 43% | 0% | 0% | 0% | 0% | 0% |
| 3.6 | 0.4 | 5 | 0 | 0 | 0 | 0 | 0 | 6 | 0 | 8 | 48% | 0% | 0% | 0% | 0% | 0% |
| 2.6 | 0.6 | 5 | 0 | 0 | 0 | 0 | 0 | 6 | 0 | 8 | 37% | 0% | 0% | 0% | 0% | 0% |
| 3 | 0.6 | 5 | 0 | 0 | 0 | 0 | 0 | 6 | 0 | 8 | 43% | 0% | 0% | 0% | 0% | 0% |
| 3.4 | 0.6 | 5 | 0 | 0 | 0 | 0 | 0 | 6 | 0 | 8 | 48% | 0% | 0% | 0% | 0% | 0% |
| 2.4 | 0.8 | 5 | 0 | 0 | 0 | 0 | 0 | 6 | 0 | 8 | 38% | 0% | 0% | 0% | 0% | 0% |
| 2.8 | 0.8 | 5 | 0 | 0 | 0 | 0 | 0 | 6 | 0 | 8 | 44% | 0% | 0% | 0% | 0% | 0% |
| 3.2 | 0.8 | 5 | 0 | 0 | 0 | 0 | 0 | 6 | 0 | 8 | 48% | 0% | 0% | 0% | 0% | 0% |
| 1.8 | 1 | 5 | 0 | 0 | 0 | 0 | 0 | 6 | 0 | 8 | 33% | 0% | 0% | 0% | 0% | 0% |
| 2.2 | 1 | 5 | 0 | 0 | 0 | 0 | 0 | 6 | 0 | 8 | 38% | 0% | 0% | 0% | 0% | 0% |
| 2.6 | 1 | 5 | 0 | 0 | 0 | 0 | 0 | 6 | 0 | 8 | 44% | 0% | 0% | 0% | 0% | 0% |
| 3 | 1 | 5 | 0 | 0 | 0 | 0 | 0 | 6 | 0 | 8 | 49% | 0% | 0% | 0% | 0% | 0% |
| 1.9 | 1.1 | 5 | 0 | 0 | 0 | 0 | 0 | 6 | 0 | 8 | 24% | 0% | 0% | 0% | 1% | 0% |
| 1.8 | 1.2 | 5 | 0 | 0 | 0 | 0 | 0 | 6 | 0 | 8 | 36% | 0% | 0% | 0% | 0% | 0% |
| 2.2 | 1.2 | 5 | 0 | 0 | 0 | 0 | 0 | 6 | 0 | 8 | 41% | 0% | 0% | 0% | 0% | 0% |
| 2.6 | 1.2 | 5 | 0 | 0 | 0 | 0 | 0 | 6 | 0 | 8 | 47% | 0% | 0% | 0% | 0% | 0% |
| 1.3 | 1.3 | 5 | 0 | 0 | 0 | 0 | 0 | 6 | 0 | 8 | 21% | 0% | 0% | 0% | 1% | 0% |
| 1.5 | 1.3 | 5 | 0 | 0 | 0 | 0 | 0 | 6 | 0 | 8 | 23% | 0% | 0% | 0% | 1% | 0% |
| 1.7 | 1.3 | 5 | 0 | 0 | 0 | 0 | 0 | 6 | 0 | 8 | 24% | 0% | 0% | 0% | 1% | 0% |
| 1.2 | 1.4 | 5 | 0 | 0 | 0 | 0 | 0 | 6 | 0 | 8 | 29% | 0% | 0% | 0% | 0% | 4% |
| 1.6 | 1.4 | 5 | 0 | 0 | 0 | 0 | 0 | 6 | 0 | 8 | 34% | 0% | 0% | 0% | 0% | 0% |
| 2 | 1.4 | 5 | 0 | 0 | 0 | 0 | 0 | 6 | 0 | 8 | 40% | 0% | 0% | 0% | 0% | 0% |
| 2.4 | 1.4 | 5 | 0 | 0 | 0 | 0 | 0 | 6 | 0 | 8 | 46% | 0% | 0% | 0% | 0% | 0% |
| 0.7 | 1.5 | 5 | 0 | 0 | 0 | 0 | 0 | 6 | 0 | 8 | 19% | 0% | 0% | 0% | 1% | 9% |
| 1.1 | 1.5 | 5 | 0 | 0 | 0 | 0 | 0 | 6 | 0 | 8 | 21% | 0% | 0% | 0% | 1% | 0% |
| 1.3 | 1.5 | 5 | 0 | 0 | 0 | 0 | 0 | 6 | 0 | 8 | 23% | 0% | 0% | 0% | 1% | 0% |
| 1.5 | 1.5 | 5 | 0 | 0 | 0 | 0 | 0 | 6 | 0 | 8 | 24% | 0% | 0% | 0% | 1% | 0% |
| 1.7 | 1.5 | 5 | 0 | 0 | 0 | 0 | 0 | 6 | 0 | 8 | 26% | 0% | 0% | 0% | 1% | 0% |
| 1 | 1.6 | 5 | 0 | 0 | 0 | 0 | 0 | 6 | 0 | 8 | 28% | 0% | 0% | 0% | 0% | 0% |
| 1.4 | 1.6 | 5 | 0 | 0 | 0 | 0 | 0 | 6 | 0 | 8 | 33% | 0% | 0% | 0% | 1% | 0% |
| 1.8 | 1.6 | 5 | 0 | 0 | 0 | 0 | 0 | 6 | 0 | 8 | 38% | 0% | 0% | 0% | 1% | 0% |
| 2.2 | 1.6 | 5 | 0 | 0 | 0 | 0 | 0 | 6 | 0 | 8 | 44% | 0% | 0% | 0% | 0% | 0% |
| 2.6 | 1.6 | 5 | 0 | 0 | 0 | 0 | 0 | 6 | 0 | 8 | 49% | 0% | 0% | 0% | 0% | 0% |
| 0.7 | 1.7 | 5 | 0 | 0 | 0 | 0 | 0 | 6 | 0 | 8 | 20% | 0% | 0% | 0% | 1% | 0% |
| 1.1 | 1.7 | 5 | 0 | 0 | 0 | 0 | 0 | 6 | 0 | 8 | 23% | 0% | 0% | 0% | 1% | 0% |
| 1.3 | 1.7 | 5 | 0 | 0 | 0 | 0 | 0 | 6 | 0 | 8 | 24% | 0% | 0% | 0% | 1% | 0% |
| 1.5 | 1.7 | 5 | 0 | 0 | 0 | 0 | 0 | 6 | 0 | 8 | 26% | 0% | 0% | 0% | 1% | 0% |
| 1.7 | 1.7 | 5 | 0 | 0 | 0 | 0 | 0 | 6 | 0 | 8 | 27% | 0% | 0% | 0% | 1% | 0% |
| 1 | 1.8 | 5 | 0 | 0 | 0 | 0 | 0 | 6 | 0 | 8 | 28% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.4 | 1.8 | 5 | 0 | 0 | 0 | 0 | 0 | 6 | 0 | 8 | 33% | 0% | 0% | 0% | 1% | 0% |
| 1.8 | 1.8 | 5 | 0 | 0 | 0 | 0 | 0 | 6 | 0 | 8 | 39% | 0% | 0% | 0% | 1% | 0% |
| 2.2 | 1.8 | 5 | 0 | 0 | 0 | 0 | 0 | 6 | 0 | 8 | 44% | 0% | 0% | 0% | 1% | 0% |
| 2.6 | 1.8 | 5 | 0 | 0 | 0 | 0 | 0 | 6 | 0 | 8 | 49% | 0% | 0% | 0% | 1% | 0% |
| 0.7 | 1.9 | 5 | 0 | 0 | 0 | 0 | 0 | 6 | 0 | 8 | 22% | 0% | 0% | 0% | 1% | 0% |
| 1.1 | 1.9 | 5 | 0 | 0 | 0 | 0 | 0 | 6 | 0 | 8 | 24% | 0% | 0% | 0% | 1% | 0% |
| 1.3 | 1.9 | 5 | 0 | 0 | 0 | 0 | 0 | 6 | 0 | 8 | 25% | 0% | 0% | 0% | 1% | 0% |
| 1.5 | 1.9 | 5 | 0 | 0 | 0 | 0 | 0 | 6 | 0 | 8 | 15% | 0% | 0% | 0% | 1% | 0% |
| 1.9 | 1.9 | 5 | 0 | 0 | 0 | 0 | 0 | 6 | 0 | 8 | 28% | 0% | 0% | 0% | 1% | 0% |
| 1.2 | 2 | 5 | 0 | 0 | 0 | 0 | 0 | 6 | 0 | 8 | 31% | 0% | 0% | 0% | 1% | 0% |
| 1.6 | 2 | 5 | 0 | 0 | 0 | 0 | 0 | 6 | 0 | 8 | 37% | 0% | 0% | 0% | 1% | 0% |
| 2 | 2 | 5 | 0 | 0 | 0 | 0 | 0 | 6 | 0 | 8 | 42% | 0% | 0% | 0% | 1% | 0% |
| 2.4 | 2 | 5 | 0 | 0 | 0 | 0 | 0 | 6 | 0 | 8 | 47% | 0% | 0% | 0% | 1% | 0% |
| 1 | 2.2 | 5 | 0 | 0 | 0 | 0 | 0 | 6 | 0 | 8 | 29% | 0% | 0% | 0% | 1% | 0% |
| 1.4 | 2.2 | 5 | 0 | 0 | 0 | 0 | 0 | 6 | 0 | 8 | 34% | 0% | 0% | 0% | 1% | 0% |
| 1.8 | 2.2 | 5 | 0 | 0 | 0 | 0 | 0 | 6 | 0 | 8 | 40% | 0% | 0% | 0% | 1% | 0% |
| 1 | 2.4 | 5 | 0 | 0 | 0 | 0 | 0 | 6 | 0 | 8 | 30% | 0% | 0% | 0% | 1% | 0% |
| 1.4 | 2.4 | 5 | 0 | 0 | 0 | 0 | 0 | 6 | 0 | 8 | 35% | 0% | 0% | 0% | 1% | 0% |
| 1.8 | 2.4 | 5 | 0 | 0 | 0 | 0 | 0 | 6 | 0 | 8 | 40% | 0% | 0% | 0% | 1% | 0% |
| 1 | 2.6 | 5 | 0 | 0 | 0 | 0 | 0 | 6 | 0 | 8 | 30% | 0% | 0% | 0% | 1% | 0% |
| 1.4 | 2.6 | 5 | 0 | 0 | 0 | 0 | 0 | 6 | 0 | 8 | 36% | 0% | 0% | 0% | 1% | 0% |
| 1.7 | 1.3 | 10 | 0 | 0 | 0 | 0 | 0 | 6 | 0 | 8 | 29% | 0% | 0% | 0% | 1% | 3% |
| 1.3 | 1.5 | 10 | 0 | 0 | 0 | 0 | 0 | 6 | 0 | 8 | 28% | 0% | 0% | 0% | 1% | 5% |
| 1.5 | 1.5 | 10 | 0 | 0 | 0 | 0 | 0 | 6 | 0 | 8 | 30% | 0% | 0% | 0% | 1% | 0% |
| 1.7 | 1.5 | 10 | 0 | 0 | 0 | 0 | 0 | 6 | 0 | 8 | 32% | 0% | 0% | 0% | 1% | 0% |
| 0.9 | 1.7 | 10 | 0 | 0 | 0 | 0 | 0 | 6 | 0 | 8 | 27% | 0% | 0% | 0% | 1% | 6% |
| 1.1 | 1.7 | 10 | 0 | 0 | 0 | 0 | 0 | 6 | 0 | 8 | 29% | 0% | 0% | 0% | 1% | 0% |
| 1.3 | 1.7 | 10 | 0 | 0 | 0 | 0 | 0 | 6 | 0 | 8 | 31% | 0% | 0% | 0% | 1% | 0% |
| 1.5 | 1.7 | 10 | 0 | 0 | 0 | 0 | 0 | 6 | 0 | 8 | 33% | 0% | 0% | 0% | 1% | 0% |
| 1.9 | 1.7 | 10 | 0 | 0 | 0 | 0 | 0 | 6 | 0 | 8 | 36% | 0% | 0% | 0% | 1% | 0% |
| 0.7 | 1.9 | 10 | 0 | 0 | 0 | 0 | 0 | 6 | 0 | 8 | 26% | 0% | 0% | 0% | 1% | 0% |
| 1.1 | 1.9 | 10 | 0 | 0 | 0 | 0 | 0 | 6 | 0 | 8 | 31% | 0% | 0% | 0% | 1% | 0% |
| 1.3 | 1.9 | 10 | 0 | 0 | 0 | 0 | 0 | 6 | 0 | 8 | 33% | 0% | 0% | 0% | 1% | 0% |
| 1.5 | 1.9 | 10 | 0 | 0 | 0 | 0 | 0 | 6 | 0 | 8 | 35% | 0% | 0% | 0% | 1% | 0% |
| 1.9 | 1.9 | 10 | 0 | 0 | 0 | 0 | 0 | 6 | 0 | 8 | 38% | 0% | 0% | 0% | 1% | 0% |
| 1.5 | 1.7 | 15 | 0 | 0 | 0 | 0 | 0 | 6 | 0 | 8 | 36% | 0% | 0% | 0% | 1% | 8% |
| 1.7 | 1.7 | 15 | 0 | 0 | 0 | 0 | 0 | 6 | 0 | 8 | 38% | 0% | 0% | 0% | 1% | 1% |
| 1.3 | 1.9 | 15 | 0 | 0 | 0 | 0 | 0 | 6 | 0 | 8 | 35% | 0% | 0% | 0% | 1% | 3% |
| 1.5 | 1.9 | 15 | 0 | 0 | 0 | 0 | 0 | 6 | 0 | 8 | 37% | 0% | 0% | 0% | 1% | 0% |
| 1.9 | 1.9 | 15 | 0 | 0 | 0 | 0 | 0 | 6 | 0 | 8 | 41% | 0% | 0% | 0% | 1% | 0% |
| 0.92 | 1.01 | 7 | 0.19 | 0 | 3.09 | 0 | 0.48 | 0.26 | 2 | 8 | 21% | 0% | 0% | 0% | 1% | 7% |
| 0.8 | 1 | 1 | 1.3 | 0 | 1.5 | 0 | 1.5 | 0.4 | 2 | 8 | 14% | 0% | 0% | 0% | 1% | 1% |
| 0.8 | 1 | 3 | 1.3 | 0 | 1.5 | 0 | 1.5 | 0.4 | 2 | 8 | 15% | 0% | 0% | 0% | 1% | 0% |
| 0.8 | 1 | 5 | 1.3 | 0 | 1.5 | 0 | 1.5 | 0.4 | 2 | 8 | 14% | 0% | 0% | 0% | 1% | 4% |
| 2.67 | 0.47 | 4.04 | 0 | 0 | 2.53 | 0 | 0 | 0 | 0 | 8.07 | 42% | 0% | 0% | 0% | 0% | 0% |
| 0.78 | 1 | 3.26 | 1.74 | 0 | 1.59 | 0 | 1.17 | 0.11 | 1.48 | 8.21 | 16% | 0% | 0% | 0% | 1% | 0% |
| 0.8 | 1 | 5 | 0 | 1 | 0 | 0 | 0 | 0 | 0 | 9 | 16% | 0% | 0% | 0% | 1% | 0% |
| 0.8 | 1 | 5 | 0 | 4 | 0 | 0 | 0 | 0 | 0 | 9 | 19% | 0% | 0% | 0% | 1% | 0% |
| 0.8 | 1 | 5 | 0 | 6 | 0 | 0 | 0 | 0 | 0 | 9 | 19% | 0% | 0% | 0% | 1% | 0% |
| 0.8 | 1 | 5 | 0 | 8 | 0 | 0 | 0 | 0 | 0 | 9 | 17% | 0% | 0% | 0% | 1% | 0% |
| 0.8 | 1 | 5 | 0 | 10 | 0 | 0 | 0 | 0 | 0 | 9 | 16% | 1% | 0% | 0% | 1% | 0% |
| 0.8 | 1 | 5 | 0 | 0 | 1 | 0 | 0 | 0 | 0 | 9 | 14% | 0% | 0% | 0% | 1% | 0% |
| 0.8 | 1 | 5 | 0 | 2 | 1 | 0 | 0 | 0 | 0 | 9 | 16% | 0% | 0% | 0% | 1% | 0% |
| 0.8 | 1 | 5 | 0 | 4 | 1 | 0 | 0 | 0 | 0 | 9 | 18% | 0% | 0% | 0% | 1% | 0% |
| 0.8 | 1 | 5 | 0 | 6 | 1 | 0 | 0 | 0 | 0 | 9 | 18% | 0% | 0% | 0% | 1% | 0% |
| 0.8 | 1 | 5 | 0 | 8 | 1 | 0 | 0 | 0 | 0 | 9 | 16% | 0% | 0% | 0% | 1% | 0% |
| 0.8 | 1 | 5 | 0 | 10 | 1 | 0 | 0 | 0 | 0 | 9 | 15% | 1% | 0% | 0% | 1% | 0% |
| 0.8 | 0.9 | 3.5 | 1.3 | 0 | 2 | 0 | 0 | 0 | 0 | 9 | 14% | 0% | 0% | 0% | 1% | 0% |
| 0.8 | 1 | 5 | 0 | 2 | 2 | 0 | 0 | 0 | 0 | 9 | 16% | 0% | 0% | 0% | 1% | 0% |
| 0.8 | 1 | 5 | 0 | 4 | 2 | 0 | 0 | 0 | 0 | 9 | 18% | 0% | 0% | 0% | 1% | 0% |
| 0.8 | 1 | 5 | 0 | 6 | 2 | 0 | 0 | 0 | 0 | 9 | 17% | 0% | 0% | 0% | 1% | 3% |
| 0.8 | 1 | 5 | 0 | 8 | 2 | 0 | 0 | 0 | 0 | 9 | 16% | 0% | 0% | 0% | 1% | 4% |
| 0.8 | 1 | 5 | 0 | 10 | 2 | 0 | 0 | 0 | 0 | 9 | 14% | 0% | 0% | 0% | 1% | 4% |
| 0.8 | 0.9 | 3.5 | 1.3 | 0 | 5 | 0 | 0 | 0 | 0 | 9 | 18% | 0% | 0% | 0% | 1% | 0% |
| 0.8 | 1 | 5 | 0 | 1 | 0 | 0 | 2 | 0 | 0 | 9 | 14% | 0% | 0% | 0% | 1% | 0% |
| 0.8 | 1 | 5 | 0 | 7 | 0 | 0 | 2 | 0 | 0 | 9 | 17% | 3% | 0% | 0% | 1% | 0% |
| 0.8 | 1 | 5 | 0 | 9 | 0 | 0 | 2 | 0 | 0 | 9 | 16% | 4% | 0% | 0% | 1% | 5% |
| 0.8 | 1 | 5 | 0 | 1 | 1 | 0 | 2 | 0 | 0 | 9 | 14% | 0% | 0% | 0% | 1% | 0% |
| 0.8 | 1 | 5 | 0 | 3 | 1 | 0 | 2 | 0 | 0 | 9 | 16% | 1% | 0% | 0% | 1% | 0% |
| 0.8 | 1 | 5 | 0 | 5 | 1 | 0 | 2 | 0 | 0 | 9 | 18% | 2% | 0% | 0% | 1% | 0% |
| 0.8 | 1 | 5 | 0 | 7 | 1 | 0 | 2 | 0 | 0 | 9 | 16% | 3% | 0% | 0% | 1% | 0% |
| 0.8 | 1 | 5 | 0 | 0 | 2 | 0 | 2 | 0 | 0 | 9 | 14% | 0% | 0% | 0% | 1% | 0% |
| 0.8 | 1 | 5 | 0 | 2 | 2 | 0 | 2 | 0 | 0 | 9 | 15% | 0% | 0% | 0% | 1% | 0% |
| 0.8 | 1 | 5 | 0 | 4 | 2 | 0 | 2 | 0 | 0 | 9 | 18% | 2% | 0% | 0% | 1% | 0% |
| 0.8 | 1 | 5 | 0 | 6 | 2 | 0 | 2 | 0 | 0 | 9 | 16% | 3% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 0.8 | 0.9 | 3.5 | 0 | 0 | 1.5 | 0 | 0 | 0.4 | 0 | 9 | 11% | 0% | 0% | 0% | 1% | 0% |
| 0.8 | 1.1 | 3.5 | 0 | 0 | 1.5 | 0 | 0 | 0.4 | 0 | 9 | 14% | 0% | 0% | 0% | 1% | 0% |
| 0.8 | 1.3 | 3.5 | 0 | 0 | 1.5 | 0 | 0 | 0.4 | 0 | 9 | 15% | 0% | 0% | 0% | 1% | 0% |
| 0.8 | 1 | 0 | 1.3 | 0 | 1.5 | 0 | 1.5 | 0.4 | 0 | 9 | 15% | 1% | 0% | 0% | 1% | 0% |
| 0.8 | 1 | 2 | 1.3 | 0 | 1.5 | 0 | 1.5 | 0.4 | 0 | 9 | 14% | 0% | 0% | 0% | 1% | 0% |
| 0.8 | 1 | 4 | 1.3 | 0 | 1.5 | 0 | 1.5 | 0.4 | 0 | 9 | 14% | 0% | 0% | 0% | 1% | 0% |
| 0.8 | 1 | 6 | 1.3 | 0 | 1.5 | 0 | 1.5 | 0.4 | 0 | 9 | 16% | 0% | 0% | 0% | 1% | 0% |
| 0.8 | 1 | 8 | 1.3 | 0 | 1.5 | 0 | 1.5 | 0.4 | 0 | 9 | 20% | 0% | 0% | 0% | 1% | 0% |
| 0.8 | 1 | 5 | 0 | 1 | 0 | 0 | 0 | 1 | 0 | 9 | 14% | 0% | 0% | 0% | 1% | 0% |
| 0.8 | 1 | 5 | 0 | 3 | 0 | 0 | 0 | 1 | 0 | 9 | 15% | 0% | 0% | 0% | 1% | 0% |
| 0.8 | 1 | 5 | 0 | 5 | 0 | 0 | 0 | 1 | 0 | 9 | 17% | 0% | 0% | 0% | 1% | 0% |
| 0.8 | 1 | 5 | 0 | 7 | 0 | 0 | 0 | 1 | 0 | 9 | 16% | 0% | 0% | 0% | 1% | 4% |
| 0.8 | 1 | 5 | 0 | 9 | 0 | 0 | 0 | 1 | 0 | 9 | 14% | 0% | 0% | 0% | 1% | 1% |
| 0.6 | 1 | 5 | 0 | 0 | 1 | 0 | 0 | 1 | 0 | 9 | 12% | 0% | 0% | 0% | 1% | 0% |
| 1 | 1 | 5 | 0 | 0 | 1 | 0 | 0 | 1 | 0 | 9 | 18% | 0% | 0% | 0% | 1% | 0% |
| 0.6 | 1.2 | 5 | 0 | 0 | 1 | 0 | 0 | 1 | 0 | 9 | 14% | 0% | 0% | 0% | 1% | 0% |
| 1 | 1.2 | 5 | 0 | 0 | 1 | 0 | 0 | 1 | 0 | 9 | 18% | 0% | 0% | 0% | 1% | 0% |
| 0.6 | 1.4 | 5 | 0 | 0 | 1 | 0 | 0 | 1 | 0 | 9 | 17% | 0% | 0% | 0% | 1% | 0% |
| 1 | 1.4 | 5 | 0 | 0 | 1 | 0 | 0 | 1 | 0 | 9 | 19% | 0% | 0% | 0% | 1% | 0% |
| 0.8 | 1 | 5 | 0 | 1 | 1 | 0 | 0 | 1 | 0 | 9 | 15% | 0% | 0% | 0% | 1% | 0% |
| 0.8 | 1 | 5 | 0 | 3 | 1 | 0 | 0 | 1 | 0 | 9 | 15% | 0% | 0% | 0% | 1% | 0% |
| 0.8 | 1 | 5 | 0 | 0 | 2 | 0 | 0 | 1 | 0 | 9 | 16% | 0% | 0% | 0% | 1% | 0% |
| 0.8 | 1 | 5 | 0 | 2 | 2 | 0 | 0 | 1 | 0 | 9 | 16% | 0% | 0% | 0% | 1% | 0% |
| 0.8 | 1 | 5 | 0 | 0 | 3 | 0 | 0 | 1 | 0 | 9 | 17% | 0% | 0% | 0% | 1% | 0% |
| 1.2 | 1 | 5 | 0 | 0 | 3 | 0 | 0 | 1 | 0 | 9 | 23% | 0% | 0% | 0% | 1% | 0% |
| 0.8 | 1.2 | 5 | 0 | 0 | 3 | 0 | 0 | 1 | 0 | 9 | 17% | 0% | 0% | 0% | 1% | 0% |
| 1.2 | 1.2 | 5 | 0 | 0 | 3 | 0 | 0 | 1 | 0 | 9 | 23% | 0% | 0% | 0% | 1% | 0% |
| 0.8 | 1.4 | 5 | 0 | 0 | 3 | 0 | 0 | 1 | 0 | 9 | 18% | 0% | 0% | 0% | 1% | 0% |
| 1.2 | 1.4 | 5 | 0 | 0 | 3 | 0 | 0 | 1 | 0 | 9 | 23% | 0% | 0% | 0% | 1% | 0% |
| 0.8 | 1.6 | 5 | 0 | 0 | 3 | 0 | 0 | 1 | 0 | 9 | 20% | 0% | 0% | 0% | 1% | 0% |
| 1.2 | 1.6 | 5 | 0 | 0 | 3 | 0 | 0 | 1 | 0 | 9 | 24% | 0% | 0% | 0% | 1% | 0% |
| 1 | 1 | 5 | 0 | 0 | 5 | 0 | 0 | 1 | 0 | 9 | 23% | 0% | 0% | 0% | 0% | 0% |
| 0.8 | 1.2 | 5 | 0 | 0 | 5 | 0 | 0 | 1 | 0 | 9 | 20% | 0% | 0% | 0% | 1% | 0% |
| 1.2 | 1.2 | 5 | 0 | 0 | 5 | 0 | 0 | 1 | 0 | 9 | 25% | 0% | 0% | 0% | 1% | 0% |
| 0.8 | 1.4 | 5 | 0 | 0 | 5 | 0 | 0 | 1 | 0 | 9 | 20% | 0% | 0% | 0% | 1% | 0% |
| 1.2 | 1.4 | 5 | 0 | 0 | 5 | 0 | 0 | 1 | 0 | 9 | 25% | 0% | 0% | 0% | 1% | 0% |
| 0.8 | 1.6 | 5 | 0 | 0 | 5 | 0 | 0 | 1 | 0 | 9 | 20% | 0% | 0% | 0% | 1% | 0% |
| 1.2 | 1.6 | 5 | 0 | 0 | 5 | 0 | 0 | 1 | 0 | 9 | 25% | 0% | 0% | 0% | 1% | 0% |
| 0.8 | 1.8 | 5 | 0 | 0 | 5 | 0 | 0 | 1 | 0 | 9 | 22% | 0% | 0% | 0% | 1% | 0% |
| 1.2 | 1.8 | 5 | 0 | 0 | 5 | 0 | 0 | 1 | 0 | 9 | 25% | 0% | 0% | 0% | 1% | 0% |
| 1 | 2 | 5 | 0 | 0 | 5 | 0 | 0 | 1 | 0 | 9 | 27% | 0% | 0% | 0% | 1% | 0% |
| 1 | 1.2 | 5 | 0 | 0 | 7 | 0 | 0 | 1 | 0 | 9 | 25% | 0% | 0% | 0% | 0% | 0% |
| 0.8 | 1.4 | 5 | 0 | 0 | 7 | 0 | 0 | 1 | 0 | 9 | 22% | 0% | 0% | 0% | 1% | 0% |
| 1.2 | 1.4 | 5 | 0 | 0 | 7 | 0 | 0 | 1 | 0 | 9 | 28% | 0% | 0% | 0% | 0% | 0% |
| 0.8 | 1.6 | 5 | 0 | 0 | 7 | 0 | 0 | 1 | 0 | 9 | 22% | 0% | 0% | 0% | 1% | 0% |
| 1.2 | 1.6 | 5 | 0 | 0 | 7 | 0 | 0 | 1 | 0 | 9 | 28% | 0% | 0% | 0% | 1% | 0% |
| 0.8 | 1.8 | 5 | 0 | 0 | 7 | 0 | 0 | 1 | 0 | 9 | 23% | 0% | 0% | 0% | 1% | 0% |
| 1.2 | 1.8 | 5 | 0 | 0 | 7 | 0 | 0 | 1 | 0 | 9 | 28% | 0% | 0% | 0% | 1% | 0% |
| 0.8 | 2 | 5 | 0 | 0 | 7 | 0 | 0 | 1 | 0 | 9 | 24% | 0% | 0% | 0% | 1% | 0% |
| 1.2 | 2 | 5 | 0 | 0 | 7 | 0 | 0 | 1 | 0 | 9 | 28% | 0% | 0% | 0% | 1% | 0% |
| 1 | 2.2 | 5 | 0 | 0 | 7 | 0 | 0 | 1 | 0 | 9 | 28% | 0% | 0% | 0% | 1% | 0% |
| 0.8 | 1.4 | 5 | 0 | 0 | 9 | 0 | 0 | 1 | 0 | 9 | 24% | 0% | 0% | 0% | 0% | 0% |
| 1.2 | 1.4 | 5 | 0 | 0 | 9 | 0 | 0 | 1 | 0 | 9 | 30% | 0% | 0% | 0% | 0% | 0% |
| 1 | 1.6 | 5 | 0 | 0 | 9 | 0 | 0 | 1 | 0 | 9 | 27% | 0% | 0% | 0% | 1% | 0% |
| 0.6 | 1.8 | 5 | 0 | 0 | 9 | 0 | 0 | 1 | 0 | 9 | 22% | 0% | 0% | 0% | 1% | 0% |
| 1 | 1.8 | 5 | 0 | 0 | 9 | 0 | 0 | 1 | 0 | 9 | 28% | 0% | 0% | 0% | 1% | 0% |
| 0.6 | 2 | 5 | 0 | 0 | 9 | 0 | 0 | 1 | 0 | 9 | 23% | 0% | 0% | 0% | 1% | 0% |
| 1 | 2 | 5 | 0 | 0 | 9 | 0 | 0 | 1 | 0 | 9 | 28% | 0% | 0% | 0% | 1% | 0% |
| 0.6 | 2.2 | 5 | 0 | 0 | 9 | 0 | 0 | 1 | 0 | 9 | 25% | 0% | 0% | 0% | 1% | 0% |
| 1 | 2.2 | 5 | 0 | 0 | 9 | 0 | 0 | 1 | 0 | 9 | 28% | 0% | 0% | 0% | 1% | 0% |
| 0.8 | 2.4 | 5 | 0 | 0 | 9 | 0 | 0 | 1 | 0 | 9 | 28% | 0% | 0% | 0% | 1% | 0% |
| 1.2 | 2.4 | 5 | 0 | 0 | 9 | 0 | 0 | 1 | 0 | 9 | 33% | 0% | 0% | 0% | 1% | 0% |
| 0.8 | 1 | 5 | 0 | 1 | 0 | 0 | 2 | 1 | 0 | 9 | 14% | 0% | 0% | 0% | 1% | 0% |
| 0.8 | 1 | 5 | 0 | 3 | 0 | 0 | 2 | 1 | 0 | 9 | 14% | 0% | 0% | 0% | 1% | 0% |
| 0.8 | 1 | 5 | 0 | 5 | 0 | 0 | 2 | 1 | 0 | 9 | 16% | 2% | 0% | 0% | 1% | 0% |
| 0.8 | 1 | 5 | 0 | 7 | 0 | 0 | 2 | 1 | 0 | 9 | 15% | 3% | 0% | 0% | 1% | 0% |
| 0.8 | 1 | 5 | 0 | 1 | 1 | 0 | 2 | 1 | 0 | 9 | 15% | 0% | 0% | 0% | 1% | 1% |
| 0.8 | 1 | 5 | 0 | 3 | 1 | 0 | 2 | 1 | 0 | 9 | 15% | 1% | 0% | 0% | 1% | 0% |
| 0.8 | 1 | 5 | 0 | 5 | 1 | 0 | 2 | 1 | 0 | 9 | 16% | 0% | 0% | 0% | 1% | 2% |
| 0.8 | 1 | 5 | 0 | 7 | 1 | 0 | 2 | 1 | 0 | 9 | 15% | 1% | 0% | 0% | 1% | 6% |
| 0.8 | 1 | 5 | 0 | 1 | 0 | 0 | 0 | 2 | 0 | 9 | 17% | 0% | 0% | 0% | 1% | 0% |
| 0.8 | 1 | 5 | 0 | 3 | 0 | 0 | 0 | 2 | 0 | 9 | 16% | 0% | 0% | 0% | 1% | 0% |
| 0.8 | 1 | 5 | 0 | 1 | 1 | 0 | 0 | 2 | 0 | 9 | 17% | 0% | 0% | 0% | 1% | 0% |
| 0.8 | 1 | 5 | 0 | 0 | 2 | 0 | 0 | 2 | 0 | 9 | 19% | 0% | 0% | 0% | 1% | 8% |
| 0.8 | 1 | 5 | 0 | 0 | 0 | 0 | 2 | 2 | 0 | 9 | 17% | 0% | 0% | 0% | 1% | 9% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 0.8 | 1 | 5 | 0 | 2 | 0 | 0 | 2 | 2 | 0 | 9 | 16% | 0% | 0% | 0% | 1% | 3% |
| 0.8 | 1 | 5 | 0 | 4 | 0 | 0 | 2 | 2 | 0 | 9 | 16% | 0% | 0% | 0% | 1% | 9% |
| 1.2 | 1 | 5 | 0 | 0 | 1 | 0 | 0 | 3 | 0 | 9 | 25% | 0% | 0% | 0% | 0% | 0% |
| 1 | 1.2 | 5 | 0 | 0 | 1 | 0 | 0 | 3 | 0 | 9 | 23% | 0% | 0% | 0% | 1% | 0% |
| 0.6 | 1.4 | 5 | 0 | 0 | 1 | 0 | 0 | 3 | 0 | 9 | 18% | 0% | 0% | 0% | 1% | 0% |
| 1 | 1.4 | 5 | 0 | 0 | 1 | 0 | 0 | 3 | 0 | 9 | 23% | 0% | 0% | 0% | 1% | 0% |
| 0.6 | 1.6 | 5 | 0 | 0 | 1 | 0 | 0 | 3 | 0 | 9 | 18% | 0% | 0% | 0% | 1% | 0% |
| 1 | 1.6 | 5 | 0 | 0 | 1 | 0 | 0 | 3 | 0 | 9 | 23% | 0% | 0% | 0% | 1% | 0% |
| 0.6 | 1.8 | 5 | 0 | 0 | 1 | 0 | 0 | 3 | 0 | 9 | 18% | 0% | 0% | 0% | 1% | 0% |
| 1 | 1.8 | 5 | 0 | 0 | 1 | 0 | 0 | 3 | 0 | 9 | 23% | 0% | 0% | 0% | 1% | 0% |
| 0.6 | 2 | 5 | 0 | 0 | 1 | 0 | 0 | 3 | 0 | 9 | 20% | 0% | 0% | 0% | 1% | 0% |
| 1 | 2 | 5 | 0 | 0 | 1 | 0 | 0 | 3 | 0 | 9 | 24% | 0% | 0% | 0% | 1% | 0% |
| 0.6 | 2.2 | 5 | 0 | 0 | 1 | 0 | 0 | 3 | 0 | 9 | 23% | 0% | 0% | 0% | 2% | 0% |
| 1 | 1.2 | 5 | 0 | 0 | 3 | 0 | 0 | 3 | 0 | 9 | 24% | 0% | 0% | 0% | 0% | 0% |
| 0.8 | 1.4 | 5 | 0 | 0 | 3 | 0 | 0 | 3 | 0 | 9 | 22% | 0% | 0% | 0% | 1% | 2% |
| 1.2 | 1.4 | 5 | 0 | 0 | 3 | 0 | 0 | 3 | 0 | 9 | 27% | 0% | 0% | 0% | 1% | 0% |
| 0.8 | 1.6 | 5 | 0 | 0 | 3 | 0 | 0 | 3 | 0 | 9 | 22% | 0% | 0% | 0% | 1% | 0% |
| 1.2 | 1.6 | 5 | 0 | 0 | 3 | 0 | 0 | 3 | 0 | 9 | 28% | 0% | 0% | 0% | 1% | 0% |
| 0.8 | 1.8 | 5 | 0 | 0 | 3 | 0 | 0 | 3 | 0 | 9 | 23% | 0% | 0% | 0% | 1% | 0% |
| 1.2 | 1.8 | 5 | 0 | 0 | 3 | 0 | 0 | 3 | 0 | 9 | 28% | 0% | 0% | 0% | 1% | 0% |
| 0.8 | 2 | 5 | 0 | 0 | 3 | 0 | 0 | 3 | 0 | 9 | 23% | 0% | 0% | 0% | 1% | 0% |
| 1.2 | 2 | 5 | 0 | 0 | 3 | 0 | 0 | 3 | 0 | 9 | 28% | 0% | 0% | 0% | 1% | 0% |
| 0.8 | 2.2 | 5 | 0 | 0 | 3 | 0 | 0 | 3 | 0 | 9 | 24% | 0% | 0% | 0% | 1% | 0% |
| 1.2 | 2.2 | 5 | 0 | 0 | 3 | 0 | 0 | 3 | 0 | 9 | 30% | 0% | 0% | 0% | 1% | 0% |
| 1 | 1.4 | 5 | 0 | 0 | 5 | 0 | 0 | 3 | 0 | 9 | 27% | 0% | 0% | 0% | 0% | 0% |
| 0.8 | 1.6 | 5 | 0 | 0 | 5 | 0 | 0 | 3 | 0 | 9 | 24% | 0% | 0% | 0% | 1% | 2% |
| 1.2 | 1.6 | 5 | 0 | 0 | 5 | 0 | 0 | 3 | 0 | 9 | 30% | 0% | 0% | 0% | 0% | 0% |
| 0.8 | 1.8 | 5 | 0 | 0 | 5 | 0 | 0 | 3 | 0 | 9 | 25% | 0% | 0% | 0% | 1% | 0% |
| 1.2 | 1.8 | 5 | 0 | 0 | 5 | 0 | 0 | 3 | 0 | 9 | 30% | 0% | 0% | 0% | 1% | 0% |
| 0.8 | 2 | 5 | 0 | 0 | 5 | 0 | 0 | 3 | 0 | 9 | 25% | 0% | 0% | 0% | 1% | 0% |
| 1.2 | 2 | 5 | 0 | 0 | 5 | 0 | 0 | 3 | 0 | 9 | 30% | 0% | 0% | 0% | 1% | 0% |
| 0.8 | 2.2 | 5 | 0 | 0 | 5 | 0 | 0 | 3 | 0 | 9 | 25% | 0% | 0% | 0% | 1% | 0% |
| 1.2 | 2.2 | 5 | 0 | 0 | 5 | 0 | 0 | 3 | 0 | 9 | 30% | 0% | 0% | 0% | 1% | 0% |
| 0.8 | 2.4 | 5 | 0 | 0 | 5 | 0 | 0 | 3 | 0 | 9 | 26% | 0% | 0% | 0% | 1% | 0% |
| 1.2 | 2.4 | 5 | 0 | 0 | 5 | 0 | 0 | 3 | 0 | 9 | 31% | 0% | 0% | 0% | 1% | 0% |
| 0.8 | 1.6 | 5 | 0 | 0 | 7 | 0 | 0 | 3 | 0 | 9 | 26% | 0% | 0% | 0% | 0% | 8% |
| 1.2 | 1.6 | 5 | 0 | 0 | 7 | 0 | 0 | 3 | 0 | 9 | 31% | 0% | 0% | 0% | 0% | 0% |
| 1 | 1.8 | 5 | 0 | 0 | 7 | 0 | 0 | 3 | 0 | 9 | 29% | 0% | 0% | 0% | 1% | 0% |
| 0.6 | 2 | 5 | 0 | 0 | 7 | 0 | 0 | 3 | 0 | 9 | 24% | 0% | 0% | 0% | 1% | 6% |
| 1 | 2 | 5 | 0 | 0 | 7 | 0 | 0 | 3 | 0 | 9 | 29% | 0% | 0% | 0% | 1% | 0% |
| 0.6 | 2.2 | 5 | 0 | 0 | 7 | 0 | 0 | 3 | 0 | 9 | 24% | 0% | 0% | 0% | 1% | 0% |
| 1 | 2.2 | 5 | 0 | 0 | 7 | 0 | 0 | 3 | 0 | 9 | 30% | 0% | 0% | 0% | 1% | 0% |
| 0.6 | 2.4 | 5 | 0 | 0 | 7 | 0 | 0 | 3 | 0 | 9 | 25% | 0% | 0% | 0% | 1% | 0% |
| 1 | 2.4 | 5 | 0 | 0 | 7 | 0 | 0 | 3 | 0 | 9 | 30% | 0% | 0% | 0% | 1% | 0% |
| 0.6 | 2.6 | 5 | 0 | 0 | 7 | 0 | 0 | 3 | 0 | 9 | 28% | 0% | 0% | 0% | 1% | 0% |
| 1 | 2.6 | 5 | 0 | 0 | 7 | 0 | 0 | 3 | 0 | 9 | 30% | 0% | 0% | 0% | 1% | 0% |
| 0.8 | 2.8 | 5 | 0 | 0 | 7 | 0 | 0 | 3 | 0 | 9 | 31% | 0% | 0% | 0% | 1% | 0% |
| 1 | 1.8 | 5 | 0 | 0 | 9 | 0 | 0 | 3 | 0 | 9 | 31% | 0% | 0% | 0% | 0% | 0% |
| 0.8 | 2 | 5 | 0 | 0 | 9 | 0 | 0 | 3 | 0 | 9 | 29% | 0% | 0% | 0% | 0% | 0% |
| 1.2 | 2 | 5 | 0 | 0 | 9 | 0 | 0 | 3 | 0 | 9 | 34% | 0% | 0% | 0% | 0% | 0% |
| 0.8 | 2.2 | 5 | 0 | 0 | 9 | 0 | 0 | 3 | 0 | 9 | 29% | 0% | 0% | 0% | 1% | 0% |
| 1.2 | 2.2 | 5 | 0 | 0 | 9 | 0 | 0 | 3 | 0 | 9 | 34% | 0% | 0% | 0% | 1% | 0% |
| 0.8 | 2.4 | 5 | 0 | 0 | 9 | 0 | 0 | 3 | 0 | 9 | 29% | 0% | 0% | 0% | 1% | 0% |
| 1.2 | 2.4 | 5 | 0 | 0 | 9 | 0 | 0 | 3 | 0 | 9 | 34% | 0% | 0% | 0% | 1% | 0% |
| 0.8 | 2.6 | 5 | 0 | 0 | 9 | 0 | 0 | 3 | 0 | 9 | 30% | 0% | 0% | 0% | 1% | 0% |
| 1.2 | 2.6 | 5 | 0 | 0 | 9 | 0 | 0 | 3 | 0 | 9 | 35% | 0% | 0% | 0% | 1% | 0% |
| 0.8 | 2.8 | 5 | 0 | 0 | 9 | 0 | 0 | 3 | 0 | 9 | 30% | 0% | 0% | 0% | 1% | 0% |
| 1.2 | 2.8 | 5 | 0 | 0 | 9 | 0 | 0 | 3 | 0 | 9 | 35% | 0% | 0% | 0% | 1% | 0% |
| 0.8 | 3 | 5 | 0 | 0 | 9 | 0 | 0 | 3 | 0 | 9 | 33% | 0% | 0% | 0% | 1% | 0% |
| 1.2 | 1.4 | 5 | 0 | 0 | 1 | 0 | 0 | 5 | 0 | 9 | 29% | 0% | 0% | 0% | 0% | 0% |
| 1 | 1.6 | 5 | 0 | 0 | 1 | 0 | 0 | 5 | 0 | 9 | 27% | 0% | 0% | 0% | 0% | 0% |
| 0.6 | 1.8 | 5 | 0 | 0 | 1 | 0 | 0 | 5 | 0 | 9 | 22% | 0% | 0% | 0% | 1% | 0% |
| 1 | 1.8 | 5 | 0 | 0 | 1 | 0 | 0 | 5 | 0 | 9 | 28% | 0% | 0% | 0% | 1% | 0% |
| 0.6 | 2 | 5 | 0 | 0 | 1 | 0 | 0 | 5 | 0 | 9 | 23% | 0% | 0% | 0% | 1% | 0% |
| 1 | 2 | 5 | 0 | 0 | 1 | 0 | 0 | 5 | 0 | 9 | 28% | 0% | 0% | 0% | 1% | 0% |
| 0.6 | 2.2 | 5 | 0 | 0 | 1 | 0 | 0 | 5 | 0 | 9 | 24% | 0% | 0% | 0% | 1% | 0% |
| 1 | 2.2 | 5 | 0 | 0 | 1 | 0 | 0 | 5 | 0 | 9 | 28% | 0% | 0% | 0% | 1% | 0% |
| 0.6 | 2.4 | 5 | 0 | 0 | 1 | 0 | 0 | 5 | 0 | 9 | 24% | 0% | 0% | 0% | 1% | 0% |
| 1 | 2.4 | 5 | 0 | 0 | 1 | 0 | 0 | 5 | 0 | 9 | 29% | 0% | 0% | 0% | 1% | 0% |
| 0.6 | 2.6 | 5 | 0 | 0 | 1 | 0 | 0 | 5 | 0 | 9 | 24% | 0% | 0% | 0% | 2% | 0% |
| 1 | 2.6 | 5 | 0 | 0 | 1 | 0 | 0 | 5 | 0 | 9 | 30% | 0% | 0% | 0% | 1% | 0% |
| 0.6 | 2.8 | 5 | 0 | 0 | 1 | 0 | 0 | 5 | 0 | 9 | 27% | 0% | 0% | 0% | 2% | 0% |
| 1.2 | 1.6 | 5 | 0 | 0 | 3 | 0 | 0 | 5 | 0 | 9 | 31% | 0% | 0% | 0% | 0% | 0% |
| 1 | 1.8 | 5 | 0 | 0 | 3 | 0 | 0 | 5 | 0 | 9 | 29% | 0% | 0% | 0% | 0% | 0% |
| 0.6 | 2 | 5 | 0 | 0 | 3 | 0 | 0 | 5 | 0 | 9 | 24% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1 | 2 | 5 | 0 | 0 | 3 | 0 | 0 | 5 | 0 | 9 | 29% | 0% | 0% | 0% | 1% | 0% |
| 0.6 | 2.2 | 5 | 0 | 0 | 3 | 0 | 0 | 5 | 0 | 9 | 25% | 0% | 0% | 0% | 1% | 0% |
| 1 | 2.2 | 5 | 0 | 0 | 3 | 0 | 0 | 5 | 0 | 9 | 30% | 0% | 0% | 0% | 1% | 0% |
| 0.6 | 2.4 | 5 | 0 | 0 | 3 | 0 | 0 | 5 | 0 | 9 | 25% | 0% | 0% | 0% | 1% | 0% |
| 1 | 2.4 | 5 | 0 | 0 | 3 | 0 | 0 | 5 | 0 | 9 | 30% | 0% | 0% | 0% | 1% | 0% |
| 0.6 | 2.6 | 5 | 0 | 0 | 3 | 0 | 0 | 5 | 0 | 9 | 26% | 0% | 0% | 0% | 1% | 0% |
| 1 | 2.6 | 5 | 0 | 0 | 3 | 0 | 0 | 5 | 0 | 9 | 30% | 0% | 0% | 0% | 1% | 0% |
| 0.6 | 2.8 | 5 | 0 | 0 | 3 | 0 | 0 | 5 | 0 | 9 | 26% | 0% | 0% | 0% | 1% | 0% |
| 1 | 2.8 | 5 | 0 | 0 | 3 | 0 | 0 | 5 | 0 | 9 | 32% | 0% | 0% | 0% | 1% | 0% |
| 0.6 | 3 | 5 | 0 | 0 | 3 | 0 | 0 | 5 | 0 | 9 | 29% | 0% | 0% | 0% | 2% | 0% |
| 1 | 2 | 5 | 0 | 0 | 5 | 0 | 0 | 5 | 0 | 9 | 31% | 0% | 0% | 0% | 1% | 0% |
| 0.6 | 2.2 | 5 | 0 | 0 | 5 | 0 | 0 | 5 | 0 | 9 | 26% | 0% | 0% | 0% | 1% | 7% |
| 1 | 2.2 | 5 | 0 | 0 | 5 | 0 | 0 | 5 | 0 | 9 | 31% | 0% | 0% | 0% | 1% | 0% |
| 0.6 | 2.4 | 5 | 0 | 0 | 5 | 0 | 0 | 5 | 0 | 9 | 27% | 0% | 0% | 0% | 1% | 0% |
| 1 | 2.4 | 5 | 0 | 0 | 5 | 0 | 0 | 5 | 0 | 9 | 32% | 0% | 0% | 0% | 1% | 0% |
| 0.6 | 2.6 | 5 | 0 | 0 | 5 | 0 | 0 | 5 | 0 | 9 | 27% | 0% | 0% | 0% | 1% | 0% |
| 1 | 2.6 | 5 | 0 | 0 | 5 | 0 | 0 | 5 | 0 | 9 | 32% | 0% | 0% | 0% | 1% | 0% |
| 0.6 | 2.8 | 5 | 0 | 0 | 5 | 0 | 0 | 5 | 0 | 9 | 28% | 0% | 0% | 0% | 1% | 0% |
| 1 | 2.8 | 5 | 0 | 0 | 5 | 0 | 0 | 5 | 0 | 9 | 32% | 0% | 0% | 0% | 1% | 0% |
| 0.6 | 3 | 5 | 0 | 0 | 5 | 0 | 0 | 5 | 0 | 9 | 29% | 0% | 0% | 0% | 1% | 0% |
| 1 | 3 | 5 | 0 | 0 | 5 | 0 | 0 | 5 | 0 | 9 | 33% | 0% | 0% | 0% | 1% | 0% |
| 0.6 | 3.2 | 5 | 0 | 0 | 5 | 0 | 0 | 5 | 0 | 9 | 31% | 0% | 0% | 0% | 2% | 0% |
| 0.8 | 2.2 | 5 | 0 | 0 | 7 | 0 | 0 | 5 | 0 | 9 | 30% | 0% | 0% | 0% | 0% | 1% |
| 1.2 | 2.2 | 5 | 0 | 0 | 7 | 0 | 0 | 5 | 0 | 9 | 36% | 0% | 0% | 0% | 0% | 0% |
| 0.8 | 2.4 | 5 | 0 | 0 | 7 | 0 | 0 | 5 | 0 | 9 | 31% | 0% | 0% | 0% | 1% | 0% |
| 1.2 | 2.4 | 5 | 0 | 0 | 7 | 0 | 0 | 5 | 0 | 9 | 36% | 0% | 0% | 0% | 1% | 0% |
| 0.8 | 2.6 | 5 | 0 | 0 | 7 | 0 | 0 | 5 | 0 | 9 | 31% | 0% | 0% | 0% | 1% | 0% |
| 1.2 | 2.6 | 5 | 0 | 0 | 7 | 0 | 0 | 5 | 0 | 9 | 36% | 0% | 0% | 0% | 1% | 0% |
| 0.8 | 2.8 | 5 | 0 | 0 | 7 | 0 | 0 | 5 | 0 | 9 | 32% | 0% | 0% | 0% | 1% | 0% |
| 1.2 | 2.8 | 5 | 0 | 0 | 7 | 0 | 0 | 5 | 0 | 9 | 37% | 0% | 0% | 0% | 1% | 0% |
| 0.8 | 3 | 5 | 0 | 0 | 7 | 0 | 0 | 5 | 0 | 9 | 32% | 0% | 0% | 0% | 1% | 0% |
| 1.2 | 3 | 5 | 0 | 0 | 7 | 0 | 0 | 5 | 0 | 9 | 37% | 0% | 0% | 0% | 1% | 0% |
| 0.8 | 3.2 | 5 | 0 | 0 | 7 | 0 | 0 | 5 | 0 | 9 | 33% | 0% | 0% | 0% | 1% | 0% |
| 1.2 | 3.2 | 5 | 0 | 0 | 7 | 0 | 0 | 5 | 0 | 9 | 39% | 0% | 0% | 0% | 1% | 0% |
| 0.8 | 3.4 | 5 | 0 | 0 | 7 | 0 | 0 | 5 | 0 | 9 | 36% | 0% | 0% | 0% | 2% | 0% |
| 1 | 2.4 | 5 | 0 | 0 | 9 | 0 | 0 | 5 | 0 | 9 | 35% | 0% | 0% | 0% | 0% | 0% |
| 0.6 | 2.6 | 5 | 0 | 0 | 9 | 0 | 0 | 5 | 0 | 9 | 30% | 0% | 0% | 0% | 1% | 6% |
| 1 | 2.6 | 5 | 0 | 0 | 9 | 0 | 0 | 5 | 0 | 9 | 36% | 0% | 0% | 0% | 0% | 0% |
| 0.6 | 2.8 | 5 | 0 | 0 | 9 | 0 | 0 | 5 | 0 | 9 | 31% | 0% | 0% | 0% | 1% | 0% |
| 1 | 2.8 | 5 | 0 | 0 | 9 | 0 | 0 | 5 | 0 | 9 | 36% | 0% | 0% | 0% | 1% | 0% |
| 0.6 | 3 | 5 | 0 | 0 | 9 | 0 | 0 | 5 | 0 | 9 | 32% | 0% | 0% | 0% | 1% | 0% |
| 1 | 3 | 5 | 0 | 0 | 9 | 0 | 0 | 5 | 0 | 9 | 36% | 0% | 0% | 0% | 1% | 0% |
| 0.6 | 3.2 | 5 | 0 | 0 | 9 | 0 | 0 | 5 | 0 | 9 | 32% | 0% | 0% | 0% | 1% | 0% |
| 1 | 3.2 | 5 | 0 | 0 | 9 | 0 | 0 | 5 | 0 | 9 | 37% | 0% | 0% | 0% | 1% | 0% |
| 0.6 | 3.4 | 5 | 0 | 0 | 9 | 0 | 0 | 5 | 0 | 9 | 33% | 0% | 0% | 0% | 1% | 0% |
| 1 | 3.4 | 5 | 0 | 0 | 9 | 0 | 0 | 5 | 0 | 9 | 37% | 0% | 0% | 0% | 1% | 0% |
| 0.6 | 3.6 | 5 | 0 | 0 | 9 | 0 | 0 | 5 | 0 | 9 | 36% | 0% | 0% | 0% | 2% | 0% |
| 0.8 | 2 | 5 | 0 | 0 | 1 | 0 | 0 | 7 | 0 | 9 | 28% | 0% | 0% | 0% | 0% | 1% |
| 1.2 | 2 | 5 | 0 | 0 | 1 | 0 | 0 | 7 | 0 | 9 | 33% | 0% | 0% | 0% | 0% | 0% |
| 0.8 | 2.2 | 5 | 0 | 0 | 1 | 0 | 0 | 7 | 0 | 9 | 29% | 0% | 0% | 0% | 1% | 0% |
| 1.2 | 2.2 | 5 | 0 | 0 | 1 | 0 | 0 | 7 | 0 | 9 | 34% | 0% | 0% | 0% | 1% | 0% |
| 0.8 | 2.4 | 5 | 0 | 0 | 1 | 0 | 0 | 7 | 0 | 9 | 30% | 0% | 0% | 0% | 1% | 0% |
| 1.2 | 2.4 | 5 | 0 | 0 | 1 | 0 | 0 | 7 | 0 | 9 | 34% | 0% | 0% | 0% | 1% | 0% |
| 0.8 | 2.6 | 5 | 0 | 0 | 1 | 0 | 0 | 7 | 0 | 9 | 30% | 0% | 0% | 0% | 1% | 0% |
| 1.2 | 2.6 | 5 | 0 | 0 | 1 | 0 | 0 | 7 | 0 | 9 | 35% | 0% | 0% | 0% | 1% | 0% |
| 0.8 | 2.8 | 5 | 0 | 0 | 1 | 0 | 0 | 7 | 0 | 9 | 31% | 0% | 0% | 0% | 1% | 0% |
| 1.2 | 2.8 | 5 | 0 | 0 | 1 | 0 | 0 | 7 | 0 | 9 | 35% | 0% | 0% | 0% | 1% | 0% |
| 0.8 | 3 | 5 | 0 | 0 | 1 | 0 | 0 | 7 | 0 | 9 | 31% | 0% | 0% | 0% | 1% | 0% |
| 1.2 | 3 | 5 | 0 | 0 | 1 | 0 | 0 | 7 | 0 | 9 | 36% | 0% | 0% | 0% | 1% | 0% |
| 0.8 | 3.2 | 5 | 0 | 0 | 1 | 0 | 0 | 7 | 0 | 9 | 31% | 0% | 0% | 0% | 2% | 0% |
| 0.6 | 3.4 | 5 | 0 | 0 | 1 | 0 | 0 | 7 | 0 | 9 | 32% | 0% | 0% | 0% | 2% | 0% |
| 1 | 2.2 | 5 | 0 | 0 | 3 | 0 | 0 | 7 | 0 | 9 | 33% | 0% | 0% | 0% | 0% | 0% |
| 0.6 | 2.4 | 5 | 0 | 0 | 3 | 0 | 0 | 7 | 0 | 9 | 28% | 0% | 0% | 0% | 1% | 5% |
| 1 | 2.4 | 5 | 0 | 0 | 3 | 0 | 0 | 7 | 0 | 9 | 33% | 0% | 0% | 0% | 1% | 0% |
| 0.6 | 2.6 | 5 | 0 | 0 | 3 | 0 | 0 | 7 | 0 | 9 | 29% | 0% | 0% | 0% | 1% | 0% |
| 1 | 2.6 | 5 | 0 | 0 | 3 | 0 | 0 | 7 | 0 | 9 | 34% | 0% | 0% | 0% | 1% | 0% |
| 0.6 | 2.8 | 5 | 0 | 0 | 3 | 0 | 0 | 7 | 0 | 9 | 30% | 0% | 0% | 0% | 1% | 0% |
| 1 | 2.8 | 5 | 0 | 0 | 3 | 0 | 0 | 7 | 0 | 9 | 34% | 0% | 0% | 0% | 1% | 0% |
| 0.6 | 3 | 5 | 0 | 0 | 3 | 0 | 0 | 7 | 0 | 9 | 30% | 0% | 0% | 0% | 1% | 0% |
| 1 | 3 | 5 | 0 | 0 | 3 | 0 | 0 | 7 | 0 | 9 | 35% | 0% | 0% | 0% | 1% | 0% |
| 0.6 | 3.2 | 5 | 0 | 0 | 3 | 0 | 0 | 7 | 0 | 9 | 31% | 0% | 0% | 0% | 1% | 0% |
| 1 | 3.2 | 5 | 0 | 0 | 3 | 0 | 0 | 7 | 0 | 9 | 35% | 0% | 0% | 0% | 1% | 0% |
| 0.6 | 3.4 | 5 | 0 | 0 | 3 | 0 | 0 | 7 | 0 | 9 | 31% | 0% | 0% | 0% | 2% | 0% |
| 1 | 3.4 | 5 | 0 | 0 | 3 | 0 | 0 | 7 | 0 | 9 | 38% | 0% | 0% | 0% | 2% | 0% |
| 0.8 | 2.4 | 5 | 0 | 0 | 5 | 0 | 0 | 7 | 0 | 9 | 32% | 0% | 0% | 0% | 0% | 1% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.2 | 2.4 | 5 | 0 | 0 | 5 | 0 | 0 | 7 | 0 | 9 | 37% | 0% | 0% | 0% | 0% | 0% |
| 0.8 | 2.6 | 5 | 0 | 0 | 5 | 0 | 0 | 7 | 0 | 9 | 33% | 0% | 0% | 0% | 0% | 0% |
| 1.2 | 2.6 | 5 | 0 | 0 | 5 | 0 | 0 | 7 | 0 | 9 | 38% | 0% | 0% | 0% | 1% | 0% |
| 0.8 | 2.8 | 5 | 0 | 0 | 5 | 0 | 0 | 7 | 0 | 9 | 33% | 0% | 0% | 0% | 1% | 0% |
| 1.2 | 2.8 | 5 | 0 | 0 | 5 | 0 | 0 | 7 | 0 | 9 | 38% | 0% | 0% | 0% | 1% | 0% |
| 0.8 | 3 | 5 | 0 | 0 | 5 | 0 | 0 | 7 | 0 | 9 | 34% | 0% | 0% | 0% | 1% | 0% |
| 1.2 | 3 | 5 | 0 | 0 | 5 | 0 | 0 | 7 | 0 | 9 | 38% | 0% | 0% | 0% | 1% | 0% |
| 0.8 | 3.2 | 5 | 0 | 0 | 5 | 0 | 0 | 7 | 0 | 9 | 34% | 0% | 0% | 0% | 1% | 0% |
| 1.2 | 3.2 | 5 | 0 | 0 | 5 | 0 | 0 | 7 | 0 | 9 | 39% | 0% | 0% | 0% | 1% | 0% |
| 0.8 | 3.4 | 5 | 0 | 0 | 5 | 0 | 0 | 7 | 0 | 9 | 35% | 0% | 0% | 0% | 1% | 0% |
| 1.2 | 3.4 | 5 | 0 | 0 | 5 | 0 | 0 | 7 | 0 | 9 | 39% | 0% | 0% | 0% | 1% | 0% |
| 0.8 | 3.6 | 5 | 0 | 0 | 5 | 0 | 0 | 7 | 0 | 9 | 35% | 0% | 0% | 0% | 2% | 0% |
| 0.6 | 3.8 | 5 | 0 | 0 | 5 | 0 | 0 | 7 | 0 | 9 | 36% | 0% | 0% | 0% | 2% | 0% |
| 1 | 2.6 | 5 | 0 | 0 | 7 | 0 | 0 | 7 | 0 | 9 | 37% | 0% | 0% | 0% | 0% | 0% |
| 0.6 | 2.8 | 5 | 0 | 0 | 7 | 0 | 0 | 7 | 0 | 9 | 32% | 0% | 0% | 0% | 1% | 8% |
| 1 | 2.8 | 5 | 0 | 0 | 7 | 0 | 0 | 7 | 0 | 9 | 37% | 0% | 0% | 0% | 0% | 0% |
| 0.6 | 3 | 5 | 0 | 0 | 7 | 0 | 0 | 7 | 0 | 9 | 33% | 0% | 0% | 0% | 1% | 0% |
| 1 | 3 | 5 | 0 | 0 | 7 | 0 | 0 | 7 | 0 | 9 | 38% | 0% | 0% | 0% | 1% | 0% |
| 0.6 | 3.2 | 5 | 0 | 0 | 7 | 0 | 0 | 7 | 0 | 9 | 34% | 0% | 0% | 0% | 1% | 0% |
| 1 | 3.2 | 5 | 0 | 0 | 7 | 0 | 0 | 7 | 0 | 9 | 38% | 0% | 0% | 0% | 1% | 0% |
| 0.6 | 3.4 | 5 | 0 | 0 | 7 | 0 | 0 | 7 | 0 | 9 | 34% | 0% | 0% | 0% | 1% | 0% |
| 1 | 3.4 | 5 | 0 | 0 | 7 | 0 | 0 | 7 | 0 | 9 | 39% | 0% | 0% | 0% | 1% | 0% |
| 0.6 | 3.6 | 5 | 0 | 0 | 7 | 0 | 0 | 7 | 0 | 9 | 35% | 0% | 0% | 0% | 1% | 0% |
| 1 | 3.6 | 5 | 0 | 0 | 7 | 0 | 0 | 7 | 0 | 9 | 39% | 0% | 0% | 0% | 1% | 0% |
| 0.6 | 3.8 | 5 | 0 | 0 | 7 | 0 | 0 | 7 | 0 | 9 | 35% | 0% | 0% | 0% | 2% | 0% |
| 1 | 3.8 | 5 | 0 | 0 | 7 | 0 | 0 | 7 | 0 | 9 | 41% | 0% | 0% | 0% | 1% | 0% |
| 0.8 | 2.8 | 5 | 0 | 0 | 9 | 0 | 0 | 7 | 0 | 9 | 36% | 0% | 0% | 0% | 0% | 0% |
| 1.2 | 2.8 | 5 | 0 | 0 | 9 | 0 | 0 | 7 | 0 | 9 | 41% | 0% | 0% | 0% | 0% | 0% |
| 0.8 | 3 | 5 | 0 | 0 | 9 | 0 | 0 | 7 | 0 | 9 | 37% | 0% | 0% | 0% | 1% | 0% |
| 1.2 | 3 | 5 | 0 | 0 | 9 | 0 | 0 | 7 | 0 | 9 | 42% | 0% | 0% | 0% | 0% | 0% |
| 0.8 | 3.2 | 5 | 0 | 0 | 9 | 0 | 0 | 7 | 0 | 9 | 37% | 0% | 0% | 0% | 1% | 0% |
| 1.2 | 3.2 | 5 | 0 | 0 | 9 | 0 | 0 | 7 | 0 | 9 | 42% | 0% | 0% | 0% | 1% | 0% |
| 0.8 | 3.4 | 5 | 0 | 0 | 9 | 0 | 0 | 7 | 0 | 9 | 38% | 0% | 0% | 0% | 1% | 0% |
| 1.2 | 3.4 | 5 | 0 | 0 | 9 | 0 | 0 | 7 | 0 | 9 | 42% | 0% | 0% | 0% | 1% | 0% |
| 0.8 | 3.6 | 5 | 0 | 0 | 9 | 0 | 0 | 7 | 0 | 9 | 38% | 0% | 0% | 0% | 1% | 0% |
| 1.2 | 3.6 | 5 | 0 | 0 | 9 | 0 | 0 | 7 | 0 | 9 | 43% | 0% | 0% | 0% | 1% | 0% |
| 0.8 | 3.8 | 5 | 0 | 0 | 9 | 0 | 0 | 7 | 0 | 9 | 39% | 0% | 0% | 0% | 1% | 0% |
| 1.2 | 3.8 | 5 | 0 | 0 | 9 | 0 | 0 | 7 | 0 | 9 | 43% | 0% | 0% | 0% | 1% | 0% |
| 0.8 | 4 | 5 | 0 | 0 | 9 | 0 | 0 | 7 | 0 | 9 | 39% | 0% | 0% | 0% | 2% | 0% |
| 1.2 | 4 | 5 | 0 | 0 | 9 | 0 | 0 | 7 | 0 | 9 | 47% | 0% | 0% | 0% | 1% | 0% |
| 1 | 2.4 | 5 | 0 | 0 | 1 | 0 | 0 | 9 | 0 | 9 | 34% | 0% | 0% | 0% | 0% | 0% |
| 0.6 | 2.6 | 5 | 0 | 0 | 1 | 0 | 0 | 9 | 0 | 9 | 30% | 0% | 0% | 0% | 0% | 0% |
| 1 | 2.6 | 5 | 0 | 0 | 1 | 0 | 0 | 9 | 0 | 9 | 35% | 0% | 0% | 0% | 0% | 0% |
| 0.6 | 2.8 | 5 | 0 | 0 | 1 | 0 | 0 | 9 | 0 | 9 | 31% | 0% | 0% | 0% | 1% | 0% |
| 1 | 2.8 | 5 | 0 | 0 | 1 | 0 | 0 | 9 | 0 | 9 | 36% | 0% | 0% | 0% | 1% | 0% |
| 0.6 | 3 | 5 | 0 | 0 | 1 | 0 | 0 | 9 | 0 | 9 | 32% | 0% | 0% | 0% | 1% | 0% |
| 1 | 3 | 5 | 0 | 0 | 1 | 0 | 0 | 9 | 0 | 9 | 36% | 0% | 0% | 0% | 1% | 0% |
| 0.6 | 3.2 | 5 | 0 | 0 | 1 | 0 | 0 | 9 | 0 | 9 | 33% | 0% | 0% | 0% | 1% | 0% |
| 1 | 3.2 | 5 | 0 | 0 | 1 | 0 | 0 | 9 | 0 | 9 | 37% | 0% | 0% | 0% | 1% | 0% |
| 0.6 | 3.4 | 5 | 0 | 0 | 1 | 0 | 0 | 9 | 0 | 9 | 33% | 0% | 0% | 0% | 1% | 0% |
| 1 | 3.4 | 5 | 0 | 0 | 1 | 0 | 0 | 9 | 0 | 9 | 37% | 0% | 0% | 0% | 1% | 0% |
| 0.6 | 3.6 | 5 | 0 | 0 | 1 | 0 | 0 | 9 | 0 | 9 | 34% | 0% | 0% | 0% | 2% | 0% |
| 1 | 3.6 | 5 | 0 | 0 | 1 | 0 | 0 | 9 | 0 | 9 | 38% | 0% | 0% | 0% | 2% | 0% |
| 0.6 | 3.8 | 5 | 0 | 0 | 1 | 0 | 0 | 9 | 0 | 9 | 34% | 0% | 0% | 0% | 2% | 0% |
| 0.8 | 2.6 | 5 | 0 | 0 | 3 | 0 | 0 | 9 | 0 | 9 | 34% | 0% | 0% | 0% | 0% | 1% |
| 1.2 | 2.6 | 5 | 0 | 0 | 3 | 0 | 0 | 9 | 0 | 9 | 39% | 0% | 0% | 0% | 0% | 0% |
| 0.8 | 2.8 | 5 | 0 | 0 | 3 | 0 | 0 | 9 | 0 | 9 | 35% | 0% | 0% | 0% | 0% | 0% |
| 1.2 | 2.8 | 5 | 0 | 0 | 3 | 0 | 0 | 9 | 0 | 9 | 39% | 0% | 0% | 0% | 1% | 0% |
| 0.8 | 3 | 5 | 0 | 0 | 3 | 0 | 0 | 9 | 0 | 9 | 35% | 0% | 0% | 0% | 1% | 0% |
| 1.2 | 3 | 5 | 0 | 0 | 3 | 0 | 0 | 9 | 0 | 9 | 40% | 0% | 0% | 0% | 1% | 0% |
| 0.8 | 3.2 | 5 | 0 | 0 | 3 | 0 | 0 | 9 | 0 | 9 | 36% | 0% | 0% | 0% | 1% | 0% |
| 1.2 | 3.2 | 5 | 0 | 0 | 3 | 0 | 0 | 9 | 0 | 9 | 40% | 0% | 0% | 0% | 1% | 0% |
| 0.8 | 3.4 | 5 | 0 | 0 | 3 | 0 | 0 | 9 | 0 | 9 | 37% | 0% | 0% | 0% | 1% | 0% |
| 1.2 | 3.4 | 5 | 0 | 0 | 3 | 0 | 0 | 9 | 0 | 9 | 41% | 0% | 0% | 0% | 1% | 0% |
| 0.8 | 3.6 | 5 | 0 | 0 | 3 | 0 | 0 | 9 | 0 | 9 | 37% | 0% | 0% | 0% | 1% | 0% |
| 1.2 | 3.6 | 5 | 0 | 0 | 3 | 0 | 0 | 9 | 0 | 9 | 41% | 0% | 0% | 0% | 1% | 0% |
| 0.8 | 3.8 | 5 | 0 | 0 | 3 | 0 | 0 | 9 | 0 | 9 | 37% | 0% | 0% | 0% | 2% | 0% |
| 1.2 | 3.8 | 5 | 0 | 0 | 3 | 0 | 0 | 9 | 0 | 9 | 43% | 0% | 0% | 0% | 1% | 0% |
| 0.8 | 4 | 5 | 0 | 0 | 3 | 0 | 0 | 9 | 0 | 9 | 39% | 0% | 0% | 0% | 2% | 0% |
| 1 | 2.8 | 5 | 0 | 0 | 5 | 0 | 0 | 9 | 0 | 9 | 38% | 0% | 0% | 0% | 0% | 0% |
| 0.6 | 3 | 5 | 0 | 0 | 5 | 0 | 0 | 9 | 0 | 9 | 34% | 0% | 0% | 0% | 1% | 8% |
| 1 | 3 | 5 | 0 | 0 | 5 | 0 | 0 | 9 | 0 | 9 | 39% | 0% | 0% | 0% | 0% | 0% |
| 0.6 | 3.2 | 5 | 0 | 0 | 5 | 0 | 0 | 9 | 0 | 9 | 35% | 0% | 0% | 0% | 1% | 0% |
| 1 | 3.2 | 5 | 0 | 0 | 5 | 0 | 0 | 9 | 0 | 9 | 40% | 0% | 0% | 0% | 1% | 0% |
| 0.6 | 3.4 | 5 | 0 | 0 | 5 | 0 | 0 | 9 | 0 | 9 | 36% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1 | 3.4 | 5 | 0 | 0 | 5 | 0 | 0 | 9 | 0 | 9 | 40% | 0% | 0% | 0% | 1% | 0% |
| 0.6 | 3.6 | 5 | 0 | 0 | 5 | 0 | 0 | 9 | 0 | 9 | 36% | 0% | 0% | 0% | 1% | 0% |
| 1 | 3.6 | 5 | 0 | 0 | 5 | 0 | 0 | 9 | 0 | 9 | 41% | 0% | 0% | 0% | 1% | 0% |
| 0.6 | 3.8 | 5 | 0 | 0 | 5 | 0 | 0 | 9 | 0 | 9 | 37% | 0% | 0% | 0% | 1% | 0% |
| 1 | 3.8 | 5 | 0 | 0 | 5 | 0 | 0 | 9 | 0 | 9 | 41% | 0% | 0% | 0% | 1% | 0% |
| 0.6 | 4 | 5 | 0 | 0 | 5 | 0 | 0 | 9 | 0 | 9 | 37% | 0% | 0% | 0% | 1% | 0% |
| 1 | 4 | 5 | 0 | 0 | 5 | 0 | 0 | 9 | 0 | 9 | 41% | 0% | 0% | 0% | 1% | 0% |
| 1 | 3 | 5 | 0 | 0 | 7 | 0 | 0 | 9 | 0 | 9 | 40% | 0% | 0% | 0% | 0% | 1% |
| 0.6 | 3.2 | 5 | 0 | 0 | 7 | 0 | 0 | 9 | 0 | 9 | 36% | 0% | 0% | 0% | 1% | 8% |
| 1 | 3.2 | 5 | 0 | 0 | 7 | 0 | 0 | 9 | 0 | 9 | 41% | 0% | 0% | 0% | 0% | 0% |
| 0.6 | 3.4 | 5 | 0 | 0 | 7 | 0 | 0 | 9 | 0 | 9 | 37% | 0% | 0% | 0% | 1% | 0% |
| 1 | 3.4 | 5 | 0 | 0 | 7 | 0 | 0 | 9 | 0 | 9 | 41% | 0% | 0% | 0% | 1% | 0% |
| 0.6 | 3.6 | 5 | 0 | 0 | 7 | 0 | 0 | 9 | 0 | 9 | 37% | 0% | 0% | 0% | 1% | 0% |
| 1 | 3.6 | 5 | 0 | 0 | 7 | 0 | 0 | 9 | 0 | 9 | 42% | 0% | 0% | 0% | 1% | 0% |
| 0.6 | 3.8 | 5 | 0 | 0 | 7 | 0 | 0 | 9 | 0 | 9 | 38% | 0% | 0% | 0% | 1% | 0% |
| 1 | 3.8 | 5 | 0 | 0 | 7 | 0 | 0 | 9 | 0 | 9 | 42% | 0% | 0% | 0% | 1% | 0% |
| 0.6 | 4 | 5 | 0 | 0 | 7 | 0 | 0 | 9 | 0 | 9 | 39% | 0% | 0% | 0% | 1% | 0% |
| 1 | 4 | 5 | 0 | 0 | 7 | 0 | 0 | 9 | 0 | 9 | 43% | 0% | 0% | 0% | 1% | 0% |
| 0.6 | 3.4 | 5 | 0 | 0 | 9 | 0 | 0 | 9 | 0 | 9 | 38% | 0% | 0% | 0% | 1% | 7% |
| 1 | 3.4 | 5 | 0 | 0 | 9 | 0 | 0 | 9 | 0 | 9 | 43% | 0% | 0% | 0% | 0% | 0% |
| 0.6 | 3.6 | 5 | 0 | 0 | 9 | 0 | 0 | 9 | 0 | 9 | 39% | 0% | 0% | 0% | 1% | 0% |
| 1 | 3.6 | 5 | 0 | 0 | 9 | 0 | 0 | 9 | 0 | 9 | 43% | 0% | 0% | 0% | 1% | 0% |
| 0.6 | 3.8 | 5 | 0 | 0 | 9 | 0 | 0 | 9 | 0 | 9 | 39% | 0% | 0% | 0% | 1% | 0% |
| 1 | 3.8 | 5 | 0 | 0 | 9 | 0 | 0 | 9 | 0 | 9 | 44% | 0% | 0% | 0% | 1% | 0% |
| 0.6 | 4 | 5 | 0 | 0 | 9 | 0 | 0 | 9 | 0 | 9 | 40% | 0% | 0% | 0% | 1% | 0% |
| 1 | 4 | 5 | 0 | 0 | 9 | 0 | 0 | 9 | 0 | 9 | 44% | 0% | 0% | 0% | 1% | 0% |
| 0.8 | 0.9 | 3.5 | 0 | 0 | 1.5 | 0 | 0 | 0.4 | 0.5 | 9 | 15% | 0% | 0% | 0% | 1% | 0% |
| 0.8 | 1.1 | 3.5 | 0 | 0 | 1.5 | 0 | 0 | 0.4 | 0.5 | 9 | 15% | 0% | 0% | 0% | 1% | 0% |
| 0.8 | 1.3 | 3.5 | 0 | 0 | 1.5 | 0 | 0 | 0.4 | 0.5 | 9 | 15% | 0% | 0% | 0% | 1% | 0% |
| 0.8 | 1.5 | 3.5 | 0 | 0 | 1.5 | 0 | 0 | 0.4 | 0.5 | 9 | 18% | 0% | 0% | 0% | 2% | 0% |
| 0.8 | 1 | 3.5 | 0 | 0 | 1.5 | 0 | 0 | 0.4 | 1 | 9 | 12% | 0% | 0% | 0% | 1% | 0% |
| 0.8 | 1.2 | 3.5 | 0 | 0 | 1.5 | 0 | 0 | 0.4 | 1 | 9 | 13% | 0% | 0% | 0% | 1% | 0% |
| 0.8 | 1.4 | 3.5 | 0 | 0 | 1.5 | 0 | 0 | 0.4 | 1 | 9 | 13% | 0% | 0% | 0% | 1% | 0% |
| 0.8 | 0.9 | 3.5 | 0 | 0 | 1.5 | 0 | 0 | 0.4 | 1.5 | 9 | 14% | 0% | 0% | 0% | 1% | 0% |
| 0.8 | 1.1 | 3.5 | 0 | 0 | 1.5 | 0 | 0 | 0.4 | 1.5 | 9 | 14% | 0% | 0% | 0% | 1% | 0% |
| 0.8 | 1.3 | 3.5 | 0 | 0 | 1.5 | 0 | 0 | 0.4 | 1.5 | 9 | 14% | 0% | 0% | 0% | 1% | 0% |
| 0.8 | 1.5 | 3.5 | 0 | 0 | 1.5 | 0 | 0 | 0.4 | 1.5 | 9 | 14% | 0% | 0% | 0% | 1% | 0% |
| 0.92 | 1.01 | 6 | 0.19 | 0 | 3.09 | 0 | 0.48 | 0.26 | 2 | 9 | 21% | 0% | 0% | 0% | 1% | 7% |
| 0.8 | 0.9 | 3.5 | 0 | 0 | 1.5 | 0 | 0 | 0.4 | 2 | 9 | 15% | 0% | 0% | 0% | 1% | 7% |
| 0.8 | 1.1 | 3.5 | 0 | 0 | 1.5 | 0 | 0 | 0.4 | 2 | 9 | 15% | 0% | 0% | 0% | 1% | 0% |
| 0.8 | 1.3 | 3.5 | 0 | 0 | 1.5 | 0 | 0 | 0.4 | 2 | 9 | 15% | 0% | 0% | 0% | 1% | 0% |
| 0.8 | 1.5 | 3.5 | 0 | 0 | 1.5 | 0 | 0 | 0.4 | 2 | 9 | 16% | 0% | 0% | 0% | 2% | 0% |
| 0.8 | 1 | 1 | 1.3 | 0 | 1.5 | 0 | 1.5 | 0.4 | 2 | 9 | 15% | 0% | 0% | 0% | 1% | 0% |
| 0.8 | 1 | 3 | 1.3 | 0 | 1.5 | 0 | 1.5 | 0.4 | 2 | 9 | 14% | 0% | 0% | 0% | 1% | 0% |
| 0.8 | 1 | 5 | 1.3 | 0 | 1.5 | 0 | 1.5 | 0.4 | 2 | 9 | 15% | 0% | 0% | 0% | 1% | 9% |
| 1.75 | 0.5 | 0 | 0.25 | 0 | 2 | 0 | 0.25 | 0.25 | 2 | 9.15 | 27% | 0% | 0% | 0% | 0% | 0% |
| 2.25 | 0.5 | 0 | 0.25 | 0 | 2 | 0 | 0.25 | 0.25 | 2 | 9.15 | 34% | 0% | 0% | 0% | 0% | 0% |
| 1.5 | 0.75 | 0 | 0.25 | 0 | 2 | 0 | 0.25 | 0.25 | 2 | 9.15 | 24% | 0% | 0% | 0% | 1% | 0% |
| 2 | 0.75 | 0 | 0.25 | 0 | 2 | 0 | 0.25 | 0.25 | 2 | 9.15 | 31% | 0% | 0% | 0% | 1% | 0% |
| 2.5 | 0.75 | 0 | 0.25 | 0 | 2 | 0 | 0.25 | 0.25 | 2 | 9.15 | 38% | 2% | 0% | 0% | 1% | 0% |
| 0.75 | 1 | 0 | 0.25 | 0 | 2 | 0 | 0.25 | 0.25 | 2 | 9.15 | 5% | 0% | 0% | 0% | 1% | 0% |
| 1.25 | 1 | 0 | 0.25 | 0 | 2 | 0 | 0.25 | 0.25 | 2 | 9.15 | 20% | 0% | 0% | 0% | 1% | 0% |
| 1.75 | 1 | 0 | 0.25 | 0 | 2 | 0 | 0.25 | 0.25 | 2 | 9.15 | 28% | 0% | 0% | 0% | 1% | 0% |
| 2.25 | 1 | 0 | 0.25 | 0 | 2 | 0 | 0.25 | 0.25 | 2 | 9.15 | 35% | 2% | 0% | 0% | 1% | 0% |
| 0.5 | 1.25 | 0 | 0.25 | 0 | 2 | 0 | 0.25 | 0.25 | 2 | 9.15 | 10% | 0% | 0% | 0% | 1% | 0% |
| 1 | 1.25 | 0 | 0.25 | 0 | 2 | 0 | 0.25 | 0.25 | 2 | 9.15 | 12% | 0% | 0% | 0% | 1% | 0% |
| 1.5 | 1.25 | 0 | 0.25 | 0 | 2 | 0 | 0.25 | 0.25 | 2 | 9.15 | 28% | 0% | 0% | 0% | 1% | 0% |
| 2 | 1.25 | 0 | 0.25 | 0 | 2 | 0 | 0.25 | 0.25 | 2 | 9.15 | 36% | 1% | 0% | 0% | 1% | 0% |
| 2.5 | 1.25 | 0 | 0.25 | 0 | 2 | 0 | 0.25 | 0.25 | 2 | 9.15 | 40% | 3% | 0% | 0% | 1% | 0% |
| 0.75 | 1.5 | 0 | 0.25 | 0 | 2 | 0 | 0.25 | 0.25 | 2 | 9.15 | 10% | 0% | 0% | 0% | 1% | 0% |
| 1.25 | 1.5 | 0 | 0.25 | 0 | 2 | 0 | 0.25 | 0.25 | 2 | 9.15 | 22% | 0% | 0% | 0% | 1% | 0% |
| 1.75 | 1.5 | 0 | 0.25 | 0 | 2 | 0 | 0.25 | 0.25 | 2 | 9.15 | 39% | 1% | 0% | 0% | 1% | 0% |
| 2.25 | 1.5 | 0 | 0.25 | 0 | 2 | 0 | 0.25 | 0.25 | 2 | 9.15 | 41% | 3% | 0% | 0% | 1% | 0% |
| 0.5 | 1.75 | 0 | 0.25 | 0 | 2 | 0 | 0.25 | 0.25 | 2 | 9.15 | 10% | 0% | 0% | 0% | 2% | 0% |
| 1 | 1.75 | 0 | 0.25 | 0 | 2 | 0 | 0.25 | 0.25 | 2 | 9.15 | 26% | 0% | 0% | 0% | 2% | 0% |
| 1.5 | 1.75 | 0 | 0.25 | 0 | 2 | 0 | 0.25 | 0.25 | 2 | 9.15 | 38% | 0% | 0% | 0% | 2% | 0% |
| 2 | 1.75 | 0 | 0.25 | 0 | 2 | 0 | 0.25 | 0.25 | 2 | 9.15 | 50% | 2% | 0% | 0% | 2% | 0% |
| 0.5 | 2 | 0 | 0.25 | 0 | 2 | 0 | 0.25 | 0.25 | 2 | 9.15 | 12% | 0% | 0% | 0% | 2% | 0% |
| 1 | 2 | 0 | 0.25 | 0 | 2 | 0 | 0.25 | 0.25 | 2 | 9.15 | 29% | 0% | 0% | 0% | 2% | 0% |
| 1.75 | 2 | 0 | 0.25 | 0 | 2 | 0 | 0.25 | 0.25 | 2 | 9.15 | 47% | 2% | 0% | 0% | 2% | 0% |
| 0.5 | 2.25 | 0 | 0.25 | 0 | 2 | 0 | 0.25 | 0.25 | 2 | 9.15 | 17% | 0% | 0% | 0% | 2% | 0% |
| 1 | 2.25 | 0 | 0.25 | 0 | 2 | 0 | 0.25 | 0.25 | 2 | 9.15 | 33% | 0% | 0% | 0% | 2% | 0% |
| 1.5 | 2.25 | 0 | 0.25 | 0 | 2 | 0 | 0.25 | 0.25 | 2 | 9.15 | 39% | 1% | 0% | 0% | 2% | 0% |
| 0.5 | 2.5 | 0 | 0.25 | 0 | 2 | 0 | 0.25 | 0.25 | 2 | 9.15 | 21% | 0% | 0% | 0% | 2% | 0% |
| 1 | 2.5 | 0 | 0.25 | 0 | 2 | 0 | 0.25 | 0.25 | 2 | 9.15 | 36% | 0% | 0% | 0% | 2% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.5 | 2.5 | 0 | 0.25 | 0 | 2 | 0 | 0.25 | 0.25 | 2 | 9.15 | 43% | 1% | 0% | 0% | 2% | 0% |
| 2.25 | 0.5 | 0 | 0.25 | 0 | 2.5 | 0 | 0.25 | 0.25 | 2 | 9.15 | 34% | 1% | 0% | 0% | 0% | 7% |
| 1.5 | 0.75 | 0 | 0.25 | 0 | 2.5 | 0 | 0.25 | 0.25 | 2 | 9.15 | 24% | 0% | 0% | 0% | 1% | 0% |
| 2 | 0.75 | 0 | 0.25 | 0 | 2.5 | 0 | 0.25 | 0.25 | 2 | 9.15 | 32% | 0% | 0% | 0% | 1% | 0% |
| 2.5 | 0.75 | 0 | 0.25 | 0 | 2.5 | 0 | 0.25 | 0.25 | 2 | 9.15 | 39% | 2% | 0% | 0% | 1% | 0% |
| 1 | 1 | 0 | 0.25 | 0 | 2.5 | 0 | 0.25 | 0.25 | 2 | 9.15 | 17% | 0% | 0% | 0% | 1% | 0% |
| 1.5 | 1 | 0 | 0.25 | 0 | 2.5 | 0 | 0.25 | 0.25 | 2 | 9.15 | 25% | 0% | 0% | 0% | 1% | 0% |
| 2 | 1 | 0 | 0.25 | 0 | 2.5 | 0 | 0.25 | 0.25 | 2 | 9.15 | 32% | 0% | 0% | 0% | 1% | 0% |
| 2.5 | 1 | 0 | 0.25 | 0 | 2.5 | 0 | 0.25 | 0.25 | 2 | 9.15 | 39% | 2% | 0% | 0% | 1% | 0% |
| 0.75 | 1.25 | 0 | 0.25 | 0 | 2.5 | 0 | 0.25 | 0.25 | 2 | 9.15 | 7% | 0% | 0% | 0% | 1% | 0% |
| 1.25 | 1.25 | 0 | 0.25 | 0 | 2.5 | 0 | 0.25 | 0.25 | 2 | 9.15 | 22% | 0% | 0% | 0% | 1% | 0% |
| 1.75 | 1.25 | 0 | 0.25 | 0 | 2.5 | 0 | 0.25 | 0.25 | 2 | 9.15 | 31% | 0% | 0% | 0% | 1% | 0% |
| 2.25 | 1.25 | 0 | 0.25 | 0 | 2.5 | 0 | 0.25 | 0.25 | 2 | 9.15 | 35% | 2% | 0% | 0% | 1% | 0% |
| 0.5 | 1.5 | 0 | 0.25 | 0 | 2.5 | 0 | 0.25 | 0.25 | 2 | 9.15 | 10% | 0% | 0% | 0% | 1% | 0% |
| 1 | 1.5 | 0 | 0.25 | 0 | 2.5 | 0 | 0.25 | 0.25 | 2 | 9.15 | 17% | 0% | 0% | 0% | 1% | 0% |
| 1.5 | 1.5 | 0 | 0.25 | 0 | 2.5 | 0 | 0.25 | 0.25 | 2 | 9.15 | 27% | 0% | 0% | 0% | 1% | 0% |
| 2 | 1.5 | 0 | 0.25 | 0 | 2.5 | 0 | 0.25 | 0.25 | 2 | 9.15 | 42% | 1% | 0% | 0% | 1% | 0% |
| 2.5 | 1.5 | 0 | 0.25 | 0 | 2.5 | 0 | 0.25 | 0.25 | 2 | 9.15 | 45% | 3% | 0% | 0% | 1% | 0% |
| 0.75 | 1.75 | 0 | 0.25 | 0 | 2.5 | 0 | 0.25 | 0.25 | 2 | 9.15 | 19% | 0% | 0% | 0% | 1% | 0% |
| 1.25 | 1.75 | 0 | 0.25 | 0 | 2.5 | 0 | 0.25 | 0.25 | 2 | 9.15 | 47% | 0% | 0% | 0% | 1% | 0% |
| 1.75 | 1.75 | 0 | 0.25 | 0 | 2.5 | 0 | 0.25 | 0.25 | 2 | 9.15 | 37% | 1% | 0% | 0% | 1% | 0% |
| 2.25 | 1.75 | 0 | 0.25 | 0 | 2.5 | 0 | 0.25 | 0.25 | 2 | 9.15 | 46% | 3% | 0% | 0% | 1% | 0% |
| 0.75 | 2 | 0 | 0.25 | 0 | 2.5 | 0 | 0.25 | 0.25 | 2 | 9.15 | 22% | 0% | 0% | 0% | 2% | 0% |
| 1.25 | 2 | 0 | 0.25 | 0 | 2.5 | 0 | 0.25 | 0.25 | 2 | 9.15 | 29% | 0% | 0% | 0% | 2% | 0% |
| 2 | 2 | 0 | 0.25 | 0 | 2.5 | 0 | 0.25 | 0.25 | 2 | 9.15 | 46% | 2% | 0% | 0% | 2% | 0% |
| 0.75 | 2.25 | 0 | 0.25 | 0 | 2.5 | 0 | 0.25 | 0.25 | 2 | 9.15 | 25% | 0% | 0% | 0% | 2% | 0% |
| 1.25 | 2.25 | 0 | 0.25 | 0 | 2.5 | 0 | 0.25 | 0.25 | 2 | 9.15 | 39% | 0% | 0% | 0% | 2% | 0% |
| 0.5 | 2.5 | 0 | 0.25 | 0 | 2.5 | 0 | 0.25 | 0.25 | 2 | 9.15 | 21% | 0% | 0% | 0% | 2% | 0% |
| 1 | 2.5 | 0 | 0.25 | 0 | 2.5 | 0 | 0.25 | 0.25 | 2 | 9.15 | 36% | 0% | 0% | 0% | 2% | 0% |
| 1.5 | 2.5 | 0 | 0.25 | 0 | 2.5 | 0 | 0.25 | 0.25 | 2 | 9.15 | 42% | 1% | 0% | 0% | 2% | 0% |
| 2.25 | 0.5 | 0 | 0.25 | 0 | 3 | 0 | 0.25 | 0.25 | 2 | 9.15 | 34% | 1% | 0% | 0% | 0% | 8% |
| 1.5 | 0.75 | 0 | 0.25 | 0 | 3 | 0 | 0.25 | 0.25 | 2 | 9.15 | 25% | 0% | 0% | 0% | 1% | 1% |
| 2 | 0.75 | 0 | 0.25 | 0 | 3 | 0 | 0.25 | 0.25 | 2 | 9.15 | 32% | 0% | 0% | 0% | 0% | 0% |
| 2.5 | 0.75 | 0 | 0.25 | 0 | 3 | 0 | 0.25 | 0.25 | 2 | 9.15 | 39% | 2% | 0% | 0% | 0% | 0% |
| 1 | 1 | 0 | 0.25 | 0 | 3 | 0 | 0.25 | 0.25 | 2 | 9.15 | 18% | 0% | 0% | 0% | 1% | 0% |
| 1.5 | 1 | 0 | 0.25 | 0 | 3 | 0 | 0.25 | 0.25 | 2 | 9.15 | 26% | 0% | 0% | 0% | 1% | 0% |
| 2 | 1 | 0 | 0.25 | 0 | 3 | 0 | 0.25 | 0.25 | 2 | 9.15 | 33% | 0% | 0% | 0% | 1% | 0% |
| 2.5 | 1 | 0 | 0.25 | 0 | 3 | 0 | 0.25 | 0.25 | 2 | 9.15 | 40% | 2% | 0% | 0% | 1% | 0% |
| 0.75 | 1.25 | 0 | 0.25 | 0 | 3 | 0 | 0.25 | 0.25 | 2 | 9.15 | 8% | 0% | 0% | 0% | 1% | 0% |
| 1.25 | 1.25 | 0 | 0.25 | 0 | 3 | 0 | 0.25 | 0.25 | 2 | 9.15 | 22% | 0% | 0% | 0% | 1% | 0% |
| 1.75 | 1.25 | 0 | 0.25 | 0 | 3 | 0 | 0.25 | 0.25 | 2 | 9.15 | 30% | 0% | 0% | 0% | 1% | 0% |
| 2.25 | 1.25 | 0 | 0.25 | 0 | 3 | 0 | 0.25 | 0.25 | 2 | 9.15 | 37% | 2% | 0% | 0% | 1% | 0% |
| 0.5 | 1.5 | 0 | 0.25 | 0 | 3 | 0 | 0.25 | 0.25 | 2 | 9.15 | 11% | 0% | 0% | 0% | 1% | 0% |
| 1 | 1.5 | 0 | 0.25 | 0 | 3 | 0 | 0.25 | 0.25 | 2 | 9.15 | 17% | 0% | 0% | 0% | 1% | 0% |
| 1.5 | 1.5 | 0 | 0.25 | 0 | 3 | 0 | 0.25 | 0.25 | 2 | 9.15 | 27% | 0% | 0% | 0% | 1% | 0% |
| 2 | 1.5 | 0 | 0.25 | 0 | 3 | 0 | 0.25 | 0.25 | 2 | 9.15 | 36% | 1% | 0% | 0% | 1% | 0% |
| 2.5 | 1.5 | 0 | 0.25 | 0 | 3 | 0 | 0.25 | 0.25 | 2 | 9.15 | 44% | 3% | 0% | 0% | 1% | 0% |
| 0.75 | 1.75 | 0 | 0.25 | 0 | 3 | 0 | 0.25 | 0.25 | 2 | 9.15 | 19% | 0% | 0% | 0% | 1% | 0% |
| 1.25 | 1.75 | 0 | 0.25 | 0 | 3 | 0 | 0.25 | 0.25 | 2 | 9.15 | 25% | 0% | 0% | 0% | 1% | 0% |
| 1.75 | 1.75 | 0 | 0.25 | 0 | 3 | 0 | 0.25 | 0.25 | 2 | 9.15 | 36% | 1% | 0% | 0% | 1% | 0% |
| 2.5 | 1.75 | 0 | 0.25 | 0 | 3 | 0 | 0.25 | 0.25 | 2 | 9.15 | 50% | 3% | 0% | 0% | 1% | 0% |
| 0.75 | 2 | 0 | 0.25 | 0 | 3 | 0 | 0.25 | 0.25 | 2 | 9.15 | 22% | 0% | 0% | 0% | 2% | 0% |
| 1.75 | 2 | 0 | 0.25 | 0 | 3 | 0 | 0.25 | 0.25 | 2 | 9.15 | 40% | 2% | 0% | 0% | 2% | 0% |
| 0.5 | 2.25 | 0 | 0.25 | 0 | 3 | 0 | 0.25 | 0.25 | 2 | 9.15 | 16% | 0% | 0% | 0% | 2% | 0% |
| 1 | 2.25 | 0 | 0.25 | 0 | 3 | 0 | 0.25 | 0.25 | 2 | 9.15 | 32% | 0% | 0% | 0% | 2% | 0% |
| 2 | 2.25 | 0 | 0.25 | 0 | 3 | 0 | 0.25 | 0.25 | 2 | 9.15 | 49% | 2% | 0% | 0% | 2% | 0% |
| 0.75 | 2.5 | 0 | 0.25 | 0 | 3 | 0 | 0.25 | 0.25 | 2 | 9.15 | 29% | 0% | 0% | 0% | 2% | 0% |
| 1.25 | 2.5 | 0 | 0.25 | 0 | 3 | 0 | 0.25 | 0.25 | 2 | 9.15 | 42% | 1% | 0% | 0% | 2% | 0% |
| 1.75 | 2.5 | 0 | 0.25 | 0 | 3 | 0 | 0.25 | 0.25 | 2 | 9.15 | 48% | 2% | 0% | 0% | 2% | 0% |
| 2.5 | 0.5 | 0 | 0.25 | 0 | 3.5 | 0 | 0.25 | 0.25 | 2 | 9.15 | 38% | 3% | 0% | 0% | 0% | 0% |
| 1.75 | 0.75 | 0 | 0.25 | 0 | 3.5 | 0 | 0.25 | 0.25 | 2 | 9.15 | 29% | 0% | 0% | 0% | 0% | 0% |
| 2.25 | 0.75 | 0 | 0.25 | 0 | 3.5 | 0 | 0.25 | 0.25 | 2 | 9.15 | 36% | 1% | 0% | 0% | 0% | 0% |
| 1.25 | 1 | 0 | 0.25 | 0 | 3.5 | 0 | 0.25 | 0.25 | 2 | 9.15 | 23% | 0% | 0% | 0% | 1% | 0% |
| 1.75 | 1 | 0 | 0.25 | 0 | 3.5 | 0 | 0.25 | 0.25 | 2 | 9.15 | 30% | 0% | 0% | 0% | 1% | 0% |
| 2.25 | 1 | 0 | 0.25 | 0 | 3.5 | 0 | 0.25 | 0.25 | 2 | 9.15 | 37% | 2% | 0% | 0% | 1% | 0% |
| 0.5 | 1.25 | 0 | 0.25 | 0 | 3.5 | 0 | 0.25 | 0.25 | 2 | 9.15 | 12% | 0% | 0% | 0% | 1% | 0% |
| 1 | 1.25 | 0 | 0.25 | 0 | 3.5 | 0 | 0.25 | 0.25 | 2 | 9.15 | 13% | 0% | 0% | 0% | 1% | 0% |
| 1.5 | 1.25 | 0 | 0.25 | 0 | 3.5 | 0 | 0.25 | 0.25 | 2 | 9.15 | 27% | 0% | 0% | 0% | 1% | 0% |
| 2 | 1.25 | 0 | 0.25 | 0 | 3.5 | 0 | 0.25 | 0.25 | 2 | 9.15 | 34% | 2% | 0% | 0% | 1% | 0% |
| 2.5 | 1.25 | 0 | 0.25 | 0 | 3.5 | 0 | 0.25 | 0.25 | 2 | 9.15 | 41% | 2% | 0% | 0% | 1% | 0% |
| 0.75 | 1.5 | 0 | 0.25 | 0 | 3.5 | 0 | 0.25 | 0.25 | 2 | 9.15 | 16% | 0% | 0% | 0% | 1% | 0% |
| 1.25 | 1.5 | 0 | 0.25 | 0 | 3.5 | 0 | 0.25 | 0.25 | 2 | 9.15 | 21% | 0% | 0% | 0% | 1% | 0% |
| 1.75 | 1.5 | 0 | 0.25 | 0 | 3.5 | 0 | 0.25 | 0.25 | 2 | 9.15 | 36% | 1% | 0% | 0% | 1% | 0% |
| 2.25 | 1.5 | 0 | 0.25 | 0 | 3.5 | 0 | 0.25 | 0.25 | 2 | 9.15 | 39% | 2% | 0% | 0% | 1% | 0% |
| 0.5 | 1.75 | 0 | 0.25 | 0 | 3.5 | 0 | 0.25 | 0.25 | 2 | 9.15 | 12% | 0% | 0% | 0% | 1% | 0% |

TABLE 9-continued

Alloy Compositions which meet the Thermodynamic Criteria Described in this Disclosure

| B | C | Cr | Mn | Mo | Nb | Ni | Si | Ti | V | W | 1 | 2 | 3 | 4 | 5 | 6 |
|---|---|---|---|---|---|---|---|---|---|---|---|---|---|---|---|---|
| 1 | 1.75 | 0 | 0.25 | 0 | 3.5 | 0 | 0.25 | 0.25 | 2 | 9.15 | 33% | 0% | 0% | 0% | 1% | 0% |
| 1.5 | 1.75 | 0 | 0.25 | 0 | 3.5 | 0 | 0.25 | 0.25 | 2 | 9.15 | 31% | 0% | 0% | 0% | 1% | 0% |
| 2 | 1.75 | 0 | 0.25 | 0 | 3.5 | 0 | 0.25 | 0.25 | 2 | 9.15 | 47% | 1% | 0% | 0% | 1% | 0% |
| 2.5 | 1.75 | 0 | 0.25 | 0 | 3.5 | 0 | 0.25 | 0.25 | 2 | 9.15 | 49% | 3% | 0% | 0% | 1% | 0% |
| 0.75 | 2 | 0 | 0.25 | 0 | 3.5 | 0 | 0.25 | 0.25 | 2 | 9.15 | 22% | 0% | 0% | 0% | 2% | 0% |
| 1.5 | 2 | 0 | 0.25 | 0 | 3.5 | 0 | 0.25 | 0.25 | 2 | 9.15 | 34% | 0% | 0% | 0% | 2% | 0% |
| 2 | 2 | 0 | 0.25 | 0 | 3.5 | 0 | 0.25 | 0.25 | 2 | 9.15 | 45% | 2% | 0% | 0% | 2% | 0% |
| 0.75 | 2.25 | 0 | 0.25 | 0 | 3.5 | 0 | 0.25 | 0.25 | 2 | 9.15 | 25% | 0% | 0% | 0% | 2% | 0% |
| 1.25 | 2.25 | 0 | 0.25 | 0 | 3.5 | 0 | 0.25 | 0.25 | 2 | 9.15 | 32% | 0% | 0% | 0% | 2% | 0% |
| 2 | 2.25 | 0 | 0.25 | 0 | 3.5 | 0 | 0.25 | 0.25 | 2 | 9.15 | 49% | 2% | 0% | 0% | 2% | 0% |
| 0.75 | 2.5 | 0 | 0.25 | 0 | 3.5 | 0 | 0.25 | 0.25 | 2 | 9.15 | 29% | 0% | 0% | 0% | 2% | 0% |
| 1.25 | 2.5 | 0 | 0.25 | 0 | 3.5 | 0 | 0.25 | 0.25 | 2 | 9.15 | 42% | 1% | 0% | 0% | 2% | 0% |
| 1.5 | 0.75 | 0 | 0.25 | 0 | 4 | 0 | 0.25 | 0.25 | 2 | 9.15 | 26% | 0% | 0% | 0% | 0% | 4% |
| 2 | 0.75 | 0 | 0.25 | 0 | 4 | 0 | 0.25 | 0.25 | 2 | 9.15 | 33% | 0% | 0% | 0% | 0% | 0% |
| 2.5 | 0.75 | 0 | 0.25 | 0 | 4 | 0 | 0.25 | 0.25 | 2 | 9.15 | 40% | 3% | 0% | 0% | 0% | 0% |
| 1.5 | 1 | 0 | 0.25 | 0 | 4 | 0 | 0.25 | 0.25 | 2 | 9.15 | 27% | 0% | 0% | 0% | 1% | 0% |
| 2 | 1 | 0 | 0.25 | 0 | 4 | 0 | 0.25 | 0.25 | 2 | 9.15 | 34% | 0% | 0% | 0% | 1% | 0% |
| 2.5 | 1 | 0 | 0.25 | 0 | 4 | 0 | 0.25 | 0.25 | 2 | 9.15 | 41% | 2% | 0% | 0% | 1% | 0% |
| 0.75 | 1.25 | 0 | 0.25 | 0 | 4 | 0 | 0.25 | 0.25 | 2 | 9.15 | 9% | 0% | 0% | 0% | 1% | 0% |
| 1.25 | 1.25 | 0 | 0.25 | 0 | 4 | 0 | 0.25 | 0.25 | 2 | 9.15 | 24% | 0% | 0% | 0% | 1% | 0% |
| 1.75 | 1.25 | 0 | 0.25 | 0 | 4 | 0 | 0.25 | 0.25 | 2 | 9.15 | 31% | 0% | 0% | 0% | 1% | 0% |
| 2.25 | 1.25 | 0 | 0.25 | 0 | 4 | 0 | 0.25 | 0.25 | 2 | 9.15 | 38% | 2% | 0% | 0% | 1% | 0% |
| 0.5 | 1.5 | 0 | 0.25 | 0 | 4 | 0 | 0.25 | 0.25 | 2 | 9.15 | 13% | 0% | 0% | 0% | 1% | 0% |
| 1 | 1.5 | 0 | 0.25 | 0 | 4 | 0 | 0.25 | 0.25 | 2 | 9.15 | 16% | 0% | 0% | 0% | 1% | 0% |
| 1.5 | 1.5 | 0 | 0.25 | 0 | 4 | 0 | 0.25 | 0.25 | 2 | 9.15 | 31% | 0% | 0% | 0% | 1% | 0% |
| 2 | 1.5 | 0 | 0.25 | 0 | 4 | 0 | 0.25 | 0.25 | 2 | 9.15 | 34% | 1% | 0% | 0% | 1% | 0% |
| 2.5 | 1.5 | 0 | 0.25 | 0 | 4 | 0 | 0.25 | 0.25 | 2 | 9.15 | 43% | 3% | 0% | 0% | 1% | 0% |
| 0.75 | 1.75 | 0 | 0.25 | 0 | 4 | 0 | 0.25 | 0.25 | 2 | 9.15 | 13% | 0% | 0% | 0% | 1% | 0% |
| 1.25 | 1.75 | 0 | 0.25 | 0 | 4 | 0 | 0.25 | 0.25 | 2 | 9.15 | 25% | 0% | 0% | 0% | 1% | 0% |
| 1.75 | 1.75 | 0 | 0.25 | 0 | 4 | 0 | 0.25 | 0.25 | 2 | 9.15 | 42% | 1% | 0% | 0% | 1% | 0% |
| 2.25 | 1.75 | 0 | 0.25 | 0 | 4 | 0 | 0.25 | 0.25 | 2 | 9.15 | 44% | 3% | 0% | 0% | 1% | 0% |
| 0.5 | 2 | 0 | 0.25 | 0 | 4 | 0 | 0.25 | 0.25 | 2 | 9.15 | 13% | 0% | 0% | 0% | 2% | 0% |
| 1 | 2 | 0 | 0.25 | 0 | 4 | 0 | 0.25 | 0.25 | 2 | 9.15 | 29% | 0% | 0% | 0% | 2% | 0% |
| 1.75 | 2 | 0 | 0.25 | 0 | 4 | 0 | 0.25 | 0.25 | 2 | 9.15 | 40% | 1% | 0% | 0% | 2% | 0% |
| 0.5 | 2.25 | 0 | 0.25 | 0 | 4 | 0 | 0.25 | 0.25 | 2 | 9.15 | 16% | 0% | 0% | 0% | 2% | 0% |
| 1 | 2.25 | 0 | 0.25 | 0 | 4 | 0 | 0.25 | 0.25 | 2 | 9.15 | 32% | 0% | 0% | 0% | 2% | 0% |
| 1.75 | 2.25 | 0 | 0.25 | 0 | 4 | 0 | 0.25 | 0.25 | 2 | 9.15 | 43% | 2% | 0% | 0% | 2% | 0% |
| 0.5 | 2.5 | 0 | 0.25 | 0 | 4 | 0 | 0.25 | 0.25 | 2 | 9.15 | 20% | 0% | 0% | 0% | 2% | 0% |
| 1 | 2.5 | 0 | 0.25 | 0 | 4 | 0 | 0.25 | 0.25 | 2 | 9.15 | 36% | 0% | 0% | 0% | 2% | 0% |
| 1.5 | 2.5 | 0 | 0.25 | 0 | 4 | 0 | 0.25 | 0.25 | 2 | 9.15 | 42% | 1% | 0% | 0% | 2% | 0% |
| 1.01 | 1.29 | 4.64 | 0.21 | 0 | 4.64 | 0 | 0.52 | 0.54 | 0 | 9.8 | 21% | 0% | 0% | 0% | 1% | 0% |
| 1.05 | 1.29 | 4.76 | 0 | 0 | 4.94 | 0 | 0.46 | 0.5 | 0.2 | 9.94 | 22% | 0% | 0% | 0% | 1% | 0% |
| 1.05 | 1.29 | 4.76 | 0 | 0 | 4.94 | 0 | 0.46 | 0.5 | 0.6 | 9.94 | 23% | 0% | 0% | 0% | 1% | 0% |
| 1.05 | 1.29 | 4.76 | 0 | 0 | 4.94 | 0 | 0.46 | 0.5 | 1 | 9.94 | 24% | 0% | 0% | 0% | 1% | 1% |
| 1.05 | 1.29 | 4.76 | 0 | 0 | 4.94 | 0 | 0.46 | 0.5 | 1.4 | 9.94 | 23% | 0% | 0% | 0% | 1% | 0% |
| 1.05 | 1.29 | 4.76 | 0 | 0 | 4.94 | 0 | 0.46 | 0.5 | 1.8 | 9.94 | 23% | 0% | 0% | 0% | 1% | 0% |
| 1.05 | 1.29 | 4.76 | 0 | 0 | 4.94 | 0 | 0.46 | 0.5 | 2.2 | 9.94 | 23% | 0% | 0% | 0% | 1% | 1% |
| 0.8 | 1 | 1 | 1.3 | 0 | 1.5 | 0 | 1.5 | 0.4 | 0 | 10 | 14% | 0% | 0% | 0% | 1% | 0% |
| 0.8 | 1 | 3 | 1.3 | 0 | 1.5 | 0 | 1.5 | 0.4 | 0 | 10 | 14% | 0% | 0% | 0% | 1% | 0% |
| 0.8 | 1 | 5 | 1.3 | 0 | 1.5 | 0 | 1.5 | 0.4 | 0 | 10 | 15% | 0% | 0% | 0% | 1% | 0% |
| 0.8 | 1 | 7 | 1.3 | 0 | 1.5 | 0 | 1.5 | 0.4 | 0 | 10 | 19% | 0% | 0% | 0% | 1% | 0% |
| 1.7 | 0.5 | 5 | 0 | 0 | 0 | 0 | 0 | 2 | 0 | 10 | 19% | 0% | 0% | 0% | 1% | 5% |
| 1.1 | 0.7 | 5 | 0 | 0 | 0 | 0 | 0 | 2 | 0 | 10 | 17% | 0% | 0% | 0% | 1% | 0% |
| 1.3 | 0.7 | 5 | 0 | 0 | 0 | 0 | 0 | 2 | 0 | 10 | 18% | 0% | 0% | 0% | 1% | 0% |
| 1.5 | 0.7 | 5 | 0 | 0 | 0 | 0 | 0 | 2 | 0 | 10 | 19% | 0% | 0% | 0% | 1% | 0% |
| 1.9 | 0.7 | 5 | 0 | 0 | 0 | 0 | 0 | 2 | 0 | 10 | 22% | 0% | 0% | 0% | 1% | 0% |
| 0.7 | 0.9 | 5 | 0 | 0 | 0 | 0 | 0 | 2 | 0 | 10 | 15% | 0% | 0% | 0% | 1% | 0% |
| 1.1 | 0.9 | 5 | 0 | 0 | 0 | 0 | 0 | 2 | 0 | 10 | 18% | 0% | 0% | 0% | 1% | 0% |
| 1.3 | 0.9 | 5 | 0 | 0 | 0 | 0 | 0 | 2 | 0 | 10 | 19% | 0% | 0% | 0% | 1% | 0% |
| 1.5 | 0.9 | 5 | 0 | 0 | 0 | 0 | 0 | 2 | 0 | 10 | 20% | 0% | 0% | 0% | 1% | 0% |
| 1.9 | 0.9 | 5 | 0 | 0 | 0 | 0 | 0 | 2 | 0 | 10 | 22% | 0% | 0% | 0% | 1% | 0% |
| 0.7 | 1.1 | 5 | 0 | 0 | 0 | 0 | 0 | 2 | 0 | 10 | 16% | 0% | 0% | 0% | 1% | 0% |
| 1.1 | 1.1 | 5 | 0 | 0 | 0 | 0 | 0 | 2 | 0 | 10 | 19% | 0% | 0% | 0% | 1% | 0% |
| 1.3 | 1.1 | 5 | 0 | 0 | 0 | 0 | 0 | 2 | 0 | 10 | 20% | 0% | 0% | 0% | 1% | 0% |
| 1.5 | 1.1 | 5 | 0 | 0 | 0 | 0 | 0 | 2 | 0 | 10 | 21% | 0% | 0% | 0% | 1% | 0% |
| 0.5 | 1.3 | 5 | 0 | 0 | 0 | 0 | 0 | 2 | 0 | 10 | 14% | 0% | 0% | 0% | 1% | 0% |
| 0.9 | 1.3 | 5 | 0 | 0 | 0 | 0 | 0 | 2 | 0 | 10 | 19% | 0% | 0% | 0% | 1% | 0% |
| 1.3 | 1.3 | 5 | 0 | 0 | 0 | 0 | 0 | 2 | 0 | 10 | 21% | 0% | 0% | 0% | 1% | 0% |
| 0.5 | 1.5 | 5 | 0 | 0 | 0 | 0 | 0 | 2 | 0 | 10 | 16% | 0% | 0% | 0% | 1% | 0% |
| 0.9 | 1.5 | 5 | 0 | 0 | 0 | 0 | 0 | 2 | 0 | 10 | 19% | 0% | 0% | 0% | 1% | 0% |
| 1.3 | 0.7 | 10 | 0 | 0 | 0 | 0 | 0 | 2 | 0 | 10 | 24% | 0% | 0% | 0% | 1% | 9% |
| 1.5 | 0.7 | 10 | 0 | 0 | 0 | 0 | 0 | 2 | 0 | 10 | 26% | 0% | 0% | 0% | 1% | 0% |
| 1.7 | 0.7 | 10 | 0 | 0 | 0 | 0 | 0 | 2 | 0 | 10 | 28% | 0% | 0% | 0% | 1% | 0% |
| 0.9 | 0.9 | 10 | 0 | 0 | 0 | 0 | 0 | 2 | 0 | 10 | 20% | 0% | 0% | 0% | 1% | 0% |
| 1.3 | 0.9 | 10 | 0 | 0 | 0 | 0 | 0 | 2 | 0 | 10 | 24% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.5 | 0.9 | 10 | 0 | 0 | 0 | 0 | 0 | 2 | 0 | 10 | 27% | 0% | 0% | 0% | 1% | 0% |
| 1.7 | 0.9 | 10 | 0 | 0 | 0 | 0 | 0 | 2 | 0 | 10 | 30% | 0% | 0% | 0% | 1% | 0% |
| 0.5 | 1.1 | 10 | 0 | 0 | 0 | 0 | 0 | 2 | 0 | 10 | 19% | 0% | 0% | 0% | 1% | 0% |
| 0.9 | 1.1 | 10 | 0 | 0 | 0 | 0 | 0 | 2 | 0 | 10 | 23% | 0% | 0% | 0% | 1% | 0% |
| 1.3 | 1.1 | 10 | 0 | 0 | 0 | 0 | 0 | 2 | 0 | 10 | 27% | 0% | 0% | 0% | 1% | 0% |
| 1.5 | 1.1 | 10 | 0 | 0 | 0 | 0 | 0 | 2 | 0 | 10 | 28% | 0% | 0% | 0% | 1% | 0% |
| 1.7 | 1.1 | 10 | 0 | 0 | 0 | 0 | 0 | 2 | 0 | 10 | 30% | 0% | 0% | 0% | 1% | 0% |
| 1.1 | 1.3 | 10 | 0 | 0 | 0 | 0 | 0 | 2 | 0 | 10 | 28% | 0% | 0% | 0% | 1% | 0% |
| 1.3 | 1.3 | 10 | 0 | 0 | 0 | 0 | 0 | 2 | 0 | 10 | 29% | 0% | 0% | 0% | 1% | 0% |
| 1.5 | 1.3 | 10 | 0 | 0 | 0 | 0 | 0 | 2 | 0 | 10 | 31% | 0% | 0% | 0% | 1% | 0% |
| 1.5 | 1.5 | 10 | 0 | 0 | 0 | 0 | 0 | 2 | 0 | 10 | 33% | 0% | 0% | 0% | 2% | 0% |
| 1.7 | 0.7 | 15 | 0 | 0 | 0 | 0 | 0 | 2 | 0 | 10 | 31% | 0% | 0% | 0% | 1% | 6% |
| 1.5 | 0.9 | 15 | 0 | 0 | 0 | 0 | 0 | 2 | 0 | 10 | 31% | 0% | 0% | 0% | 1% | 2% |
| 1.7 | 0.9 | 15 | 0 | 0 | 0 | 0 | 0 | 2 | 0 | 10 | 33% | 0% | 0% | 0% | 1% | 0% |
| 1.5 | 1.1 | 15 | 0 | 0 | 0 | 0 | 0 | 2 | 0 | 10 | 34% | 0% | 0% | 0% | 1% | 0% |
| 1.7 | 1.1 | 15 | 0 | 0 | 0 | 0 | 0 | 2 | 0 | 10 | 36% | 0% | 0% | 0% | 1% | 0% |
| 1.9 | 0.7 | 5 | 0 | 0 | 0 | 0 | 0 | 4 | 0 | 10 | 22% | 0% | 0% | 0% | 1% | 3% |
| 1.5 | 0.9 | 5 | 0 | 0 | 0 | 0 | 0 | 4 | 0 | 10 | 21% | 0% | 0% | 0% | 1% | 0% |
| 1.9 | 0.9 | 5 | 0 | 0 | 0 | 0 | 0 | 4 | 0 | 10 | 24% | 0% | 0% | 0% | 1% | 0% |
| 1.3 | 1.1 | 5 | 0 | 0 | 0 | 0 | 0 | 4 | 0 | 10 | 21% | 0% | 0% | 0% | 1% | 0% |
| 1.5 | 1.1 | 5 | 0 | 0 | 0 | 0 | 0 | 4 | 0 | 10 | 22% | 0% | 0% | 0% | 1% | 0% |
| 1.7 | 1.1 | 5 | 0 | 0 | 0 | 0 | 0 | 4 | 0 | 10 | 24% | 0% | 0% | 0% | 1% | 0% |
| 0.7 | 1.3 | 5 | 0 | 0 | 0 | 0 | 0 | 4 | 0 | 10 | 18% | 0% | 0% | 0% | 1% | 0% |
| 1.1 | 1.3 | 5 | 0 | 0 | 0 | 0 | 0 | 4 | 0 | 10 | 21% | 0% | 0% | 0% | 1% | 0% |
| 1.3 | 1.3 | 5 | 0 | 0 | 0 | 0 | 0 | 4 | 0 | 10 | 23% | 0% | 0% | 0% | 1% | 0% |
| 1.5 | 1.3 | 5 | 0 | 0 | 0 | 0 | 0 | 4 | 0 | 10 | 24% | 0% | 0% | 0% | 1% | 0% |
| 1.9 | 1.3 | 5 | 0 | 0 | 0 | 0 | 0 | 4 | 0 | 10 | 26% | 0% | 0% | 0% | 1% | 0% |
| 0.7 | 1.5 | 5 | 0 | 0 | 0 | 0 | 0 | 4 | 0 | 10 | 20% | 0% | 0% | 0% | 1% | 0% |
| 1.1 | 1.5 | 5 | 0 | 0 | 0 | 0 | 0 | 4 | 0 | 10 | 23% | 0% | 0% | 0% | 1% | 0% |
| 1.3 | 1.5 | 5 | 0 | 0 | 0 | 0 | 0 | 4 | 0 | 10 | 24% | 0% | 0% | 0% | 1% | 0% |
| 1.5 | 1.5 | 5 | 0 | 0 | 0 | 0 | 0 | 4 | 0 | 10 | 25% | 0% | 0% | 0% | 1% | 0% |
| 1.7 | 1.5 | 5 | 0 | 0 | 0 | 0 | 0 | 4 | 0 | 10 | 25% | 0% | 0% | 0% | 1% | 0% |
| 0.7 | 1.7 | 5 | 0 | 0 | 0 | 0 | 0 | 4 | 0 | 10 | 21% | 0% | 0% | 0% | 1% | 0% |
| 1.1 | 1.7 | 5 | 0 | 0 | 0 | 0 | 0 | 4 | 0 | 10 | 23% | 0% | 0% | 0% | 1% | 0% |
| 1.3 | 1.7 | 5 | 0 | 0 | 0 | 0 | 0 | 4 | 0 | 10 | 24% | 0% | 0% | 0% | 1% | 0% |
| 1.5 | 1.7 | 5 | 0 | 0 | 0 | 0 | 0 | 4 | 0 | 10 | 25% | 0% | 0% | 0% | 1% | 0% |
| 0.5 | 1.9 | 5 | 0 | 0 | 0 | 0 | 0 | 4 | 0 | 10 | 19% | 0% | 0% | 0% | 1% | 0% |
| 0.9 | 1.9 | 5 | 0 | 0 | 0 | 0 | 0 | 4 | 0 | 10 | 23% | 0% | 0% | 0% | 1% | 0% |
| 1.1 | 1.9 | 5 | 0 | 0 | 0 | 0 | 0 | 4 | 0 | 10 | 24% | 0% | 0% | 0% | 1% | 0% |
| 1.5 | 1.1 | 10 | 0 | 0 | 0 | 0 | 0 | 4 | 0 | 10 | 29% | 0% | 0% | 0% | 1% | 0% |
| 1.7 | 1.1 | 10 | 0 | 0 | 0 | 0 | 0 | 4 | 0 | 10 | 31% | 0% | 0% | 0% | 1% | 0% |
| 1.1 | 1.3 | 10 | 0 | 0 | 0 | 0 | 0 | 4 | 0 | 10 | 26% | 0% | 0% | 0% | 1% | 0% |
| 1.3 | 1.3 | 10 | 0 | 0 | 0 | 0 | 0 | 4 | 0 | 10 | 29% | 0% | 0% | 0% | 1% | 0% |
| 1.5 | 1.3 | 10 | 0 | 0 | 0 | 0 | 0 | 4 | 0 | 10 | 31% | 0% | 0% | 0% | 1% | 0% |
| 1.9 | 1.3 | 10 | 0 | 0 | 0 | 0 | 0 | 4 | 0 | 10 | 35% | 0% | 0% | 0% | 1% | 0% |
| 0.9 | 1.5 | 10 | 0 | 0 | 0 | 0 | 0 | 4 | 0 | 10 | 25% | 0% | 0% | 0% | 1% | 0% |
| 1.1 | 1.5 | 10 | 0 | 0 | 0 | 0 | 0 | 4 | 0 | 10 | 27% | 0% | 0% | 0% | 1% | 0% |
| 1.3 | 1.5 | 10 | 0 | 0 | 0 | 0 | 0 | 4 | 0 | 10 | 30% | 0% | 0% | 0% | 1% | 0% |
| 1.5 | 1.5 | 10 | 0 | 0 | 0 | 0 | 0 | 4 | 0 | 10 | 32% | 0% | 0% | 0% | 1% | 0% |
| 1.9 | 1.5 | 10 | 0 | 0 | 0 | 0 | 0 | 4 | 0 | 10 | 37% | 0% | 0% | 0% | 1% | 0% |
| 0.7 | 1.7 | 10 | 0 | 0 | 0 | 0 | 0 | 4 | 0 | 10 | 26% | 0% | 0% | 0% | 1% | 0% |
| 1.1 | 1.7 | 10 | 0 | 0 | 0 | 0 | 0 | 4 | 0 | 10 | 29% | 0% | 0% | 0% | 1% | 0% |
| 1.3 | 1.7 | 10 | 0 | 0 | 0 | 0 | 0 | 4 | 0 | 10 | 31% | 0% | 0% | 0% | 1% | 0% |
| 1.5 | 1.7 | 10 | 0 | 0 | 0 | 0 | 0 | 4 | 0 | 10 | 33% | 0% | 0% | 0% | 1% | 0% |
| 1.7 | 1.7 | 10 | 0 | 0 | 0 | 0 | 0 | 4 | 0 | 10 | 35% | 0% | 0% | 0% | 1% | 0% |
| 0.9 | 1.9 | 10 | 0 | 0 | 0 | 0 | 0 | 4 | 0 | 10 | 30% | 0% | 0% | 0% | 1% | 0% |
| 1.1 | 1.9 | 10 | 0 | 0 | 0 | 0 | 0 | 4 | 0 | 10 | 32% | 0% | 0% | 0% | 1% | 0% |
| 1.3 | 1.9 | 10 | 0 | 0 | 0 | 0 | 0 | 4 | 0 | 10 | 33% | 0% | 0% | 0% | 1% | 0% |
| 1.7 | 1.9 | 10 | 0 | 0 | 0 | 0 | 0 | 4 | 0 | 10 | 36% | 0% | 0% | 0% | 2% | 0% |
| 1.7 | 1.3 | 15 | 0 | 0 | 0 | 0 | 0 | 4 | 0 | 10 | 35% | 0% | 0% | 0% | 1% | 0% |
| 1.3 | 1.5 | 15 | 0 | 0 | 0 | 0 | 0 | 4 | 0 | 10 | 34% | 0% | 0% | 0% | 1% | 0% |
| 1.5 | 1.5 | 15 | 0 | 0 | 0 | 0 | 0 | 4 | 0 | 10 | 36% | 0% | 0% | 0% | 1% | 0% |
| 1.7 | 1.5 | 15 | 0 | 0 | 0 | 0 | 0 | 4 | 0 | 10 | 38% | 0% | 0% | 0% | 1% | 0% |
| 1.5 | 1.7 | 15 | 0 | 0 | 0 | 0 | 0 | 4 | 0 | 10 | 39% | 0% | 0% | 0% | 1% | 0% |
| 1.7 | 1.7 | 15 | 0 | 0 | 0 | 0 | 0 | 4 | 0 | 10 | 41% | 0% | 0% | 0% | 1% | 0% |
| 3.2 | 0.2 | 5 | 0 | 0 | 0 | 0 | 0 | 6 | 0 | 10 | 40% | 0% | 0% | 0% | 0% | 0% |
| 3.6 | 0.2 | 5 | 0 | 0 | 0 | 0 | 0 | 6 | 0 | 10 | 45% | 0% | 0% | 0% | 0% | 0% |
| 2.8 | 0.4 | 5 | 0 | 0 | 0 | 0 | 0 | 6 | 0 | 10 | 37% | 0% | 0% | 0% | 0% | 0% |
| 3.2 | 0.4 | 5 | 0 | 0 | 0 | 0 | 0 | 6 | 0 | 10 | 43% | 0% | 0% | 0% | 0% | 0% |
| 3.6 | 0.4 | 5 | 0 | 0 | 0 | 0 | 0 | 6 | 0 | 10 | 48% | 0% | 0% | 0% | 0% | 0% |
| 2.8 | 0.6 | 5 | 0 | 0 | 0 | 0 | 0 | 6 | 0 | 10 | 40% | 0% | 0% | 0% | 0% | 0% |
| 3.2 | 0.6 | 5 | 0 | 0 | 0 | 0 | 0 | 6 | 0 | 10 | 46% | 0% | 0% | 0% | 0% | 0% |
| 2.4 | 0.8 | 5 | 0 | 0 | 0 | 0 | 0 | 6 | 0 | 10 | 38% | 0% | 0% | 0% | 0% | 0% |
| 2.8 | 0.8 | 5 | 0 | 0 | 0 | 0 | 0 | 6 | 0 | 10 | 44% | 0% | 0% | 0% | 0% | 0% |
| 3.2 | 0.8 | 5 | 0 | 0 | 0 | 0 | 0 | 6 | 0 | 10 | 49% | 0% | 0% | 0% | 0% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 2.2 | 1 | 5 | 0 | 0 | 0 | 0 | 0 | 6 | 0 | 10 | 38% | 0% | 0% | 0% | 0% | 0% |
| 2.6 | 1 | 5 | 0 | 0 | 0 | 0 | 0 | 6 | 0 | 10 | 44% | 0% | 0% | 0% | 0% | 0% |
| 3 | 1 | 5 | 0 | 0 | 0 | 0 | 0 | 6 | 0 | 10 | 49% | 0% | 0% | 0% | 0% | 0% |
| 1.8 | 1.2 | 5 | 0 | 0 | 0 | 0 | 0 | 6 | 0 | 10 | 36% | 0% | 0% | 0% | 0% | 0% |
| 2.2 | 1.2 | 5 | 0 | 0 | 0 | 0 | 0 | 6 | 0 | 10 | 41% | 0% | 0% | 0% | 0% | 0% |
| 2.6 | 1.2 | 5 | 0 | 0 | 0 | 0 | 0 | 6 | 0 | 10 | 47% | 0% | 0% | 0% | 0% | 0% |
| 1.7 | 1.3 | 5 | 0 | 0 | 0 | 0 | 0 | 6 | 0 | 10 | 25% | 0% | 0% | 0% | 1% | 0% |
| 1.4 | 1.4 | 5 | 0 | 0 | 0 | 0 | 0 | 6 | 0 | 10 | 32% | 0% | 0% | 0% | 0% | 6% |
| 1.8 | 1.4 | 5 | 0 | 0 | 0 | 0 | 0 | 6 | 0 | 10 | 37% | 0% | 0% | 0% | 0% | 0% |
| 2.2 | 1.4 | 5 | 0 | 0 | 0 | 0 | 0 | 6 | 0 | 10 | 43% | 0% | 0% | 0% | 0% | 0% |
| 2.6 | 1.4 | 5 | 0 | 0 | 0 | 0 | 0 | 6 | 0 | 10 | 49% | 0% | 0% | 0% | 0% | 0% |
| 1.1 | 1.5 | 5 | 0 | 0 | 0 | 0 | 0 | 6 | 0 | 10 | 22% | 0% | 0% | 0% | 1% | 7% |
| 1.3 | 1.5 | 5 | 0 | 0 | 0 | 0 | 0 | 6 | 0 | 10 | 24% | 0% | 0% | 0% | 1% | 0% |
| 1.5 | 1.5 | 5 | 0 | 0 | 0 | 0 | 0 | 6 | 0 | 10 | 25% | 0% | 0% | 0% | 1% | 0% |
| 1.9 | 1.5 | 5 | 0 | 0 | 0 | 0 | 0 | 6 | 0 | 10 | 28% | 0% | 0% | 0% | 1% | 0% |
| 1.2 | 1.6 | 5 | 0 | 0 | 0 | 0 | 0 | 6 | 0 | 10 | 30% | 0% | 0% | 0% | 0% | 0% |
| 1.6 | 1.6 | 5 | 0 | 0 | 0 | 0 | 0 | 6 | 0 | 10 | 35% | 0% | 0% | 0% | 1% | 0% |
| 2 | 1.6 | 5 | 0 | 0 | 0 | 0 | 0 | 6 | 0 | 10 | 41% | 0% | 0% | 0% | 1% | 0% |
| 2.4 | 1.6 | 5 | 0 | 0 | 0 | 0 | 0 | 6 | 0 | 10 | 47% | 0% | 0% | 0% | 0% | 0% |
| 0.7 | 1.7 | 5 | 0 | 0 | 0 | 0 | 0 | 6 | 0 | 10 | 21% | 0% | 0% | 0% | 1% | 4% |
| 1.1 | 1.7 | 5 | 0 | 0 | 0 | 0 | 0 | 6 | 0 | 10 | 24% | 0% | 0% | 0% | 1% | 0% |
| 1.3 | 1.7 | 5 | 0 | 0 | 0 | 0 | 0 | 6 | 0 | 10 | 26% | 0% | 0% | 0% | 1% | 0% |
| 1.5 | 1.7 | 5 | 0 | 0 | 0 | 0 | 0 | 6 | 0 | 10 | 27% | 0% | 0% | 0% | 1% | 0% |
| 1.7 | 1.7 | 5 | 0 | 0 | 0 | 0 | 0 | 6 | 0 | 10 | 28% | 0% | 0% | 0% | 1% | 0% |
| 1 | 1.8 | 5 | 0 | 0 | 0 | 0 | 0 | 6 | 0 | 10 | 29% | 0% | 0% | 0% | 0% | 0% |
| 1.4 | 1.8 | 5 | 0 | 0 | 0 | 0 | 0 | 6 | 0 | 10 | 33% | 0% | 0% | 0% | 1% | 0% |
| 1.8 | 1.8 | 5 | 0 | 0 | 0 | 0 | 0 | 6 | 0 | 10 | 39% | 0% | 0% | 0% | 1% | 0% |
| 2.2 | 1.8 | 5 | 0 | 0 | 0 | 0 | 0 | 6 | 0 | 10 | 45% | 0% | 0% | 0% | 1% | 0% |
| 2.6 | 1.8 | 5 | 0 | 0 | 0 | 0 | 0 | 6 | 0 | 10 | 49% | 0% | 0% | 0% | 1% | 0% |
| 0.7 | 1.9 | 5 | 0 | 0 | 0 | 0 | 0 | 6 | 0 | 10 | 23% | 0% | 0% | 0% | 1% | 0% |
| 1.1 | 1.9 | 5 | 0 | 0 | 0 | 0 | 0 | 6 | 0 | 10 | 26% | 0% | 0% | 0% | 1% | 0% |
| 1.3 | 1.9 | 5 | 0 | 0 | 0 | 0 | 0 | 6 | 0 | 10 | 27% | 0% | 0% | 0% | 1% | 0% |
| 1.5 | 1.9 | 5 | 0 | 0 | 0 | 0 | 0 | 6 | 0 | 10 | 28% | 0% | 0% | 0% | 1% | 0% |
| 1.9 | 1.9 | 5 | 0 | 0 | 0 | 0 | 0 | 6 | 0 | 10 | 29% | 0% | 0% | 0% | 1% | 0% |
| 1.2 | 2 | 5 | 0 | 0 | 0 | 0 | 0 | 6 | 0 | 10 | 31% | 0% | 0% | 0% | 1% | 0% |
| 1.6 | 2 | 5 | 0 | 0 | 0 | 0 | 0 | 6 | 0 | 10 | 37% | 0% | 0% | 0% | 1% | 0% |
| 2 | 2 | 5 | 0 | 0 | 0 | 0 | 0 | 6 | 0 | 10 | 42% | 0% | 0% | 0% | 1% | 0% |
| 2.4 | 2 | 5 | 0 | 0 | 0 | 0 | 0 | 6 | 0 | 10 | 47% | 0% | 0% | 0% | 1% | 0% |
| 1 | 2.2 | 5 | 0 | 0 | 0 | 0 | 0 | 6 | 0 | 10 | 30% | 0% | 0% | 0% | 1% | 0% |
| 1.4 | 2.2 | 5 | 0 | 0 | 0 | 0 | 0 | 6 | 0 | 10 | 34% | 0% | 0% | 0% | 1% | 0% |
| 1.8 | 2.2 | 5 | 0 | 0 | 0 | 0 | 0 | 6 | 0 | 10 | 40% | 0% | 0% | 0% | 1% | 0% |
| 1 | 2.4 | 5 | 0 | 0 | 0 | 0 | 0 | 6 | 0 | 10 | 30% | 0% | 0% | 0% | 1% | 0% |
| 1.4 | 2.4 | 5 | 0 | 0 | 0 | 0 | 0 | 6 | 0 | 10 | 35% | 0% | 0% | 0% | 1% | 0% |
| 1.8 | 2.4 | 5 | 0 | 0 | 0 | 0 | 0 | 6 | 0 | 10 | 41% | 0% | 0% | 0% | 1% | 0% |
| 1 | 2.6 | 5 | 0 | 0 | 0 | 0 | 0 | 6 | 0 | 10 | 14% | 0% | 0% | 0% | 1% | 0% |
| 1.4 | 2.6 | 5 | 0 | 0 | 0 | 0 | 0 | 6 | 0 | 10 | 36% | 0% | 0% | 0% | 1% | 0% |
| 1 | 2.8 | 5 | 0 | 0 | 0 | 0 | 0 | 6 | 0 | 10 | 15% | 0% | 0% | 0% | 2% | 0% |
| 1.9 | 1.3 | 10 | 0 | 0 | 0 | 0 | 0 | 6 | 0 | 10 | 32% | 0% | 0% | 0% | 1% | 8% |
| 1.5 | 1.5 | 10 | 0 | 0 | 0 | 0 | 0 | 6 | 0 | 10 | 31% | 0% | 0% | 0% | 1% | 8% |
| 1.9 | 1.5 | 10 | 0 | 0 | 0 | 0 | 0 | 6 | 0 | 10 | 35% | 0% | 0% | 0% | 1% | 0% |
| 1.1 | 1.7 | 10 | 0 | 0 | 0 | 0 | 0 | 6 | 0 | 10 | 30% | 0% | 0% | 0% | 1% | 7% |
| 1.3 | 1.7 | 10 | 0 | 0 | 0 | 0 | 0 | 6 | 0 | 10 | 32% | 0% | 0% | 0% | 1% | 0% |
| 1.5 | 1.7 | 10 | 0 | 0 | 0 | 0 | 0 | 6 | 0 | 10 | 34% | 0% | 0% | 0% | 1% | 0% |
| 1.9 | 1.7 | 10 | 0 | 0 | 0 | 0 | 0 | 6 | 0 | 10 | 37% | 0% | 0% | 0% | 1% | 0% |
| 0.9 | 1.9 | 10 | 0 | 0 | 0 | 0 | 0 | 6 | 0 | 10 | 29% | 0% | 0% | 0% | 1% | 0% |
| 1.1 | 1.9 | 10 | 0 | 0 | 0 | 0 | 0 | 6 | 0 | 10 | 31% | 0% | 0% | 0% | 1% | 0% |
| 1.3 | 1.9 | 10 | 0 | 0 | 0 | 0 | 0 | 6 | 0 | 10 | 34% | 0% | 0% | 0% | 1% | 0% |
| 1.7 | 1.9 | 10 | 0 | 0 | 0 | 0 | 0 | 6 | 0 | 10 | 38% | 0% | 0% | 0% | 1% | 0% |
| 1.9 | 1.7 | 15 | 0 | 0 | 0 | 0 | 0 | 6 | 0 | 10 | 41% | 0% | 0% | 0% | 1% | 0% |
| 1.7 | 1.9 | 15 | 0 | 0 | 0 | 0 | 0 | 6 | 0 | 10 | 40% | 0% | 0% | 0% | 1% | 0% |
| 0.92 | 1.01 | 4 | 0.19 | 0 | 3.09 | 0 | 0.48 | 0.26 | 2 | 10 | 16% | 0% | 0% | 0% | 1% | 10% |
| 0.92 | 1.01 | 6 | 0.19 | 0 | 3.09 | 0 | 0.48 | 0.26 | 2 | 10 | 21% | 0% | 0% | 0% | 1% | 6% |
| 0.8 | 1 | 1 | 1.3 | 0 | 1.5 | 0 | 1.5 | 0.4 | 2 | 10 | 13% | 0% | 0% | 0% | 1% | 0% |
| 0.8 | 1 | 3 | 1.3 | 0 | 1.5 | 0 | 1.5 | 0.4 | 2 | 10 | 15% | 0% | 0% | 0% | 1% | 0% |
| 1.5 | 1.1 | 4.8 | 0.5 | 0 | 5 | 0 | 0.5 | 0.5 | 2 | 10 | 31% | 0% | 0% | 0% | 1% | 9% |
| 1.7 | 1.1 | 4.8 | 0.5 | 0 | 5 | 0 | 0.5 | 0.5 | 2 | 10 | 33% | 0% | 0% | 0% | 1% | 0% |
| 1.9 | 1.1 | 4.8 | 0.5 | 0 | 5 | 0 | 0.5 | 0.5 | 2 | 10 | 36% | 0% | 0% | 0% | 1% | 0% |
| 2.1 | 1.1 | 4.8 | 0.5 | 0 | 5 | 0 | 0.5 | 0.5 | 2 | 10 | 39% | 0% | 0% | 0% | 1% | 0% |
| 1.44 | 1.11 | 4.8 | 0.5 | 0 | 5 | 0 | 0.5 | 0.5 | 2 | 10 | 30% | 0% | 0% | 0% | 1% | 9% |
| 1.52 | 1.11 | 4.8 | 0.5 | 0 | 5 | 0 | 0.5 | 0.5 | 2 | 10 | 31% | 0% | 0% | 0% | 1% | 5% |
| 1.12 | 1.16 | 4.8 | 0.5 | 0 | 5 | 0 | 0.5 | 0.5 | 2 | 10 | 26% | 0% | 0% | 0% | 1% | 9% |
| 1.2 | 1.16 | 4.8 | 0.5 | 0 | 5 | 0 | 0.5 | 0.5 | 2 | 10 | 27% | 0% | 0% | 0% | 1% | 5% |
| 1.28 | 1.16 | 4.8 | 0.5 | 0 | 5 | 0 | 0.5 | 0.5 | 2 | 10 | 28% | 0% | 0% | 0% | 1% | 2% |
| 1.36 | 1.16 | 4.8 | 0.5 | 0 | 5 | 0 | 0.5 | 0.5 | 2 | 10 | 29% | 0% | 0% | 0% | 1% | 0% |
| 1.44 | 1.16 | 4.8 | 0.5 | 0 | 5 | 0 | 0.5 | 0.5 | 2 | 10 | 30% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.52 | 1.16 | 4.8 | 0.5 | 0 | 5 | 0 | 0.5 | 0.5 | 2 | 10 | 31% | 0% | 0% | 0% | 1% | 0% |
| 0.9 | 1.2 | 4.8 | 0.5 | 0 | 5 | 0 | 0.5 | 0.5 | 2 | 10 | 23% | 0% | 0% | 0% | 1% | 10% |
| 1.1 | 1.2 | 4.8 | 0.5 | 0 | 5 | 0 | 0.5 | 0.5 | 2 | 10 | 26% | 0% | 0% | 0% | 1% | 0% |
| 1.3 | 1.2 | 4.8 | 0.5 | 0 | 5 | 0 | 0.5 | 0.5 | 2 | 10 | 28% | 0% | 0% | 0% | 1% | 0% |
| 1.5 | 1.2 | 4.8 | 0.5 | 0 | 5 | 0 | 0.5 | 0.5 | 2 | 10 | 31% | 0% | 0% | 0% | 1% | 0% |
| 1.7 | 1.2 | 4.8 | 0.5 | 0 | 5 | 0 | 0.5 | 0.5 | 2 | 10 | 34% | 0% | 0% | 0% | 1% | 0% |
| 1.9 | 1.2 | 4.8 | 0.5 | 0 | 5 | 0 | 0.5 | 0.5 | 2 | 10 | 37% | 0% | 0% | 0% | 1% | 0% |
| 2.1 | 1.2 | 4.8 | 0.5 | 0 | 5 | 0 | 0.5 | 0.5 | 2 | 10 | 40% | 0% | 0% | 0% | 1% | 0% |
| 0.92 | 1.21 | 4.8 | 0.5 | 0 | 5 | 0 | 0.5 | 0.5 | 2 | 10 | 23% | 0% | 0% | 0% | 1% | 8% |
| 1 | 1.21 | 4.8 | 0.5 | 0 | 5 | 0 | 0.5 | 0.5 | 2 | 10 | 24% | 0% | 0% | 0% | 1% | 3% |
| 1.08 | 1.21 | 4.8 | 0.5 | 0 | 5 | 0 | 0.5 | 0.5 | 2 | 10 | 25% | 0% | 0% | 0% | 1% | 0% |
| 1.16 | 1.21 | 4.8 | 0.5 | 0 | 5 | 0 | 0.5 | 0.5 | 2 | 10 | 26% | 0% | 0% | 0% | 1% | 0% |
| 1.24 | 1.21 | 4.8 | 0.5 | 0 | 5 | 0 | 0.5 | 0.5 | 2 | 10 | 28% | 0% | 0% | 0% | 1% | 0% |
| 1.32 | 1.21 | 4.8 | 0.5 | 0 | 5 | 0 | 0.5 | 0.5 | 2 | 10 | 29% | 0% | 0% | 0% | 1% | 0% |
| 1.4 | 1.21 | 4.8 | 0.5 | 0 | 5 | 0 | 0.5 | 0.5 | 2 | 10 | 30% | 0% | 0% | 0% | 1% | 0% |
| 1.48 | 1.21 | 4.8 | 0.5 | 0 | 5 | 0 | 0.5 | 0.5 | 2 | 10 | 31% | 0% | 0% | 0% | 1% | 0% |
| 1.56 | 1.21 | 4.8 | 0.5 | 0 | 5 | 0 | 0.5 | 0.5 | 2 | 10 | 32% | 0% | 0% | 0% | 1% | 0% |
| 0.96 | 1.26 | 4.8 | 0.5 | 0 | 5 | 0 | 0.5 | 0.5 | 2 | 10 | 24% | 0% | 0% | 0% | 1% | 3% |
| 1.04 | 1.26 | 4.8 | 0.5 | 0 | 5 | 0 | 0.5 | 0.5 | 2 | 10 | 25% | 0% | 0% | 0% | 1% | 0% |
| 1.12 | 1.26 | 4.8 | 0.5 | 0 | 5 | 0 | 0.5 | 0.5 | 2 | 10 | 26% | 0% | 0% | 0% | 1% | 0% |
| 1.2 | 1.26 | 4.8 | 0.5 | 0 | 5 | 0 | 0.5 | 0.5 | 2 | 10 | 27% | 0% | 0% | 0% | 1% | 0% |
| 1.28 | 1.26 | 4.8 | 0.5 | 0 | 5 | 0 | 0.5 | 0.5 | 2 | 10 | 21% | 0% | 0% | 0% | 1% | 0% |
| 1.36 | 1.26 | 4.8 | 0.5 | 0 | 5 | 0 | 0.5 | 0.5 | 2 | 10 | 29% | 0% | 0% | 0% | 1% | 0% |
| 1.44 | 1.26 | 4.8 | 0.5 | 0 | 5 | 0 | 0.5 | 0.5 | 2 | 10 | 31% | 0% | 0% | 0% | 1% | 0% |
| 1.52 | 1.26 | 4.8 | 0.5 | 0 | 5 | 0 | 0.5 | 0.5 | 2 | 10 | 32% | 0% | 0% | 0% | 1% | 0% |
| 0.9 | 1.3 | 4.8 | 0.5 | 0 | 5 | 0 | 0.5 | 0.5 | 2 | 10 | 23% | 0% | 0% | 0% | 1% | 5% |
| 1.1 | 1.3 | 4.8 | 0.5 | 0 | 5 | 0 | 0.5 | 0.5 | 2 | 10 | 26% | 0% | 0% | 0% | 1% | 0% |
| 1.3 | 1.3 | 4.8 | 0.5 | 0 | 5 | 0 | 0.5 | 0.5 | 2 | 10 | 29% | 0% | 0% | 0% | 1% | 0% |
| 1.5 | 1.3 | 4.8 | 0.5 | 0 | 5 | 0 | 0.5 | 0.5 | 2 | 10 | 32% | 0% | 0% | 0% | 1% | 0% |
| 1.7 | 1.3 | 4.8 | 0.5 | 0 | 5 | 0 | 0.5 | 0.5 | 2 | 10 | 34% | 0% | 0% | 0% | 1% | 0% |
| 1.9 | 1.3 | 4.8 | 0.5 | 0 | 5 | 0 | 0.5 | 0.5 | 2 | 10 | 35% | 0% | 0% | 0% | 1% | 0% |
| 2.1 | 1.3 | 4.8 | 0.5 | 0 | 5 | 0 | 0.5 | 0.5 | 2 | 10 | 37% | 0% | 0% | 0% | 1% | 0% |
| 0.92 | 1.31 | 4.8 | 0.5 | 0 | 5 | 0 | 0.5 | 0.5 | 2 | 10 | 24% | 0% | 0% | 0% | 1% | 3% |
| 1 | 1.31 | 4.8 | 0.5 | 0 | 5 | 0 | 0.5 | 0.5 | 2 | 10 | 25% | 0% | 0% | 0% | 1% | 0% |
| 1.08 | 1.31 | 4.8 | 0.5 | 0 | 5 | 0 | 0.5 | 0.5 | 2 | 10 | 26% | 0% | 0% | 0% | 1% | 0% |
| 1.16 | 1.31 | 4.8 | 0.5 | 0 | 5 | 0 | 0.5 | 0.5 | 2 | 10 | 27% | 0% | 0% | 0% | 1% | 0% |
| 1.24 | 1.31 | 4.8 | 0.5 | 0 | 5 | 0 | 0.5 | 0.5 | 2 | 10 | 28% | 0% | 0% | 0% | 1% | 0% |
| 1.32 | 1.31 | 4.8 | 0.5 | 0 | 5 | 0 | 0.5 | 0.5 | 2 | 10 | 29% | 0% | 0% | 0% | 1% | 0% |
| 1.4 | 1.31 | 4.8 | 0.5 | 0 | 5 | 0 | 0.5 | 0.5 | 2 | 10 | 30% | 0% | 0% | 0% | 1% | 0% |
| 1.48 | 1.31 | 4.8 | 0.5 | 0 | 5 | 0 | 0.5 | 0.5 | 2 | 10 | 31% | 0% | 0% | 0% | 1% | 0% |
| 1.56 | 1.31 | 4.8 | 0.5 | 0 | 5 | 0 | 0.5 | 0.5 | 2 | 10 | 32% | 0% | 0% | 0% | 1% | 0% |
| 0.96 | 1.36 | 4.8 | 0.5 | 0 | 5 | 0 | 0.5 | 0.5 | 2 | 10 | 24% | 0% | 0% | 0% | 1% | 0% |
| 1.04 | 1.36 | 4.8 | 0.5 | 0 | 5 | 0 | 0.5 | 0.5 | 2 | 10 | 25% | 0% | 0% | 0% | 1% | 0% |
| 1.12 | 1.36 | 4.8 | 0.5 | 0 | 5 | 0 | 0.5 | 0.5 | 2 | 10 | 27% | 0% | 0% | 0% | 1% | 0% |
| 1.2 | 1.36 | 4.8 | 0.5 | 0 | 5 | 0 | 0.5 | 0.5 | 2 | 10 | 28% | 0% | 0% | 0% | 1% | 0% |
| 1.28 | 1.36 | 4.8 | 0.5 | 0 | 5 | 0 | 0.5 | 0.5 | 2 | 10 | 29% | 0% | 0% | 0% | 1% | 0% |
| 1.36 | 1.36 | 4.8 | 0.5 | 0 | 5 | 0 | 0.5 | 0.5 | 2 | 10 | 30% | 0% | 0% | 0% | 1% | 0% |
| 1.44 | 1.36 | 4.8 | 0.5 | 0 | 5 | 0 | 0.5 | 0.5 | 2 | 10 | 31% | 0% | 0% | 0% | 1% | 0% |
| 1.52 | 1.36 | 4.8 | 0.5 | 0 | 5 | 0 | 0.5 | 0.5 | 2 | 10 | 32% | 0% | 0% | 0% | 1% | 0% |
| 0.9 | 1.4 | 4.8 | 0.5 | 0 | 5 | 0 | 0.5 | 0.5 | 2 | 10 | 24% | 0% | 0% | 0% | 1% | 0% |
| 1.1 | 1.4 | 4.8 | 0.5 | 0 | 5 | 0 | 0.5 | 0.5 | 2 | 10 | 26% | 0% | 0% | 0% | 1% | 0% |
| 1.3 | 1.4 | 4.8 | 0.5 | 0 | 5 | 0 | 0.5 | 0.5 | 2 | 10 | 29% | 0% | 0% | 0% | 1% | 0% |
| 1.5 | 1.4 | 4.8 | 0.5 | 0 | 5 | 0 | 0.5 | 0.5 | 2 | 10 | 32% | 0% | 0% | 0% | 1% | 0% |
| 1.7 | 1.4 | 4.8 | 0.5 | 0 | 5 | 0 | 0.5 | 0.5 | 2 | 10 | 34% | 0% | 0% | 0% | 1% | 0% |
| 1.9 | 1.4 | 4.8 | 0.5 | 0 | 5 | 0 | 0.5 | 0.5 | 2 | 10 | 35% | 0% | 0% | 0% | 1% | 0% |
| 2.1 | 1.4 | 4.8 | 0.5 | 0 | 5 | 0 | 0.5 | 0.5 | 2 | 10 | 26% | 0% | 0% | 0% | 1% | 0% |
| 0.92 | 1.41 | 4.8 | 0.5 | 0 | 5 | 0 | 0.5 | 0.5 | 2 | 10 | 24% | 0% | 0% | 0% | 1% | 0% |
| 1 | 1.41 | 4.8 | 0.5 | 0 | 5 | 0 | 0.5 | 0.5 | 2 | 10 | 25% | 0% | 0% | 0% | 1% | 0% |
| 1.08 | 1.41 | 4.8 | 0.5 | 0 | 5 | 0 | 0.5 | 0.5 | 2 | 10 | 26% | 0% | 0% | 0% | 1% | 0% |
| 1.16 | 1.41 | 4.8 | 0.5 | 0 | 5 | 0 | 0.5 | 0.5 | 2 | 10 | 27% | 0% | 0% | 0% | 1% | 0% |
| 1.24 | 1.41 | 4.8 | 0.5 | 0 | 5 | 0 | 0.5 | 0.5 | 2 | 10 | 28% | 0% | 0% | 0% | 1% | 0% |
| 1.32 | 1.41 | 4.8 | 0.5 | 0 | 5 | 0 | 0.5 | 0.5 | 2 | 10 | 29% | 0% | 0% | 0% | 1% | 0% |
| 1.4 | 1.41 | 4.8 | 0.5 | 0 | 5 | 0 | 0.5 | 0.5 | 2 | 10 | 30% | 0% | 0% | 0% | 1% | 0% |
| 1.48 | 1.41 | 4.8 | 0.5 | 0 | 5 | 0 | 0.5 | 0.5 | 2 | 10 | 32% | 0% | 0% | 0% | 1% | 0% |
| 1.56 | 1.41 | 4.8 | 0.5 | 0 | 5 | 0 | 0.5 | 0.5 | 2 | 10 | 33% | 0% | 0% | 0% | 1% | 0% |
| 0.96 | 1.46 | 4.8 | 0.5 | 0 | 5 | 0 | 0.5 | 0.5 | 2 | 10 | 25% | 0% | 0% | 0% | 1% | 0% |
| 1.04 | 1.46 | 4.8 | 0.5 | 0 | 5 | 0 | 0.5 | 0.5 | 2 | 10 | 26% | 0% | 0% | 0% | 1% | 0% |
| 1.12 | 1.46 | 4.8 | 0.5 | 0 | 5 | 0 | 0.5 | 0.5 | 2 | 10 | 27% | 0% | 0% | 0% | 1% | 0% |
| 1.2 | 1.46 | 4.8 | 0.5 | 0 | 5 | 0 | 0.5 | 0.5 | 2 | 10 | 28% | 0% | 0% | 0% | 1% | 0% |
| 1.28 | 1.46 | 4.8 | 0.5 | 0 | 5 | 0 | 0.5 | 0.5 | 2 | 10 | 29% | 0% | 0% | 0% | 1% | 0% |
| 1.36 | 1.46 | 4.8 | 0.5 | 0 | 5 | 0 | 0.5 | 0.5 | 2 | 10 | 30% | 0% | 0% | 0% | 1% | 0% |
| 1.44 | 1.46 | 4.8 | 0.5 | 0 | 5 | 0 | 0.5 | 0.5 | 2 | 10 | 31% | 0% | 0% | 0% | 1% | 0% |
| 1.52 | 1.46 | 4.8 | 0.5 | 0 | 5 | 0 | 0.5 | 0.5 | 2 | 10 | 32% | 0% | 0% | 0% | 1% | 0% |
| 0.9 | 1.5 | 4.8 | 0.5 | 0 | 5 | 0 | 0.5 | 0.5 | 2 | 10 | 24% | 0% | 0% | 0% | 1% | 0% |
| 1.1 | 1.5 | 4.8 | 0.5 | 0 | 5 | 0 | 0.5 | 0.5 | 2 | 10 | 27% | 0% | 0% | 0% | 1% | 0% |

TABLE 9-continued

| Alloy Compositions which meet the Thermodynamic Criteria Described in this Disclosure | | | | | | | | | | | | | | | | |
|---|---|---|---|---|---|---|---|---|---|---|---|---|---|---|---|---|
| B | C | Cr | Mn | Mo | Nb | Ni | Si | Ti | V | W | 1 | 2 | 3 | 4 | 5 | 6 |
| 1.3 | 1.5 | 4.8 | 0.5 | 0 | 5 | 0 | 0.5 | 0.5 | 2 | 10 | 29% | 0% | 0% | 0% | 1% | 0% |
| 1.5 | 1.5 | 4.8 | 0.5 | 0 | 5 | 0 | 0.5 | 0.5 | 2 | 10 | 32% | 0% | 0% | 0% | 1% | 0% |
| 1.7 | 1.5 | 4.8 | 0.5 | 0 | 5 | 0 | 0.5 | 0.5 | 2 | 10 | 32% | 0% | 0% | 0% | 1% | 0% |
| 1.9 | 1.5 | 4.8 | 0.5 | 0 | 5 | 0 | 0.5 | 0.5 | 2 | 10 | 35% | 0% | 0% | 0% | 1% | 0% |
| 2.1 | 1.5 | 4.8 | 0.5 | 0 | 5 | 0 | 0.5 | 0.5 | 2 | 10 | 32% | 0% | 0% | 0% | 1% | 0% |
| 0.9 | 1.6 | 4.8 | 0.5 | 0 | 5 | 0 | 0.5 | 0.5 | 2 | 10 | 24% | 0% | 0% | 0% | 1% | 0% |
| 1.1 | 1.6 | 4.8 | 0.5 | 0 | 5 | 0 | 0.5 | 0.5 | 2 | 10 | 27% | 0% | 0% | 0% | 1% | 0% |
| 1.3 | 1.6 | 4.8 | 0.5 | 0 | 5 | 0 | 0.5 | 0.5 | 2 | 10 | 30% | 0% | 0% | 0% | 1% | 0% |
| 1.5 | 1.6 | 4.8 | 0.5 | 0 | 5 | 0 | 0.5 | 0.5 | 2 | 10 | 32% | 0% | 0% | 0% | 1% | 0% |
| 1.7 | 1.6 | 4.8 | 0.5 | 0 | 5 | 0 | 0.5 | 0.5 | 2 | 10 | 35% | 0% | 0% | 0% | 1% | 0% |
| 1.9 | 1.6 | 4.8 | 0.5 | 0 | 5 | 0 | 0.5 | 0.5 | 2 | 10 | 35% | 0% | 0% | 0% | 1% | 0% |
| 2.1 | 1.6 | 4.8 | 0.5 | 0 | 5 | 0 | 0.5 | 0.5 | 2 | 10 | 32% | 0% | 0% | 0% | 1% | 0% |
| 1.04 | 1.33 | 4.97 | 0.23 | 0 | 5.2 | 0 | 0.56 | 0 | 1.93 | 10.3 | 17% | 0% | 0% | 0% | 1% | 0% |
| 0.8 | 1 | 0 | 1.3 | 0 | 1.5 | 0 | 1.5 | 0.4 | 0 | 11 | 14% | 0% | 0% | 0% | 1% | 0% |
| 0.8 | 1 | 2 | 1.3 | 0 | 1.5 | 0 | 1.5 | 0.4 | 0 | 11 | 14% | 2% | 0% | 0% | 1% | 0% |
| 0.8 | 1 | 4 | 1.3 | 0 | 1.5 | 0 | 1.5 | 0.4 | 0 | 11 | 14% | 0% | 0% | 0% | 1% | 0% |
| 0.8 | 1 | 6 | 1.3 | 0 | 1.5 | 0 | 1.5 | 0.4 | 0 | 11 | 18% | 0% | 0% | 0% | 1% | 0% |
| 0.8 | 1 | 8 | 1.3 | 0 | 1.5 | 0 | 1.5 | 0.4 | 0 | 11 | 21% | 0% | 0% | 0% | 1% | 0% |
| 0.8 | 1 | 1 | 1.3 | 0 | 1.5 | 0 | 1.5 | 0.4 | 2 | 11 | 18% | 0% | 0% | 0% | 1% | 0% |
| 0.8 | 1 | 3 | 1.3 | 0 | 1.5 | 0 | 1.5 | 0.4 | 2 | 11 | 15% | 0% | 0% | 0% | 1% | 4% |
| 0.8 | 1 | 0 | 1.3 | 0 | 1.5 | 0 | 1.5 | 0.4 | 0 | 12 | 13% | 2% | 0% | 0% | 1% | 0% |
| 0.8 | 1 | 2 | 1.3 | 0 | 1.5 | 0 | 1.5 | 0.4 | 0 | 12 | 14% | 0% | 0% | 0% | 1% | 0% |
| 0.8 | 1 | 4 | 1.3 | 0 | 1.5 | 0 | 1.5 | 0.4 | 0 | 12 | 14% | 0% | 0% | 0% | 1% | 0% |
| 0.8 | 1 | 6 | 1.3 | 0 | 1.5 | 0 | 1.5 | 0.4 | 0 | 12 | 18% | 0% | 0% | 0% | 1% | 0% |
| 0.8 | 1 | 0 | 1.3 | 0 | 1.5 | 0 | 1.5 | 0.4 | 2 | 12 | 13% | 0% | 0% | 0% | 1% | 0% |
| 0.8 | 1 | 2 | 1.3 | 0 | 1.5 | 0 | 1.5 | 0.4 | 2 | 12 | 15% | 0% | 0% | 0% | 1% | 3% |
| 0.8 | 1 | 0 | 1.3 | 0 | 1.5 | 0 | 1.5 | 0.4 | 0 | 13 | 13% | 0% | 0% | 0% | 1% | 0% |
| 0.8 | 1 | 2 | 1.3 | 0 | 1.5 | 0 | 1.5 | 0.4 | 0 | 13 | 14% | 0% | 0% | 0% | 1% | 0% |
| 0.8 | 1 | 4 | 1.3 | 0 | 1.5 | 0 | 1.5 | 0.4 | 0 | 13 | 14% | 0% | 0% | 0% | 1% | 0% |
| 0.8 | 1 | 6 | 1.3 | 0 | 1.5 | 0 | 1.5 | 0.4 | 0 | 13 | 19% | 0% | 0% | 0% | 1% | 0% |
| 0.8 | 1 | 0 | 1.3 | 0 | 1.5 | 0 | 1.5 | 0.4 | 2 | 13 | 13% | 1% | 0% | 0% | 1% | 2% |
| 0.8 | 1 | 2 | 1.3 | 0 | 1.5 | 0 | 1.5 | 0.4 | 2 | 13 | 15% | 0% | 0% | 0% | 1% | 8% |
| 0.8 | 1 | 1 | 1.3 | 0 | 1.5 | 0 | 1.5 | 0.4 | 0 | 14 | 14% | 0% | 0% | 0% | 1% | 0% |
| 0.8 | 1 | 3 | 1.3 | 0 | 1.5 | 0 | 1.5 | 0.4 | 0 | 14 | 14% | 0% | 0% | 0% | 1% | 0% |
| 0.8 | 1 | 5 | 1.3 | 0 | 1.5 | 0 | 1.5 | 0.4 | 0 | 14 | 17% | 0% | 0% | 0% | 1% | 0% |
| 0.8 | 1 | 0 | 1.3 | 0 | 1.5 | 0 | 1.5 | 0.4 | 2 | 14 | 13% | 2% | 0% | 0% | 1% | 7% |
| 0.8 | 1 | 0 | 1.3 | 0 | 1.5 | 0 | 1.5 | 0.4 | 0 | 15 | 14% | 1% | 0% | 0% | 1% | 0% |
| 0.8 | 1 | 2 | 1.3 | 0 | 1.5 | 0 | 1.5 | 0.4 | 0 | 15 | 14% | 0% | 0% | 0% | 1% | 0% |
| 0.8 | 1 | 4 | 1.3 | 0 | 1.5 | 0 | 1.5 | 0.4 | 0 | 15 | 16% | 0% | 0% | 0% | 1% | 0% |
| 0.8 | 1 | 6 | 1.3 | 0 | 1.5 | 0 | 1.5 | 0.4 | 0 | 15 | 20% | 0% | 0% | 0% | 1% | 0% |
| 0.8 | 1 | 1 | 1.3 | 0 | 1.5 | 0 | 1.5 | 0.4 | 0 | 16 | 15% | 0% | 0% | 0% | 1% | 0% |
| 0.8 | 1 | 3 | 1.3 | 0 | 1.5 | 0 | 1.5 | 0.4 | 0 | 16 | 15% | 0% | 0% | 0% | 1% | 0% |
| 0.8 | 1 | 5 | 1.3 | 0 | 1.5 | 0 | 1.5 | 0.4 | 0 | 16 | 19% | 0% | 0% | 0% | 1% | 0% |
| 0.8 | 1 | 1 | 1.3 | 0 | 1.5 | 0 | 1.5 | 0.4 | 0 | 17 | 15% | 2% | 0% | 0% | 1% | 0% |
| 0.8 | 1 | 3 | 1.3 | 0 | 1.5 | 0 | 1.5 | 0.4 | 0 | 17 | 15% | 0% | 0% | 0% | 1% | 0% |
| 0.8 | 1 | 5 | 1.3 | 0 | 1.5 | 0 | 1.5 | 0.4 | 0 | 17 | 20% | 0% | 0% | 0% | 1% | 0% |
| 0.8 | 1 | 1 | 1.3 | 0 | 1.5 | 0 | 1.5 | 0.4 | 0 | 18 | 16% | 0% | 0% | 0% | 1% | 0% |
| 0.8 | 1 | 3 | 1.3 | 0 | 1.5 | 0 | 1.5 | 0.4 | 0 | 18 | 16% | 0% | 0% | 0% | 1% | 0% |
| 0.8 | 1 | 5 | 1.3 | 0 | 1.5 | 0 | 1.5 | 0.4 | 0 | 18 | 20% | 0% | 0% | 0% | 1% | 0% |
| 0.8 | 1 | 1 | 1.3 | 0 | 1.5 | 0 | 1.5 | 0.4 | 0 | 19 | 17% | 0% | 0% | 0% | 1% | 0% |
| 0.8 | 1 | 3 | 1.3 | 0 | 1.5 | 0 | 1.5 | 0.4 | 0 | 19 | 17% | 0% | 0% | 0% | 1% | 0% |
| 0.8 | 1 | 5 | 1.3 | 0 | 1.5 | 0 | 1.5 | 0.4 | 0 | 19 | 20% | 0% | 0% | 0% | 1% | 0% |
| 0.8 | 1 | 1 | 1.3 | 0 | 1.5 | 0 | 1.5 | 0.4 | 0 | 20 | 17% | 0% | 0% | 0% | 1% | 0% |
| 0.8 | 1 | 3 | 1.3 | 0 | 1.5 | 0 | 1.5 | 0.4 | 0 | 20 | 17% | 0% | 0% | 0% | 1% | 0% |
| 0.8 | 1 | 5 | 1.3 | 0 | 1.5 | 0 | 1.5 | 0.4 | 0 | 20 | 20% | 0% | 0% | 0% | 1% | 0% |

Microstructural Criteria

Some embodiments of this disclosure are related to microstructural features of the alloy which can govern the performance of the material.

Figure 4:
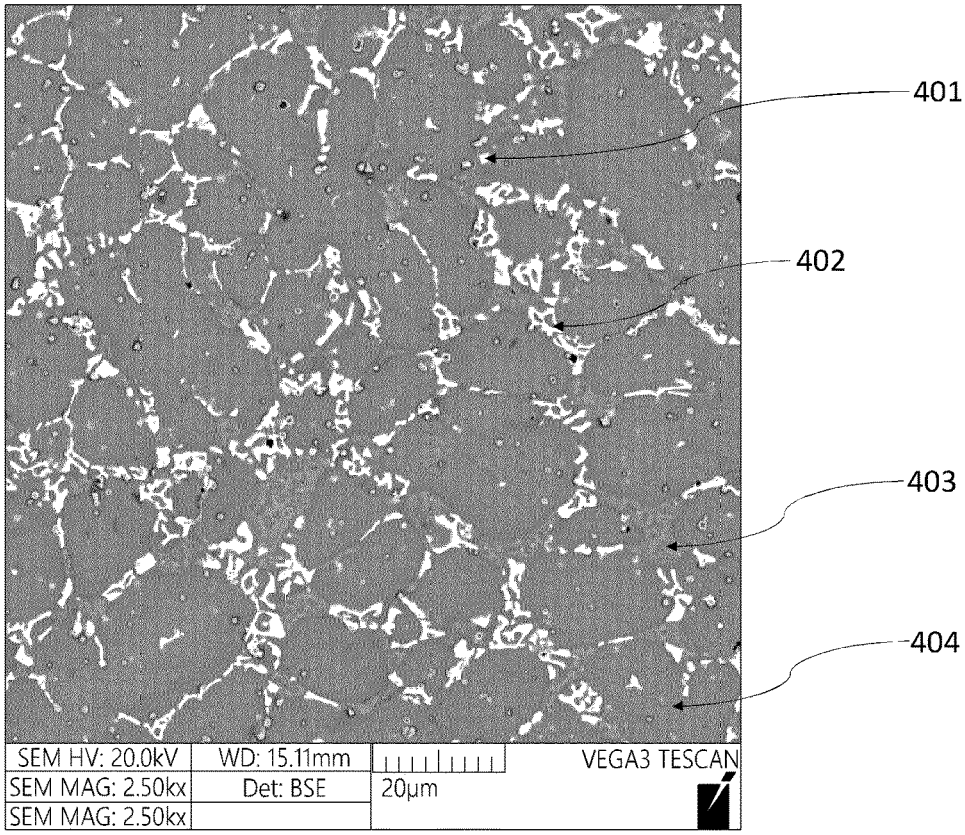
FIG. 4 illustrates an embodiment of a hardfacing microstructure of Alloy P1.

In some embodiments, the alloy can possess a minimum fraction of hard phases which precipitate in the material upon cooling from the liquid state. Several non-limiting examples of known hard phases which are extremely hard and also tend to form at very high temperatures in conventional alloys include: zirconium boride, titanium nitride, tungsten carbide, (chromium, molybdenum, tungsten) boride, tantalum carbide, zirconium carbide, alumina, beryllium carbide, (titanium, niobium, vanadium) carbide, silicon carbide, aluminum boride, boron carbide, and diamond. Specific examples presented in this embodiment include Cr and W-rich borides and Nb, Ti, and/or V rich carbides. An example of this specific embodiment is shown in FIG. 4, depicting niobium, vanadium, titanium carbide [401] and chromium tungsten boride [402] particles, both of which are defined as extremely hard phases.

In some embodiments, the alloy can be described by the microstructural features it possesses as a hardfacing coating. The alloys are primarily defined according to the measured volume fraction of the extremely hard phases after deposition. Any deposition technique can be used, and some non-limiting examples of deposition techniques for these alloys include plasma transferred arc welding (PTA), laser cladding, high velocity oxygen fuel (HVOF) thermal spray, plasma thermal spray, combustion thermal spray, and detonation gun thermal spray.

In some embodiments, the alloy can possess at least 2 volume % (or at least about 2 volume %) extremely hard particles. In some embodiments, the alloy can possess at least 5 volume % (or at least about 5 volume %) extremely hard particles. In some embodiments, the alloy can possess at least 10 volume % (or at least about 10 volume %) extremely hard particles. In the specific embodiment shown in FIG. 4, over 10 volume % extremely hard particles are present.

Figure 5:
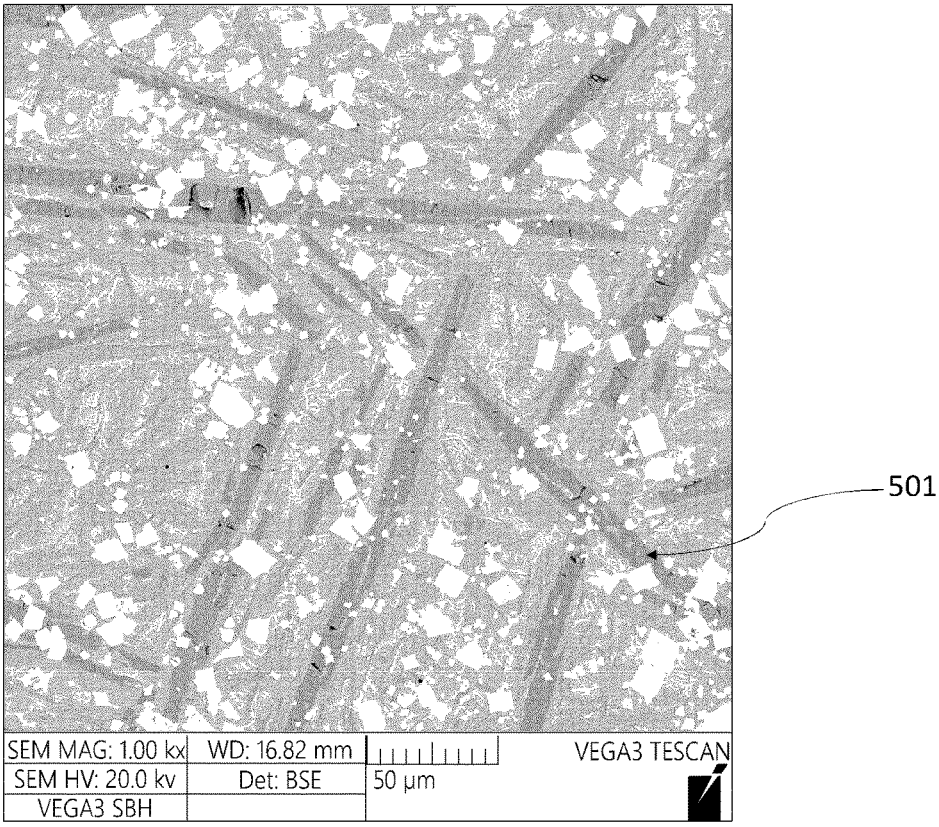
FIG. 5 illustrates hard phases in SHS 9192.

The second microstructural criteria is the absence or reduced content of any rod like boride or carbide hard phases. These hard phases are known to embrittle the material as will be demonstrated later in this disclosure. Several non-limiting examples of known phases which produce rod-like hypereutectic phases include $Cr_2B$, $M_{23}C_6$, and CrC. All of these phases can be used in hardfacing materials. As FIG. 4 depicts a specific embodiment of this disclosure, no rod-like hypereutectic phases are present. In order to demonstrate the morphology of rod-like hypereutectic phases, FIG. 5 is presented. As shown in this example, which is the commercial alloy SHS 9192, the Cr2B phase [501] is present as a rod-like morphology. This rod-like morphology is also seen in alloys described in U.S. Pat. Nos. 8,704,134, 7,553,382, and 8,474,541 and U.S. Pat. App. No. 2007/0029295, the entirety of each of which is hereby incorporated by reference.

In some embodiments, the alloy can possess below 5% (or below about 5%) volume fraction of hypereutectic boride phases. In some embodiments, the alloy can possess below 2.5% (or below about 2.5%) volume fraction of hypereutectic boride phases. In some embodiments, the alloy can possess 0% (or about 0%) volume fraction of hypereutectic boride phases.

Figure 6:
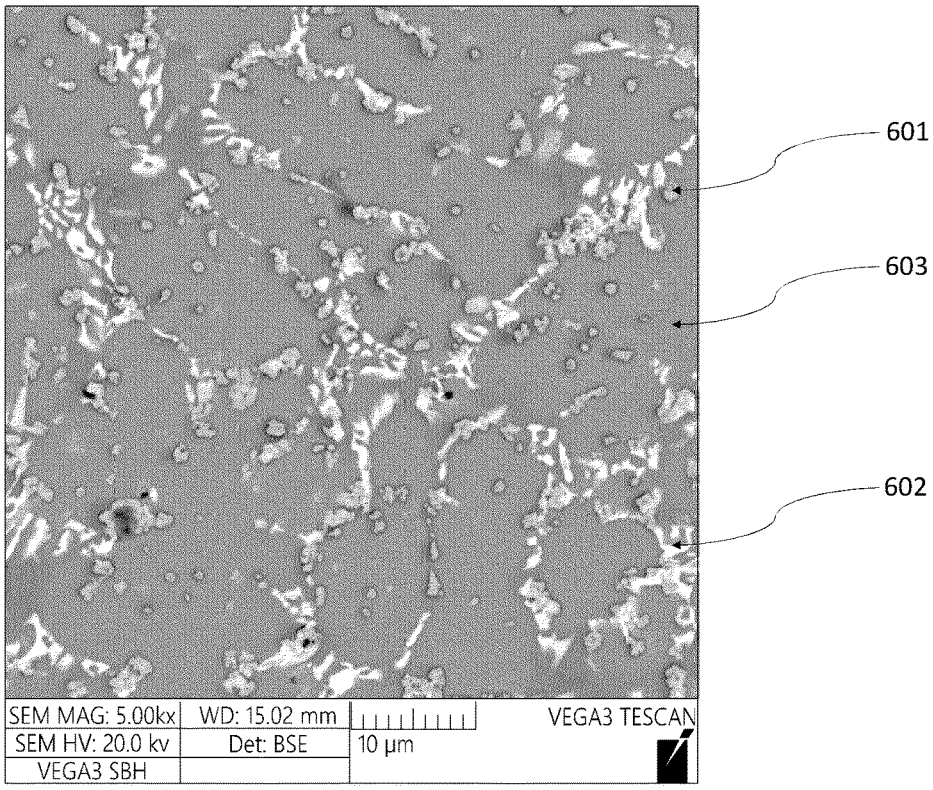
FIG. 6 illustrates an embodiment of an arc weld deposit according to the disclosure.

The third microstructural criteria is the absence or reduced content of a semi-continuous borocarbide phase. This phase, when present in significant quantity can reduce the impact resistance of the material. A non-limiting example of a borocarbide phase which is known to form this type of morphology is the $M_{23}(C,B)_6$ phase. $M_{23}(C,B)_6$ is a common phase designation, whereby M species a metallic element, and (C,B) represents carbon, boron, or a combination of carbon and boron. FIG. 4 shows a microstructure of Alloy P1 which contains a reduced portion of the $M_{23}(C,B)_6$ phase [403]. However, another embodiment is shown in FIG. 6. The microstructure of FIG. 6 shows no $M_{23}(C,B)_6$ phase, and only the advantageous Cr,W borides [602] and Nb,Ti,V carbides [601].

The above three microstructural criteria can relate to the content of hard particles which provide wear resistance and the specific morphology of the hard particles such that they do not significantly reduce the impact resistance. It should be noted that the three examples of the thermodynamic criteria and corresponding microstructures show that there is good correlation between the predicted and experimentally produced microstructure.

In some embodiments, the alloy can possess below 10% (or below about 10%) volume fraction of $M_{23}(C,B)_6$ phases. In some embodiments, the alloy can possess below 5% (or below about 5%) volume fraction of $M_{23}(C,B)_6$ hypereutectic boride phases. In some embodiments, the alloy can possess 0% (or about 0%) volume fraction of hypereutectic boride phases.

A fourth microstructural criteria is the matrix phase of the alloy. In some embodiments, it can be advantageous for the matrix of the alloy to be martensitic and thus increase the global hardness of the material. The two example embodiments shown in FIG. 4 and FIG. 6 possess a martensitic matrix [404] and [603] respectively.

In some embodiments, the alloy can form both carbides and borides in the microstructure.

However, it should be noted that in some embodiments, the microstructural features may not be sufficient criteria to define the alloys disclosed herein. In these embodiments, the manufacturability of the alloy cannot by determined by evaluating the microstructure, as in fact the majority of alloys which contain a relatively high fraction of extremely hard particles will not meet the performance criteria described herein.

Table 10 shows microstructural measurements for the experimentally produced ingots evaluated in this study; % HARD is the total volume fraction of hard phases, % HYPER B in the total volume fraction of hypereutectic phases, % EUTECTIC BC is the total volume fraction of the $M_{23}(C,B)_6$ phase, and each alloys is denoted as meeting all the specifications (YES) or not (NO). 41% of the alloys evaluated in this study met the microstructural specifications in this patent. Thus, the Fe—(Cr,W,Mo)—(Nb,Ti,V)—C—B alloy system and its variants do not inherently meet the disclosed criteria. As shown, the most frequent violation of the disclosed criteria is the formation of the $M_{23}(C,B)_6$ phase.

TABLE 10

Alloy Chemistries Produced in Ingot Form and Experimentally Measured Microstructural Phase Fractions

| Alloy | Hardness | % HARD | % HYPER B | % EUTECTIC BC | MEETS MICRO CRITERIA |
|---|---|---|---|---|---|
| X4 | 62.0 | 20.9 | 0 | 0 | YES |
| X5 | 58.6 | 58.6 | 0 | 58.6 | NO |
| X6 | 64.0 | 47 | 0 | 44.7 | NO |
| X7 | 62.2 | 42.9 | 0 | 42.9 | NO |
| X8 | 65.8 | 40 | 0 | 37.9 | NO |
| X9 | 63.6 | 31.3 | 0 | 31.3 | NO |
| X10 | 59.6 | 40.2 | 0 | 0 | YES |
| X11 | 59.5 | 45.9 | 0 | 42.1 | NO |
| X12 | 64.0 | 42.5 | 0 | 39.5 | NO |
| X13 | 61.3 | 20.84 | 0 | 0 | YES |
| X14 | 63.5 | 25.88 | 0 | 25.8 | NO |
| X15 | 55.8 | 35.612 | 0 | 5.4 | YES |
| X17 | 57.6 | 24.392 | 0 | 0 | YES |
| X25 | 61.6 | 15.08 | 0 | 0 | YES |
| X26 | 61.6 | 17.85 | 0 | 5 | YES |
| X27 | 43.2 | 53.74 | 0 | 50 | NO |
| X28 | 62.6 | 46.03 | 0 | 12.3 | NO |
| X29 | 59.2 | 47.58 | 22.6 | 0 | NO |
| X30 | 60.8 | 19.93 | 0 | 0 | YES |
| X31 | 64.6 | 59.96 | 29.5 | 19.4 | NO |
| X33 | 64.8 | 56.93 | 29.8 | 17.7 | NO |

In some embodiments, the disclosed microstructural criteria can be combined with the other criteria defined in the disclosure as, in some embodiments, the microstructural features alone may not be sufficient to determine manufacturability of the alloy. For example, some embodiments of alloys using only microstructural criteria may not meet the performance criteria described herein.

Performance Criteria

Some embodiments of this disclosure are related to the desirable performance traits that alloys described in this disclosure possess.

In some embodiments, the alloy can be described by meeting certain performance characteristics. It can be advantageous for hardfacing alloys to simultaneously have 1) a very high resistance to abrasion, and 2) a very high resistance to impact. Alloys possessing both traits will function well in many mining operations where the coating must resist both abrasion due to sand and impact due to larger rocks. However, no conventional alloys possess both these performance traits. Abrasion resistance is commonly measured via the industry standard ASTM G65 test. There is no repeated impact test to simulate relevant mining conditions so a specific test was developed in order to conduct this study.

The abrasion resistance of hardfacing alloys can be characterized by the ASTM G65 dry sand abrasion test, hereby incorporated by reference in its entirety. In some embodiments, the hardfacing alloy layer can have an ASTM G65 abrasion loss of less than 0.5 grams (or less than about 0.5 grams). In some embodiments, the hardfacing alloy layer can have an ASTM G65 abrasion loss of less than 0.3 grams (or less than about 0.3 grams). In some embodiments, the hardfacing alloy layer can have an ASTM G65 abrasion loss of less than 0.25 grams (or less than about 0.25 grams). In some embodiments, the hardfacing alloy layer can have an ASTM G65 abrasion loss of less than 0.2 grams (or less than about 0.2 grams). In some embodiments, the hardfacing alloy layer can have an ASTM G65 abrasion loss of less than 0.15 grams (or less than about 0.15 grams). In some embodiments, the hardfacing alloy layer can have an ASTM G65 abrasion loss of less than 0.1 grams (or less than about 0.1 grams).

In the developed impact test a rotating hammer is made to repeatedly impact a test specimen. The impact energy of the hammer can be controlled by controlling the rotational speed of the hammer of known weight. In testing conducted for this study, the impact energy was set to 20 Joules. The impact resistance of a material is quantified by measuring how many impacts it takes to achieve a measurable mass loss in the test specimen, greater to or equal to 1 gram.

In some embodiments, the alloy possess high impact resistance as characterized by resisting over 2,000 (or over about 2,000) 20 J impacts without failure. In some embodiments, the alloy can possess high impact resistance as characterized by resisting over 5,000 (or over about 5,000) 20 J impacts without failure. In some embodiments, the alloy can possess high impact resistance as characterized by resisting over 6,000 (or over about 6,000) 20 J impacts without failure. In some embodiments, the alloy can possess high impact resistance as characterized by resisting over 10,000 (or about 10,000) 20 J impacts without failure.

In some embodiments, the alloy can possess both sufficient strength and toughness such that high compressive strengths can be measured. High compressive strength can be advantageous for a variety of crushing and grinding operations whereby the material is subject to high compressive loads.

In some embodiments, the alloy can have a compressive strength of 3 GPA (or about 3 GPA) or higher. In some embodiments, the alloy can have a compressive strength of 3.5 GPA (or about 3.5 GPA) or higher. In some embodiments, the alloy has a compressive strength of 4 GPA (or about 4 GPA) or higher.

In some embodiments, the alloy can have a high hardness. High hardness can be advantageous for hardfacing alloys, and is a factor in dictating the abrasion resistance of the material.

In some embodiments, the alloy has a hardness of 55 HRC (or about 55 HRC) or greater. In some embodiments, the alloy can have a hardness of 60 HRC (or about 60 HRC) or greater. In some embodiments, the alloy can have a hardness of 65 HRC (or about 65 HRC) or greater.

The above embodiments describe the performance criteria as relevant to the end user. However, it can also be advantageous for the alloy to be easy to manufacture, and high have productivity during welding.

In some embodiments, the alloys can be easy to be manufacture in conventional metal powder production techniques. The manufacturability is commonly characterized by the yield of intended powder size produced during the manufacturing process.

In some embodiments, the hardfacing alloy can be manufactured into a 53-180 μm (or about 53 to about 180 μm) powder size distribution at a 50% or greater yield (or about 50% or greater yield). In some embodiments, the hardfacing alloy can be manufactured into a 53-180 μm (or about 53 to about 180 μm) powder size distribution at a 60% or greater yield (or about 60% or greater yield). In some embodiments, the hardfacing alloy can be manufactured into a 53-180 μm (or about 53 to about 180 μm) powder size distribution at a 70% or greater yield (or about 70% or greater yield).

In some embodiments, the alloy can have high productivity and deposition efficiency when welded using the plasma transferred arc welding process.

In some embodiments, the alloy can be deposited at a volumetric rate at least 45% (or at least about 45%) faster than WC/Ni using equivalent welding equipment. In some embodiments, the alloy can be welded at least 70% (or at least about 70%) faster than WC/Ni. In some embodiments, the alloy can be welded at least 100% (or at least about 100%) faster than WC/Ni.

In some embodiments, the deposition efficiency (lbs. of material used/lbs. of material which are deposited) of embodiments of the disclosed alloy is 95-99% (or about 95 to about 99%) for plasma transferred arc welding (PTA). In some embodiments, the alloys can be deposited a rate of 180-210 $mm^3$/min (or about 180 to about 210 $mm^3$/min). In some embodiments, the alloys can be deposited at about 2, 3, 4, 5, or 6 times faster than the recited deposition rate. On the other hand, deposition efficiency of WC/Ni PTA is 60-80% and deposition rate of WC/Ni is 100-120 $mm^3$/min.

Correlation Between Criteria

As described in this disclosure, the thermodynamic criteria can be used to define an advantageous microstructure, which in turn is used to describe desirable performance characteristics. It should be noted that the correlation between thermodynamic criteria and microstructural criteria as well as the relationship between microstructural criteria and performance criteria are the product of extensive research, experimental analysis, computational modelling, and inventive process.

The ingot study disclosed herein represents a good measure of the correlation between thermodynamic and microstructural criteria, because a wide variety of alloy chemistries were evaluated in this study. The similarity between alloy compositions is quite varied, and thus the microstructural effects can be related to thermodynamic criteria as opposed to chemistry. Table 2 shows the glow discharge chemistry for the ingots produced in this study. The thermodynamics and microstructural features were evaluated in a subset of these alloys in Table 8 and Table 10 respectively. Not all the alloys tested in this study are considered in this cross structural evaluation, because a wider variety of ally systems were considered for this performance space, then was ultimately determined to meet the criteria of this patent. For example, alloy X1 does not contain boron in the chemical composition and thus does not meet the general scope of this disclosure because it does not contain borides.

When evaluating Table 8, 10 out of the 21 listed alloys, 48%, meet the thermodynamic criteria. Not all of the alloys meet the criteria, because this ingot study was used in determining how to construct the appropriate criteria in order to produce the appropriate microstructure. Thus, it is demonstrated that the thermodynamic criteria listed herein are not am inherent feature of a broader alloy compositional space. These thermodynamic criteria are compared against the experimentally measured microstructural features. 8 of the 21 listed alloys, 38%, meet the microstructural criteria. All 8 of the alloys which met the microstructural criteria also met the thermodynamic criteria. Thus, the alloys which passed the microstructural criteria are a subset of those which passes the thermodynamic criteria. Thus, when utilizing the thermodynamic criteria outlined in this disclosure, 80% of alloys which pass that metric will possess the desired microstructure. When considering the most preferred thermodynamic criteria, there is a 100% match between alloys that meet the thermodynamic and microstructural criteria. Thus, it is demonstrated that the thermodynamic criteria outlined in this disclosure are a good predictive tool in designing alloys of the disclosed microstructure.

In order to demonstrate the good correlation between the disclosed microstructure and the desired performance characteristics several examples are presented. There is a 100% correlation between microstructural features and performance characteristics. 100% of the alloys tested which possessed hypereutectic rod-like borides demonstrated poor impact resistance outside of the scope of this disclosure (<2,000 impacts to failure on average). Alloys with greater than 10% volume fractions of the $M_{23}(C,B)_6$ phase showed similarly poor impact resistance. Alloys with a limited fraction of $M_{23}(C,B)_6$ showed good impact resistance within the scope of this disclosure (>2,000 impacts to failure on average). Alloys with none of the $M_{23}(C,B)_6$ showed good impact resistance within the scope of this disclosure (>5,000 impacts to failure on average). Only alloys with good abrasion resistance (<0.3 grams lost in ASTM G65 testing) where tested in this study. There are many alloys with poor abrasion resistance and good impact resistance, and not within the scope of this disclosure.

EXAMPLES

The following examples are intended to be illustrative an non-limiting.

Example 1

Figure 8:
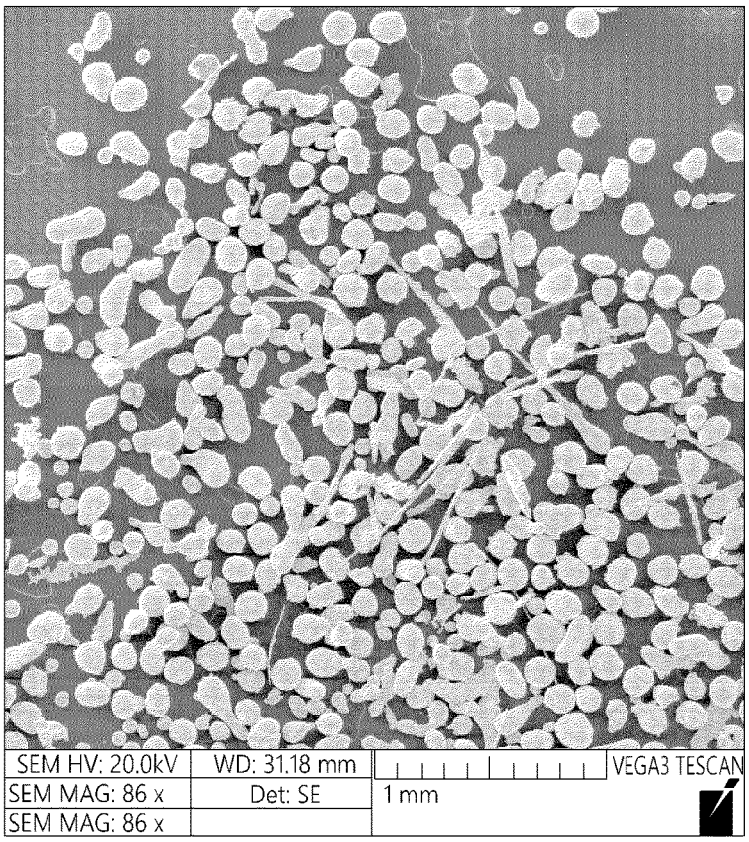
FIG. 8 shows the Micrograph of Alloy P1 metallic powder produced via atomization process.

Alloy P1 was discovered using computational metallurgy techniques and meets the thermodynamic criteria disclosed herein. The alloy was manufactured using an atomization process into the 53-180 μm size for the purposed of using it as feedstock for plasma transferred arc welding and laser cladding. A micrograph of the manufactured powder is shown in FIG. 8. This powder was used in the plasma transferred arc welding with the parameters provided in Table 11 to produce a hardfacing layer.

TABLE 11

Plasma transferred arc welding parameters used to produce Alloy P1 hardfacing layer.

| Voltage | Amps | Gap | Weld Feed | Pitch | Width | Speed |
|---|---|---|---|---|---|---|
| 32 | 180 | 40 mm | (50%) | 2.9 mm | 24 mm | 50 mm/s |

The hardfacing layer was additionally characterized according to the performance criteria in this disclosure. The global hardness of the weld overlay was 62-66 HRC. It contained about 6 volume % W boride and about 3-4% Nb carbide in the microstructure. The ASTM G65 mass loss was measured at about 0.12 grams lost in a single layer weld and about 0.09 to 0.1 grams lost in a double layer weld.

This alloy was impact tested as a double layer overlay and had an average impact resistance of 3,710 20 J impacts prior to failure. Double layer weld overlay is the typical hardfacing procedure used in the mining industry when using PTA hardfacing. The microstructure of this material is shown in FIG. 4, which shows the presence of the $M_{23}(C.B)_6$ phase in relatively small quantity. The volume fraction of the $M_{23}(C,B)_6$ phase is within the microstructural specifications of this disclosure, but not within the preferred microstructural specifications. As a result of this, this specific alloy also does not perform within the preferred performance specification of this disclosure as it relates to impact. The thorough microstructural and performance evaluation of this alloy led to the additional powder alloy design, which will be disclosed in Example 5. Nevertheless, it was determined in this study, that alloys of this type demonstrated good deposition efficiency in comparison to other commonly used PTA hardfacing products.

The deposition efficiency of this alloy was measured to be 99%. This deposition efficiency is unique for hardfacing alloys of this type. For example, typical WC—Ni cermets have deposition efficiencies in the range of 60-80%. This high deposition efficiency is likely due to the low melting point of this alloy and lack of high temperature phases. The high deposit efficiency of this alloy also allows for the welding speed to be increased such that the deposition productivity can be increased by 200% over typical tungsten carbide overlays. Thus, the low melt range thermodynamic criteria also has beneficial effects to productivity in addition to the benefits previously described. This productivity benefit was specifically analyzed in PTA welding experiments. PTA productivity is measured in the amount of hardfacing material volume that can be deposited as a function of time.

The results of the productivity study shown in Table 12. The typical industrial standard parameters used to weld WC/Ni hardfacing was used as baseline parameters for this study. As shown, when the P1 alloy was welded under equivalent condition (Process 1), the productivity was increased based simply on the increased deposition efficiency. The productivity could be further increased, as demonstrated in process 2 and process 3, as a result of increasing the powder feed and traverse speed.

TABLE 12

PTA Parameters used in P1 Alloy Welding Study and Productivity Results

| Parameters/ Results | WC/Ni Process | P1 - Process 1 | P1 - Process 2 | P1 - Process 3 |
|---|---|---|---|---|
| Powder Feed | 50% | 50% | 50% | 60% |
| Traverse | 40 mm/min | 40 mm/min | 50 mm/min | 60 mm/min |
| Thickness | 2.5-3 mm | 4 mm | 3-3.5 mm | 3-3.5 mm |
| Deposition Efficiency | 65-75% | ~99% | ~99% | ~99% |
| Productivity Index | 1 | 1.45 | 1.7 | 2 |

The resultant high productivity is likely due to the uniformity in melting temperature of the alloy. In other words, all the phases in this alloy form from the liquid at a similar temperature. This physical phenomenon is predicted by the thermodynamic melt range parameter; a low melt range is thus likely to predict an alloy which can be PTA welded at high productivity. Furthermore, the presence of unequal phase formation temperatures is physically revealed in the form of rod-like hypereutectic phases. Thus, alloys which form a rod-like hypereutectic carbide or boride structure similar to that shown in FIG. 5 are unlikely to demonstrate good productivity in the PTA process. Low productivity of hypereutectic alloys has been demonstrated in several hypereutectic boride steels.

Example 2

Several alloy chemistries listed in Table 13 were manufactured into ingots and cut into compression testing specimens. The compression testing results show a distinct correlation between the compressive strength of the alloy and the presence of undesirable $M_{23}(C,B)_6$. As seen in Table 14, as the volume fraction of $M_{23}(C,B)_6$ increases the compressive strength of the alloy decreases. It is advantageous in many hardfacing applications for an alloy to have high compressive strength. Thus, reducing or eliminating $M_{23}(C,B)_6$ from the alloy can be beneficial for compressive strength as well as impact resistance as mentioned previously.

It is important to note that creating an alloy with a high fraction of carbides and borides that is free of $M_{23}(C,B)_6$ is unique. It is common in hardfacing alloy design to increase C and B, along with carbide and boride forming elements, to increase the carbide and boride content in the alloy in order to improve abrasion resistance. However, increasing B and C almost always promotes the formation of $M_{23}(C,B)_6$ along with other carbides and borides. Computational metallurgy is required to design alloys with high carbide and boride content without forming $M_{23}(C,B)_6$.

TABLE 13

Alloys Compression Tested

| Alloy | B | C | Cr | Mn | Mo | Nb | Si | Ti | V | W |
|---|---|---|---|---|---|---|---|---|---|---|
| C1 | 2 | 1.37 | 2 | 0.2 | 0 | 5 | 0.5 | 0.5 | 2 | 6 |
| C2 | 1.5 | 1.37 | 4 | 0.2 | 0 | 5 | 0.5 | 0.5 | 2 | 9 |
| C3 | 1 | 1.37 | 5 | 0.2 | 0 | 5 | 0.5 | 0.5 | 2 | 9.5 |
| C4 | 1 | 1.37 | 5 | 0.2 | 5 | 5 | 0.5 | 0.5 | 2 | 9.5 |

TABLE 14

Phase Fraction Measurements of M23C6 and Compression Testing Results

| Alloy | $M_{23}C_6$ Phase Fraction | Average Compressive Strength MPa | Standard Deviation |
|---|---|---|---|
| C1 | 38.3 | 2601 | 294.2 |
| C2 | 10.3 | 3306 | 200.0 |
| C3 | 7.4 | 4107 | 102.6 |
| C4 | 0.0 | 4235 | 446.3 |

Example 3

Alloys W1-W10 as specified into Table 3 were produced in the form of a 1/16" cored wire intended for the MIG welding process. Each alloy was welded using the conditions as shown in Table 15.

TABLE 15

MIG Welding Parameters Used in This Study

| | |
|---|---|
| Wire Size | 1/16 |
| Volts | 26-29 |
| Amps | 250-300 |
| Wire Feed | 240-280 |
| Shielding Gas | 100% Ar, 98% Ar/2% O2 |
| Stickout | 1-1.25 in |
| Torch Angle | 8-15° |

Alloys W1-W4 represent slight chemistry modifications related to manufacturing variations from a single nominal chemistry, and the results of numerous ASTM G65 tests are shown in Table 16. As shown, this alloys family has an average mass loss of 0.11±0.02 grams. Furthermore, Table 16 demonstrates the repeatability and consistency of the abrasion resistance in this alloy family. Alloy W3 was also tested for impact resistance. Alloy W3 demonstrated high impact resistance as characterized by surviving 10,000 20 J impacts without failure. Alloy W9 also met the microstructural and performance criteria of this disclosure. Alloy W9 was made without V, which demonstrates the ability to use Nb, Ti, and V interchangeably as carbide formers to create the desired microstructure.

TABLE 16

ASTM G65 Procedure Testing of Alloys Which Meet the Described Criteria of this Disclosure

| Alloy | Mass Loss (g) | Volume Loss ($mm^3$) |
|---|---|---|
| W1 | 0.0824 | 10.73 |
| W1 | 0.0844 | 10.99 |
| W1 | 0.1067 | 13.89 |
| W1 | 0.1063 | 13.84 |
| W1 | 0.1157 | 15.07 |
| W2 | 0.1297 | 16.89 |
| W2 | 0.1253 | 16.32 |
| W3 | 0.1107 | 14.41 |
| W4 | 0.106 | 13.8 |
| W4 | 0.0941 | 12.25 |
| W4 | 0.1245 | 16.21 |
| W4 | 0.1350 | 17.58 |
| W4 | 0.1305 | 16.99 |
| W4 | 0.1395 | 18.16 |
| W4 | 0.1280 | 16.67 |
| W4 | 0.1123 | 14.62 |
| W4 | 0.1159 | 15.09 |
| W4 | 0.1104 | 14.37 |
| W9 | 0.0909 | 15.10 |

Alloys W5-W8 and W10 represent significant chemistry modifications which resulted in microstructural features which do not adhere to the criteria presented in this disclosure. Specifically, each of these alloys formed the undesirable $M_{23}(C,B)_6$ phase which resulted in decreased performance in both impact and abrasion performance due to alloy embrittlement. Table 17 shows the abrasion resistance for these alloys. As shown, the abrasion resistance varies from within the performance specifications to well outside the specifications. As demonstrated, alloys containing the $M_{23}(C,B)_6$ phase can possess good abrasion resistance.

TABLE 17

ASTM G65 Test Results for Alloys Containing $M_{23}(C,B)_6$

| Alloy | Mass Loss (g) | Volume Loss ($mm_3$) |
|---|---|---|
| W5 | 0.1848 | 24.06 |
| W6 | 0.1766 | 22.99 |
| W7 | 0.1762 | 22.94 |
| W8 | 0.6253 | 81.42 |
| W10 | 0.116 | 11.84 |

However, the toughness and associated impact resistance of these materials can suffer significantly from the $M_{23}(C,B)_6$ phase. This can be determined immediately by those skilled in the art during welding due to the increased cracking occurring in these alloys compared to those meeting the specifications of this disclosure.

This example demonstrates the relatively narrow alloy space this disclosure occupies. It is well known by those skilled in the art that adding carbon and boron to an alloy will form increased fractions of carbides and borides. However, as this example demonstrates, these simple additions can and will result in a deleterious $M_{23}(C,B)_6$ phase. In order to avoid this phase, one must consider the interdependence between all the carbide and boride forming element and the relative ratios with carbon and boron. It requires accurate thermodynamic models and high throughput computational metallurgy to identify the narrow compositional bands which meet the desired criteria, and which reside in this large compositional space.

Example 4

Figure 7:
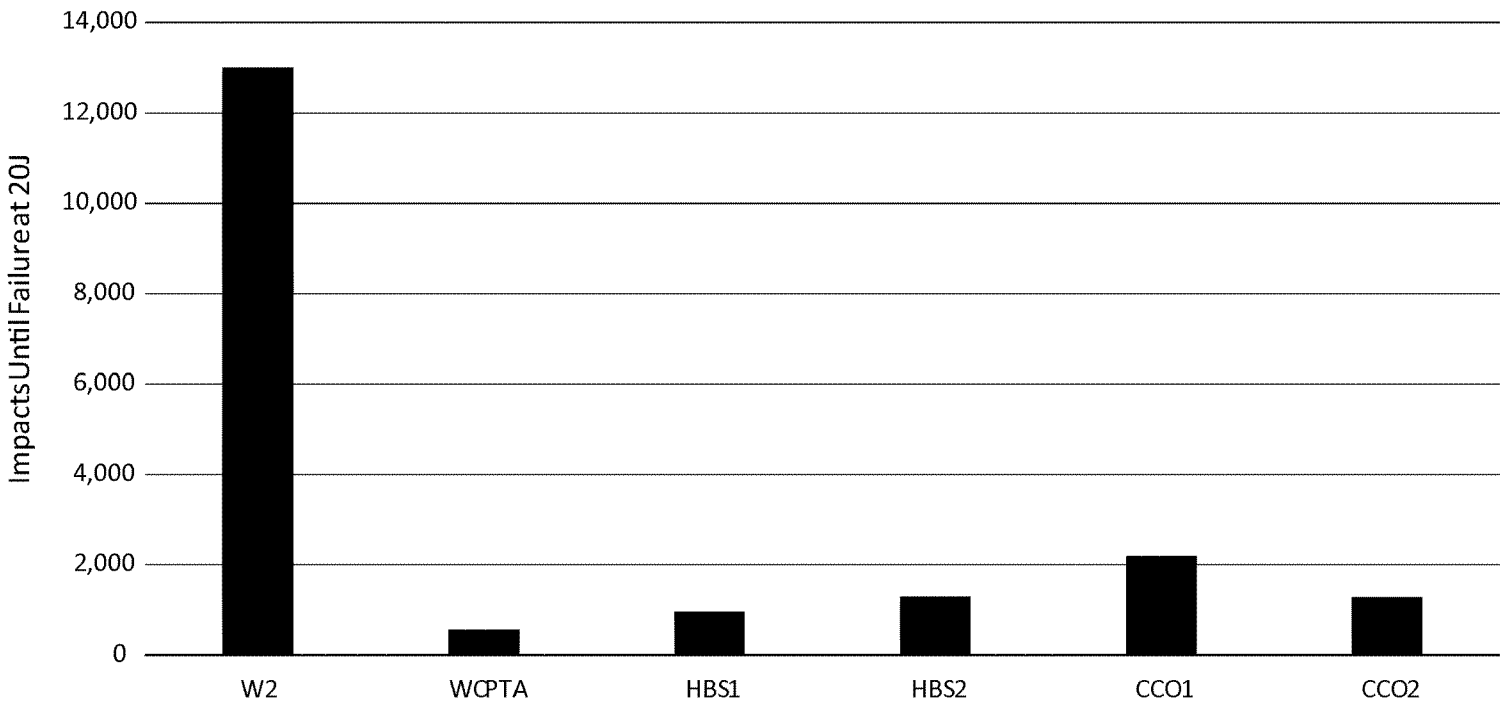
FIG. 7 illustrates impact testing results for embodiments of the disclosure.

In order to understand the significance of the W3 alloy surviving 10,000 20 J impacts without measurable mass loss, commercial hardfacing alloys were tested in a similar way. Three classes of material were tested in this way: WC/Ni PTA coatings, chromium carbide overlays (CCO), and Hyper-Eutectic Boride steels (HBS). All three material classes are relevant hardfacing materials which are used by industry. This example is intended to demonstrate the unique combination of high abrasion resistance and high impact resistance in the alloys specified in this disclosure. FIG. 7 shows the results of this study, whereby the average impacts until failure are reported for each material. While all the hardfacing materials are known to exhibit good abrasion resistance as defined with the performance specifications of this disclosure, only the W2 alloy simultaneously also exhibits the high impact resistance. It can be appreciated that the elevated impact resistance demonstrated in the W2 alloy is not an inherent characteristic of hardfacing alloys containing carbides (such as CCO) or alloy containing both carbides and borides (such as the FIBS alloys) This study has determined the microstructure cause of this elevated impact resistance as well as the thermodynamic criteria which can be utilized to predict this structure as a function of composition.

The relatively poor impact resistance of the Fe-based alloys, CCO and FIBS alloys can also be explained as a function of microstructural features. Both alloys possess hypereutectic rod-like hard phases: carbides in the case of CCO, and borides in the case of HBS. These hard phases, whether borides or carbides, have morphologies [501] of that shown in FIG. 5. There are variations of CCO, which utilize lower levels of carbon which eliminate the rod-like hypereutectic phases and increase the impact resistance. However, this compositional alteration significantly reduces the abrasion resistance to levels outside the scope of this disclosure. This example provides a demonstration of the difficulty of creating an Fe-based alloy which is simultaneously void of hypereutectic phases and has good abrasion resistance.

Example 5

In order to make improvement upon the impact performance of the PTA welds presented in Example 1, several chemistry modifications were made. These chemistries were selected based on extensive thermodynamic modelling and experimental research. It was determined during this research that the cause of reduced performance in Example 1 was the presence of the $M_{23}(C,B)_6$ borocarbide phase. Subsequently, thermodynamic criteria for eliminating the borocarbide phase were built. Alloy P2-P6 were manufactured into powder and used for feedstock in PTA weld testing. The following parameters were used to deposit each alloy. This study demonstrates the role of borocarbide hard phases on the impact resistance. As this phase is reduced and subsequently eliminated in alloys P2-P6 as shown in Table 18, the impact resistance is increased.

TABLE 18

Impact Resistance of PTA Weld Alloys as a Function of Borocarbide Volume Fraction

| Alloy | Volume % $M_{23}(C,B)_6$ | 20 J Impacts Until Failure (Average) |
|---|---|---|
| P1 | 10% | 2,500 |
| P2 | 5% | 3,610 |
| P3 | 1% | 4,724 |
| P4 | 0% | 5,425 |
| P5 | 0% | 5,425 |
| P6 | 0% | 8,427 |

Example 6

Alloy W11 was manufactured into a 7/64" cored wire intended for submerged arc welding. In this example, the feedstock alloy was modified such that the desired weld chemistry was achieved. The submerged arc wire feedstock chemistry had to be altered from the 1/16" gas shield wire chemistry presented in Example 3 due to the difference in dilution in each process. This example demonstrates the true importance of the weld chemistry as opposed to the feedstock chemistry. Thus, the feedstock chemistry can be altered to account for the process dilution in order to achieve the desired weld chemistry.

The submerged arc weld deposit was evaluated and met the microstructural features described in this patent, possessing a microstructure of the type shown in FIG. 6; no $M_{23}(C,B)_6$ phase and a high fraction of primary (Nb,Ti,V)C and eutectic (W,Cr) boride hard phases. The ASTM G65 mass loss was 0.1065 grams lost and the weld specimen lasted 10,000 20 J impacts without failure. Thus, this weld met the primary performance criteria.

Example 7

Alloys W12-W16 were welded and tested in open arc welding. Open arc welding often produces higher dilution and elemental burn off due to the lack of shielding gas, and thus the weld wire feedstock chemistry must be altered in order to achieve the desired weld chemistry. Chemistries which are similar or equivalent to gas shielded welding wires, such as W12 and W16 produce a microstructure with less than 10% (W,Cr) Boride phase, which results in abrasion performance which is below the preferred embodiments of this disclosure. Thus, the W13-W15 chemistries were developed in order to produce the preferred performance with the open arc welding process. W14 and W15 produced a high fraction of $M_{23}(C,B)_6$, and thus resulted in poor performance. Alloy W13 produced some $M_{23}(C,B)_6$ phase, and thus fit within the desired performance criteria of this patent. As a result of this presence of $M_{23}(C,B)_6$, this alloy lasted 2,196 20 J impacts until failure. This result, again, shows the necessity to minimize or eliminate the $M_{23}(C,B)_6$ phase in order to achieve good impact resistance.

Applications and Processes for Use:

Embodiments of the alloys described in this patent can be used in a variety of applications and industries. Some non-limiting examples of applications of use include:

Surface Mining applications include the following components and coatings for the following components: Wear resistant sleeves and/or wear resistant hardfacing for slurry pipelines, mud pump components including pump housing or impeller or hardfacing for mud pump components, ore feed chute components including chute blocks or hardfacing of chute blocks, separation screens including but not limited to rotary breaker screens, banana screens, and shaker screens, liners for autogenous grinding mills and semi-autogenous grinding mills, ground engaging tools and hardfacing for ground engaging tools, drill bits and drill bit inserts, wear plate for buckets and dumptruck liners, heel blocks and hardfacing for heel blocks on mining shovels, grader blades and hardfacing for grader blades, stacker reclaimers, sizer crushers, general wear packages for mining components and other comminution components.

Upstream oil and gas applications include the following components and coatings for the following components: Downhole casing and downhole casing, drill pipe and coatings for drill pipe including hardbanding, mud management components, mud motors, fracking pump sleeves, fracking impellers, fracking blender pumps, stop collars, drill bits and drill bit components, directional drilling equipment and coatings for directional drilling equipment including stabilizers and centralizers, blow out preventers and coatings for blow out preventers and blow out preventer components including the shear rams, oil country tubular goods and coatings for oil country tubular goods.

Downstream oil and gas applications include the following components and coatings for the following components: Process vessels and coating for process vessels including steam generation equipment, amine vessels, distillation towers, cyclones, catalytic crackers, general refinery piping, corrosion under insulation protection, sulfur recovery units, convection hoods, sour stripper lines, scrubbers, hydrocarbon drums, and other refinery equipment and vessels.

Pulp and paper applications include the following components and coatings for the following components: Rolls used in paper machines including yankee dryers and other dryers, calendar rolls, machine rolls, press rolls, digesters, pulp mixers, pulpers, pumps, boilers, shredders, tissue machines, roll and bale handling machines, doctor blades, evaporators, pulp mills, head boxes, wire parts, press parts, M.G. cylinders, pope reels, winders, vacuum pumps, deflakers, and other pulp and paper equipment, Power generation applications include the following components and coatings for the following components: boiler tubes, precipitators, fireboxes, turbines, generators, cooling towers, condensers, chutes and troughs, augers, bag houses, ducts, ID fans, coal piping, and other power generation components.

Agriculture applications include the following components and coatings for the following components: chutes, base cutter blades, troughs, primary fan blades, secondary fan blades, augers and other agricultural applications.

Construction applications include the following components and coatings for the following components: cement chutes, cement piping, bag houses, mixing equipment and other construction applications Machine element applications include the following components and coatings for the following components: Shaft journals, paper rolls, gear boxes, drive rollers, impellers, general reclamation and dimensional restoration applications and other machine element applications Steel applications include the following components and coatings for the following components: cold rolling mills, hot rolling mills, wire rod mills, galvanizing lines, continue pickling lines, continuous casting rolls and other steel mill rolls, and other steel applications.

The alloys described in this patent can be produced and or deposited in a variety of techniques effectively. Some non-limiting examples of processes include:

Thermal spray process including those using a wire feedstock such as twin wire arc, spray, high velocity arc spray, combustion spray and those using a powder feedstock such as high velocity oxygen fuel, high velocity air spray, plasma spray, detonation gun spray, and cold spray. Wire feedstock can be in the form of a metal core wire, solid wire, or flux core wire. Powder feedstock can be either a single homogenous alloy or a combination of multiple alloy powder which result in the desired chemistry when melted together.

Welding processes including those using a wire feedstock including but not limited to metal inert gas (MIG) welding, tungsten inert gas (TIG) welding, arc welding, submerged arc welding, open arc welding, bulk welding, laser cladding, and those using a powder feedstock including but not limited to laser cladding and plasma transferred arc welding. Wire feedstock can be in the form of a metal core wire, solid wire, or flux core wire. Powder feedstock can be either a single homogenous alloy or a combination of multiple alloy powder which result in the desired chemistry when melted together.

Casting processes including processes typical to producing cast iron including but not limited to sand casting, permanent mold casting, chill casting, investment casting, lost foam casting, die casting, centrifugal casting, glass casting, slip casting and process typical to producing wrought steel products including continuous casting processes.

Post processing techniques including but not limited to rolling, forging, surface treatments such as carburizing, nitriding, carbonitriding, heat treatments including but not limited to austenitizing, normalizing, annealing, stress relieving, tempering, aging, quenching, cryogenic treatments, flame hardening, induction hardening, differential hardening, case hardening, decarburization, machining, grinding, cold working, work hardening, and welding.

From the foregoing description, it will be appreciated that an inventive product and approaches for impact resistant hardfacing alloys are disclosed. While several components, techniques and aspects have been described with a certain degree of particularity, it is manifest that many changes can be made in the specific designs, constructions and methodology herein above described without departing from the spirit and scope of this disclosure.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount. If the stated amount is 0 (e.g., none, having no), the above recited ranges can be specific ranges, and not within a particular % of the value. For example, within less than or equal to 10 wt./vol. % of, within less than or equal to 5 wt./vol. % of, within less than or equal to 1 wt./vol. % of, within less than or equal to 0.1 wt./vol. % of, and within less than or equal to 0.01 wt./vol. % of the stated amount.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A feedstock material comprising:

Fe;

between about 0.6 to about 1.0 wt. % B;

between about 0.5 to about 1.5 wt. % C;

between about 3 to about 4 wt. % Cr;

between about 1 to about 2 wt. % Nb;

between 3 to about 4.5 wt. % V;

between about 1.0 to about 2.0 wt. % Mn;

between about 0 and about 1 wt. % Ti; and about 6 to about 10 wt. % W;

wherein the feedstock material is configured to form a martensitic matrix and is characterized by having, under thermodynamic equilibrium conditions:

a melt range of less than 100K;

at least 15 mole % of extremely hard boride/carbide particles having a Vickers hardness of at least 1000;

any carbides formed from Nb, Ti, and V are isolated carbides;

about 0 mole % of hypereutectic boride phases; and about 0 mole % of a eutectic $M_{23}C_6$ phase and a eutectic $M_7C_3$ phase.

2. The feedstock material of claim 1, wherein a difference between a formation temperature of the extremely hard boride/carbide particles and a formation temperature of an iron matrix phase of the feedstock material is 200K or lower.

3. The feedstock material of claim 1, wherein the matrix comprises both borides and carbides.

4. The feedstock material of claim 1, wherein the feedstock material is characterized by having, under thermodynamic equilibrium conditions, at least 10 mole % of the extremely hard boride/carbide particles.

5. The feedstock material of claim 4, wherein the feedstock material is characterized by having, under thermodynamic equilibrium conditions, at least 20 mole % of the extremely hard boride/carbide particles.

6. The feedstock material of claim 1, wherein the feedstock material is characterized by having, under thermodynamic equilibrium conditions:

0 mole % of a hypereutectic boride phases when the feedstock material is in a liquid state; and 0 mole % of a eutectic $M_{23}C_6$ phase and a eutectic $M_7C_3$ phase at a temperature when the feedstock material is in the liquid state;

wherein a difference between a formation temperature of the extremely hard boride/carbide particles and a formation temperature of an iron matrix phase of the feedstock material is 100K or lower.

7. A hardfacing layer formed from the feedstock material of claim 1.

8. The hardfacing layer of claim 7, wherein the layer comprises:

a compressive strength of 3 GPA or higher;

a hardness of 55 HRC or greater;

high abrasion resistance as characterized by ASTM G65 mass loss of 0.15 grams or less; and high impact resistance as characterized by surviving at least 5,000 20 J impacts prior to failure.

9. The hardfacing layer of claim 7, wherein the layer comprises:

a martensitic microstructure;

at least 2 volume % of extremely hard boride/carbide particles having a Vickers hardness of at least 1000;

a compressive strength of 3 GPA or higher;

a hardness of 55 HRC or greater;

high abrasion resistance as characterized by ASTM G65 mass loss of 0.15 grams or less; and high impact resistance as characterized by surviving at least 5,000 20 J impacts prior to failure.

10. The hardfacing layer of claim 7, wherein the layer comprises:

greater than 2 volume % of extremely hard boride/carbide particles having a Knoop hardness of 1500 or greater;

an ASTM G65 abrasion loss of less than 0.5 grams; and a macro-hardness of 55 HRC or greater;

wherein a difference between a formation temperature of the extremely hard boride/carbide particles and a formation temperature of an iron matrix phase of the feedstock material is 200K or lower.

11. The hardfacing layer of claim 7, wherein the martensitic matrix comprises:

an ASTM G65 abrasion loss of less than 0.15 grams; and a macro-hardness of 65 HRC or greater;

wherein a difference between a formation temperature of the extremely hard boride/carbide particles and a formation temperature of an iron matrix phase of the feedstock material is 100K or lower.

12. The hardfacing layer of claim 10, wherein the layer has greater than 5 volume % of the extremely hard boride/carbide particles.

13. The hardfacing layer of claim 10, wherein the layer has greater than 10 volume % of the extremely hard boride/carbide particles.

14. The feedstock material of claim 1, wherein the feedstock material comprises a powder.

15. The feedstock material of claim 14, wherein a composition of the powder comprises Fe and, in wt. %:

B: about 0.8;

C: about 0.8 to about 1;

Cr: about 3.5;

and

W: about 9.

16. The feedstock material of claim 15, wherein the composition of the powder further comprises in wt. %:

Ti: about 0.4;

Mn: about 1.3; and

Si: about 1.5.

17. The feedstock material of claim 14, wherein a composition of the powder comprises Fe and, in wt. %:

B: about 0.8;

C: about 0.95;

Cr: about 3.5;

Mn: about 1.3;

Nb: about 1.5;

Ni: about 0;

Si: about 1.5

Ti: about 0.4;

V: about 3.5; and

W: about 9.

18. The feedstock material of claim 1, wherein the feedstock material comprises a wire or a plurality of wires.

19. The feedstock material of claim 1, wherein the feedstock material is at least one of a weld overlay material and a thermal spray material.

20. The feedstock material of claim 1, further comprising about 1.5 wt. % Si.

* * * * *